US010964299B1

(12) United States Patent
Estes et al.

(10) Patent No.: US 10,964,299 B1
(45) Date of Patent: Mar. 30, 2021

(54) METHOD OF AND SYSTEM FOR AUTOMATICALLY GENERATING DIGITAL PERFORMANCES OF MUSIC COMPOSITIONS USING NOTES SELECTED FROM VIRTUAL MUSICAL INSTRUMENTS BASED ON THE MUSIC-THEORETIC STATES OF THE MUSIC COMPOSITIONS

(71) Applicant: Shutterstock, Inc., New York, NY (US)

(72) Inventors: Samuel Estes, Los Angeles, CA (US); Cole Ingraham, Brooklyn, NY (US); Hunter Ewen, Westerville, OH (US); Andrew H. Silverstein, New York, NY (US)

(73) Assignee: Shutterstock, Inc., New York, NY (US)

( * ) Notice: Subject to any disclaimer, the term of this patent is extended or adjusted under 35 U.S.C. 154(b) by 0 days.

(21) Appl. No.: 16/653,554

(22) Filed: Oct. 15, 2019

(51) Int. Cl.
*G10H 1/00* (2006.01)

(52) U.S. Cl.
CPC ..... *G10H 1/0025* (2013.01); *G10H 2210/111* (2013.01); *G10H 2240/121* (2013.01)

(58) Field of Classification Search
CPC ..... G10H 1/0025; G10H 7/008; G10H 2210/111; G10H 2240/121
See application file for complete search history.

(56) References Cited

U.S. PATENT DOCUMENTS 4,108,035 A 8/1978 Alonso
4,178,822 A 12/1979 Alonso
(Continued)

FOREIGN PATENT DOCUMENTS

AU 2002355066 B2 3/2007
CA 2894332 A1 12/2015
(Continued)

OTHER PUBLICATIONS

US 10,126,932 B1, 11/2018, Trncic (withdrawn)
(Continued)

*Primary Examiner* — Jeffrey Donels
(74) *Attorney, Agent, or Firm* — McDermott Will & Emery LLP

(57) ABSTRACT

An automated music performance system that is driven by the music-theoretic state descriptors of any musical structure (e.g. a music composition or sound recording). The system can be used with next generation digital audio workstations (DAWs), virtual studio technology (VST) plugins, virtual music instrument libraries, and automated music composition and generation engines, systems and platforms. The automated music performance system generates unique digital performances of pieces of music, using virtual musical instruments created from sampled notes or sounds and/or synthesized notes or sounds. Each virtual music instrument has its own set of music-theoretic state responsive performance rules that are automatically triggered by the music theoretic state descriptors of the music composition or performance to be digitally performed. An automated virtual music instrument (VMI) library selection and performance subsystem is provided for managing the virtual musical instruments during the automated digital music performance process.

6 Claims, 118 Drawing Sheets

FIRST EMBODIMENT

(56) References Cited

U.S. PATENT DOCUMENTS

| | | | |
|---|---|---|---|
| 4,279,185 | A | 7/1981 | Alonso |
| 4,345,500 | A | 8/1982 | Alonso |
| 4,356,752 | A | 11/1982 | Suzuki |
| 4,399,731 | A | 8/1983 | Aoki |
| 4,554,855 | A | 11/1985 | Alonso |
| 4,680,479 | A | 7/1987 | Alonso |
| 4,704,933 | A | 11/1987 | Kurakake |
| 4,731,847 | A | 3/1988 | Lybrook |
| 4,745,836 | A | 5/1988 | Dannenberg |
| 4,771,671 | A | 9/1988 | Hoff |
| 4,926,737 | A | 5/1990 | Minamitaka |
| 4,982,643 | A | 1/1991 | Minamitaka |
| 5,099,740 | A | 3/1992 | Minamitaka |
| 5,208,416 | A | 5/1993 | Hayakawa |
| 5,315,057 | A | 5/1994 | Land |
| 5,375,501 | A | 12/1994 | Okuda |
| 5,393,926 | A | 2/1995 | Johnson |
| 5,451,709 | A | 9/1995 | Minamitaka |
| 5,453,569 | A | 9/1995 | Saito |
| 5,492,049 | A | 2/1996 | Aoki |
| 5,496,962 | A | 3/1996 | Meier |
| 5,510,573 | A | 4/1996 | Cho |
| 5,521,324 | A | 5/1996 | Dannenberg |
| 5,679,913 | A | 10/1997 | Bruti |
| 5,696,343 | A | 12/1997 | Nakata |
| 5,723,802 | A | 3/1998 | Johnson |
| 5,736,663 | A | 4/1998 | Aoki |
| 5,736,666 | A | 4/1998 | Goodman |
| 5,753,843 | A | 5/1998 | Fay |
| 5,877,445 | A | 3/1999 | Hufford |
| 5,883,326 | A | 3/1999 | Goodman |
| 5,913,259 | A | 6/1999 | Grubb |
| 5,958,005 | A | 9/1999 | Thorne |
| 6,006,018 | A | 12/1999 | Burnett |
| 6,012,088 | A | 1/2000 | Li |
| 6,028,262 | A | 2/2000 | Minamitaka |
| 6,051,770 | A | 4/2000 | Milburn |
| 6,072,480 | A | 6/2000 | Gorbet |
| 6,075,193 | A | 6/2000 | Aoki |
| 6,084,169 | A | 7/2000 | Hasegawa |
| 6,103,964 | A | 8/2000 | Kay |
| 6,122,666 | A | 9/2000 | Beurket |
| 6,162,982 | A | 12/2000 | Aoki |
| 6,175,072 | B1 | 1/2001 | Aoki |
| 6,252,152 | B1 | 6/2001 | Aoki |
| 6,291,756 | B1 | 9/2001 | Urbanek |
| 6,297,439 | B1 | 10/2001 | Browne |
| 6,319,130 | B1 | 11/2001 | Ooseki |
| 6,337,433 | B1 | 1/2002 | Nishimoto |
| 6,363,350 | B1 | 3/2002 | Lafe |
| 6,385,581 | B1 | 5/2002 | Stephenson |
| 6,388,183 | B1 | 5/2002 | Leh |
| 6,392,133 | B1 | 5/2002 | Georges |
| 6,395,970 | B2 | 5/2002 | Aoki |
| 6,462,264 | B1 | 10/2002 | Elam |
| 6,506,969 | B1 | 1/2003 | Baron |
| 6,545,209 | B1 | 4/2003 | Flannery |
| 6,576,828 | B2 | 6/2003 | Aoki |
| 6,606,596 | B1 | 8/2003 | Zirngibl |
| 6,633,908 | B1 | 10/2003 | Leymann |
| 6,636,247 | B1 | 10/2003 | Hamzy |
| 6,636,855 | B2 | 10/2003 | Holloway |
| 6,637,020 | B1 | 10/2003 | Hammond |
| 6,654,794 | B1 | 11/2003 | French |
| 6,684,238 | B1 | 1/2004 | Dutta |
| 6,700,048 | B1 | 3/2004 | Terada |
| 6,746,246 | B2 | 6/2004 | Cliff |
| 6,747,201 | B2 | 6/2004 | Birmingham |
| 6,756,533 | B2 | 6/2004 | Aoki |
| 6,765,997 | B1 | 7/2004 | Zirngibl |
| 6,822,153 | B2 | 11/2004 | Comair |
| 6,865,533 | B2 | 3/2005 | Addison |
| 6,888,999 | B2 | 5/2005 | Herberger |
| 6,897,367 | B2 | 5/2005 | Leach |
| 6,963,839 | B1 | 11/2005 | Ostermann |
| 6,969,796 | B2 | 11/2005 | Sasaki |
| 7,003,515 | B1 | 2/2006 | Glaser |
| 7,022,907 | B2 | 4/2006 | Lu |
| 7,058,428 | B2 | 6/2006 | Yamaki |
| 7,075,000 | B2 | 7/2006 | Gang |
| 7,102,067 | B2 | 9/2006 | Gang |
| 7,105,734 | B2 | 9/2006 | Tucmandl |
| 7,115,808 | B2 | 10/2006 | Lu |
| 7,133,900 | B1 | 11/2006 | Szeto |
| 7,188,143 | B2 | 3/2007 | Szeto |
| 7,250,567 | B2 | 7/2007 | Gayama |
| 7,268,791 | B1 | 9/2007 | Jannink |
| 7,310,629 | B1 | 12/2007 | Mendelson |
| 7,356,556 | B2 | 4/2008 | Brydon |
| 7,356,572 | B2 | 4/2008 | Jiang |
| 7,396,990 | B2 | 7/2008 | Lu |
| 7,424,682 | B1 | 9/2008 | Pupius |
| RE40,543 | E | 10/2008 | Aoki |
| 7,454,472 | B2 | 11/2008 | Szeto |
| 7,454,480 | B2 | 11/2008 | Labio |
| 7,478,132 | B2 | 1/2009 | Chen |
| 7,491,878 | B2 | 2/2009 | Orr |
| 7,498,504 | B2 | 3/2009 | Bourgeois |
| 7,542,996 | B2 | 6/2009 | Fanning |
| 7,552,183 | B2 | 6/2009 | Coletrane |
| 7,568,010 | B2 | 7/2009 | Lyle |
| 7,582,823 | B2 | 9/2009 | Kim |
| 7,583,793 | B2 | 9/2009 | Jacovi |
| 7,605,323 | B2 | 10/2009 | Ishii |
| 7,672,873 | B2 | 3/2010 | Kindig |
| 7,693,746 | B2 | 4/2010 | Wachi |
| 7,696,426 | B2 | 4/2010 | Cope |
| 7,703,022 | B2 | 4/2010 | Arthurs |
| 7,705,231 | B2 | 4/2010 | Morris |
| 7,711,838 | B1 | 5/2010 | Boulter |
| 7,720,910 | B2 | 5/2010 | Goodman |
| 7,720,914 | B2 | 5/2010 | Goodman |
| 7,720,934 | B2 | 5/2010 | Yanase |
| 7,729,481 | B2 | 6/2010 | Thompson |
| 7,730,178 | B2 | 6/2010 | Labio |
| 7,737,853 | B2 | 6/2010 | Moskowitz |
| 7,754,955 | B2 | 7/2010 | Egan |
| 7,754,959 | B2 | 7/2010 | Herberger |
| 7,774,420 | B2 | 8/2010 | Keohane |
| 7,790,974 | B2 | 9/2010 | Sherwani |
| 7,792,782 | B2 | 9/2010 | Yun |
| 7,792,834 | B2 | 9/2010 | Sorensen |
| 7,818,397 | B2 | 10/2010 | Jiang |
| 7,822,830 | B2 | 10/2010 | Junghuber |
| 7,831,670 | B2 | 11/2010 | Goodman |
| 7,840,838 | B2 | 11/2010 | Stewart |
| 7,844,673 | B2 | 11/2010 | Bostick |
| 7,884,274 | B1 | 2/2011 | Wieder |
| 7,902,447 | B1 | 3/2011 | Abrego |
| 7,917,148 | B2 | 3/2011 | Rosenberg |
| 7,919,707 | B2 | 4/2011 | Harvey |
| 7,948,357 | B2 | 5/2011 | Bodin |
| 7,949,649 | B2 | 5/2011 | Whitman |
| 7,958,156 | B2 | 6/2011 | Shriwas |
| 7,962,558 | B2 | 6/2011 | Nelson |
| 7,974,838 | B1 | 7/2011 | Lukin |
| 7,985,917 | B2 | 7/2011 | Morris |
| 8,022,287 | B2 | 9/2011 | Yamashita |
| 8,026,436 | B2 | 9/2011 | Hufford |
| 8,035,490 | B2 | 10/2011 | Hunt |
| 8,042,118 | B2 | 10/2011 | Gilfix |
| 8,053,659 | B2 | 11/2011 | Ricard |
| 8,073,854 | B2 | 12/2011 | Whitman |
| 8,143,509 | B1 | 3/2012 | Robertson |
| 8,161,115 | B2 | 4/2012 | Yamamoto |
| 8,166,111 | B2 | 4/2012 | Bhakta |
| 8,184,783 | B2 | 5/2012 | Thompson |
| 8,229,935 | B2 | 7/2012 | Lee |
| 8,259,192 | B2 | 9/2012 | Nair |
| 8,271,354 | B2 | 9/2012 | Deguchi |
| 8,280,889 | B2 | 10/2012 | Whitman |
| 8,316,146 | B2 | 11/2012 | Ehn |
| 8,352,331 | B2 | 1/2013 | Dunning |
| 8,354,579 | B2 | 1/2013 | Park |

(56) References Cited

U.S. PATENT DOCUMENTS 8,357,847 B2 1/2013 Huet
8,359,382 B1 1/2013 Gailloux
8,402,097 B2 3/2013 Szeto
8,428,453 B1 4/2013 Spiegel
8,475,173 B2 7/2013 Mears
8,489,606 B2 7/2013 Lee
8,527,905 B2 9/2013 Chen
8,554,868 B2 10/2013 Skyrm
8,583,615 B2 11/2013 White
8,586,847 B2 11/2013 Ellis
8,595,301 B2 11/2013 Banks
8,627,308 B2 1/2014 Deluca
8,631,358 B2 1/2014 Louch
8,644,971 B2 2/2014 Weinstein
8,660,849 B2 2/2014 Gruber
8,670,979 B2 3/2014 Gruber
8,706,503 B2 4/2014 Cheyer
8,710,343 B2 4/2014 Kellett
8,726,167 B2 5/2014 Arthurs
8,762,435 B1 6/2014 Rosenberg
8,775,972 B2 7/2014 Spiegel
8,798,438 B1 8/2014 Yagnik
8,799,000 B2 8/2014 Guzzoni
8,826,453 B2 9/2014 Arrelid
8,866,846 B2 10/2014 Kim
8,868,744 B2 10/2014 Levell
8,874,026 B2 10/2014 Anstandig
8,874,147 B2 10/2014 Chu
8,880,615 B2 11/2014 Tummalapenta
8,892,446 B2 11/2014 Cheyer
8,892,660 B2 11/2014 Chen
8,898,766 B2 11/2014 Garmark
8,903,716 B2 12/2014 Chen
8,909,725 B1 12/2014 Sehn
8,914,752 B1 12/2014 Spiegel
8,921,677 B1 12/2014 Severino
8,927,846 B2 1/2015 Matusiak
8,930,191 B2 1/2015 Gruber
8,938,507 B2 1/2015 Bostick
8,942,986 B2 1/2015 Cheyer
8,949,525 B2 2/2015 Niemela
8,969,699 B2 3/2015 Tabata
8,996,538 B1 3/2015 Cremer
9,015,285 B1 4/2015 Ebsen
9,018,505 B2 4/2015 Okuda
9,021,038 B2 4/2015 Banks
9,026,943 B1 5/2015 Spiegel
9,031,243 B2 5/2015 Leboeuf
9,032,543 B2 5/2015 Arrelid
9,042,921 B2 5/2015 Karmarkar
9,043,412 B2 5/2015 Chen
9,043,850 B2 5/2015 Hoffert
9,063,640 B2 6/2015 Hoffert
9,066,048 B2 6/2015 Hoffert
9,069,868 B2 6/2015 Chen
9,071,562 B2 6/2015 Chung
9,071,798 B2 6/2015 Hoffert
9,076,264 B1 7/2015 Gillespie
9,076,423 B2 7/2015 Matusiak
9,083,770 B1 7/2015 Dröse
9,092,759 B2 7/2015 Hammer
9,094,137 B1 7/2015 Sehn
9,094,806 B2 7/2015 Chu
9,099,064 B2 8/2015 Sheffer
9,100,618 B2 8/2015 Hoffert
9,110,955 B1 8/2015 Bernhardsson
9,111,164 B1 8/2015 Anderton
9,112,849 B1 8/2015 Werkelin Ahlin
9,113,301 B1 8/2015 Spiegel
9,117,447 B2 8/2015 Gruber
9,143,681 B1 9/2015 Ebsen
9,148,424 B1 9/2015 Yang
9,158,754 B2 10/2015 Whitman
9,165,255 B1 10/2015 Shetty
9,195,383 B2 11/2015 Garmark
9,213,747 B2 12/2015 Cremer
9,225,310 B1 12/2015 Lukin
9,225,674 B2 12/2015 Fioretti
9,225,897 B1 12/2015 Sehn
9,230,218 B2 1/2016 González
9,237,202 B1 1/2016 Sehn
9,246,967 B2 1/2016 Garmark
9,276,886 B1 3/2016 Samaranayake
9,277,126 B2 3/2016 Marlin
9,288,200 B1 3/2016 Werkelin Ahlin
9,294,425 B1 3/2016 Son
9,299,104 B2 3/2016 Boulter
9,313,154 B1 4/2016 Son
9,318,108 B2 4/2016 Gruber
9,319,445 B2 4/2016 Garmark
9,342,613 B2 5/2016 Arthurs
9,350,312 B1 5/2016 Wishnick
9,354,868 B2 5/2016 Deluca
9,361,645 B2 6/2016 Boulter
9,361,869 B2 6/2016 Rex
9,367,587 B2 6/2016 Bieschke
9,369,514 B2 6/2016 Bernhardsson
9,380,059 B2 6/2016 Aslund
9,385,983 B1 7/2016 Sehn
9,390,696 B2 7/2016 Kiely
9,396,354 B1 7/2016 Murphy
9,402,093 B2 7/2016 Lieu
9,406,072 B2 8/2016 Whitman
9,407,712 B1 8/2016 Sehn
9,407,816 B1 8/2016 Sehn
9,423,998 B2 8/2016 Dziuk
9,424,604 B2 8/2016 Boulter
9,430,783 B1 8/2016 Sehn
9,432,428 B2 8/2016 Werkelin Ahlin
D766,967 S 9/2016 Giovannini
9,436,962 B2 9/2016 Boulter
9,438,582 B2 9/2016 Garmark
9,443,266 B2 9/2016 Boulter
9,448,763 B1 9/2016 Dziuk
9,449,341 B2 9/2016 Boulter
9,451,329 B2 9/2016 Whitman
D768,674 S 10/2016 Hanover
9,473,432 B2 10/2016 Chung
9,482,882 B1 11/2016 Hanover
9,482,883 B1 11/2016 Meisenholder
9,483,166 B2 11/2016 Dziuk
9,489,113 B2 11/2016 Dziuk
9,489,527 B2 11/2016 Arrelid
9,503,500 B2 11/2016 Bernhardsson
9,503,780 B2 11/2016 Hoffert
9,509,269 B1 11/2016 Rosenberg
9,510,024 B2 11/2016 Öman
9,510,131 B2 11/2016 Zhu
9,514,476 B2 12/2016 Kay
9,515,630 B2 12/2016 Wallander
9,516,082 B2 12/2016 Hoffert
9,529,888 B2 12/2016 Hoffert
9,531,989 B1 12/2016 Jehan
9,532,171 B2 12/2016 Allen
9,536,560 B2 1/2017 Jehan
9,542,917 B2 1/2017 Sheffer
9,542,918 B2 1/2017 Matusiak
9,547,679 B2 1/2017 Whitman
9,554,186 B2 1/2017 Tsiridis
9,563,268 B2 2/2017 Smith
9,563,700 B2 2/2017 Garmark
9,565,456 B2 2/2017 Helferty
9,568,994 B2 2/2017 Jehan
9,570,059 B2 2/2017 Garmark
D781,906 S 3/2017 Yu
D782,520 S 3/2017 Yu
D782,533 S 3/2017 Yu
9,589,237 B1 3/2017 Qamar
9,600,466 B2 3/2017 Whitman
9,606,620 B2 3/2017 Dziuk
9,607,594 B2 3/2017 Chon
9,609,448 B2 3/2017 Bentley
9,613,118 B2 4/2017 Whitman
9,613,654 B2 4/2017 Cameron

(56) References Cited

U.S. PATENT DOCUMENTS 9,626,436 B2 4/2017 Rodger
9,635,068 B2 4/2017 Garmark
9,635,416 B2 4/2017 Hoffert
9,635,556 B2 4/2017 Afzelius
9,641,891 B2 5/2017 Hoffert
9,654,531 B2 5/2017 Hoffert
9,654,532 B2 5/2017 Strigeus
9,654,822 B2 5/2017 Hoffert
9,659,068 B1 5/2017 Mattsson
9,661,379 B2 5/2017 Hoffert
9,668,217 B1 5/2017 Bamberger
9,679,305 B1 6/2017 Bhat
9,716,733 B2 7/2017 Strigeus
9,728,173 B2 8/2017 Watanabe
9,729,816 B1 8/2017 Jehan
9,740,023 B1 8/2017 Ashwood
9,741,327 B2 8/2017 Rutledge
9,742,871 B1 8/2017 Gibson
9,746,692 B1 8/2017 Streets
9,749,378 B2 8/2017 Olenfalk
9,753,925 B2 9/2017 Cremer
9,766,854 B2 9/2017 Medaghri
9,773,483 B2 9/2017 Rutledge
9,787,687 B2 10/2017 Lof
9,792,010 B2 10/2017 Hoffert
9,794,309 B2 10/2017 Persson
9,794,827 B2 10/2017 Zhu
9,798,514 B2 10/2017 Silva
9,798,823 B2 10/2017 Cody
9,799,312 B1 10/2017 Cabral
9,800,631 B2 10/2017 Persson
9,825,801 B1 11/2017 Bakken
9,843,764 B1 12/2017 Jehan
9,875,010 B2 1/2018 Persson
9,881,596 B2 1/2018 Matusiak
9,883,284 B2 1/2018 Bohrarper
9,904,506 B1 2/2018 Jehan
9,917,869 B2 3/2018 Hoffert
D814,186 S 4/2018 Spiegel
D814,493 S 4/2018 Brody
D815,127 S 4/2018 Phillips
D815,128 S 4/2018 Phillips
D815,129 S 4/2018 Phillips
D815,130 S 4/2018 Phillips
9,933,993 B2 4/2018 Garmark
9,934,467 B2 4/2018 Jacobson
9,934,785 B1 4/2018 Hulaud
9,935,943 B2 4/2018 Werkelin Ahlin
9,935,944 B2 4/2018 Garmark
9,942,283 B2 4/2018 Garmark
9,942,356 B1 4/2018 Gibson
9,948,736 B1 4/2018 Mengistu
9,973,635 B1 5/2018 Edling
9,973,806 B2 5/2018 Tsiridis
9,978,426 B2 5/2018 Smith
9,979,768 B2 5/2018 Hoffert
D820,298 S 6/2018 Yu
10,002,123 B2 6/2018 Whitman
10,003,840 B2 6/2018 Richman
10,021,156 B2 7/2018 Conway
10,025,786 B2 7/2018 Jehan
10,033,474 B1 7/2018 Gibson
10,034,064 B2 7/2018 Hoffert
10,038,962 B2 7/2018 Bentley
D824,924 S 8/2018 Phillips
D825,581 S 8/2018 Phillips
D825,582 S 8/2018 Phillips
10,055,413 B2 8/2018 Jehan
10,063,600 B1 8/2018 Marsh
10,063,608 B2 8/2018 Oskarsson
10,066,954 B1 9/2018 Swanson
10,075,496 B2 9/2018 Garmark
10,082,939 B2 9/2018 Medaghri Alaoui
D829,742 S 10/2018 Phillips
D829,743 S 10/2018 Phillips
D829,750 S 10/2018 Phillips
D830,375 S 10/2018 Phillips
D830,395 S 10/2018 Phillips
D831,691 S 10/2018 Brody
10,089,309 B2 10/2018 Polacek
10,089,578 B2 10/2018 Jehan
10,095,467 B2 10/2018 Balassanian
10,097,604 B2 10/2018 Hoffert
10,101,960 B2 10/2018 Jehan
10,102,680 B2 10/2018 Jurgenson
10,108,708 B2 10/2018 O'Driscoll
10,109,264 B2 10/2018 Cabral
10,110,649 B2 10/2018 Hoffert
10,110,947 B2 10/2018 Hoffert
10,115,435 B2 10/2018 Lee
10,133,545 B2 11/2018 Gibson
10,133,918 B1 11/2018 Chang
10,133,974 B2 11/2018 Cassidy
10,134,059 B2 11/2018 Mishra
10,148,789 B2 12/2018 Gibson
10,165,357 B2 12/2018 Bohrarper
10,165,402 B1 12/2018 Davis
10,171,055 B2 1/2019 Bailey
10,185,538 B2 1/2019 Oskarsson
10,185,539 B2 1/2019 Bailey
10,185,767 B2 1/2019 Bernhardsson
10,187,676 B2 1/2019 Lieu
10,209,950 B2 2/2019 Smith
10,223,063 B2 3/2019 Gibson
10,235,127 B2 3/2019 Jehan
10,248,380 B2 4/2019 Bailey
10,250,933 B2 4/2019 Whitman
10,262,641 B2 * 4/2019 Silverstein ..... G06N 20/00
D847,788 S 5/2019 Baker
10,282,163 B2 5/2019 Jehan
10,298,636 B2 5/2019 Krawczyk
10,311,842 B2 6/2019 Silverstein
10,334,073 B2 6/2019 Gibson
10,360,260 B2 7/2019 Zhu
10,366,334 B2 7/2019 Jacobson
10,372,757 B2 8/2019 Jehan
10,380,649 B2 8/2019 Johnson
10,387,478 B2 8/2019 Cao
10,387,481 B2 8/2019 Jehan
10,387,489 B1 8/2019 Reiley, Jr.
10,396,744 B2 8/2019 Mcclellan
10,412,183 B2 9/2019 Gibson
10,423,943 B2 9/2019 Wood
10,445,809 B2 10/2019 Dunning
10,459,904 B2 10/2019 Whitman
10,460,248 B2 10/2019 Stowell
10,467,998 B2 11/2019 Silverstein
10,467,999 B2 11/2019 Lyske
10,482,857 B2 11/2019 Lyske
10,600,398 B2 3/2020 Pachet
10,657,934 B1 5/2020 Kolen
10,672,371 B2 6/2020 Silverstein
10,679,596 B2 6/2020 Balassanian
10,699,684 B2 6/2020 Wood
2001/0007960 A1 7/2001 Yoshihara
2001/0025561 A1 10/2001 Milbum
2001/0037196 A1 11/2001 Iwamoto
2001/0047717 A1 12/2001 Aoki
2002/0000156 A1 1/2002 Nishimoto
2002/0002899 A1 1/2002 Gjerdingen
2002/0007720 A1 1/2002 Aoki
2002/0007721 A1 1/2002 Aoki
2002/0007722 A1 1/2002 Aoki
2002/0011145 A1 1/2002 Aoki
2002/0017188 A1 2/2002 Aoki
2002/0023529 A1 2/2002 Kurakake
2002/0029685 A1 3/2002 Aoki
2002/0033090 A1 3/2002 Iwamoto
2002/0035915 A1 3/2002 Tolonen
2002/0129023 A1 9/2002 Holloway
2002/0134219 A1 9/2002 Aoki
2002/0177186 A1 11/2002 Sternheimer
2002/0184128 A1 12/2002 Holtsinger
2002/0193996 A1 12/2002 Squibbs

(56) References Cited

U.S. PATENT DOCUMENTS

2003/0013497 A1 1/2003 Yamaki
2003/0018727 A1 1/2003 Yamamoto
2003/0037664 A1 2/2003 Comair
2003/0089216 A1 5/2003 Birmingham
2003/0131715 A1 7/2003 Georges
2003/0160944 A1 8/2003 Foote
2003/0183065 A1 10/2003 Leach
2003/0200859 A1 10/2003 Futamase
2003/0205124 A1 11/2003 Foote
2003/0205125 A1 11/2003 Futamase
2004/0019645 A1 1/2004 Goodman
2004/0024822 A1 2/2004 Werndorfer
2004/0025668 A1 2/2004 Jarrett
2004/0027369 A1 2/2004 Kellock
2004/0089140 A1 5/2004 Georges
2004/0089141 A1 5/2004 Georges
2004/0159213 A1 8/2004 Eruera
2004/0215731 A1 10/2004 Tzann-en Szeto
2005/0051021 A1 3/2005 Laakso
2005/0076772 A1 4/2005 Gartland-Jones
2005/0086052 A1 4/2005 Shih
2005/0091278 A1 4/2005 Wang
2005/0102351 A1 5/2005 Jiang
2005/0109194 A1 5/2005 Gayama
2005/0180462 A1 8/2005 Yi
2005/0223071 A1 10/2005 Hosono
2005/0267896 A1 12/2005 Goodman
2005/0273499 A1 12/2005 Goodman
2006/0011044 A1 1/2006 Chew
2006/0015560 A1 1/2006 Macauley
2006/0018447 A1 1/2006 Jacovi
2006/0059236 A1 3/2006 Sheppard
2006/0065104 A1 3/2006 Ball
2006/0122840 A1 6/2006 Anderson
2006/0130635 A1 6/2006 Rubang, Jr.
2006/0168346 A1 7/2006 Chen
2006/0212818 A1 9/2006 Lee
2006/0230909 A1 10/2006 Song
2006/0230910 A1 10/2006 Song
2006/0236848 A1 10/2006 Stone
2006/0243119 A1 11/2006 Rubang, Jr.
2006/0258340 A1 11/2006 Eronen
2007/0005719 A1 1/2007 Szeto
2007/0006708 A1 1/2007 Laakso
2007/0022732 A1 2/2007 Holloway
2007/0044639 A1 3/2007 Farbood
2007/0094341 A1 4/2007 Bostick
2007/0106731 A1 5/2007 Bhakta
2007/0112919 A1 5/2007 Lyle
2007/0116195 A1 5/2007 Thompson
2007/0137463 A1 6/2007 Lumsden
2007/0174401 A1 7/2007 Chu
2007/0208990 A1 9/2007 Kim
2007/0209006 A1 9/2007 Arthurs
2007/0221044 A1 9/2007 Orr
2007/0227342 A1 10/2007 Ide
2007/0261535 A1 11/2007 Sherwani
2007/0285250 A1 12/2007 Moskowitz
2007/0288589 A1 12/2007 Chen
2007/0300101 A1 12/2007 Stewart
2008/0010372 A1 1/2008 Khedouri
2008/0053293 A1 3/2008 Georges
2008/0136605 A1 6/2008 Hunt
2008/0139177 A1 6/2008 Jiang
2008/0141850 A1 6/2008 Cope
2008/0147774 A1 6/2008 Tummalapenta
2008/0156178 A1 7/2008 Georges
2008/0168154 A1 7/2008 Skyrm
2008/0189171 A1 8/2008 Wasserblat
2008/0195742 A1 8/2008 Gilfix
2008/0212947 A1 9/2008 Nesvadba
2008/0222264 A1 9/2008 Bostick
2008/0230598 A1 9/2008 Bodin
2008/0235285 A1 9/2008 Della Pasqua
2008/0256208 A1 10/2008 Keohane
2008/0288095 A1 11/2008 Miyajima
2009/0019174 A1 1/2009 Ehn
2009/0031000 A1 1/2009 Szeto
2009/0064851 A1 3/2009 Morris
2009/0069914 A1 3/2009 Kemp
2009/0071315 A1 3/2009 Fortuna
2009/0089389 A1 4/2009 Chen
2009/0114079 A1 5/2009 Egan
2009/0119097 A1 5/2009 Master
2009/0132668 A1 5/2009 Coletrane
2009/0164598 A1 6/2009 Nelson
2009/0193090 A1 7/2009 Banks
2009/0216744 A1 8/2009 Shriwas
2009/0217805 A1 9/2009 Lee
2009/0222536 A1 9/2009 Junghuber
2009/0238538 A1 9/2009 Fink
2009/0244000 A1 10/2009 Thompson
2009/0249945 A1 10/2009 Yamashita
2009/0291707 A1 11/2009 Choi
2009/0316862 A1 12/2009 Sugimoto
2010/0018382 A1 1/2010 Feeney
2010/0031804 A1 2/2010 Chevreau
2010/0043625 A1 2/2010 Van Geenen
2010/0050854 A1 3/2010 Huet
2010/0115432 A1 5/2010 Arthurs
2010/0131895 A1 5/2010 Wohlert
2010/0192755 A1 8/2010 Morris
2010/0212478 A1 8/2010 Taub
2010/0224051 A1 9/2010 Kurebayashi
2010/0250510 A1 9/2010 Herberger
2010/0250585 A1 9/2010 Hagg
2010/0257995 A1 10/2010 Kamiya
2010/0288106 A1 11/2010 Sherwani
2010/0305732 A1 12/2010 Serletic
2010/0307320 A1 12/2010 Hoeberechts
2010/0307321 A1 12/2010 Mann
2011/0010321 A1 1/2011 Pachet
2011/0075851 A1 3/2011 Leboeuf
2011/0142420 A1 6/2011 Singer
2011/0184542 A1 7/2011 Tsoneva
2011/0224969 A1 9/2011 Mulligan
2011/0258383 A1 10/2011 Niemela
2011/0273455 A1 11/2011 Powar
2011/0276396 A1 11/2011 Rathod
2011/0316793 A1 12/2011 Fushiki
2011/0320545 A1 12/2011 Hammer
2012/0005667 A1 1/2012 Deluca
2012/0007605 A1 1/2012 Benedikt
2012/0007884 A1 1/2012 Kim
2012/0084373 A1 4/2012 Chen
2012/0131115 A1 5/2012 Levell
2012/0185778 A1 7/2012 Arthurs
2012/0210212 A1 8/2012 Chen
2012/0259240 A1 10/2012 Llewellynn
2012/0297958 A1 11/2012 Rassool
2012/0312145 A1 12/2012 Kellett
2013/0005346 A1 1/2013 Chu
2013/0006627 A1 1/2013 Guthery
2013/0110505 A1 5/2013 Gruber
2013/0110519 A1 5/2013 Cheyer
2013/0124658 A1 5/2013 Fioretti
2013/0139271 A1 5/2013 Arrelid
2013/0185081 A1 7/2013 Cheyer
2013/0283150 A1 10/2013 Chen
2013/0287227 A1 10/2013 Wallander
2013/0332400 A1 12/2013 Gonzalez
2013/0332532 A1 12/2013 Bernhardsson
2013/0332842 A1 12/2013 Bernhardsson
2014/0000440 A1 1/2014 Georges
2014/0006483 A1 1/2014 Garmark
2014/0006947 A1 1/2014 Garmark
2014/0040401 A1 2/2014 Banks
2014/0052282 A1 2/2014 Balassanian
2014/0053711 A1 2/2014 Serletic, II
2014/0055633 A1 2/2014 Marlin
2014/0058735 A1 2/2014 Sharp
2014/0069263 A1 3/2014 Chen
2014/0089897 A1 3/2014 Deluca
2014/0108929 A1 4/2014 Garmark

(56) References Cited

U.S. PATENT DOCUMENTS

2014/0115114 A1 4/2014 Garmark
2014/0129953 A1 5/2014 Spiegel
2014/0139555 A1 5/2014 Levy
2014/0164361 A1 6/2014 Chung
2014/0164524 A1 6/2014 Chung
2014/0174279 A1 6/2014 Wong
2014/0214927 A1 7/2014 Garmark
2014/0215334 A1 7/2014 Garmark
2014/0230629 A1 8/2014 Wieder
2014/0230630 A1 8/2014 Wieder
2014/0230631 A1 8/2014 Wieder
2014/0260915 A1 9/2014 Okuda
2014/0279817 A1 9/2014 Whitman
2014/0289241 A1 9/2014 Anderson
2014/0301573 A1 10/2014 Kiely
2014/0310779 A1 10/2014 Lof
2014/0331332 A1 11/2014 Arrelid
2014/0337959 A1 11/2014 Garmark
2014/0344718 A1 11/2014 Rapaport
2014/0355789 A1 12/2014 Bohrarper
2014/0359024 A1 12/2014 Spiegel
2014/0359032 A1 12/2014 Spiegel
2014/0368734 A1 12/2014 Hoffert
2014/0368735 A1 12/2014 Hoffert
2014/0368737 A1 12/2014 Hoffert
2014/0368738 A1 12/2014 Hoffert
2014/0372888 A1 12/2014 Hoffert
2014/0373057 A1 12/2014 Hoffert
2015/0017915 A1 1/2015 Hennequin
2015/0026578 A1 1/2015 Rav-Acha
2015/0033932 A1 2/2015 Balassanian
2015/0039726 A1 2/2015 Hoffert
2015/0039780 A1 2/2015 Hoffert
2015/0039781 A1 2/2015 Hoffert
2015/0040169 A1 2/2015 Hoffert
2015/0058733 A1 2/2015 Novikoff
2015/0059558 A1 3/2015 Morell
2015/0088828 A1 3/2015 Strigeus
2015/0088890 A1 3/2015 Hoffert
2015/0088899 A1 3/2015 Hoffert
2015/0089075 A1 3/2015 Strigeus
2015/0106887 A1 4/2015 Aslund
2015/0113407 A1 4/2015 Hoffert
2015/0154979 A1 6/2015 Uemura
2015/0161908 A1 6/2015 Ur
2015/0179157 A1* 6/2015 Chon ..... G10H 1/0025 84/645
2015/0194185 A1 7/2015 Eronen
2015/0199122 A1 7/2015 Garmark
2015/0206523 A1 7/2015 Song
2015/0229684 A1 8/2015 Olenfalk
2015/0234833 A1 8/2015 Cremer
2015/0248618 A1 9/2015 Johnson
2015/0255052 A1 9/2015 Rex
2015/0277707 A1 10/2015 Dziuk
2015/0289023 A1 10/2015 Richman
2015/0289025 A1 10/2015 Mcleod
2015/0293925 A1 10/2015 Greenzeiger
2015/0317391 A1 11/2015 Harrison
2015/0317680 A1 11/2015 Richman
2015/0317690 A1 11/2015 Mishra
2015/0317691 A1 11/2015 Mishra
2015/0319479 A1 11/2015 Mishra
2015/0324594 A1 11/2015 Arrelid
2015/0331943 A1 11/2015 Luo
2015/0334455 A1 11/2015 Hoffert
2015/0340021 A1 11/2015 Sheffer
2015/0365719 A1 12/2015 Hoffert
2015/0365720 A1 12/2015 Hoffert
2015/0365795 A1 12/2015 Allen
2015/0370466 A1 12/2015 Hoffert
2016/0006927 A1 1/2016 Sehn
2016/0007077 A1 1/2016 Hoffert
2016/0055838 A1 2/2016 Serletic, II
2016/0066004 A1 3/2016 Lieu
2016/0071549 A1 3/2016 Von Sneidern
2016/0080780 A1 3/2016 Öman
2016/0080835 A1 3/2016 Von Sneidern
2016/0085773 A1 3/2016 Chang
2016/0085863 A1 3/2016 Allen
2016/0094863 A1 3/2016 Helferty
2016/0099901 A1 4/2016 Allen
2016/0103589 A1 4/2016 Dziuk
2016/0103595 A1 4/2016 Dziuk
2016/0103656 A1 4/2016 Dziuk
2016/0124953 A1 5/2016 Cremer
2016/0124969 A1 5/2016 Rashad
2016/0125078 A1 5/2016 Rashad
2016/0125860 A1 5/2016 Rashad
2016/0127772 A1 5/2016 Tsiridis
2016/0132594 A1 5/2016 Rashad
2016/0133241 A1 5/2016 Rashad
2016/0133242 A1 5/2016 Morell
2016/0147435 A1 5/2016 Brody
2016/0148605 A1 5/2016 Minamitaka
2016/0148606 A1 5/2016 Minamitaka
2016/0173763 A1 6/2016 Marlin
2016/0180887 A1 6/2016 Sehn
2016/0182422 A1 6/2016 Sehn
2016/0182590 A1 6/2016 Afzelius
2016/0182875 A1 6/2016 Sehn
2016/0189222 A1 6/2016 Richman
2016/0189223 A1 6/2016 Mcleod
2016/0189232 A1 6/2016 Meyer
2016/0189249 A1 6/2016 Meyer
2016/0191574 A1 6/2016 Garmark
2016/0191590 A1 6/2016 Werkelin Ahlin
2016/0191599 A1 6/2016 Stridsman
2016/0191997 A1 6/2016 Eklund
2016/0192096 A1 6/2016 Bentley
2016/0196812 A1 7/2016 Rashad
2016/0203586 A1 7/2016 Chang
2016/0210545 A1 7/2016 Anderton
2016/0210947 A1 7/2016 Rutledge
2016/0210951 A1 7/2016 Rutledge
2016/0226941 A1 8/2016 Esún
2016/0234151 A1 8/2016 Son
2016/0239248 A1 8/2016 Sehn
2016/0247189 A1 8/2016 Shirley
2016/0247496 A1 8/2016 Pachet
2016/0249091 A1 8/2016 Lennon
2016/0260123 A1 9/2016 Mishra
2016/0260140 A1 9/2016 Shirley
2016/0267944 A1 9/2016 Lammers
2016/0285937 A1 9/2016 Whitman
2016/0292269 A1 10/2016 O'Driscoll
2016/0292272 A1 10/2016 O'Driscoll
2016/0292771 A1 10/2016 Afzelius
2016/0294896 A1 10/2016 O'Driscoll
2016/0309209 A1 10/2016 Lieu
2016/0313872 A1 10/2016 Garmark
2016/0321708 A1 11/2016 Sehn
2016/0323691 A1 11/2016 Zhu
2016/0328360 A1 11/2016 Pavlovskaia
2016/0328409 A1 11/2016 Ogle
2016/0334945 A1 11/2016 Medaghri Alaoui
2016/0334978 A1 11/2016 Persson
2016/0334979 A1 11/2016 Persson
2016/0334980 A1 11/2016 Persson
2016/0335045 A1 11/2016 Medaghri Alaoui
2016/0335046 A1 11/2016 Medaghri Alaoui
2016/0335047 A1 11/2016 Medaghri Alaoui
2016/0335048 A1 11/2016 Medaghri Alaoui
2016/0335049 A1 11/2016 Persson
2016/0335266 A1 11/2016 Ogle
2016/0337260 A1 11/2016 Persson
2016/0337419 A1 11/2016 Persson
2016/0337425 A1 11/2016 Medaghri Alaoui
2016/0337429 A1 11/2016 Persson
2016/0337432 A1 11/2016 Persson
2016/0337434 A1 11/2016 Bajraktari
2016/0337854 A1 11/2016 Afzelius
2016/0342199 A1 11/2016 Smith
2016/0342200 A1 11/2016 Dziuk

(56) References Cited

U.S. PATENT DOCUMENTS

2016/0342201 A1 11/2016 Jehan
2016/0342295 A1 11/2016 Jehan
2016/0342382 A1 11/2016 Jehan
2016/0342594 A1 11/2016 Jehan
2016/0342598 A1 11/2016 Jehan
2016/0342686 A1 11/2016 Garmark
2016/0342687 A1 11/2016 Garmark
2016/0343363 A1 11/2016 Garmark
2016/0343399 A1 11/2016 Jehan
2016/0343410 A1 11/2016 Smith
2016/0366458 A1 12/2016 Whitman
2016/0378269 A1 12/2016 Conway
2016/0379274 A1 12/2016 Irwin
2016/0381106 A1 12/2016 Conway
2017/0010796 A1 1/2017 Dziuk
2017/0017993 A1 1/2017 Shirley
2017/0019441 A1 1/2017 Garmark
2017/0019446 A1 1/2017 Son
2017/0024092 A1 1/2017 Dziuk
2017/0024093 A1 1/2017 Dziuk
2017/0024399 A1 1/2017 Boyle
2017/0024486 A1 1/2017 Jacobson
2017/0024650 A1 1/2017 Jacobson
2017/0024655 A1 1/2017 Stowell
2017/0039027 A1 2/2017 Dziuk
2017/0048563 A1 2/2017 Öman
2017/0048750 A1 2/2017 Zhu
2017/0075468 A1 3/2017 Dziuk
2017/0083505 A1 3/2017 Whitman
2017/0084261 A1 3/2017 Watanabe
2017/0085552 A1 3/2017 Werkelin Ahlin
2017/0085929 A1 3/2017 Arpteg
2017/0092247 A1* 3/2017 Silverstein ..... G10H 1/368
2017/0092324 A1 3/2017 Leonard
2017/0102837 A1 4/2017 Toumpelis
2017/0103075 A1 4/2017 Toumpelis
2017/0103740 A1 4/2017 Hwang
2017/0116533 A1 4/2017 Jehan
2017/0118192 A1 4/2017 Garmark
2017/0124713 A1 5/2017 Jurgenson
2017/0134795 A1 5/2017 Tsiridis
2017/0139912 A1 5/2017 Whitman
2017/0140060 A1 5/2017 Cody
2017/0140261 A1 5/2017 Qamar
2017/0149717 A1 5/2017 Sehn
2017/0150211 A1 5/2017 Helferty
2017/0154109 A1 6/2017 Lynch
2017/0161119 A1 6/2017 Boyle
2017/0161382 A1 6/2017 Ouimet
2017/0169107 A1 6/2017 Bernhardsson
2017/0169858 A1 6/2017 Lee
2017/0177297 A1 6/2017 Jehan
2017/0177585 A1 6/2017 Rodger
2017/0177605 A1 6/2017 Hoffert
2017/0180438 A1 6/2017 Persson
2017/0180826 A1 6/2017 Hoffert
2017/0187672 A1 6/2017 Banks
2017/0187771 A1 6/2017 Falcon
2017/0188102 A1 6/2017 Zhang
2017/0192649 A1 7/2017 Bakken
2017/0195813 A1 7/2017 Bentley
2017/0220316 A1 8/2017 Garmark
2017/0229030 A1 8/2017 Aguayo, Jr.
2017/0230295 A1 8/2017 Polacek
2017/0230354 A1 8/2017 Afzelius
2017/0230429 A1 8/2017 Garmark
2017/0230438 A1 8/2017 Turkoglu
2017/0235540 A1 8/2017 Jehan
2017/0235541 A1 8/2017 Smith
2017/0235826 A1 8/2017 Garmark
2017/0244770 A1 8/2017 Eckerdal
2017/0248799 A1 8/2017 Streets
2017/0248801 A1 8/2017 Ashwood
2017/0249306 A1 8/2017 Allen
2017/0251039 A1 8/2017 Hoffert
2017/0262139 A1 9/2017 Patel
2017/0262253 A1 9/2017 Silva
2017/0262994 A1 9/2017 Kudriashov
2017/0263029 A1 9/2017 Yan
2017/0263030 A1 9/2017 Allen
2017/0263225 A1 9/2017 Silverstein
2017/0263226 A1 9/2017 Silverstein
2017/0263227 A1 9/2017 Silverstein
2017/0263228 A1 9/2017 Silverstein
2017/0264578 A1 9/2017 Allen
2017/0264660 A1 9/2017 Eckerdal
2017/0264817 A1 9/2017 Yan
2017/0270125 A1 9/2017 Mattsson
2017/0286536 A1 10/2017 Rando
2017/0286752 A1 10/2017 Gusarov
2017/0289234 A1 10/2017 Andreou
2017/0289489 A1 10/2017 Hoffert
2017/0295250 A1 10/2017 Samaranayake
2017/0300567 A1 10/2017 Jehan
2017/0301372 A1 10/2017 Jehan
2017/0308794 A1 10/2017 Fischerström
2017/0344246 A1 11/2017 Burfitt
2017/0344539 A1 11/2017 Zvoncek
2017/0346867 A1 11/2017 Olenfalk
2017/0353405 A1 12/2017 O'Driscoll
2017/0358285 A1 12/2017 Cabral
2017/0358320 A1 12/2017 Cameron
2017/0366780 A1 12/2017 Jehan
2017/0372364 A1 12/2017 Andreou
2017/0374003 A1 12/2017 Allen
2017/0374508 A1 12/2017 Davis
2018/0004480 A1 1/2018 Medaghri Alaoui
2018/0005026 A1 1/2018 Shaburov
2018/0005420 A1 1/2018 Bondich
2018/0007286 A1 1/2018 Li
2018/0007444 A1 1/2018 Li
2018/0018079 A1 1/2018 Monastyrshyn
2018/0018397 A1 1/2018 Cody
2018/0018948 A1 1/2018 Silverstein
2018/0025004 A1 1/2018 Koenig
2018/0025372 A1 1/2018 Ahmed
2018/0041517 A1 2/2018 Lof
2018/0052921 A1 2/2018 Deglopper
2018/0054592 A1 2/2018 Jehan
2018/0054704 A1 2/2018 Toumpelis
2018/0069743 A1 3/2018 Bakken
2018/0076913 A1 3/2018 Kiely
2018/0089904 A1 3/2018 Jurgenson
2018/0095715 A1 4/2018 Jehan
2018/0096064 A1 4/2018 Lennon
2018/0103002 A1 4/2018 Sehn
2018/0109820 A1 4/2018 Pompa
2018/0129659 A1 5/2018 Jehan
2018/0129745 A1 5/2018 Jehan
2018/0136612 A1 5/2018 Zayets-Volshin
2018/0137845 A1 5/2018 Prokop
2018/0139333 A1 5/2018 Edling
2018/0150276 A1 5/2018 Vacek
2018/0157746 A1 6/2018 Zhu
2018/0164986 A1 6/2018 Al Majid
2018/0167726 A1 6/2018 Bohrarper
2018/0181849 A1 6/2018 Cassidy
2018/0182394 A1 6/2018 Hulaud
2018/0188054 A1 7/2018 Kennedy
2018/0188945 A1 7/2018 Garmark
2018/0189020 A1 7/2018 Oskarsson
2018/0189021 A1 7/2018 Oskarsson
2018/0189023 A1 7/2018 Garmark
2018/0189226 A1 7/2018 Hofverberg
2018/0189278 A1 7/2018 Garmark
2018/0189306 A1 7/2018 Lamere
2018/0189408 A1 7/2018 O'Driscoll
2018/0190253 A1 7/2018 O'Driscoll
2018/0191654 A1 7/2018 O'Driscoll
2018/0191795 A1 7/2018 Oskarsson
2018/0192082 A1 7/2018 O'Driscoll
2018/0192108 A1 7/2018 Lyons
2018/0192239 A1 7/2018 Liusaari
2018/0192240 A1 7/2018 Liusaari

(56) References Cited

U.S. PATENT DOCUMENTS

| | | | |
|---|---|---|---|
| 2018/0192285 | A1 | 7/2018 | Schmidt |
| 2018/0226063 | A1 | 8/2018 | Wood |
| 2018/0233119 | A1 | 8/2018 | Patti |
| 2018/0239580 | A1 | 8/2018 | Garmark |
| 2018/0246694 | A1 | 8/2018 | Gibson |
| 2018/0246961 | A1 | 8/2018 | Gibson |
| 2018/0248965 | A1 | 8/2018 | Gibson |
| 2018/0248976 | A1 | 8/2018 | Gibson |
| 2018/0248978 | A1 | 8/2018 | Gibson |
| 2018/0300331 | A1 | 10/2018 | Jehan |
| 2018/0321904 | A1 | 11/2018 | Bailey |
| 2018/0321908 | A1 | 11/2018 | Bailey |
| 2018/0323763 | A1 | 11/2018 | Bailey |
| 2018/0332024 | A1 | 11/2018 | Garmark |
| 2018/0351937 | A1 | 12/2018 | Ahlin |
| 2018/0358053 | A1 | 12/2018 | Smith |
| 2018/0367229 | A1 | 12/2018 | Gibson |
| 2018/0367580 | A1 | 12/2018 | Marsh |
| 2019/0018557 | A1 | 1/2019 | O'Driscoll |
| 2019/0018645 | A1 | 1/2019 | Mcclellan |
| 2019/0018702 | A1 | 1/2019 | O'Driscoll |
| 2019/0023705 | A1 | 1/2019 | Le Fur |
| 2019/0026817 | A1 | 1/2019 | Helferty |
| 2019/0073191 | A1 | 3/2019 | Bailey |
| 2019/0074807 | A1 | 3/2019 | Bailey |
| 2019/0237051 | A1* | 8/2019 | Silverstein ..... G10H 1/0025 |
| 2019/0279606 | A1 | 9/2019 | Silverstein |
| 2019/0304418 | A1 | 10/2019 | Silverstein |
| 2019/0340245 | A1 | 11/2019 | Zhu |
| 2019/0341898 | A1 | 11/2019 | Mcclellan |
| 2019/0362696 | A1 | 11/2019 | Balassanian |
| 2020/0168187 | A1 | 5/2020 | Silverstein |
| 2020/0168188 | A1 | 5/2020 | Silverstein |
| 2020/0168189 | A1 | 5/2020 | Silverstein |
| 2020/0168190 | A1 | 5/2020 | Silverstein |
| 2020/0168191 | A1 | 5/2020 | Silverstein |
| 2020/0168192 | A1 | 5/2020 | Silverstein |
| 2020/0168193 | A1 | 5/2020 | Silverstein |
| 2020/0168194 | A1 | 5/2020 | Silverstein |
| 2020/0168195 | A1 | 5/2020 | Silverstein |
| 2020/0168196 | A1 | 5/2020 | Silverstein |
| 2020/0168197 | A1 | 5/2020 | Silverstein |

FOREIGN PATENT DOCUMENTS

| | | | |
|---|---|---|---|
| CA | 2894332 | C | 12/2015 |
| CA | 2895728 | A1 | 1/2016 |
| CA | 2910158 | A1 | 4/2016 |
| CN | 106663264 | A | 5/2017 |
| CN | 106688031 | A | 5/2017 |
| CN | 107004225 | A | 8/2017 |
| CN | 107111430 | A | 8/2017 |
| CN | 107111828 | A | 8/2017 |
| CN | 107251006 | A | 10/2017 |
| CN | 107430697 | A | 12/2017 |
| CN | 107430767 | A | 12/2017 |
| CN | 107431632 | A | 12/2017 |
| CN | 107710188 | A | 2/2018 |
| CN | 107924590 | A | 4/2018 |
| CN | 108604378 | A | 9/2018 |
| DE | 10047266 | A1 | 4/2001 |
| DE | 10047266 | B4 | 4/2001 |
| DE | 112011103172 | T5 | 7/2013 |
| DE | 112011103081 | T5 | 9/2013 |
| EP | 1683034 | B1 | 7/2006 |
| EP | 2015542 | A1 | 1/2009 |
| EP | 2015542 | B1 | 1/2009 |
| EP | 2096324 | A1 | 9/2009 |
| EP | 2248311 | B1 | 11/2010 |
| EP | 2378435 | A1 | 10/2011 |
| EP | 2388954 | A1 | 11/2011 |
| EP | 2663899 | | 11/2013 |
| EP | 2808870 | A1 | 12/2014 |
| EP | 2808870 | B1 | 12/2014 |
| EP | 2868060 | B1 | 5/2015 |
| EP | 2868061 | B1 | 5/2015 |
| EP | 2925008 | A1 | 9/2015 |
| EP | 2999191 | A1 | 3/2016 |
| EP | 2999191 | B1 | 3/2016 |
| EP | 3035273 | A1 | 6/2016 |
| EP | 3035273 | B1 | 6/2016 |
| EP | 3041245 | A1 | 7/2016 |
| EP | 3041245 | B1 | 7/2016 |
| EP | 3055790 | B1 | 8/2016 |
| EP | 3059973 | A1 | 8/2016 |
| EP | 3061245 | B1 | 8/2016 |
| EP | 3076353 | A1 | 10/2016 |
| EP | 3093786 | A1 | 11/2016 |
| EP | 3093786 | B1 | 11/2016 |
| EP | 3094098 | A1 | 11/2016 |
| EP | 3094099 | A1 | 11/2016 |
| EP | 3096323 | A1 | 11/2016 |
| EP | 3151576 | A1 | 4/2017 |
| EP | 3196782 | A1 | 7/2017 |
| EP | 3215962 | B1 | 9/2017 |
| EP | 3255862 | A1 | 12/2017 |
| EP | 3255862 | B1 | 12/2017 |
| EP | 3255889 | A1 | 12/2017 |
| EP | 3255889 | B1 | 12/2017 |
| EP | 3258394 | A1 | 12/2017 |
| EP | 3258436 | A1 | 12/2017 |
| EP | 3268876 | B1 | 1/2018 |
| EP | 3285453 | A1 | 2/2018 |
| EP | 3285453 | B1 | 2/2018 |
| EP | 3287913 | A1 | 2/2018 |
| EP | 3306892 | A1 | 4/2018 |
| EP | 3306892 | B1 | 4/2018 |
| EP | 3310066 | A1 | 4/2018 |
| EP | 3321827 | A1 | 5/2018 |
| EP | 3324356 | A1 | 5/2018 |
| EP | 3328090 | A1 | 5/2018 |
| EP | 3330872 | A1 | 6/2018 |
| EP | 3343448 | A1 | 7/2018 |
| EP | 3343448 | B1 | 7/2018 |
| EP | 3343483 | A1 | 7/2018 |
| EP | 3343484 | A1 | 7/2018 |
| EP | 3343844 | A1 | 7/2018 |
| EP | 3343880 | A1 | 7/2018 |
| EP | 3367269 | A1 | 8/2018 |
| EP | 3367639 | A1 | 8/2018 |
| EP | 3404893 | A1 | 11/2018 |
| EP | 3425919 | A1 | 1/2019 |
| IN | 419KOLNP2006 | A | 9/2007 |
| IN | 298031 | A1 | 7/2011 |
| IN | 1369MUM2011 | A | 8/2011 |
| JP | 3680749 | | 8/2005 |
| JP | 5941065 | B2 | 2/2014 |
| KR | 1020160013213 | A | 2/2016 |
| SE | 535612 | C2 | 10/2012 |
| WO | 9324645 | | 12/1993 |
| WO | 1997021210 | A1 | 6/1997 |
| WO | 0108134 | | 2/2001 |
| WO | 0135667 | | 5/2001 |
| WO | 0184353 | | 11/2001 |
| WO | 0186624 | | 11/2001 |
| WO | 0186624 | A3 | 11/2001 |
| WO | 05057821 | | 6/2005 |
| WO | 2005057821 | A2 | 6/2005 |
| WO | 2006071876 | A2 | 7/2006 |
| WO | 2007106371 | A2 | 9/2007 |
| WO | 12096617 | | 7/2012 |
| WO | 2012136599 | A1 | 10/2012 |
| WO | 2012150602 | A1 | 11/2012 |
| WO | 2013003854 | A2 | 1/2013 |
| WO | 2013080048 | A1 | 6/2013 |
| WO | 2013153449 | A2 | 10/2013 |
| WO | 2013153449 | A3 | 10/2013 |
| WO | 2013181662 | A2 | 12/2013 |
| WO | 2013181662 | A3 | 12/2013 |
| WO | 2013184957 | A1 | 12/2013 |
| WO | 2013185107 | A1 | 12/2013 |
| WO | 2012150602 | A8 | 1/2014 |
| WO | 2014001912 | A2 | 1/2014 |
| WO | 2014001912 | A3 | 1/2014 |

(56) References Cited

FOREIGN PATENT DOCUMENTS

| | | | |
|---|---|---|---|
| WO | 2014001913 | A2 | 1/2014 |
| WO | 2014001913 | A3 | 1/2014 |
| WO | 2014001914 | A2 | 1/2014 |
| WO | 2014001914 | A3 | 1/2014 |
| WO | 2014057356 | A2 | 4/2014 |
| WO | 2014057356 | A3 | 4/2014 |
| WO | 2013003854 | A3 | 5/2014 |
| WO | 2014064531 | A1 | 5/2014 |
| WO | 2014068309 | A1 | 5/2014 |
| WO | 14144833 | | 9/2014 |
| WO | 14153133 | | 9/2014 |
| WO | 2014166953 | A1 | 10/2014 |
| WO | 2014194262 | A2 | 12/2014 |
| WO | 2014194262 | A3 | 12/2014 |
| WO | 2014204863 | A2 | 12/2014 |
| WO | 2014204863 | A3 | 12/2014 |
| WO | 2015040494 | A2 | 3/2015 |
| WO | 2015040494 | A3 | 3/2015 |
| WO | 2015056099 | A1 | 4/2015 |
| WO | 2015056102 | A1 | 4/2015 |
| WO | 15170126 | | 11/2015 |
| WO | 2015192026 | A1 | 12/2015 |
| WO | 2016007285 | A1 | 1/2016 |
| WO | 2016044424 | A1 | 3/2016 |
| WO | 2016054562 | A1 | 4/2016 |
| WO | 2016065131 | A1 | 4/2016 |
| WO | 2016085936 | A1 | 6/2016 |
| WO | 2016100318 | A2 | 6/2016 |
| WO | 2016100318 | A3 | 6/2016 |
| WO | 2016100342 | A1 | 6/2016 |
| WO | 2016107799 | A1 | 7/2016 |
| WO | 2016108086 | A1 | 7/2016 |
| WO | 2016108087 | A1 | 7/2016 |
| WO | 2016112299 | A1 | 7/2016 |
| WO | 2016118338 | A1 | 7/2016 |
| WO | 2016156553 | A1 | 10/2016 |
| WO | 2016156554 | A1 | 10/2016 |
| WO | 2016156555 | A1 | 10/2016 |
| WO | 2016156555 | A9 | 10/2016 |
| WO | 2016179166 | A1 | 11/2016 |
| WO | 2016179235 | A1 | 11/2016 |
| WO | 2016184866 | A1 | 11/2016 |
| WO | 2016184867 | A1 | 11/2016 |
| WO | 2016184868 | A1 | 11/2016 |
| WO | 2016184869 | A1 | 11/2016 |
| WO | 2016184871 | A1 | 11/2016 |
| WO | 2016186881 | A1 | 11/2016 |
| WO | 16209685 | | 12/2016 |
| WO | 2017015218 | A1 | 1/2017 |
| WO | 2017015224 | A1 | 1/2017 |
| WO | 2017019457 | A1 | 2/2017 |
| WO | 2017019458 | A1 | 2/2017 |
| WO | 2017019460 | A1 | 2/2017 |
| WO | 17048450 | | 3/2017 |
| WO | 2017040633 | A1 | 3/2017 |
| WO | 2017048450 | A1 | 3/2017 |
| WO | 17058844 | | 4/2017 |
| WO | 2017058844 | A1 | 4/2017 |
| WO | 2017070427 | A1 | 4/2017 |
| WO | 2017075476 | A1 | 5/2017 |
| WO | 2017095800 | A1 | 6/2017 |
| WO | 2017095807 | A1 | 6/2017 |
| WO | 2017103675 | A1 | 6/2017 |
| WO | 2017106529 | A1 | 6/2017 |
| WO | 2017109570 | A1 | 6/2017 |
| WO | 2017140786 | A1 | 8/2017 |
| WO | 2017147305 | A1 | 8/2017 |
| WO | 2017151519 | A1 | 9/2017 |
| WO | 2017153435 | A1 | 9/2017 |
| WO | 2017153437 | A1 | 9/2017 |
| WO | 2017175061 | A1 | 10/2017 |
| WO | 2017182304 | A1 | 10/2017 |
| WO | 2017210129 | A1 | 12/2017 |
| WO | 2017218033 | A1 | 12/2017 |
| WO | 2018006053 | A1 | 1/2018 |
| WO | 2018015122 | A1 | 1/2018 |
| WO | 2018017592 | A1 | 1/2018 |
| WO | 2018022626 | A1 | 2/2018 |
| WO | 2018033789 | A1 | 2/2018 |
| WO | 18226418 | | 12/2018 |
| WO | 18226419 | A8 | 12/2018 |

OTHER PUBLICATIONS

Richard Portelli, "ORB Composer Getting Started 1.0.0", Hexachords Entertainment, updated Apr. 1, 2018, (33 Pages).

Richard Portelli, "ORB Composer Documentation 1.0.0", Hexachords Entertainment, updated Apr. 2, 2018, (36 Pages).

Richard Portelli, "ORB Composer Dashboard—Screenshot", Hexachords Entertainment, updated Aug. 17, 2019, (1 Page).

Richard Portelli, "Getting Started with ORB Composer S V 1.5", Hexachords Entertainment, updated Dec. 8, 2019, (21 Pages).

Richard Portelli, "Getting Started with ORB Composer S V 1.0", Hexachords Entertainment, updated Mar. 3, 2019, (15 Pages).

IBM, "IBM Watson Beat: Cutting a track for the Red Bull Racing with a music-making machine", published and accessed at https://www.ibm.com/case-studies/ibm-watson-beat, on Feb. 4, 2019, (9 pages).

The Lilypond Development Team, "Wikipedia Summary of LilyPond Music Engraving Software", published and accessed at https://en.wikipedia.org/wiki/LilyPond, on Dec. 8, 2019, (8 Pages).

The Lilypond Development Team, "LilyPond Notation Reference (2015) Version 2.19.83", downloaded from http://www.lilypond.com, Dec. 2019, (882 Pages).

The Lilypond Development Team, "LilyPond Music Notation for Everyone: Text Input," published and accessed at http://lilypond.org/text-input.html, on Dec. 8, 2019, (4 Pages).

The Lilypond Development Team, "LilyPond Learning Manual (2015) Version 2.19.83", downloaded from http://www.lilypond.com on Dec. 8, 2019, (216 Pages).

The Lilypond Development Team, "LilyPond Music Glossary (2015) Version 2.19.83", downloaded from http://www.lilypond.com on Dec. 8, 2019, (98 Pages).

The Lilypond Development Team, "LilyPond Usage (2015) Version 2.19.83", downloaded from http://www.lilypond.com on Dec. 8, 2019, (69 Pages).

Avid Corporation, Screenshots from Avid Website entitled "Music Creation Solutions: Overview; Meeting the Challenge; Integrated Hardware & Software; and Notation and Scoring," published and accessed from https://www.avid.com/solutions/music-creation on Dec. 8, 2019, (3 Pages).

Amazon.com, Inc., Webpages from Amazon Web Services, Inc., for the AWS Deepcomposer, published and accessed by https://aws.amazon.com/deepcomposer/. on Dec. 8, 2019, (9 Pages).

Boomy Corporation, "Boomy Talks AI Music: We Want to Make Music That's Meaningful", published at https://musically.com/2019/07/31/boomy-talks-ai-music-we-want-to-make-music-thats-meaningful/ on Jul. 31, 2019, (13 Pages).

Musical.ly Inc., "2018 Music AI: The Music-Ally Guide", published on Nov. 22, 2018, and downloaded from https://musically.com/wp-content/uploads/2018/11/Music-Ally-AI-Music-Guide.pdf, (24 Pages).

"NotePerformer 3 User Guide", Wallander Instruments AB, updated Sep. 12, 2019, (64 Pages).

"NotePerformer 3.2 Version History", Wallander Instruments AB, updated Sep. 2, 2019, (33 Pages).

"Affective Key Characteristics", from Christian Schubart's "Ideen zu einer Aesthetik der Tonkunst" (1806), translated by Rita Steblin in A History of Key Characteristics in the 18th and Early 19th Centuries, UMI Research Press, 1983, and republished at http://www.wmich.edu/mus-theo/courses/keys.html, (3 Pages).

"Characteristics of Musical Keys,: a selection of information from the Internet about the emotion or moodassociated with musical keys", published at http://biteyourownelbow.com/keychar.htm, on Oct. 14, 2009, (6 Page).

Ableton AG, "Ableton Reference manual Version 10", Jan. 2018, (pp. 1-759).

(56) References Cited

OTHER PUBLICATIONS

Alex Rodriguez Lopez, Antonio Pedro Oliveira, and Amilcar Cardosa, "Real-Time Emotion-Driven Music Engine", Centre for Informatics and Systems, University of Coimbra, Portugal, Conference Paper, Jan. 2010, published in ResearchGate on Jun. 2015, (6 Pages).
Alexis John Kirke, and Eduardo Reck Miranda, "Artificial Social Composition: A Multi-Agent System for Composing Music Performances by Emotional Communication", 2009, Interdisciplinary Center for Computer Music Research, University of Plymouth, UK, (19 Pages).
Alison Mattek, "Computational Methods for Portraying Emotion in Generative Music Composition", May 2010, Undergraduate Thesis, Department of Music Engineering, University of Miami, Miami, Florida, (62 Page).
Alper Gungormusler, Natasa Paterson-Paulberg, and Mads Haahr, "BarelyMusician: An Adaptive Music Engine For /Video Games", AES 56th International Conference, London, UK, Feb. 11-13, 2015, published in ResearchGate, Feb. 2015, (9 Pages).
Anthony Prechtl, Robin Laney, Alistair Willis, Robert Samuels, Algorithmic Music as Intelligent Game Music, Apr. 2014, published in AISB50: The 50th Annual Convention of the AISB, Apr. 11, 2014, London, UK, (5 Pages).
Avid Technology Inc., "Pro Tools Reference Guide", Dec. 2018, (pp. 1-1489).
Michael Levine, Behind the Audio, "Why Hans Zimmer got the Job You Wanted (And You Didn't)", Jul. 2013, (pp. 1-3).
Bernard A. Hutchins Jr., Walter H. Ku, "A Simple Hardware Pitch Extractor", JAES, Mar. 1, 1982,vol. 30 issue 3, pp. 135-139, Audio Engineering Society Inc., Ithaca, New York, (5 Page).
Bill Manaris, Dana Hughes, Yiorgos Vassilandonakis, "Monterey Mirror: Combining Markov Models, Genetic Algorithms, and Power Laws", Computer Science Department, College of Charleston, SC, USA, appearred in Proceedings of 1st Workshop in Evolutionary Music, 2011 IEEE Congress on Evolutionary Computation (CEC 2011), New Orleans, LA, USA, Jun. 5, 2011, pp. 33-40, (8 Pages).
Bitwig, Dave Linnenbank, "Bitwig Studio User Guide", Feb. 2017, (pp. 1-383).
Bongjun Kim, Woon Seung Yeo, "Probabilistic Prediction of Rhythmic Characteristics in Markov Chain-Based Melodic Sequences", 2013 Graduate School of Culture Technology, Korea Republic, published in 2013 ICMC Idea, pp. 29-432, (4 Pages ).
Brit Cruise, "Real Time Control of Emotional Affect in Algorithmic Music", May 31, 2010, britcruise.com, (20 Pages).
Cambridge Innovation Capital Press Release, "Cambridge Innovation Capital Leads Follow-On Funding Round For Digital Music Creator Jukedeck", Dec. 7, 2015, Cambridge University, Cambridge England, (3 Pages).
Caroline Palmer, Sean Hutchins, "What is Musical Prosody, Psychology of Learning and Motivation", 2005, vol. 46, Elsevier Press, Montreal, Canada, (63 Pages).
Cheng Long, Raymond Chi-Wing Wong, Raymond Ka Wai Sze, "A Melody Composer Based on Frequent Pattern Mining", 2013, The Hong Kong University of Science and Technology, Hong Kong, (4 Pages).
Chih-Fang Huang, Wei-Gang Hong, Min-Hsuan Li, "A Research of Automatic Composition and Singing Voice Synthesis System for Taiwanese Popular Songs", published in Proceedings ICMC, 2014, Sep. 4-20, 2014, Athens, Greece, (6 Page).
Chih-Fang Huang, En-Ju Lin, "An Emotion-Based Method to Perform Algorithmic Composition", Jun. 2013, Department of Information Communications, Kainan University, Taiwan, (4 Pages).
Christopher Ariza, "An Open Design for Computer-Aided Algorithmic Music Composition: athenaCL", 2005, New York University, NY, NY, published on Dissertation.com, Boca Raton, Florida, 2005 (ISBN 1-58112-292-6), (25 Pages).
Christopher Ariza, Navigating the Landscape of Computer Aided Algorithmic Composition Systems: a Definition, Seven Descriptors, and a Lexicon of Systems and Research, New York University, New York, New York, published as MIT Open Course Ware, 21M.380 Music and Technology: Algorithmic and Generative MusicSpring, 2010, (8 Pages).
Chunyang Song, Marcus Pearce, Christopher Harte, "Synpy: A Python Toolkit for Syncopation Modelling", 2015, Queen Mary, University of London, London UK, (6 Page).
Claudio Galmonte, Dimitrij Hmeljak, "Study for a Real-Time Voice-to-Synthesized-Sound Converter", 1996, University of Trieste, Italy, (6 Pages).
Cockos Inc, "Up and Running: A Reaper User Guide", Apr. 2019, (pp. 1-464).
Dave Phillips, Finlay, Ohio, USA, Review of Henrich K. Taube: Notes from the Metalevel: Introduction to Algorithmic Music Composition (2004), published in Computer Music Journal (CMJ), vol. 26, Issue 3,2005 Fall, The MIT Press, Cambridge, MA, at http://www.computermusicjournal.org/reviews/29-3/phillips-taube.html, 3 Pages.
David Cope, "Experiments in Music Intelligence (EMI)", University of California, Santa Cruz, 1987, ICMC Proceedings, pp. 174-181, (8 Page).
David Cope, "Techniques of the Contempory Composer", Schirmer Thomson Learning, 1997, (123 Pages).
Donya Quick, "Kulitta: A Framework for Automated Music Composition", Dec. 2014, Yale University, US, (229 Pages).
Donya Quick, Paul Hudak, "Grammar-Based Automated Music Composition in Haskell", 2013, Department of Computer Science, Yale University, USA, (20 Pages).
Donya Quick, Paul Hudak, "Grammar-Based Automated Music Composition in Haskell", 2013, Yale University, USA, (12 Pages).
Evening Standard, Samuel Fischwick, "Robot rock: how AI singstars use machine learning to write harmonies", Mar. 2018, (pp. 1-3).
Flow Machines, "'Happy' With the Reflexive Looper", Jun. 2016, (pp. 1).
Francois Pachet, Pierre Roy, Julian Moreira, Mark D'Inverno, "Reflexive Loopers for Solo Musical Improvisation", Apr. 2013, (pp. 1-5).
G. Scott Vercoe, "Moodtrack: Practical Methods for Assembling Emotion-Driven Music", 2006, Massachusetts Institute of Technology, Massachusetts, (86 Pages).
George Sioros, Carlos Guedes, "Automatic Rhythmic Performance in Max/MSP: the kin.rythmicator", published in 2011 International Conference on New Interfaces for Musical Expression, Oslo, Norway, May 30-Jun. 1, 2011, (4 Pages).
Guilherme Ludwig, "Topics in Statistics: Extracting Patterns in Music for Composition via Markov Chains", May 11, 2012, University of Wisconsin, US, (18 Pages).
Gustavo Diaz-Jerez, "Algorithmic Music: Using mathematical Models in Music Composition", Aug. 2000, The Manhattan School of Music, New York, (284 Pages).
Hanna Jarvelainen, "Algorithmic Musical Composition", Apr. 7, 2000, Helsinki University of Technology, Finland, (12 Pages).
Heinrich Konrad Taube, "Notes from the Metalevel: An Introduction to Computer Composition", first published online by Swets Zeitlinger Publishing on Oct. 5, 2003 at http://www.moz.ac.at/sem/lehre/lib/bib/software/cm/ Notes from the Metalevel/intro.html, then later by Routledge, Taylor & Francis in 2005 (ISBN 10: 9026519575 ISBN 13: 9789026519574 Hardcover), (313 Pages).
Heinrich Taube, "An Introduction to Common Music", Computer Music Journal, Spring 1997, vol. 21, MIT Press, USA, pp. 29-34.
Horacio Alberto Garcia Salaa, Alexander Gelbukh, Hiram Calvo, Fernando Gal in Do Soria, Automatic Music Compositon with Simple Probabilistic Generative Grammars, Polibits, 2011 ,vol. 44, pp. 57-63, Center for Technological Design and Development in Computer Science, Mexico City, Mexico.
Horacio Alberto Garcia Salas, Alexander Gelbukh, Musical Composer Based on Detection of Typical Patterns in a Human Composer's Style, 2006, Mexico, (6 Pages).
Iannis Xenakis, Formalized Music: Thought and Mathematics in Composition, Pendragon Press, 1992, (201 Scanned Pages).
IBM, "IBM Watson Beat", Nov. 2011, (pp. 1-9).
IEEE Access, Luca Turchet, "Smart Musical Instruments: Vision, design Principles, and Future Directions", Oct. 2018, (pp. 1-20).
Image Line Software, "FL Studio: Getting Started Manual", Jan. 2017, (pp. 1-89).

(56) References Cited

OTHER PUBLICATIONS

International Search Report and Written Opinion of the International Searching Authority, dated Feb. 7, 2017 PCT/US2016/054066, (37 Pages).
Isabel Lacatus, "Composing Music to Picture", Nov. 2017, (pp. 1-8).
Isabel Lacatus, "How to Compose Like Hans Zimmer", Dec. 2017, (pp. 1-5).
Jacob M. Peck, Explorations in Algorithmic Composition: Systems of Composition and Examination of Several Original Works, Oct. 2011, (63 Pages).
James Harkins, A Practical Guide to Patterns, 2009, Supercollider, (72 Pages).
Joel Douek, "Music and Emotion—A Composer's Perspective", vol. 7, Article 82, Frontiers in Systems Neuroscience, Nov. 2013, (4 Pages).
Joel L. Carbonera, Joao L. T. Silva, An Emergent Markovian Model to Stochastic Music Composition, 2008, University of Caxias do Sul, Brazil, (10 Pages).
John Brownlee, "Can Computers Write Music That Has a Soul?", FastCompany, Aug. 2013, (11 Pages).
John J. Dubnowski, Ronald W. Schafer, Lawrence R. Rabiner, Real-Time Digital Hardware Pitch Detector, vol. 24, IEEE IEEE Transactions on Acoustics, Speech, and Signal Processing, Feb. 1976, (7 pages).
Jon Brantingham, "How to Spot a Film", Aug. 2017, (pp. 1-12).
Jon Sneyers, Danny De Schreye, "Apopcaleaps: Automatic Music Generation with CHRiSM", 2010, K.U. Leuven, Belgium, (8 Pages).
Kento Watanabe et al, "Modeling Structural Topic Transitions for Automatic Lyrics Generation", PACLIC 28,2014, pp. 422-431, Graduate School of Information Sciences Tohoku University, Japan, (10 Pages).
Kris Goffin, "Music Feels Like Moods Feel", vol. 5, Article 327, Frontiers in Psychology, Apr. 2014, (4 Pages).
Kristine Monteith, Tony Martinez and Dan Ventura, "Automatic Generation of Melodic Accompaniments for Lyrics", 2012, Proceedings of the Third International Conference on Computational Creativity, pp. 87-94, 15 Pages.
Kristine Monteith, Virginia Francisco, Tony Martinez, Pablo Gervas and Dan Ventura, "Automatic Generation of Emotionally-Targeted Soundtracks", 2011 Proceedings of the Second International Conference on Computational Creativity, pp. 60-62, 3 Pages.
Kristine Monteith, Virginia Francisco, Tony Martinez, Pablo Gervas Dan Ventura, "Automatic Generation of Music for Inducing Emotive Response", Computer Science Department, Brigham Young University, Proceedings of the First International Conference on Computational Creativity, 2010, pp. 140-149, (10 Pages).
Kurt Kleiner,"Is that Mozart or a Machine? Software can Compose Music in Classical, Pop, or Jazz Styles", Dec. 16, 2011, Phys.org, (1 page).
LBB Online, "Music Machines: Jukedeck is Using AI to Compose Music", Sep. 2017, (pp. 1-5).
Leon Harkleroad, "The Math Behind Music", Aug. 2006, Cambridge University Press, UK, (139 Pages).
Lorenzo J. Tardon, Carles Roig, Isabel Barbancho, Ana M Barbancho, Automatic Melody Composition Based on a Probabilistic Model of Music Style and Harmonic Rules, Aug. 2014, Knowledge Based Systems.
M D Plumbley, S A Abdallah, Automatic Music Transcription ans Audio Source Separation, 2001, Dept of Electronic Engineering, University of London, London, (20 pages).
Maia Hoeberechts, Ryan Demopoulos and Michael Katchabaw, "A Flexible Music Composition Engine", Department of Computer Science, Middlesex College, The University of Western Ontario, London, Ontario, Canada, published in Audio Mostly 2007, 2nd Conference on Interaction with Sound, Conference Proceedings, Sep. 27-28, 2007, Rontgenbau, Ilmenau, Germany, Fraunhofer Institute for Digital Media Technology IDMT, (6 Pages).
Marco Marchini, Francois Pachet, Benoit Carre, "Reflexive Looper for Structured Pop Music", May 2017, (pp. 1-6).
Marco Scirea, Mark J. Nelson, and Julian Togelius, "Moody Music Generator: Characterizing Control Parameters Using Crowsourcing", published in 2015 Proceedings of the 4th Conference on Evolutionary and Biologically Inspired Music, Sound, Art and Design, and republished at http://julian.togelius.com/Scirea2015Moody.pdf , (12 Pages).
Michael C. Mozer, Todd Soukup, Connectionist Music Composition Based on Melodic and Stylistic Constraints, 1990, Department of Computer Science and Institute of Cognitive Science, University of Colorado, Boulder Colorado, (8 Pages).
Michael Chan, John Potter, Emery Shubert, Improving Algorithmic Music Composition with Machine Learning, 9th International Conference on Music Perception and Cognition, Aug. 2006, pp. 1848-1854, University of New South Wales, Sydney, Australia, (7 Pages).
Michael Kamp, Andrei Manea, Stones: Stochastic Technique for Generating Songs, Jan. 2013, Fraunhofer Institute for Intelligent Analysis Information Systems, Germany, (6 Pages).
Miguel Febrer et al, Aneto: A Tool for Prosody Analysis of Speech, 1998, Polytechnic University of Catalunya, Barcelona, Spain, (4 Pages).
Miguel Haruki Yaimaguchi, An Extensible Tool for Automated Music Generation, May 2011, Department of Computer Science, Lafayette College, Pennsylvania, (108 Pages).
Mixonline, Michael Cooper, "Sonicsmiths The Foundary: Virtual Instrument Takes Fresh Approach to Sound Design", Apr. 2016, (pp. 1-3).
Motu, "Digital Performer 10 User Guide", Jan. 2019, (pp. 1-1036).
Motu, "Digital Performer 8 Screenshots", Sep. 2012, (pp. 1-6).
Musictech, Andy Jones, "The Essen tial Guide to DAWs", Jun. 2017, (pp. 1-8).
Native Instruments, "Session Horns Pro Manual", May 2014, (pp. 1-68).
Nonetwork LLC, Rob Hardy, "The Process of Scoring Your Own Films Just Became Insanely Simple", Nov. 2014, (pp. 1-3).
Notice of Allowanace dated May 23, 2018 for U.S. Appl. No. 15/489,693 (pp. 1-8).
Notice of Allowance dated May 28, 2019 for U.S. Appl. No. 15/489,701 (pp. 1-8).
Notice of Allowance dated Aug. 7, 2018 for U.S. Appl. No. 15/489,707 (pp. 1-8).
Notice of Allowance dated Jan. 24, 2019 for U.S. Appl. No. 15/489,672 (pp. 1-7).
Notice of Allowance dated Mar. 27, 2019 for U.S. Appl. No. 15/489,709 (pp. 1-5).
Office Action dated Aug. 30, 2018 for U.S. Appl. No. 15/489,672 (pp. 1-6).
Office Action dated Dec. 3, 2018 for U.S. Appl. No. 15/489,709 (pp. 1-5).
Office Action dated Jan. 12, 2018 for U.S. Appl. No. 15/489,707; (pp. 1-6).
Office Action dated Nov. 30, 2018 for U.S. Appl. No. 15/489,672 (pp. 1-5).
Office Action dated Sep. 26, 2019 for U.S. Appl. No. 16/253,854 (pp. 1-9).
Owen Dafydd Jones, "Transition Probabilities for the Simple Random Walk on Seirpinski Graph, Stochastic Processes and Their Applications", 1996, pp. 45-69, Elsevier, (25 Pages).
Patricio Da Silva, "David Cope and Experiments in Musical Intelligence", 2003, Spectrum Press, 86 Pages, (93 Pages).
Patrik N. Juslin, Daniel Vastfjall, "Emotional Responses to Music: The Need to Consider Underlying Mechanisms, Behavioral and Brain Sciences", 2008, pp. 559-621, vol. 31, Cambridge University Press, (63 Pages).
Paul Doornbusch, "Gerhard Nierhaus: Algorithmic Composition: Paradigms of Automated Music Generation (Review)", CMJ Reviews, 2012, vol. 34 Issue 3 Reviews, Computer Music Journal, Melbourne, Australia, (5 Pages).
Paul Nelson, "Talking About Music—A Dictionary" (Version Sep. 1, 2005), published at http://www.composertools.com/ Dictionary/, (50 Pages).
Philippe Martin, "A Tool for Text to Speech Alignment and Prosodic Analysis", 2004, Paris University, Paris, France, (4 Page).

(56) References Cited

OTHER PUBLICATIONS

"Pop Music Automation" published on Mar. 8, 2016, on Wikipedia, at https://en.wikipedia.org/wiki/Pop_music_automation Last modified on Dec. 27, 2015, at 14:34, (4 Pages).
Presonus, "Studio One 4 Reference Manual", Jan. 2019, (pp. 1-336).
Propellerhead Software, "Reason Essentials Operation Manual", Jan. 2011, (pp. 1-742).
Rebecca Dias, "A Mathematical Melody: An Introduction to Fractals and Music", Dec. 10, 2012, Trinity University, (26 Pages).
Ricardo Miguel Moreira Da Cruz, "Emotion-Based Music Composition for Virtual Environments", Apr. 2008, Technical University of Lisbon, Lisbon, Portugal, (121 Pages).
Ripple Training, "Music Scoring for Video in Logic Pro X", Jan. 2016, (pp. 1-6).
Robert Cookson, "Jukedeck's computer composes music at the touch of a button", published in the Financial Times Ltd, on Dec. 7, 2015, (3 Pages).
Robert Plutchik,"Plutchik Wheel of Emotions", reprinted on http://www.6seconds.org by permission of American Scientist magazine of Sigma XI, The Scientific Research Society, Feb. 2020, (3 Pages).
Roger B. Danneberg, Course Outline for "Week 5—Music Generation and Algorithmic Composition", Carnegie Mellon University (CMU), Spring 2014, (29 Pages).
Roger Dannenberg, Music Generation and Algorithmic Composition, Spring 2014, Carnegie Mellon University, Pennsylvania, (29 Pages).
Ruoha Zhou, Feature Extraction of Musical Content, for Automatic Music Transcription, Oct. 2006, Federal Institute of Technology, Lausanne, (169 Pages).
Ryan Demopoulos and Michael Katchabaw, "MUSIDO: A Framework for Musical Data Organization to Support Automatic Music Composition", Department of Computer Science, The University of Western Ontario, London, Ontario Canada, published in Audio Mostly 2007, 2nd Conference on Interaction with Sound, Conference Proceedings, Sep. 27-28, 2007, Rontgenbau, Ilmenau, Germany, Fraunhofer Institute for Digital Media Technology IDMT, (6 Pages).
Satoru Fukayama et al, Automatic Song Composition from the Lyrics Exploiting Prosody of Japanese Language, 2010, The University of Tokyo, Nagoya Institute of Technology, Japan, (4 Pages).
Score Cast Online, "ESP and Music", Jun. 2009, (pp. 1-6).
Score Cast Online, Deane Ogden, "'Roadmapping' a Score", Jul. 2009, (pp. 1-9).
Score Cast Online, Deane Ogden, "Tools for Studio Organization", Oct. 2010, (pp. 1-8).
Score Cast Online, James Olszewski, "Your First Spotting Experience", Mar. 2010, (pp. 1-5).
Score Cast Online, Lee Sanders, "Spotting Content", Mar. 2010, (pp. 1-6).
Score Cast Online, Lee Sanders, "Everything *BUT* Spotting", Mar. 2010, (pp. 1-10).
Score Cast Online, Leon Willett, "Spotting for Video Games", Mar. 2010, (pp. 1-7).
Score Cast Online, Nikola Jeremie, "Scoring With PreSonus Studio One—Setting Up", Nov. 2011, (pp. 1-6).
Score Cast Online, Yaiza Varona, "Scoring to Picture in Logic 9 (Part 1)", Jan. 2013, (pp. 1-8).
Score Cast Online, Yaiza Varona, "Scoring to Picture in Logic 9 (Part 2)", Feb. 2013, (pp. 1-7).
Score Cast Online,, David E. Fluhr, "Spotting With the Composer and Sound Designer", Apr. 2012, (pp. 1-11).
Simone Hill, "Markov Melody Generator", Computer Science Department, University of Massachusetts Lowell, Published on Dec. 11, 2011, at http://www.cs.uml.edu/ecg/pub/uploads/Alfall11/SimoneHill.FinalPaper. MarkovMelodyGenerator.pdf, (4 Pages).
Simpsons Music 500, "Music Editing 101—Music Spotting Notes", Aug. 2011, (pp. 1-6).
Siwei Qin et al, Lexical Tones Learning with Automatic Music Composition System Considering Prosody of Mandarin Chinese, 2010, Graduate School of Information Science and Technology, The University of Tokyo, Japan, (4 Page).
Sonicsmiths, "The Foundary", Aug. 2015, (pp. 1).
Sound on Sound, "A Touch of Logic", Jun. 2014, (pp. 1-4).
Sound on Sound, Jayne Drake, "What Does Artificial Intelligence Mean for Musicians and Producers?", Sep. 2018, (pp. 1-13).
Steinberg Media Technologies, "Cubase Pro 10 Operation Manual", Nov. 2018, (pp. 1-1156).
Steve Engels, Fabian Chan, and Tiffany Tong, Automatic Real-Time Music Generation for Games, 2015, Department of Computer Science, Department of Engineering Science, and Department of Mechanical and ndustrial Engineering, Toronto, Ontario, Canada, (3 Pages).
Steve Rubin, Maneesh Agrawala, Generating Emotionally Relevant Musical Scores for Audio Stories, UIST 2014, Oct. 2014, pp. 439-448, (10 Pages).
Supplemental Notice of Allowability dated May 2, 2017 for U.S. Appl. No. 14/869,911; (pp. 1-4).
Sweetwater, "Spotting Session", Dec. 1999, (pp. 1-2).
Thomas M. Fiore, "Music and Mathematics", University of Michigan, 2004, published on http://www-personal.umd. Umich.edu/~tmfiore/1/musictotal.pdf, (36 Pages).
Virginia Francisco, Raquel Hervas, "EmoTag: Automated Mark Up of Affective Information in Texts", Department of Software Engineering and Artificial intelligence, Complutense University, Madrid, Spain, published at http://nil.fdi.ucm.es/sites/default/files/FranciscoHervasDCEUROLAN2007.pdf, 2007, ( 8 Pages).
Website Pages from Audio Network Limited, covering the directory structure of its "Production Music Database Prganized by Musical Styles, Mood/Emotion, Instrumentation, Production Genre, Album Listing and Artists & Composers", https://www.audionetwork.com, (7 Pages).
Xsample, "Xsample Acoustic Intruments Library", Jan. 2015, (pp. 1-40).
Xsample, "Xsample AI Library: Notation Guide Part I", Jan. 2015, (pp. 1-8).
Xsample, "Xsample AI Library: Notation Guide Part II", Jan. 2015, (pp. 1-49).
Xsample, "Xsample Player Edition", Jan. 2016, (pp. 1-16).
Yu-Hao Chin, Chang-Hong Lin, Ernestasia Siahaan, Jia-Ching Wang, "Music Emotion Detection Using Hierarchical Sparse Kernel Machines", 2014, Hindawi Publishing Corporation, Taiwan, (8 Page).
Office Action dated Sep. 26, 2019 for U.S. Appl. No. 16/219,299 (pp. 1-11).
Communication Pursuant to Rules 70(2) ane 70a(2) EPC dated Jan. 10, 2019 issued in EP Application No. 16852438.7 (1 Page).
Extended European Search Report dated Dec. 9, 2019 issued in EP Application No. 16852438.7 (20 Pages).
Banshee in Avalon, "Xhail, Innovative Automatic Composing Solution: Score Music Interactive is a AE3 in Boston where they are introducing a new system for multimedia music composers," published by AudioFanZine at https://en.audiofanzine.com/misc-music-software/score-music-interactive/xhail/medias/videosfitid:35534 on Sep. 24, 2014 (1 Page).
Captured Screenshots from the "Xhail Preview" by Score Music Interactive Ltd., published on AudioFanZine at https://en.audiofanzine.com/misc-music-software/score-music-interactive/xhail/medias/videos/#id:35534 on Sep. 24, 2014 (35 Pages).
Captured Screenshots from the "Xhail Preview" by Score Music Interactive Ltd., published on Vimeo.com on Sep. 24, 2014 (34 Pages).
Jacqui Cheng, "Virtual Composer Makes Beautiful Music—and Stirs Controversy: Can A Computer Program Really Generate Musical Compositions that Are Good . . . ", published by Arstechnia at https://arstechnica.com/science/2009/09/virtual-composer-makes-beautiful-musicand-stirs-controversy/ on Sep. 29, 2009 (3 Pages).
Music Marcom, "Are You A Professional Muscian or Talented Composer? Help Xhail Find You" published by Prosound Network at https://www.prosoundnetwork.com/the-wire/are-you-a-professional-musician-or-talented-composer-help-xhail-find-you on May 19, 2015 (2 Pages).

(56) References Cited

OTHER PUBLICATIONS

Prosoundnework Editorial Staff, "Xhail Recruiting Music Talent" published by Prosound Network at https://www.prosoundnetwork.com/business/xhail-recruiting-music-talent on May 21, 2015 (1 Page).
Crunchbase Profile on Score Music Interactive Ltd., summarized as "Score Music Interactive: A Music Publishing Software Platform That Creates Original, Copyrighted Music from A Centralized Database of Tagged Musical Stems," published by Crunchbase at https://www.crunchbase.com/organization/score-music-interactive on Dec. 2, 2019 (1 Page).
Linkedin Profile on Score Music Interactive Ltd, summarized as "Xhail is the most advanced music creation platform in the world. Unique one-ofa-kind tracks created instantly with incredible flexibility. Real performances by real musicians, combining for the very first time, creating the perfect music solution. Xhail's platform gives editors, music supervisors and other professionals extreme creative control in a most intuitive way without the requirement of music skill. Our patented technology creates desired music in a fraction of the time it would take to search for a suitable standard track from a traditional music library", published at Linkedin.com on Dec. 2, 2019 (1 Page).
Screenshots taken from the Xhail WWW Site by Score Music Interactive Ltd., captioned "The Evolution of Music Creation & Licensing" and published at https://www.xhail.com/#whatis on Dec. 2, 2019 (10 Pages).
Roger B. Dannenberg, "An On-Line Algorithm for Real-Time Accompaniment," in Proceedings of the 1984 International Computer Music Conference, Computer Music Association, Jun. 1985, 193-198, (6 Pages).
Johan Sundberg, et al, "Rules for Automated Performance of Ensemble Music", Contemporary Music Review, 1989, vol. 3, pp. 89-109, Harwood Academic Publishers GmbH, (12 Pages).
Roberto Bresin, "Articulation Rules for Automatic Music Performance", Department of Speech, Music and Hearing, Royal Institute of Technology, Stockholm, Jan. 2002, (4 Pages).
Mitsuyo Hashida, et al., Rencon: Performance Rendering Contest for Automated Music Systems, Proceedings of the 10th International Conference on Music Perception and Cognition (ICMPC 10), Sapporo, Japan, Aug. 25, 2008, (5 Pages).
One Page Love, "Jukedeck, Interactive Landing Page—Beta" built by Qip Creative, Reviewed by Rob Hope on Jan. 6, 2014, (4 Pages).
Press Release by Aiva Technologies, "Composing the music of the future", Nov. 2016, (7 Pages).
Barry L. Vercoe, "New Dimensions in Computer Music," Trends and Perspectives in Signal Processing II/2, Apr. 1982, pp. 15-23 (9 Pages).
Barry L. Vercoe , "Computer Systems and Languages for Audio Research," The New World of Digital Audio (Audio Engineering Society Special Edition), 1983, pp. 245-250 (6 Pages).
Barry L. Vercoe, "Extended Csound," in Proceedings, 1996, ICMC, Hong Kong, pp. 141-142, (2 Pages).
R. B. Dannenberg, "An On-Line Algorithm for Real-Time Accompaniment", Proceedings of the 1984 International Computer Music Conference, 1985 International Computer Music Association, p. 193-198, http://www.cs.cmu.edu/~rbd/bib-accomp.html#icmc84, (6 Pages).
Barry L. Vercoe, "The Synthetic Performer in the Context of Live Performance," in Proceedings, International Computer Music Conference, 1984, Paris, pp. 199-200, (2 Pages).
Bloch and Dannenberg, "Real-Time Accompaniment of Polyphonic Keyboard Performance," Proceedings of the 1985 International Computer Music Conference, Vancouver, BC Canada, Aug. 19-22, 1985, San Francisco: International Computer Music Association, 1985. pp. 279-290, (11 Pages).
Barry L. Vercoe, and Puckette, M.S. (1985) "Synthetic Rehearsal: Training the Synthetic Performer," in Proceedings, ICMC, Burnaby, BC, Canada, 1985, pp. 275-278, (4 Pages).
Roger B. Dannenberg and Mukaino, "New Techniques for Enhanced Quality of Computer Accompaniment," in Proceedings of the International Computer Music Conference, Computer Music Association, Sep. 1988, pp. 243-249, (7 Pages).
Barry L. Vercoe, "Hearing Polyphonic Music with the Connection Machine," in Proceedings, First Workshop on Artificial Intelligence and Music, 1988, AAA-88, St. Paul, MN, pp. 183-194, (12 Pages).
Roger B. Dannenberg, "Real-Time Scheduling and Computer Accompaniment," in Current Research in Computer Music, edited by Max Mathews and John Pierce, MIT Press, 1989, (37 Pages).
Barry L. Vercoe,"Synthetic Listeners and Synthetic Performers," Proceedings, International Symposium on Multimedia Technology and Artificial Intelligence (Computerworld 90), Kobe Japan, Nov. 1990, pp. 136-141, (6 Pages).
Barry L. Vercoe, and D.P.W Ellis, "Real-time Csound: Software Synthesis with Sensing and Control," in Proceedings, ICMC, 1990, Glasgow, pp. 209-211. (3 Pages).
Grubb and Dannenberg, "Automated Accompaniment of Musical Ensembles," in Proceedings of the Twelfth National Conference on Artificial Intelligence, AAAI, 1994, pp. 94-99, (6 Pages).
Grubb and Dannenberg, "Automating Ensemble Performance," in Proceedings of the 1994 International Computer Music Conference, Aarhus and Aalborg, Denmark, Sep. 1994. International Computer Music Association, 1994. pp. 63-69, (7 Pages).
Grubb and Dannenberg, "Computer Performance in an Ensemble," in 3rd International Conference for Music Perception and Cognition Proceedings, Liege, Belgium. Jul. 23-27, 1994. Ed. Irene Deliege. Liege: European Society for the Cognitive Sciences of Music Centre de Recherche et de Formation Musicales de Wallonie, 1994. pp. 57-60, (2 Pages).
Barry L. Vercoe, ., "Computational Auditory Pathways to Music Understanding," in Deliege I. and Sloboda J (Eds.), 1997, Perception and Cognition of Music , East Sussex, UK: Psychology Press, pp. 307-326, (20 Pages).
Grubb and Dannenberg, "Enhanced Vocal Performance Tracking Using Multiple Information Sources," in Proceedings of the International Computer Music Conference, San Francisco: International Computer Music Association, 1998) pp. 37-44, (8 Sheets).
Tristan Jehan and Bernd Schoner, "An Audio-Driven, Spectral Analysis-Based, Perceptual Synthesis Engine", Audio Engineering Society Convention Paper Presented at the 110th Convention, May 12-15, 2001 Amsterdam, The Netherlands, (10 Pages).
Brian Whitman, Gary Flake and Steve Lawrence, "Artist Detection in Music with Minnowmatch," Computer Science NEC Research Institute, Princeton NJ, NNSP—Sep. 2001, (17 Pages).
Brian Whitman and Ryan Rifkin, "Musical Query-by-Description as a Multiclass Learning Problem", Jan. 1, 2003, 2002 IEEE Workshop onMultimedia Signal Processing, (4 Pages).
Daniel P. W. Ellis, Brian Whitman, Adam Berenzweig, and Steve Lawrence, "The Quest for Ground Truth in Musical Artist Similarity", ISMIR 2002, 3rd International Conference on Music Information Retrieval, Paris, France, Oct. 13-17, 2002, Proceedings, (8 Pages).
Roberto Bresin, "Articulation Rules For Automatic Music Performance", Proceedings of the 2001 International Computer Music Conference : Sep. 17-22, 2001, Havana, Cuba, pp. 294-297, (4 Pages).
Brian Whitman and Paris Smaragdis, "Combining Musical and Cultural Features for Intelligent Style Detection", ISMIR 2002, 3rd International Conference on Music Information Retrieval, Paris, France, Oct. 13-17, 2002, Proceedings, (6 Pages).
Brian Whitman and Steve Lawrence, "Inferring Descriptions and Similarity for Music from Community Metadata", Proceedings of the 2002 International Computer Music Conference, Jan. 2002, (8 Pages).
Adam Berenzweig, Beth Logan, Daniel P. W. Ellis, and Brian Whitman, "A Large-Scale Evaluation of Acoustic and Subjective Music Similarity Measures", Computer Music Journal, vol. 28(2), Nov. 2003, (7 Pages).
Roberto Bresin, "Artificial Neural Networks Based Models for Automatic Performance of Musical Scores," Journal of New Music Research, 1998, vol. 27, No. 3, pp. 239-270, (32 Pages).
Brian Whitman, Deb Roy and Barry Vercoe, "Learning Word Meanings and Descriptive Parameter Spaces from Music", Computer SciencePublished in HLT-NAACL 2003, (8 Pages).

(56) References Cited

OTHER PUBLICATIONS

Tristan Jehan, "Perceptual Segment Clustering for Music Description and Time-Axis Redundancy Cancellation", ISMIR 2004, 5th International Conference on Music Information Retrieval, Barcelona, Spain, Oct. 10-14, 2004, Proceedings, (4 Pages).
Barry Vercoe, "Audio-Pro with Multiple DSPs and Dynamic Load Distribution," BT Technology Journal, vol. 22, No. 4, Oct. 2004, (7 Pages).
Brian Whitman and Daniel P. W. Ellis, "Automatic Record Reviews," In Proceedings of ISMIR 2004—5th International Conference on Music Information Retrieval. (8 Pages).
Brian A. Whitman, "Learning the Meaning of Music", Jun. 2005, Phd., Doctoral dissertation, MIT, (104 Pages).
Brian A. Whitman, "Learning the Meaning of Music", Apr. 14, 2005, MIT, (65 Pages).
Tristan Jehan, "Creating Music by Listening", Sep. 2005, Phd. Doctoral dissertation, MIT (137 Pages).
Tristan Jehan, "Downbeat Prediction by Listening Tristan Jehan, Downbeat Prediction By Listening and Learning", 2005 IEEE Workshop on Applications of Signal Processing to Audio and Acoustics, Oct. 16-19, 2005, New Paltz, NY, (4 Pages).
Roger B. Dannenberg, "New Interfaces for Popular Music Performance," in Seventh International Conference on New Interfaces for Musical Expression: NIME 2007 New York, New York, NY: New York University, Jun. 2007, pp. 130-135. (6 Pages).
Youngmoo E. Kim et al, "Music Emotion Recognition: State of The Art Review", 11th International Society for Music Information Retrieval Conference (ISMIR 2010), (12 Pages).
Nicholas E. Gold and Roger B. Dannenberg, "A Reference Architecture and Score Representation for Popular Music Human-Computer Music Performance System," Proceedings of the International Conference on New Interfaces for Musical Expression, May 30-Jun. 1, 2011, Oslo, Norway, (4 Pages).
Roberto Bresin and Anders Friberg, "Emotion Rendering in Music: Range and Characteristics Values of Seven Musical Variables", May 17, 2011, c Cortex vol. 4 7 ( 2 0 1 1 ), Pagerds 1 0 6 8 -1 0 8 1, (14 Pages).
Roger B. Dannenberg, "A Virtual Orchestra for Human-Computer Music Performance," Proceedings of the International Computer Music Conference 2011, University of Huddersfield, UK, Jul. 31-Aug. 5, 2011, (4 Pages).
Marius Kaminskas and Francesco Ricci, "Contextual music information retrieval and recommendation: Stateof the Art and Challenges," Computer Science Review, vol. 6, Issues 2-3, May 2012, pp. 89-119, (31 Pages).
Roger B. Dannenberg, Nicolas E. Gold, Dawen Liang and Guangyu Xia, "Active Scores: Representation and Synchronization in Human-Computer Performance of Popular Music," Computer Music Journal, 38:2, pp. 51-62, Summer 2014,(12 Pages).
Roger B. Dannenberg and Andrew Russell, "Arrangements: Flexibly Adapting Music Data for Live Performance," Proceedings of the International Conference on New Interfaces for Musical Expression, Baton Rouge, LA, USA, May 31-Jun. 3, 2015, (2 Pages).
Roger B. Dannenberg, "Time-Flow Concepts and Architectures For Music and Media Synchronization," in Proceedings of the 43rd International Computer Music Conference, International Computer Music Association, 2017, pp. 104-109, (6 Pages).
Josh McDermott and March Hauser, "The Origins of Music: Innateness, Uniqueness, and Evolution", published in Music Perception vol. 23, Issue 1, Mar. 2005, pp. 29-59, (32 Pages).
Josh McDermott, "The evolution of music", published in Nature, vol. 453, No. 15, May 2008, pp. 287-288, (2 Pages).
Anne Trafton, "Why We Like The Music We Do", MIT News Office, Jul. 13, 2016, (4 Pages).
Eric Nichols, Dan Morris, Sumit Basu and Christopher Raphael, "Relationsips Between Lyrics and Melody In Popular Music", Proceedings of the 11th International Society for Music Information Retrieval Conference, Oct. 2009, (6 Pages).
Francois Panchet, "The Continuator: Musical Interaction With Style", In Proceedings of International Computer Music Conference, Gotheborg (Sweden), ICMA, Sep. 2002, (10 Pages).
Francois Panchet, Pierre Roy and Gabriele Barbieri, "Finite-Length Markov Processes with Constraints", Proceedings of the Twenty-Second International Joint Conference on Artificial Intelligence, 2011, (8 Pages).
Jonathan Cabreira, "A Music Taste Analysis Using Spotify API and Python: Exploring Audio Features and building a Machine Learning Approach," published on Toward Data Science at https://towardsdatascience.com/a-music-taste-analysis-using-spotify-api-and-python-e52d186db5fc , Aug. 17, 2019, (7 Pages).
Ben Popper, "Tastemaker: How Spotify's Discover Weekly cracked human curation at internet scale", published in the Verge, at https://www.theverge.com/2015/9/30/9416579/spotify-discover-weekly-online-music-curation-interview , Sep. 30, 2015, (18 Pages).
Eric Drott, "Why the Next Song Matters: Streaming, Recommendation, Scarcity", Twentieth-Century Music 15/3, 325-357, Cambridge University Press, 2018, (33 Pages).
Form F-1 Registration Statement Under the Securities Act of 1933, United States Securities and Exchange Commission, by Spotify Technology S.A, Feb. 28, 2018, (265 Pages).
Ipshita Sen, "How AI helps Spotify win in the music streaming world," published in outsideinsight.com, https://outsideinsight.com/insights/how-ai-helps-spotify-win-in-the-music-streaming-world/ , May 22, 2018 (12 Pages).
Ramon Lopez de Mantaras and Josep Lluis Arcos, "AI and Music: From Composition to Expressive Performance", American Association for Artificial Intelligence, Fall 2002, pp. 43-57 (16 Pages).
"User Manual for Synclavier V, Version 2.0", Arturia SA, published Oct. 15, 2018, (133 Pages).
"User Manual for Omnisphere Power Synth Version 2.6", Spectrasonics.net, Jan. 2020, (944 Pages).
"User Guide for Note Performer 3", Wallander Instruments AB, Sep. 12, 2019, (64 Pages).
"WIVI Documentation", Wallendar Instruments AB, Dec. 18, 2014, (85 Pages).
Masataka Goto and Roger B. Dannenberg, "Music Interfaces Based On Automatic Music Signal Analysis: New Ways to Create and Listen To Music", IEEE Signal Processing Magazine, Jan. 2019, pp. 74-81, Date of Publication Dec. 24, 2018, (8 Pages).
Gus G. Xia and Roger B. Dannenberg, "Improvised Duet Interaction: Learning Improvisation Techniques for Automatic Accompaniment," in Copenhagen, May 2017, pp. 110-114, (5 Pages).
Guangyu Xia, Mao Kawai, Kei Matsuki, Mutian Fu, Sarah Cosentino, Gabriele Trovato, Roger Dannenberg, Salvatore Sessa, Atsuo Takanishi, "Expressive Humanoid Robot for Automatic Accompaniment", Carnegie Mellon Univserity, https://www.cs.cmu.edu/~rbd/papers/robot-smc-2016.pdf , 2016, (6 Pages).
Guangyu Xia, Yun Wang, Roger Dannenberg, Geoffrey Gordon. "Spectral Learning for Expressive Interactive Ensemble Performance", 16th International Society for Music Information Retrieval Conference, 2015, (7 Pages).
Mutian Fu, Guangyu Xia, Roger Dannenberg, Larry Wasserman, "A Statistical View on the Expressi 0.0Timing of Piano Rolled Chords", 16th International Society for Music Information Retrieval Conference, 2015, (6 Pages).
Roger B. Danneberg and Andrew Russell, "Arrangements: Flexibly Adapting Music Data for Live Performance", Proceedings of the International Conference on New Interfaces for Musical Expression, Baton Rouge, LA, USA, May 31-Jun. 3, 2015, (2 Pages).
Roger B. Dannenberg, Nicolas E. Gold, Dawen Liang, and Guangyu Xia, "Methods and Prospects for Human-Computer Performance of Popular Music," Computer Music Journal, 38:2, pp. 36-50, Summer 2014, (15 Pages).
Tongbo Huang, Guangyu Xia, Yifei Ma, Roger Dannenberg, Christos Faloutsos, "MidiFind: Fast and Effective Similarity Searching in Large MIDI Databases", Proc. of the 10th International Symposium on Computer Music Multidisciplinary Research, Marseille, France, Oct. 15-18, 2013, (16 Pages).
Roger B. Dannenberg, Zeyu Jin, Nicolas E. Gold, Octav-Emilian Sandu, Praneeth N. Palliyaguru, Andrew Robertson, Adam Stark, Rebecca Kleinberger, "Human-Computer Music Performance: From

(56) References Cited

OTHER PUBLICATIONS

Synchronized Accompaniment to Musical Partner", Proceedings of the Sound and Music Computing Conference 2013, SMC 2013, Stockholm, Sweden, (7 Pages).
Roger B. Dannenberg, "A Vision of Creative Computation in Music Performance", Proceedings of the Second International Conference on Computational Creativity, published at https://www.cs.cmu.edu/~rbd/papers/dannenberg_1_iccc11.pdf , Jan. 2011, (6 Pages).
Roger Dannenberg, and Sukrit Mohan,"Characterizing Tempo Change In Musical Performances", Proceedings of the International Computer Music Conference 2011, University of Huddersfield, UK, Jul. 31-Aug. 5, 2011, (7 Pages).
Özgür İzmirli and Roger B. Dannenberg, "Understanding Features and Distance Functions for Music Sequence Alignment", 11th International Society for Music Information Retrieval Conference (ISMIR 2010), (6 Pages).
Roger B. Dannenberg, "Style in Music", published in The Structure of Style: Algorithmic Approaches to Understanding Manner and Meaning, Shlomo Argamon, Kevin Burns, and Shlomo Dubnov (Eds.), Berlin, Springer-Verlag, 2010, pp. 45-58, (12 Pages).
Roger B. Dannenberg and Masataka Goto, "Music Structure Analysis from Acoustic Signals", in Handbook of Signal Processing in Acoustics, pp. 305-331, Apr. 16, 2005, (19 Pages).
Byeong-jun Han, Seungmin Rho Roger B. Dannenberg Eenjun Hwang, "SMERS: Music Emotion Recognition Using Support Vector Regression", 10th International Society for Music Information Retrieval Conference (ISMIR), 2009, (6 Pages).
Roger B. Dannenberg, "Computer Coordination With Popular Music: A New Research Agenda," in Proceedings of the Eleventh Biennial Arts and Technology Symposium at Connecticut College, Mar. 2008, (6 Pages).
William D. Haines, Jesse R. Vernon, Roger B. Dannenberg, and Peter F. Driessen, "Placement of Sound Sources in the Stereo Field Using Measured Room Impulse Responses," in Proceedings of the 2007 International Computer Music Conference, vol. I. San Francisco: The International Computer Music Association, Aug. 2007, pp. I-496-499, (5 Pages).
Roger B. Dannenberg. "An Intelligent Multi-Track Audio Editor." In Proceedings of the 2007, International Computer Music Conference, vol. II. San Francisco: The International Computer Music Association, Aug. 2007, pp. II-89-94, (7 Pages).
Ning Hu and Roger B. Dannenberg, "Bootstrap learning for accurate onset detection", Machine Learning, May 6, 2006, vol. 65, pp. 457-471 (15 Pages).
William Birmingham, Roger Dannenberg, and Bryan Pardo, "Query by Humming With the Vocalsearch System", Communications of the ACM, Aug. 2006, vol. 49, No. 8, pp. 49-52, (4 Pages).
Ning Hu and Roger B. Dannenberg, "A Bootstrap Method for Training an Accurate Audio Segmenter", in Proceedings of the Sixth International Conference on Music Information Retrieval, London UK, Sep. 2005, London, Queen Mary, University of London & Goldsmiths College, University of London, 2005, pp. 223-229 (7 Pages).
Roger B. Dannenberg, Ben Brown, Garth Zeglin, Ron Lupish, "McBlare: A Robotic Bagpipe Player," in Proceedings of the International Conference on New Interfaces for Musical Expression, Vancouver: University of British Columbia, (2005), pp. 80-84.
Roger B. Dannenberg, "Toward Automated Holistic Beat Tracking, Music Analysis, and Understanding," in ISMIR 2005 6th International Conference on Music Information Retrieval Proceedings, London: Queen Mary, University of London, 2005, pp. 366-373, (8 Pages).
Roger B. Dannenberg, William P. Birmingham, George Tzanetakis, Colin Meek, Ning Hu, and Bryan Pardo, The MUSART Testbed for Query-by-Humming Evaluation, Computer Music Journal, 28:2, pp. 34-48, Summer 2004, (15 Pages).
Ning Hu, Roger B. Dannenberg and George Tzanetakis, "Polyphonic Audio Matching and Alignment for Music Retrieval", 2003 IEEE Workshop on Applications of Signal Processing to Audio and Acoustics, Oct. 19-22, 2003, New Paltz, NY, (4 Pages).
Dannenberg, Roger B. and Ning Hu, "Polyphonic Audio Matching for Score Following and Intelligent Audio Editors." Proceedings of the 2003 International Computer Music Conference, San Francisco: International Computer Music Association, pp. 27-33, (7 Pages).
Ning Hu, Roger B. Dannenberg, and Ann L. Lewis, "A Probabilistic Model of Melodic Similarity," In Proceedings of the International Computer Music Conference. San Francisco, International Computer Music Association, 2002, (4 Pages).
Ning Hu and Roger B. Dannenberg, "A Comparison of Melodic Database Retrieval Techniques Using Sung Queries," in Joint Conference on Digital Libraries, 2002, New York: ACM Press, pp. 301-307, (7 Pages).
Dannenberg and Hu. "Pattern Discovery Techniques for Music Audio" in ISMIR 2002 Conference Proceedings, Paris, France, IRCAM, 2002, pp. 63-70, appears in Journal of New Music Research, Jun. 2003, pp. 153-164, (14 Pages).
Roger B. Dannenberg and Ning Hu, "Pattern Discovery Techniques for Music Audio," In ISMIR 2002 Conference Proceedings: Third International Conference on Music Information Retrieval, M. Fingerhut, ed., Paris, IRCAM, 2002, pp. 63-70, (8 Pages).
Roger B. Dannenberg, "Listening to 'Naima': An Automated Structural Analysis of Music from Recorded Audio," In Proceedings of the International Computer Music Conference, 2002, San Francisco, International Computer Music Association, (7 Pages).
Roger B. Dannenberg and Ning Hu, "Discovering Musical Structure in Audio Recordings" in Anagnostopoulou, Ferrand, and Smaill, eds., Music and Artificial Intelligence: Second International Conference, ICMAI 2002, Edinburgh, Scotland, UK. Berlin: Springer, 2002. pp. 43-57, (11 Pages).
Mazzoni and Dannenberg, "Melody Matching Directly from Audio," in ISMIR 2001 2nd Annual International Symposium on Music Information Retrieval, Bloomington: Indiana University, 2001, pp. 73-82, (2 Pages).
Masataka Goto, "An Audio-based Real-time Beat Tracking System for Music With or Without Drum-sounds", Journal of New Music Research, 2001, vol. 30, No. 2, pp. 159-171,(14 Pages).
Roger B. Dannenberg, "Music Information Retrieval as Music Understanding," in ISMIR 2001 2nd Annual International Symposium on Music Information Retrieval, Bloomington: Indiana University, 2001, pp. 139-142, (4 Pages).
Lorin Grubb and Roger B. Dannenberg, "Enhanced Vocal Performance Tracking Using Multiple Information Sources," Proceedings of the 1998 International Computer Music Conference, San Francisco, International Computer Music Association, pp. 37-44, (8 Pages).
Grubb, L. and Dannenberg, R.B., "A Stochastic Method of Tracking a Vocal Performer", in 1997 International Computer Music Conference, 1997, International Computer Music Association. http://www.cs.cmu.edu/~rbd/bib-accomp.html# icmc97, (8 Pages).
Roger B. Dannenberg, Belinda Thom, and David Watson, "A Machine Learning Approach to Musical Style Recognition", School of Computer Science, Carnegie Mellon University, 1997, (4 Pages).
Grubb and Dannenberg, "Computer Performance in an Ensemble," in 3rd International Conference for Music Perception and Cognition Proceedings, Liege, Belgium. Jul. 23-27, 1994. Ed. Irene Deliege. Liege: European Society for the Cognitive Sciences of Music Centre de Recherche et de Formation Musicales de Wallonie, 1994. pp. 57-60, 1994, ( 2 Pages).
Lorin Grubb and Roger B. Dannenberg, "Automating Ensemble Performance", Machine Recognition of Music, ICMC Proceedings 1994, pp. 63-69, (7 Pages).
Lorin Grubb and Roger B. Dannenberg, "Automated Accompaniment of Musical Ensembles", AAAI-94 Proceedings, 1994, pp. 94-99, (6 Pages).
Allen and Dannenberg, "Tracking Musical Beats in Real Time," in 1990 International Computer Music Conference, International Computer Music Association, Sep. 1990, pp. 140-143, (4 Pages).
Allen and Dannenberg, "Tracking Musical Beats in Real Time," in Proceedings of the International Computer Music Conference, Glasgow, Scotland, Sep. 1990. International Computer Music Association, 1990. pp. 140-143, (12 Pages).

(56) References Cited

OTHER PUBLICATIONS

Dannenberg and Mukaino, "New Techniques for Enhanced Quality of Computer Accompaniment," in Proceedings of the International Computer Music Conference, Computer Music Association, Sep. 1988, pp. 243-249, (7 Pages).
Roger B. Dannenberg and Bernard Mont-Reynaud, "Following an Improvisation in Real Time," in 1987 ICMC Proceedings, International Computer Music Association, Aug. 1987, pp. 241-248, (8 Pages).
Roger B. Dannenberg, "An On-Line Algorithm for Real-Time Accompaniment", In Proceedings of the 1984 International Computer Music Conference, 1985, International Computer Music Association, 193-198. http://www.cs.cmu.edu/~rbd/bib-accomp.html#icmc84, (6 Pages).
Bloch, J. B. and Dannenberg, R.B., "Real-Time Computer Accompaniment of Keyboard Performances", In Proceedings of the 1985 International Computer Music Conference, 1985, International Computer Music Association, 279-289. http://www.cs.cmu.edu/~rbd/bib-accomp.html#icmc85, (11 Pages).
Ethan Hein, "Scales and Emotions" from the Ethan Hein Blog, Posted Mar. 2, 2010, (31 Pages).
Anastasia Voitinskaia, "Scales, Genres, Intervals, Melodies, Music Theory", published on www.musical-u.com , at https://www.musical-u.com/learn/the-many-moods-of-musical-modes/ , on Feb. 6, 2020, (5 Pages).
Score Music Interactive, Sampled Workflow of 2018-Version of XHail Automatic Loop-Based Music Composing System, Dec. 2018, (25 Pages).
Supplementantary Partial European Search Report issued in EP Application No. EP 16852438.7 dated Dec. 9, 2019 (20 Pages).
Communication Pursuant to Rules 70(2) and 70a(2) EPC issued in EP Application No. EP 16852438.7 dated Jan. 10, 2019 (1 Page).
Written Opinion Issued in International Patent Application No. PCT/US2020/014639 dated Jul. 21, 2020, (21 Pages).
PCT International Serve Report issued in International Patent Application No. PCT/2020/014639 dated Jul. 21, 2020, (2 Pages).
The Reason Essentials Operation Manual, by Propellerhead Software AB, 2011, (742 Pages).
Bitwig Studio 2.0 User Guide, Fourth Edition 2017, written by Dave Linnenbank, Bitwig GmbH, Germany, (383 Pages).
Ableton Reference Manual Vdersion 10, Windows and Mac, written by Dennis SeSantis et al, Ableton AG, 2018, Berlin, Germany (759 Pages).
Cubase Pro 10 Cubase Artist 10—Operation Manual , by Steinberg Media Technologies GmbH, Nov. 14, 2018, (1156 Pages).
Protools® Reference Guide, Version 2018.12, by Avid Technology, Inc., 2018, (1489 Pages).
Sample Robot Pro—User Manual, Version 6.0, Sep. 2018, by Skyline, Halten & Zweiling Gbr, Glinde, Germany, (88 Pages).
"This is SampleRobot: Your Personal Sampling Assistant", published at https://samplerobot.com/pages/samplerobot , by Skylife, Apr. 12, 2019, (6 Pages).
FL Studio: Getting Started Manual, by Scott Fisher and Frank Van Biesen of Image Line BVBA, Apr. 2019, (89 Pages).
"Machines Can Create Art, but Can They Jam?" by Ken Weiner, published at on the Scientific American Blog Network, https://blogs.scientificamerican.com/observations/machines-can-cr/ on Apr. 29, 2019, (13 Pages).
"Making a Custom Sampler Instrument" by Griffin Brown, IZotope Blog Contributor, https://www.izotope.com/en/blog/music-production/making-a-cus , Jan. 28, 2019, (10 Pages).
Reference Manual for PreSonus Studio One 4 , Version 4.1 , Presonus, Apr. 2019 (336 Pages).
AWS Deep Composer: Press Play on Machine Learning, published on AWS Amazon Site, https://aws.amazon.com/deepcomposer/ , Dec. 2019 (9 Pages).
Notice of Reasons for Refusal dated Oct. 6, 2020, issued in Japanese Patent Application No. 2018-536083 which is a National Stage of PCT Appliction No. PCT/US2016/054066 filed 28 Sep. 28, 2016 (9 Pages).
"Movie Pro" Software, by AHS Co. Ltd, Japan, published in Gigazine.net, 2010 (15 Pages).
Chordana Composer App for the Apple iPhone/ iPad, by Casio Computer Co. Ltd., published on Jan. 30, 2015, https://www.dtmstation.com/archives/51927504.html, (15 Pages).
Yamaha News Release on VOCALOID™ Virtual Singing Voice Synthesizer Software, by Yamaha Corporation, https://www.vocaloid.com/en/, Japan, Published Apr. 24, 2014, (4 Pages).
Kat Agres, Jamie Forth and Geraint A. Wiggins, "Evaluation of Musical Creativity and Musical Metacreation Systems," Comput. Entertain. 14, 3, Article 3 , Dec. 2016, (33 Pages).
Response to Office Action dated Apr. 17, 2020 filed in European Patent Application No. 16852438.7 (6 Pages).
Communication Pursuant to Article 94(3) EPC issued in in European Patent Application No. 16852438.7 on Jun. 29, 2020 (1 Page).
Office Action dated Jul. 24, 2020 for U.S. Appl. No. 16/653,747 (pp. 1-6).
Notice of Allowance dated Jul. 29, 2020 for U.S. Appl. No. 16/653,759 (pp. 1-9).
Office Action dated Sep. 22, 2020 for U.S. Appl. No. 16/664,814 (pp. 1-7).
Office Action dated Jun. 1, 2020 for U.S. Appl. No. 16/664,816 (pp. 1-11).
Office Action dated Jun. 1, 2020 for U.S. Appl. No. 16/664,817 (;pp. 1-11).
Office Action dated Sep. 17, 2020 for U.S. Appl. No. 16/664,824 (pp. 1-15).
Officer Action dated Oct. 6, 2020 for U.S. Appl. No. 16/672,997 (pp. 1-13).
Office Action dated Oct. 6, 2020 for U.S. Appl. No. 16/673,024 (pp. 1-12).
Notice of Allowance dated Nov. 16, 2020 for U.S. Appl. No. 16/653,759 (pp. 1-5).
Examination Report dated Nov. 20, 2020 issued in corresponding Indian Patent Application No. 201837009930 (7 Pages).

* cited by examiner

MIDI NOTE NUMBER, FREQUENCY TABLE

NOTE THAT THE MIDI PITCH SPECIFICATION ASSUMES 12-EDO TUNING.

OCTAVE -5

| OCTAVE NAME | MIDI OCTAVE | MIDI NOTE NUMBER | NOTE NAME | FREQUENCY Hz | ABSOLUTE CENTS |
|---|---|---|---|---|---|
| -- | -5 | 0 | C | 8.1757989156 | -6,900.0000 |
| -- | -5 | 1 | C#/Db | 8.6619572180 | -6,800.0000 |
| -- | -5 | 2 | D | 9.1770239974 | -6,700.0000 |
| -- | -5 | 3 | D#/Eb | 9.7227182413 | -6,600.0000 |
| -- | -5 | 4 | E | 10.3008611535 | -6,500.0000 |
| -- | -5 | 5 | F | 10.9133822323 | -6,400.0000 |
| -- | -5 | 6 | F#/Gb | 11.5623257097 | -6,300.0000 |
| -- | -5 | 7 | G | 12.2498573744 | -6,200.0000 |
| -- | -5 | 8 | G#/Ab | 12.9782717994 | -6,100.0000 |
| -- | -5 | 9 | A | 13.7500000000 | -6,000.0000 |
| -- | -5 | 10 | A#/Bb | 14.5676175474 | -5,900.0000 |
| -- | -5 | 11 | B | 15.4338531643 | -5,800.0000 |

OCTAVE -4

| OCTAVE NAME | MIDI OCTAVE | MIDI NOTE NUMBER | NOTE NAME | FREQUENCY Hz | ABSOLUTE CENTS |
|---|---|---|---|---|---|
| -- | -4 | 12 | C | 16.3515978313 | -5,700.00 |
| -- | -4 | 13 | C#/Db | 17.3239144361 | -5,600.00 |
| -- | -4 | 14 | D | 18.3540479948 | -5,500.00 |
| -- | -4 | 15 | D#/Eb | 19.4454364826 | -5,400.00 |
| -- | -4 | 16 | E | 20.6017223071 | -5,300.00 |
| -- | -4 | 17 | F | 21.8267644646 | -5,200.00 |
| -- | -4 | 18 | F#/Gb | 23.1246514195 | -5,100.00 |
| -- | -4 | 19 | G | 24.4997147489 | -5,000.00 |
| -- | -4 | 20 | G#/Ab | 25.9565435987 | -4,900.00 |
| -- | -4 | 21 | A | 27.5000000000 | -4,800.00 |
| -- | -4 | 22 | A#/Bb | 29.1352350949 | -4,700.00 |
| -- | -4 | 23 | B | 30.8677053285 | -4,600.00 |

FIG. 1A
(PRIOR ART)

OCTAVE -3

| OCTAVE NAME | MIDI OCTAVE | MIDI NOTE NUMBER | NOTE NAME | FREQUENCY Hz | ABSOLUTE CENTS |
|---|---|---|---|---|---|
| -- | -3 | 24 | C | 32.7031956626 | -4,500.00 |
| -- | -3 | 25 | C#/Db | 34.6478288721 | -4,400.00 |
| -- | -3 | 26 | D | 36.7080959897 | -4,300.00 |
| -- | -3 | 27 | D#/Eb | 38.8908729653 | -4,200.00 |
| -- | -3 | 28 | E | 41.2034446141 | -4,100.00 |
| -- | -3 | 29 | F | 43.6535289291 | -4,000.00 |
| -- | -3 | 30 | F#/Gb | 46.2493028390 | -3,900.00 |
| LOW | -3 | 31 | G | 48.9994294977 | -3,800.00 |
| LOW | -3 | 32 | G#/Ab | 51.9130871975 | -3,700.00 |
| LOW | -3 | 33 | A | 55.0000000000 | -3,600.00 |
| LOW | -3 | 34 | A#/Bb | 58.2704701898 | -3,500.00 |
| LOW | -3 | 35 | B | 61.7354126570 | -3,400.00 |

OCTAVE -2

| OCTAVE NAME | MIDI OCTAVE | MIDI NOTE NUMBER | NOTE NAME | FREQUENCY Hz | ABSOLUTE CENTS |
|---|---|---|---|---|---|
| -- | -2 | 36 | C | 65.4063913251 | -3,300.00 |
| -- | -2 | 37 | C#/Db | 69.2956577442 | -3,200.00 |
| -- | -2 | 38 | D | 73.4161919794 | -3,100.00 |
| -- | -2 | 39 | D#/Eb | 77.7817459305 | -3,000.00 |
| -- | -2 | 40 | E | 82.4068892282 | -2,900.00 |
| -- | -2 | 41 | F | 87.3070578583 | -2,800.00 |
| -- | -2 | 42 | F#/Gb | 92.4986056779 | -2,700.00 |
| LOW | -2 | 43 | G | 97.9988589954 | -2,600.00 |
| LOW | -2 | 44 | G#/Ab | 103.8261743950 | -2,500.00 |
| LOW | -2 | 45 | A | 110.0000000000 | -2,400.00 |
| LOW | -2 | 46 | A#/Bb | 116.5409403795 | -2,300.00 |
| LOW | -2 | 47 | B | 123.4708253140 | -2,200.00 |

OCTAVE -1

| OCTAVE NAME | MIDI OCTAVE | MIDI NOTE NUMBER | NOTE NAME | FREQUENCY Hz | ABSOLUTE CENTS |
|---|---|---|---|---|---|
| BASS | -1 | 48 | C | 130.8127826503 | -2,100.00 |
| BASS | -1 | 49 | C#/Db | 138.5913154884 | -2,000.00 |

FIG. 1B
(PRIOR ART)

| | | | | | |
|---|---|---|---|---|---|
| BASS | -1 | 50 | D | 146.8323839587 | -1,900.00 |
| BASS | -1 | 51 | D#/Eb | 155.5634918610 | -1,800.00 |
| BASS | -1 | 52 | E | 164.8137784564 | -1,700.00 |
| BASS | -1 | 53 | F | 174.6141157165 | -1,600.00 |
| BASS | -1 | 54 | F#/Gb | 184.9972113558 | -1,500.00 |
| MIDDLE | -1 | 55 | G | 195.9977179909 | -1,400.00 |
| MIDDLE | -1 | 56 | G#/Ab | 207.6523487900 | -1,300.00 |
| MIDDLE | -1 | 57 | A | 220.0000000000 | -1,200.00 |
| MIDDLE | -1 | 58 | A#/Bb | 233.0818807590 | -1,100.00 |
| MIDDLE | -1 | 59 | B | 246.9416506281 | -1,000.00 |

OCTAVE 0

| OCTAVE NAME | MIDI OCTAVE | MIDI NOTE NUMBER | NOTE NAME | FREQUENCY Hz | ABSOLUTE CENTS |
|---|---|---|---|---|---|
| MIDDLE | 0 | 60 | C | 261.6255653006 | -900.00 |
| MIDDLE | 0 | 61 | C#/Db | 277.1826309769 | -800.00 |
| MIDDLE | 0 | 62 | D | 293.6647679174 | -700.00 |
| MIDDLE | 0 | 63 | D#/Eb | 311.1269837221 | -600.00 |
| MIDDLE | 0 | 64 | E | 329.6275569129 | -500.00 |
| MIDDLE | 0 | 65 | F | 349.2282314330 | -400.00 |
| TREBLE | 0 | 66 | F#/Gb | 369.9944227116 | -300.00 |
| TREBLE | 0 | 67 | G | 391.9954359817 | -200.00 |
| TREBLE | 0 | 68 | G#/Ab | 415.3046975799 | -100.00 |
| TREBLE | 0 | 69 | A | 440.0000000000 | 0.00 |
| TREBLE | 0 | 70 | A#/Bb | 466.1637615181 | 100.00 |
| TREBLE | 0 | 71 | B | 493.8833012561 | 200.00 |

OCTAVE 1

| OCTAVE NAME | MIDI OCTAVE | MIDI NOTE NUMBER | NOTE NAME | FREQUENCY Hz | ABSOLUTE CENTS |
|---|---|---|---|---|---|
| TREBLE | 1 | 72 | C | 523.2511306012 | 300.00 |
| TREBLE | 1 | 73 | C#/Db | 554.3652619537 | 400.00 |
| TREBLE | 1 | 74 | D | 587.3295358348 | 500.00 |
| TREBLE | 1 | 75 | D#/Eb | 622.2539674442 | 600.00 |
| TREBLE | 1 | 76 | E | 659.2551138257 | 700.00 |
| TREBLE | 1 | 77 | F | 698.4564628660 | 800.00 |
| HIGH | 1 | 78 | F#/Gb | 739.9888454233 | 900.00 |

FIG. 1C
(PRIOR ART)

| | | | | | |
|---|---|---|---|---|---|
| HIGH | 1 | 79 | G | 783.9908719635 | 1,000.00 |
| HIGH | 1 | 80 | G#/Ab | 830.6093951599 | 1,100.00 |
| HIGH | 1 | 81 | A | 880.0000000000 | 1,200.00 |
| HIGH | 1 | 82 | A#/Bb | 932.3275230362 | 1,300.00 |
| HIGH | 1 | 83 | B | 987.7666025122 | 1,400.00 |

OCTAVE 2

| OCTAVE NAME | MIDI OCTAVE | MIDI NOTE NUMBER | NOTE NAME | FREQUENCY Hz | ABSOLUTE CENTS |
|---|---|---|---|---|---|
| HIGH | 2 | 84 | C | 1,046.5022612024 | 1,500.00 |
| HIGH | 2 | 85 | C#/Db | 1,108.7305239075 | 1,600.00 |
| HIGH | 2 | 86 | D | 1,174.6590716696 | 1,700.00 |
| HIGH | 2 | 87 | D#/Eb | 1,244.5079348883 | 1,800.00 |
| HIGH | 2 | 88 | E | 1,318.5102276515 | 1,900.00 |
| HIGH | 2 | 89 | F | 1,396.9129257320 | 2,000.00 |
| -- | 2 | 90 | F#/Gb | 1,479.9776908465 | 2,100.00 |
| -- | 2 | 91 | G | 1,567.9817439270 | 2,200.00 |
| -- | 2 | 92 | G#/Ab | 1,661.2187903198 | 2,300.00 |
| -- | 2 | 93 | A | 1,760.0000000000 | 2,400.00 |
| -- | 2 | 94 | A#/Bb | 1,864.6550460724 | 2,500.00 |
| -- | 2 | 95 | B | 1,975.5332050245 | 2,600.00 |

OCTAVE 3

| OCTAVE NAME | MIDI OCTAVE | MIDI NOTE NUMBER | NOTE NAME | FREQUENCY Hz | ABSOLUTE CENTS |
|---|---|---|---|---|---|
| -- | 3 | 96 | C | 2,093.0045224048 | 2,700.00 |
| -- | 3 | 97 | C#/Db | 2,217.4610478150 | 2,800.00 |
| -- | 3 | 98 | D | 2,349.3181433393 | 2,900.00 |
| -- | 3 | 99 | D#/Eb | 2,489.0158697766 | 3,000.00 |
| -- | 3 | 100 | E | 2,637.0204553030 | 3,100.00 |
| -- | 3 | 101 | F | 2,783.8258514640 | 3,200.00 |
| -- | 3 | 102 | F#/Gb | 2,958.9553816931 | 3,300.00 |
| -- | 3 | 103 | G | 3,135.9634878540 | 3,400.00 |
| -- | 3 | 104 | G#/Ab | 3,322.4375806396 | 3,500.00 |
| -- | 3 | 105 | A | 3,520.0000000000 | 3,600.00 |
| -- | 3 | 106 | A#/Bb | 3,729.3100921447 | 3,700.00 |
| -- | 3 | 107 | B | 3,951.0664100490 | 3,800.00 |

FIG. 1D
(PRIOR ART)

OCTAVE 4

| OCTAVE NAME | MIDI OCTAVE | MIDI NOTE NUMBER | NOTE NAME | FREQUENCY Hz | ABSOLUTE CENTS |
|---|---|---|---|---|---|
| -- | 4 | 108 | C | 4,186.0090448096 | 3,900.00 |
| -- | 4 | 109 | C#/Db | 4,434.9220956300 | 4,000.00 |
| -- | 4 | 110 | D | 4,698.6362866785 | 4,100.00 |
| -- | 4 | 111 | D#/Eb | 4,978.0217395533 | 4,200.00 |
| -- | 4 | 112 | E | 5,274.0409106059 | 4,300.00 |
| -- | 4 | 113 | F | 5,587.6517029281 | 4,400.00 |
| -- | 4 | 114 | F#/Gb | 5,919.9107633862 | 4,500.00 |
| -- | 4 | 115 | G | 6,271.92697571 | 4,600.00 |
| -- | 4 | 116 | G#/Ab | 6,644.8751612791 | 4,700.00 |
| -- | 4 | 117 | A | 7,040.0000000000 | 4,800.00 |
| -- | 4 | 118 | A#/Bb | 7,458.6201842884 | 4,900.00 |
| -- | 4 | 119 | B | 7,902.1328200980 | 5,000.00 |

OCTAVE 5

| OCTAVE NAME | MIDI OCTAVE | MIDI NOTE NUMBER | NOTE NAME | FREQUENCY Hz | ABSOLUTE CENTS |
|---|---|---|---|---|---|
| -- | 5 | 120 | C | 8,372.0180896192 | 5,100.00 |
| -- | 5 | 121 | C#/Db | 8,869.8441912599 | 5,200.00 |
| -- | 5 | 122 | D | 8,397.2725733570 | 5,300.00 |
| -- | 5 | 123 | D#/Eb | 9,956.0634791066 | 5,400.00 |
| -- | 5 | 124 | E | 10,548.0818212118 | 5,500.00 |
| -- | 5 | 125 | F | 11,175.3034058561 | 5,600.00 |
| -- | 5 | 126 | F#/Gb | 11,839.8215267723 | 5,700.00 |
| -- | 5 | 127 | G | 12,543.8539514160 | 5,800.00 |

FIG. 1E
(PRIOR ART)

FIRST EMBODIMENT

METHOD OF AUTOMATED INSTRUMENT AND NOTE SELECTION AND PERFORMANCE USING DEEPLY-SAMPLED VIRTUAL MUSIC INSTRUMENT(DS-VMI)LIBRARIES TO GENERATE A DIGITAL PERFORMANCE OF A MUSIC COMPOSITION

MUSIC-THEORETIC STATE DESCRIPTORS AUTOMATICALLY EVALUATED BY AUTOMATED MUSIC PERFORMANCE SYSTEM OF THE FIRST ILLUSTRATIVE EMBODIMENT DURING AUTOMATED SELECTION OF MUSICAL INSTRUMENTS AND SAMPLED NOTES DURING EACH DIGITAL PERFORMANCE

PRIMARY EVALUATION LEVEL:

- PHYTHMIC DENSITY BY TEMPO
- DURATION OF NOTES
- MIDI NOTE VALUE (A1, B2, ETC.)
- DYNAMICS

STATIC NOTE RELATIONSHIPS:

- POSITION OF NOTES IN A CHORD
- METER AND POSITION OF STRONG AND WEAK BEATS
- POSITION OF NOTES IN A MEASURE
- POSITION OF NOTES IN A PHRASE
- POSITION OF NOTES IN A SECTION
- POSITION OF NOTES IN A REGION

NOTE MODIFIER (ALTERNATE SAMPLE SELECTION, AFTER BEHAVIOR SELECTION)

EVALUATION LEVEL:

SITUATIONAL RELATIONSHIP:

- MIDI NOTE VALUE PRECEDENCE AND ANTECEDENCE
- POSITION OR EXISTENCE OF NOTES FROM OTHER INSTRUMENT LANES
- RELATION OF SECTIONS TO EACH OTHER
- ACCENTS
- TIMING BASED RHYTHM MODIFIERS

INSTRUMENT SELECTION (SAMPLE BANK / PERFORMANCE ASSIGNMENT):

- WHAT INSTRUMENTS ARE AVAILABLE
- WHAT INSTRUMENTS ARE PLAYING
- WHAT INSTRUMENTS SHOULD OR MIGHT BE PLAYED
- WHAT INSTRUMENTS ARE ASSIGNED TO A ROLE (E.G. PLAY IN BACKGROUND, PLAY AS A BED, PLAY BASS, ETC.)
- HOW MANY INSTRUMENTS ARE AVAILABLE

FIG. 8

SECOND EMBODIMENT

METHOD OF GENERATING A DIGITAL PERFORMANCE OF A MUSIC COMPOSITION USING THE AUTOMATED MUSIC PERFORMANCE SYSTEM OF THE PRESENT INVENTION

METHOD OF AUTOMATED INSTRUMENT AND NOTE SELECTION AND PERFORMANCE USING DEEPLY-SAMPLED VIRTUAL MUSIC INSTRUMENT (DS-VMI) LIBRARIES TO GENERATE A DIGITAL PERFORMANCE OF A MUSIC COMPOSITION

MUSIC-THEORETIC STATE DESCRIPTORS AUTOMATICALLY EVALUATED BY AUTOMATED MUSIC PERFORMANCE SYSTEM OF THE SECOND ILLUSTRATIVE EMBODIMENT DURING AUTOMATED SELECTION OF MUSICAL INSTRUMENTS AND SAMPLED NOTES DURING EACH DIGITAL PERFORMANCE

PRIMARY EVALUATION LEVEL:

. PHYTHMIC DENSITY BY TEMPO
. DURATION OF NOTES
. MIDI NOTE VALUE (A1, B2, ETC.)
. DYNAMICS

STATIC NOTE RELATIONSHIPS:

. POSITION OF NOTES IN A CHORD
. METER AND POSITION OF STRONG AND WEAK BEATS
. POSITION OF NOTES IN A MEASURE
. POSITION OF NOTES IN A PHRASE
. POSITION OF NOTES IN A SECTION
. POSITION OF NOTES IN A REGION

NOTE MODIFIER (ALTERNATE SAMPLE SELECTION, AFTER BEHAVIOR SELECTION) EVALUATION LEVEL:

SITUATIONAL RELATIONSHIP:

. MIDI NOTE VALUE PRECEDENCE AND ANTECEDENCE
. POSITION OR EXISTENCE OF NOTES FROM OTHER INSTRUMENT LANES
. RELATION OF SECTIONS TO EACH OTHER
. ACCENTS
. TIMING BASED RHYTHM MODIFIERS

INSTRUMENT SELECTION (SAMPLE BANK / PERFORMANCE ASSIGNMENT):

. WHAT INSTRUMENTS ARE AVAILABLE
. WHAT INSTRUMENTS ARE PLAYING
. WHAT INSTRUMENTS SHOULD OR MIGHT BE PLAYED
. WHAT INSTRUMENTS ARE ASSIGNED TO A ROLE (E.G. PLAY IN BACKGROUND, PLAY AS A BED, PLAY BASS, ETC.)
. HOW MANY INSTRUMENTS AREA AVAILABLE

FIG. 16

THIRD EMBODIMENT

WEB-BASED AUTOMATED MUSIC COMPOSITION, PERFORMANCE AND GENERATION SYSTEM PLATFORM ACCESSIBLE USING WEB-ENABLED MOBILE AND DESKTOP CLIENT MACHINES

METHOD OF AUTOMATED MUSIC COMPOSITION, PERFORMANCE AND PRODUCTION USING DEEPLY-SAMPLED VIRTUAL MUSICAL INSTRUMENT LIBRARIES AND COMPOSITION-STATE-AWARE PERFORMANCE RULES

A: SELECTING REAL MUSICAL INSTRUMENTS TO BE SAMPLED, RECORDED, AND CATALOGUED FOR USE IN THE DEEPLY-SAMPLED VIRTUAL MUSICAL INSTRUMENT (DS-VMI) LIBRARY MANAGEMENT SYSTEM OF THE PRESENT INVENTION

B: USING AN INSTRUMENT TYPE AND BEHAVIOR BASED SCHEMA (I.E. PLAN) FOR SAMPLING, RECORDING AND CATALOGUING THE SELECTED REAL MUSICAL INSTRUMENTS IN THE VIRTUAL MUSICAL INSTRUMENT SAMPLE LIBRARY MANAGEMENT SYSTEM OF PRESENT INVENTION

C: USING THE INSTRUMENT TYPE AND BEHAVIOR BASED SCHEMA TO DEVELOP THE ACTION PART OF MUSIC-THEORETIC STATE (MTS) RESPONSIVE PERFORMANCE RULES FOR PROCESSING SAMPLED NOTES IN VIRTUAL MUSICAL INSTRUMENT SAMPLE LIBRARIES BEING MANAGED IN THE LIBRARY MANAGEMENT SYSTEM, DURING THE AUTOMATED MUSIC PERFORMANCE PROCESS

D: LOADING THE DS-VMI LIBRARIES AND MUSIC-THEORETIC STATE (MTS) RESPONSIVE PERFORMANCE LOGIC (I.E. RULES) INTO THE SYSTEM BEFORE THE AUTOMATED MUSIC PERFORMANCE GENERATION PROCESS

E: DURING AN AUTOMATED MUSIC COMPOSITION PROCESS, THE SYSTEM USER PROVIDING EMOTION AND STYLE TYPE MUSICAL EXPERIENCE (MEX) DESCRIPTORS AND TIMING PARAMETERS TO THE SYSTEM, THEN THE SYSTEM TRANSFORMING MEX DESCRIPTORS AND TIMING PARAMETERS INTO A SET OF MUSIC-THEORETIC SYSTEM OPERATING PARAMETERS FOR USE DURING THE AUTOMATED MUSIC COMPOSITION AND GENERATION PROCESS

F: PROVIDING THE MUSIC-THEORETIC SYSTEM OPERATING PARAMETERS (MT-SOP DESCRIPTORS) TO THE AUTOMATED MUSIC COMPOSITION ENGINE SUBSYSTEM FOR USE IN AUTOMATICALLY COMPOSING A MUSIC COMPOSITION

G: PROVIDING THE MUSIC COMPOSITION TO THE AUTOMATED MUSIC PERFORMANCE ENGINE (AMCPE) SUBSYSTEM AND PRODUCING A TIME-LINE INDEXED MUSIC-THEORETIC STATE DESCRIPTORS DATA (I.E. MUSIC COMPOSITION META-DATA)

H: THE AUTOMATED MUSIC PERFORMANCE ENGINE (AMPE) EVALUATING THE MUSIC-THEORETIC STATE DESCRIPTOR (MTSD) DATA TO AUTOMATICALLY SELECT SAMPLED NOTES FROM DEEPLY-SAMPLED VIRTUAL MUSICAL INSTRUMENT LIBRARIES, AND USING MUSIC-THEORETIC STATE DESCRIPTOR RESPONSIVE PERFORMANCE RULES TO EVALUATE THE PARAMETERS OF THE MTSD DATA AND SELECT AND PROCESS SAMPLED NOTES, AND GENERATE THE NOTES FOR THE DIGITAL PERFORMANCE OF THE MUSIC COMPOSITION

I: ASSEMBLING AND FINALIZING THE PROCESSED SAMPLED NOTES SELECTED FOR THE DIGITAL PERFORMANCE OF THE MUSIC COMPOSITION

J: PRODUCING THE NOTES OF THE DIGITAL PERFORMANCE OF THE MUSIC COMPOSITION, FOR REVIEW AND EVALUATION BY HUMAN LISTENERS

FIG. 18

METHOD OF GENERATING A DIGITAL PERFORMANCE OF A MUSIC COMPOSITION USING THE AUTOMATED MUSIC PERFORMANCE SYSTEM OF THE PRESENT INVENTION

METHOD OF AUTOMATED INSTRUMENT AND NOTE SELECTION AND PERFORMANCE USING DEEPLY-SAMPLED VIRTUAL MUSIC INSTRUMENT (DS-VMI) LIBRARIES TO GENERATE A DIGITAL PERFORMANCE OF A MUSIC COMPOSITION

MUSIC-THEORETIC STATE DESCRIPTORS AUTOMATICALLY EVALUATED BY AUTOMATED MUSIC PERFORMANCE SYSTEM OF THE THIRD ILLUSTRATIVE EMBODIMENT DURING AUTOMATED SELECTION OF MUSICAL INSTRUMENTS AND SAMPLED NOTES DURING EACH DIGITAL PERFORMANCE

PRIMARY EVALUATION LEVEL:

. PHYTHMIC DENSITY BY TEMPO
. DURATION OF NOTES
. MIDI NOTE VALUE (A1, B2, ETC.)
. DYNAMICS

STATIC NOTE RELATIONSHIPS:

. POSITION OF NOTES IN A CHORD
. METER AND POSITION OF STRONG AND WEAK BEATS
. POSITION OF NOTES IN A MEASURE
. POSITION OF NOTES IN A PHRASE
. POSITION OF NOTES IN A SECTION
. POSITION OF NOTES IN A REGION

NOTE MODIFIER (ALTERNATE SAMPLE SELECTION, AFTER BEHAVIOR SELECTION) EVALUATION LEVEL:

SITUATIONAL RELATIONSHIP:

. MIDI NOTE VALUE PRECEDENCE AND ANTECEDENCE
. POSITION OR EXISTENCE OF NOTES FROM OTHER INSTRUMENT LANES
. RELATION OF SECTIONS TO EACH OTHER
. ACCENTS
. TIMING BASED RHYTHM MODIFIERS

INSTRUMENT SELECTION (SAMPLE BANK / PERFORMANCE ASSIGNMENT):

. WHAT INSTRUMENTS ARE AVAILABLE
. WHAT INSTRUMENTS ARE PLAYING
. WHAT INSTRUMENTS SHOULD OR MIGHT BE PLAYED
. WHAT INSTRUMENTS ARE ASSIGNED TO A ROLE (E.G. PLAY IN BACKGROUND, PLAY AS A BED, PLAY BASS, ETC.)
. HOW MANY INSTRUMENTS AREA AVAILABLE

FIG. 23

EXEMPLARY MUSICAL COMPOSITION TO BE DIGITALLY PERFORMED BY A DIGITAL MUSICAL PERFORMANCE PERFORMED USING DEEPLY-SAMPLED VIRTUAL MUSICAL INSTRUMENTS SUPPORTED BY THE AUTOMATED MUSIC PERFORMANCE SYSTEM OF THE PRESENT INVENTION

MUSICAL SCORE REPRESENTATION

A SPECIFICATION OF MUSIC-THEORETIC STATE DESCRIPTORS AND MUSIC METRICS IN EACH MUSIC COMPOSITION TO BE PERFORMED BY DEEPLY-SAMPLED VIRTUAL MUSICAL INSTRUMENTS (DS-VMI) SELECTED FROM THE DEEPLY-SAMPLED VIRTUAL MUSICAL INSTRUMENT (DS-VMI) LIBRARY MANAGEMENT SUBSYSTEM

PRIMARY EVALUATION LEVEL:

. PHYTHMIC DENSITY BY TEMPO
. DURATION OF NOTES
. MIDI NOTE VALUE (A1, B2, ETC.)
. DYNAMICS

STATIC NOTE RELATIONSHIPS:

. POSITION OF NOTES IN A CHORD
. METER AND POSITION OF STRONG AND WEAK BEATS
. POSITION OF NOTES IN A MEASURE
. POSITION OF NOTES IN A PHRASE
. POSITION OF NOTES IN A SECTION
. POSITION OF NOTES IN A REGION

SITUATIONAL RELATIONSHIP:

. MIDI NOTE VALUE PRECEDENCE AND ANTECEDENCE
. POSITION OR EXISTENCE OF NOTES FROM OTHER INSTRUMENT LANES
. RELATION OF SECTIONS TO EACH OTHER
. ACCENTS
. TIMING BASED RHYTHM MODIFIERS

INSTRUMENT SELECTION :

. WHAT INSTRUMENTS ARE SPECIFIED
. WHAT INSTRUMENTS SHOULD OR MIGHT BE PLAYED

FIG. 27

SPECIFICATION ON EXEMPLARY MUSICAL ROLES (I.E. MUSICAL PARTS) OF EACH MUSIC COMPOSITION TO BE AUTOMATICALLY ANALYZED

INSTRUMENTS WITH THEIR ASSOCIATED PERFORMANCES CAN GET THE FOLLOWING ROLES: (NOTE: A SINGLE ROLE IS ASSIGNED TO AN INSTRUMENT, AND MULTIPLE ROLES CANNOT BE ASSIGNED TO A SINGLE INSTRUMENT, BUT MULTIPLE INSTRUMENTS CAN BE ASSIGNED A SINGLE ROLE)

ACCENT - THIS IS THE ROLE THAT PROVIDES INFORMATION ON WHEN LARGE MUSICAL ACCENTS SHOULD BE PLAYED
BACK BEAT - THIS IS THE ROLE THAT PROVIDES NOTE DATA THAT HAPPEN ON THE WEAKER BEATS OF A PIECE
BACKGROUND - LOWER DENSITY ROLE, NOTES THAT OFTEN ARE THE LOWEST ENERGY AND DENSITY THAT LIVES IN THE BACKGROUND OF A COMPOSITION
BIG HIT - NOTES THAT HAPPEN OUTSIDE OF ANY MEASUREMENT, USUALLY A SINGULAR NOTE THAT HAPPENS RARELY
COLOR - THIS IS THE ROLE RESERVED FOR SMALL MUSICAL SEGMENTS THAT PLAY SEMI-REGULAR BUT ADD SMALL MUSICAL PHRASES THROUGHOUT A PIECE
CONSISTENT - THIS IS THE ROLE THAT IS RESERVED FOR PARTS THAT LIVE OUTSIDE OF THE NORMAL STRUCTURE OF PHRASE
CONSTANT - THIS IS THE ROLE THAT IS OFTEN MONOPHONIC AND HAS CONSTANT SET OF NOTES OF THE SAME VALUE (E.G.: ALL 8TH NOTES PLAYED CONSECUTIVELY)
DECORATION - SIMILAR TO COLOR, THIS ROLE IS RESERVED FOR A SMALL FLOURISH OF NOTES THAT HAPPENS LESS REGULARLY THAN COLOR
HIGH LANE - VERY ACTIVE AND HIGH-NOTE DENSITY, USUALLY RESERVED FOR PERCUSSION
HIGH-MID LANE - MOSTLY ACTIVE AND MEDIUM-NOTE DENSITY, USUALLY RESERVED FOR PERCUSSION
LOW LANE - LOW ACTIVE, LOW NOTE-DENSITY INSTRUMENT, USUALLY RESERVED FOR PERCUSSION
LOW-MID LANE - MOSTLY LOW ACTIVITY, MOSTLY LOW NOTE-DENSITY INSTRUMENT, USUALLY RESERVED FOR PERCUSSION
MIDDLE - MIDDLE ACTIVITY, ABOVE THE BACKGROUND ROLE, BUT NOT PRIMARY OR SECONDARY INFORMATION.
ON BEAT - NOTES THAT HAPPEN ON STRONG BEATS
PAD - LONG HELD NOTES THAT PLAY AT EVERY CHORD CHANGE
PEDAL - LONG HELD NOTES, THAT HOLD THE SAME NOTE THROUGHOUT A SECTION
PRIMARY - ROLE THAT IS THE "LEAD" OR MAIN MELODIC PART
SECONDARY - ROLE THAT IS SECONDARY TO THE "LEAD" PART, OFTEN THE COUNTERPOINT TO THE PRIMARY ROLE
---
DRUM SET ROLES: (THIS IS A SINGLE PERFORMER THAT HAS MULTIPLE INSTRUMENTS WHICH ARE ASSIGNED MULTIPLE ROLES THAT ARE AWARE OF EACH OTHER)
HI-HAT - DRUM SET ROLE THAT DOES HI-HAT NOTES
SNARE - DRUM SET ROLE THAT DOES SNARE NOTES
CYMBAL - DRUM SET ROLE OF THAT DOES EITHER A CRASH OR A RIDE
TOM - DRUM SET ROLE THAT DOES THE TOM PARTS
KICK - DRUM SET ROLE THAT DOES KICK NOTES

FIG. 28A

SPECIFICATION MUSICAL ROLE ASSIGNMENT RULES
EMPLOYED IN THE SYSTEM OF THE FIRST ILLUSTRATIVE EMBODIMENT

ACCENT ROLE:
1. ROLE-TO-NOTE ASSIGNMENT RULE:
IF THE DENSITY OF NOTES ARE FAIRLY SPARSE
AND FOLLOW ALONG A CONSISTENT STRONG BEAT TO WEAK BEAT PERIODICITY, OR/AND IF SEVERAL INSTRUMENT PARTS HAVE REGULAR PERIODICITY IN STRONG BEAT GROUPINGS, THEN ASSIGN TO THE ACCENT ROLE TO THESE NOTES.

2. ROLE-TO-INSTRUMENT-TYPE ASSIGNMENT RULE:
ASSIGN THE ACCENT ROLE TO INSTRUMENT_TYPES RESERVED FOR ACCENTS, WHICH ARE TYPICALLY PERCUSSIVE, (E.G. ".HIT()" ASPECT VALUE OF: AUX_PERC, BIG_HIT, CYMBAL, ETC.).

3. ROLE-TO-INSTRUMENT-PERFORMANCE-LOGIC ASSIGNMENT RULE:
ASSIGN THE ACCENT ROLE TO INSTRUMENT PERFORMANCE LOGIC OF OTHER ROLES BY THROUGH CHANGE IN VELOCITY OR NOT PLAY/PLAY NOTES IN CURRENT ASSIGNED ROLE (EX: AUGMENTING ROLE).

BACK BEAT ROLE:
1. ROLE-TO-NOTE ASSIGNMENT RULE:
IF NOTES HAVE A PERIODICITY OF PRIMARILY WEAK BEAT AND THAT ARE TONAL, THEN ASSIGN TO THE BACK BEAT ROLE TO THESE NOTES.

2. ROLE-TO-INSTRUMENT-TYPE ASSIGNMENT RULE:
ASSIGN THIS ROLE INSTRUMENT TYPES THAT PROVIDE A MORE RHYTHMIC AND PERCUSSIVE TONAL PERFORMANCE (MONO OR POLYPHONIC)

3. ROLE-TO-INSTRUMENT-PERFORMANCE-LOGIC ASSIGNMENT RULE:
ASSIGN THIS ROLE TO INSTRUMENT PERFORMANCES (I.E. INSTRUMENT PERFORMANCE LOGIC/RULES) SUCH AS, E.G. ACOUSTIC_PIANO WITH "TRIADIC CHORDS CLOSED VOICING", ACOUSTIC_GUITAR WITH "UP-STRUM TOP THREE STRINGS", ETC.

BACKGROUND ROLE:
1. ROLE-TO-NOTE ASSIGNMENT RULE:
IF NOTES HAVE A MEDIUM-LOW DENSITY (PLAYING SLIGHTLY MORE THAN ONCE PER CHORD, POLYTONAL), THEN ASSIGN THE BACKGROUND ROLE TO THESE NOTES.

2. ROLE-TO-INSTRUMENT-TYPE ASSIGNMENT RULE:
ASSIGN THE BACKGROUND ROLE TO INSTRUMENT TYPES THAT CAN SUPPORT POLYPHONIC (NOTE) PERFORMANCES.

3. ROLE-TO-PERFORMANCE-LOGIC ASSIGNMENT RULE:
PLAY POLYPHONIC CHORDS OR PARTS OF CHORDS IN INSTRUMENT TYPES (E.G. KEYBOARD, ACOUSTIC_PIANO, SYNTH_STRINGS, ETC.)

FIG. 28B1

SPECIFICATION MUSICAL ROLE ASSIGNMENT RULES
EMPLOYED IN THE SYSTEM OF THE FIRST ILLUSTRATIVE EMBODIMENT

BIG HIT ROLE:
1. ROLE-TO-NOTE ASSIGNMENT RULE:
IF NOTES HAPPEN WITH EXTREME IRREGULARITY AND ARE VERY SPARSE, AND/OR EITHER FALL WITH A NOTE IN THE ACCENT LANE OR OUTSIDE OF ANY TIME SIGNATURE, THEN ASSIGN THE BIG HIT ROLE TO THESE NOTES.

2. ROLE-TO-INSTRUMENT-TYPE ASSIGNMENT RULE:
ASSIGN THIS ROLE INSTRUMENT TYPE PRIMARILY TO SINGLE HIT, NON-TONAL, PERCUSSIVE INSTRUMENTS

3. ROLE-TO-INSTRUMENT-PERFORMANCE-LOGIC ASSIGNMENT RULE:
PERFORMANCE LOGIC IS PLAY A "HIT()" IN THE ASSIGNED INSTRUMENT TYPE (E.G. BIG_HIT, BASS_DRUM, ETC.).

COLOR ROLE:
1. ROLE-TO-NOTE ASSIGNMENT RULE:
IF NOTES HAPPEN IN SMALL CLUSTERS, WITH RESTS BETWEEN EACH SET OF CLUSTERS, AND HAVE SOME REGULAR PERIODICITY LESS THAN ONCE PER PHRASE, THEN ASSIGN THE COLOR ROLE TO THESE NOTES.

2. ROLE-TO-INSTRUMENT-TYPE ASSIGNMENT RULE:
ASSIGN THE COLOR ROLE TO INSTRUMENT TYPES THAT ARE EITHER PERCUSSIVE (IF NOTES ARE UNPITCHED) OR TONAL (IF NOTES FOLLOW PITCHES WITHIN THE KEY) AND CAN BE ASSIGNED TO TYPICALLY MONOPHONIC OR INSTRUMENTS WITH HARMONIC/RHYTHMIC TAGS (E.G. INSTRUMENTS WITH DELAY TAG, TICKIES, SYNTH_LEAD, ETC.)

3. ROLE-TO-INSTRUMENT-PERFORMANCE-LOGIC ASSIGNMENT RULE:
MAY ASSIGN PERFORMANCES THAT ARE SOFTER IN VELOCITY OR LIGHTER IN ARTICULATION ATTACK.

CONSISTENT ROLE:
1. ROLE-TO-NOTE ASSIGNMENT RULE:
IF NOTES ARE RELATIVELY DENSE, HAVE SOME PERIODICITY, AND CHANGE IN EITHER NOTE PATTERN ORGANIZATION, RHYTHMIC PATTERN ORGANIZATION MORE THAN ONCE PER A FEW BARS, THEN ASSIGN THE CONSISTENT ROLE TO THESE NOTES.

2. ROLE-TO-INSTRUMENT-TYPE ASSIGNMENT RULE:
ASSIGN THE COLOR ROLE TO INSTRUMENT TYPES THAT HAVE TYPICALLY MONOPHONIC PERFORMANCES (E.G. SYNTH_LEAD, GUITAR_LEAD).

3. ROLE-TO-INSTRUMENT-PERFORMANCE-LOGIC ASSIGNMENT RULE:
MAY ASSIGN PERFORMANCES THAT UTILIZE VARIOUS ARPEGGIATION PATTERNS (EG: LINE UP/DOWN, SAWTOOTH, ETC.)

FIG. 28B2

SPECIFICATION MUSICAL ROLE ASSIGNMENT RULES
EMPLOYED IN THE SYSTEM OF THE FIRST ILLUSTRATIVE EMBODIMENT

CONSTANT ROLE:
1. ROLE-TO-NOTE ASSIGNMENT RULE:
IF NOTES THAT ARE RELATIVELY DENSE, AND HAVE VERY STATIC RHYTHMI INFORMATION WITH PERIODICITY, THEN ASSIGN THE CONSTANT ROLE TO THESE NOTES.

2. ROLE-TO-INSTRUMENT-TYPE ASSIGNMENT RULE:
ASSIGN THE CONSTANT ROLE TO EITHER TONAL (MONOPHONIC) OR PERCUSSIVE INSTRUMENT TYPES.

3. ROLE-TO-INSTRUMENT-PERFORMANCE-LOGIC ASSIGNMENT RULE:
ASSIGN THE CONSTANT ROLE TO INSTRUMENT PERFORMANCES THAT ARE TEMPO DEPENDENT (E.G. SHAKER WITH "FRONT()" ONLY, SYNTH_LEAD WITH "ARPEGGIATION UP", ETC.).

DECORATION ROLE:
1. ROLE-TO-NOTE ASSIGNMENT RULE:
IF NOTES HAPPEN IN SMALL CLUSTERS, WITH RESTS BETWEEN EACH SET OF CLUSTERS, AND OCCUR ONE PER PHRASE OR LONGER, THEN ASSIGN THE DECORATION ROLE TO THESE NOTES.

2. ROLE-TO-INSTRUMENT-TYPE ASSIGNMENT RULE:
ASSIGN THE DECORATION ROLE TO INSTRUMENT TYPES THAT ARE EITHER PERCUSSIVE (IF NOTES ARE UNPITCHED) OR TONAL (IF NOTES FOLLOW PITCHES WITHIN THE KEY) AND CAN BE ASSIGNED TO TYPICALLY MONOPHONIC OR INSTRUMENTS WITH HARMONIC/RHYTHMIC TAGS (E.G. INSTRUMENTS WITH DELAY TAG, TICKIES, SYNTH_LEAD, ETC.)

3. ROLE-TO-INSTRUMENT-PERFORMANCE-LOGIC ASSIGNMENT RULE:
MAY ASSIGN PERFORMANCES THAT ARE SOFTER IN VELOCITY OR LIGHTER IN ARTICULATION ATTACK.

HIGH LANE ROLE:
1. ROLE-TO-NOTE ASSIGNMENT RULE:
IF NOTES THAT ARE UNPITCHED THAT HAPPEN IN USUALLY RAPID SUCCESSION OR HIGH DENSITY, THEN ASSIGN THE HIGH LANE

2. ROLE TO THESE NOTES. ROLE-TO-INSTRUMENT-TYPE ASSIGNMENT RULE:
UNLESS OTHERWISE DIRECTED BY AN EXTERNAL INPUT, USUALLY ASSIGN THE HIGH LANE ROLE TO HIGH-PITCHED IN TIMBRE PERCUSSION INSTRUMENTS (E.G. TICKIES, SHAKERS, AUX_DRUM ("RIM"), ETC.)

3. ROLE-TO-INSTRUMENT-PERFORMANCE-LOGIC ASSIGNMENT RULE:
CHOOSE PERFORMANCES THAT ACTIVATE ARTICULATIONS THAT ARE TAGGED WITH "HIGH" AND/OR "SHORT"

FIG. 28B3

SPECIFICATION MUSICAL ROLE ASSIGNMENT RULES
EMPLOYED IN THE SYSTEM OF THE FIRST ILLUSTRATIVE EMBODIMENT

HIGH-MID LANE ROLE:
1. ROLE-TO-NOTE ASSIGNMENT RULE:
IF NOTES THAT ARE UNPITCHED THAT HAPPEN IN MEDIUM-HIGH DENSITY, THEN ASSIGN THE HIGH-MID LANE ROLE TO THESE NOTES.

2. ROLE-TO-INSTRUMENT-TYPE ASSIGNMENT RULE:
UNLESS OTHERWISE DIRECTED BY AN EXTERNAL INPUT, USUALLY ASSIGN THIS ROLE TO HIGH-PITCHED OR MEDIUM IN TIMBRE PERCUSSION INSTRUMENTS (E.G. TICKIES, AUX_DRUM, HAND_DRUM, ETC.)

3. ROLE-TO-INSTRUMENT-PERFORMANCE-LOGIC ASSIGNMENT RULE:
CHOOSE PERFORMANCES THAT ACTIVATE ARTICULATIONS THAT ARE TAGGED WITH "MIDDLE" AND/OR "SHORT/MEDIUM"

LOW-MID LANE ROLE:
1. ROLE-TO-NOTE ASSIGNMENT RULE:
IF NOTES THAT ARE UNPITCHED THAT HAPPEN IN MEDIUM-LOW DENSITY, THEN ASSIGN THE LOW-MID LANE ROLE TO THESE NOTES.

2. ROLE-TO-INSTRUMENT-TYPE ASSIGNMENT RULE:
UNLESS OTHERWISE DIRECTED BY AN EXTERNAL INPUT, USUALLY ASSIGN THIS ROLE TO MEDIUM TO MEDIUM-LOW IN TIMBRE PERCUSSION INSTRUMENTS
(E.G. AUX_DRUM, HAND_DRUM, TAIKO, ETC.)

3. ROLE-TO-INSTRUMENT-PERFORMANCE-LOGIC ASSIGNMENT RULE:
CHOOSE PERFORMANCES THAT ACTIVATE ARTICULATIONS THAT ARE TAGGED WITH "MIDDLE," "LOW," AND/OR "MEDIUM/LONG"

LOW LANE ROLE:
1. ROLE-TO-NOTE ASSIGNMENT RULE:
ASSIGN THE LOW LANE ROLE TO NOTES THAT ARE UNPITCHED THAT HAPPEN IN LOW DENSITY.

2. ROLE-TO-INSTRUMENT-TYPE ASSIGNMENT RULE:
UNLESS OTHERWISE DIRECTED BY AN EXTERNAL INPUT, ASSIGN THIS ROLE USUALLY TO INSTRUMENT TYPES THAT ARE LOW IN TIMBRE PERCUSSION (E.G. BASS_DRUM, SURDO, TAIKO, ETC.)

3. ROLE-TO-INSTRUMENT-PERFORMANCE-LOGIC ASSIGNMENT RULE:
CHOOSE PERFORMANCES THAT ACTIVATE ARTICULATIONS THAT ARE TAGGED WIT H "LOW," AND/OR "LONG"

FIG. 28B4

SPECIFICATION MUSICAL ROLE ASSIGNMENT RULES
EMPLOYED IN THE SYSTEM OF THE FIRST ILLUSTRATIVE EMBODIMENT

MIDDLE ROLE:
1. ROLE-TO-NOTE ASSIGNMENT RULE:
IF NOTES HAVE A MEDIUM DENSITY (PLAYING MORE THAN ONCE PER CHORD, POLYTONAL, WITH OCCASIONAL RUNNING LINES), THEN ASSIGN THE MIDDLE ROLE TO THESE NOTES.

2. ROLE-TO-INSTRUMENT-TYPE ASSIGNMENT RULE:
TYPICALLY ASSIGN THIS ROLE TO INSTRUMENT TYPES THAT CAN SUPPORT POLYPHONIC PLAYBACK AND PERFORMANCE. (E.G. KEYBOARD, ACOUSTIC_PIANO, SYNTH_STRINGS, VIOLINS, ETC.).

3. ROLE-TO-INSTRUMENT-PERFORMANCE-LOGIC ASSIGNMENT RULE:
TYPICALLY ASSIGN THIS ROLE TO INSTRUMENT PERFORMANCES SUPPORT POLYPHONIC PERFORMANCE. (E.G. KEYBOARD, ACOUSTIC_PIANO, SYNTH_STRINGS, VIOLINS, ETC).

ON BEAT ROLE:
1. ROLE-TO-NOTE ASSIGNMENT RULE:
IF NOTES HAVE A PERIODICITY OF PRIMARILY STRONG BEAT AND THAT ARE TONAL, THEN ASSIGN THE ON BEAT ROLE TO THESE NOTES.

2. ROLE-TO-INSTRUMENT-TYPE ASSIGNMENT RULE:
ASSIGN THIS ROLE TO INSTRUMENT TYPES THAT PRODUCE MORE RHYTHMIC AND PERCUSSIVE TONAL PERFORMANCES (MONO OR POLYPHONIC)

3. ROLE-TO-INSTRUMENT-PERFORMANCE-LOGIC ASSIGNMENT RULE:
ASSIGN THIS ROLE TO INSTRUMENT PERFORMANCES THAT HAVE "STRONG" PERFORMANCE TAG ASSOCIATION (EG: ACOUSTIC_BASS "ROOTS WITH 5THS", ACOUSTIC_GUITAR WITH "DOWN-STRUM POWER CHORD", ETC.)

PAD ROLE:
1. ROLE-TO-NOTE ASSIGNMENT RULE:
IF NOTES ARE SUSTAINED THROUGH THE DURATION OF A CHORD, THEN ASSIGN THE PAD ROLE TO THESE NOTES.

2. ROLE-TO-INSTRUMENT -TYPE ASSIGNMENT RULE:
TYPICALLY ASSIGN THIS ROLE TO POLYPHONIC INSTRUMENT TYPES THAT SUSTAIN NOTES (E.G. MID_PAD, SYNTH_STRING,

3. SYNTH_BASS) ROLE-TO-INSTRUMENT-PERFORMANCE-LOGIC ASSIGNMENT RULE:
TYPICALLY ASSIGN THIS ROLE TO INSTRUMENT PERFORMANCES INVOLVING POLYPHONIC PERFORMANCES THAT SUSTAIN NOTES DURING A CHORD, AND CHANGE NOTES ON CHORD CHANGE (E.G. MID_PAD, SYNTH_STRING, SYNTH_BASS)

FIG. 28B5

SPECIFICATION MUSICAL ROLE ASSIGNMENT RULES
EMPLOYED IN THE SYSTEM OF THE FIRST ILLUSTRATIVE EMBODIMENT

PEDAL ROLE:
1. ROLE-TO-NOTE ASSIGNMENT RULE:
IF NOTES SUSTAIN THROUGH CHORDS AND STAY ON ONE PITCH (OFTEN THE ROOT) OF AN ENTIRE PHRASE, THEN ASSIGN THE PEDAL ROLE TO THESE NOTES.

2. ROLE-TO-INSTRUMENT-TYPE ASSIGNMENT RULE:
ASSIGN THIS ROLE TYPICALLY TO MONOPHONIC INSTRUMENT TYPES SUCH AS, E.G. LOW_PAD, SYNTH_BASS, PULSE, ETC.

3. ROLE-TO-INSTRUMENT-PERFORMANCE-LOGIC ASSIGNMENT RULE:
ASSIGN THIS ROLE TYPICALLY TO INSTRUMENT PERFORMANCES SUPPORTING MONOPHONIC PERFORMANCES THAT EITHER SUSTAIN INDEFINITELY, OR CAN QUICKLY
REATTACK CONSECUTIVELY TO CREATE A PULSE-LIKE PEDAL TONE
(E.G. LOW_PAD, SYNTH_BASS, PULSE, ETC.)

PRIMARY ROLE:
1. ROLE-TO-NOTE ASSIGNMENT RULE:
IF NOTES ARE MOSTLY MONOPHONIC, PLAYED
WITH MORE DENSITY, RHYTHMIC STRUCTURE VARIANCES, OFTEN WITH SOME REPETITION AND PERIODICITY, AND ARE ACCOMPANIED WITH EITHER GREAT DYNAMIC MARKINGS, HIGH VELOCITIES, AND/OR OTHER INDICATIONS DEPENDING ON THE MEDIUM READ, THEN ASSIGN THE PRIMARY ROLE TO THESE NOTES.

2. ROLE-TO-INSTRUMENT-TYPE ASSIGNMENT RULE:
ASSIGN THIS ROLE TYPICALLY TO INSTRUMENT TYPES OFTEN USED TO PERFORM AS LEAD INSTRUMENTS (E.G. VIOLIN, LEAD_SYNTH,LEAD_GUITAR, ETC.)

3. ROLE-TO-INSTRUMENT-PERFORMANCE-LOGIC ASSIGNMENT RULE:
MAY CHOOSE LIMITED POLYPHONIC OR MONOPHONIC PERFORMANCE, THAT MAY UTILIZES A GREAT AMOUNT OF ARTICULATION CONTROL AND SWITCHING.

SECONDARY ROLE:
1. ROLE-TO-NOTE ASSIGNMENT RULE:
IF NOTES ARE MOSTLY MONOPHONIC, PLAY WITH MORE DENSITY, RHYTHMIC STRUCTURE VARIANCES, OFTEN WITH SOME REPETITION AND PERIODICITY, AND ARE ACCOMPANIED WITH EITHER GREAT DYNAMIC MARKINGS, HIGH VELOCITIES, ARE EITHER LOWER IN PITCH OR PLAY LESS DENSE THEN ANOTHER PART, AND/OR OTHER INDICATIONS DEPENDING ON THE MEDIUM READ, THEN ASSIGN THE SECONDARY ROLE TO THESE NOTES.

2. ROLE-TO-INSTRUMENT-TYPE ASSIGNMENT RULE:
ASSIGN THIS ROLE TO INSTRUMENT TYPES THAT OFTEN PERFORM AS LEAD INSTRUMENTS (E.G. VIOLIN, LEAD_SYNTH, LEAD_GUITAR, ETC.)

3. ROLE-TO-INSTRUMENT-PERFORMANCE-LOGIC ASSIGNMENT RULE:
MAY CHOOSE LIMITED POLYPHONIC OR MONOPHONIC PERFORMANCE, THAT MAY UTILIZES A GREAT AMOUNT OF ARTICULATION CONTROL AND SWITCHING.

FIG. 28B6

SPECIFICATION MUSICAL ROLE ASSIGNMENT RULES
EMPLOYED IN THE SYSTEM OF THE FIRST ILLUSTRATIVE EMBODIMENT

DRUM SET ROLES:
THESE ARE THE ROLES LISTED BELOW THAT ARE GIVEN SPECIFIC RHYTHMIC PARTS (NON-TONAL) THAT SHOULD BE ASSIGNED TO ONE ROLE -PERFORMER, BUT HAVE TO BE BROKEN OUT BECAUSE THE INSTRUMENTS USED ARE NATURALLY SEPARATED. NOTES WILL NEED TO BE PARSED INTO DIFFERENT ROLES, AND OFTEN CAN BE DETERMINED BY MIDI NOTE PITCH, STAFF POSITION, OR RHYTHMIC DENSITY.

HI-HAT DRUM SET ROLE:
1. ROLE-TO-NOTE ASSIGNMENT RULE:
ASSIGN THIS ROLE TO OFTEN REPEATED CONSECUTIVE NOTES, USUALLY A QUARTER NOTE OR FASTER.

2. ROLE-TO-INSTRUMENT-TYPE ASSIGNMENT RULE:
THIS ROLE MAY BE ASSIGNED TO INSTRUMENT TYPES SUCH RELATED TO HI-HATS.

3. ROLE-TO-INSTRUMENT-PERFORMANCE-LOGIC ASSIGNMENT RULE:
DEPENDING ON DENSITY OF PART, AND PERCEIVED STYLE, THIS ROLE WILL BE ASSIGNED A SPECIFIC PERFORMANCE THAT CAN DETERMINE HOW TO SWITCH ALL THE ARTICULATIONS CONTAINED WITHIN A HI-HAT. (E.G. CLOSED HIT WITH OPEN ON 4 AND)

SNARE DRUM SET ROLE:
1. ROLE-TO-NOTE ASSIGNMENT RULE:
THIS ROLE IS OFTEN ASSIGNED TO NOTES CLOSE TO OR AROUND THE WEAK BEATS.

2. ROLE-TO-INSTRUMENT-TYPE ASSIGNMENT RULE:
THIS ROLE MAY BE ASSIGNED TO BE INSTRUMENT TYPES RELATED TO SNARE (STICK_SNARE, BRUSH_SNARE, SYNTH_SNARE, ETC.).

3. ROLE-TO-INSTRUMENT-PERFORMANCE-LOGIC ASSIGNMENT RULE:
DEPENDING ON DENSITY OF PART, AND PERCEIVED STYLE, THIS ROLE WILL BE ASSIGNED A SPECIFIC PERFORMANCE THAT CAN DETERMINE HOW TO SWITCH ALL THE ARTICULATIONS CONTAINED WITHIN A SNARE DRUM.

CYMBAL DRUM SET ROLE:
1. ROLE-TO-NOTE ASSIGNMENT RULE:
THIS ROLE MAY BE ASSIGNED TO EITHER REPEATED CONSECUTIVE NOTES (RIDE) OR SINGLE NOTES ON DOWNBEATS OF MEASURES OR PHRASES (CRASH).

2. ROLE-TO-INSTRUMENT-TYPE ASSIGNMENT RULE:
THIS ROLE MAY BE ASSIGNED TO BE INSTRUMENT TYPES RELATED TO CYMBAL.

3. ROLE-TO-INSTRUMENT-PERFORMANCE-LOGIC ASSIGNMENT RULE:
DEPENDING ON DENSITY OF PART, AND PERCEIVED STYLE, THE CYMBAL DRUM SET ROLE WILL BE ASSIGNED TO A SPECIFIC PERFORMANCE THAT CAN DETERMINE HOW TO SWITCH ALL THE ARTICULATIONS CONTAINED WITHIN A CYMBAL.

FIG. 28B7

SPECIFICATION MUSICAL ROLE ASSIGNMENT RULES
EMPLOYED IN THE SYSTEM OF THE FIRST ILLUSTRATIVE EMBODIMENT

TOM DRUM SET ROLE:
1. ROLE-TO-NOTE ASSIGNMENT RULE:
THIS ROLE MAY BE ASSIGNED TO CLUSTERS OF NOTES THAT HAPPEN AT THE END OF MEASURES, OR THAT ARE DENSER, BUT THAT ARE LESS CONSISTENT THAN HI-HAT OR CYMBAL(RIDE).

2. ROLE-TO-INSTRUMENT-TYPE ASSIGNMENT RULE:
THIS ROLE MAYBE ASSIGNED TO INSTUMENT TYPES RELATED TO A TOM DRUM SET

3. ROLE-TO-INSTRUMENT-PERFORMANCE-LOGIC ASSIGNMENT RULE:
THIS ROLE WILL BE ASSIGNED TO INSTRUMENT PERFORMANCES BASED ON DENSITY AND POSITION IN MEASURE THAT WILL DETERMINE WHICH TOMS PLAY WHICH PITCHES AND WHEN THE PITCHES SWITCH. (E.G. TOM "LOW PITCH ONLY", TOM "LOW TOM WITH LOW-MID TOM ACCENT")

KICK DRUM SET ROLE:
1. ROLE-TO-NOTE ASSIGNMENT RULE:
THIS ROLE IS ASSIGNED OFTEN TO NOTES CLOSE TO OR AROUND THE STRONG BEATS.

2. ROLE-TO-INSTRUMENT-TYPE ASSIGNMENT RULE:
THE KICK DRUM SET ROLE MAY BE ASSIGNED INSTRUMENT TYPES RELATED TO KICK.

3. ROLE-TO-INSTRUMENT-PERFORMANCE-LOGIC ASSIGNMENT RULE:
THE KICK DRUM SET ROLE MAY BE ASSIGNED TO INSTRUMENT PERFORMANCES RELATED TO KICK.DEPENDING ON DENSITY OF PART, AND PERCEIVED STYLE, THIS ROLE WILL BE ASSIGNED A SPECIFIC PERFORMANCE THAT CAN DETERMINE HOW TO SWITCH ALL THE ARTICULATIONS CONTAINED WITHIN A KICK.

FIG. 28B8

GRAPHICAL REPRESENTATION OF A MUSIC-THEORETIC STATE DESCRIPTOR DATA FILE AUTOMATICALLY PRODUCED FOR AN EXEMPLARY MUSIC COMPOSITION CONTAINING MUSIC COMPOSITION ROLES, NOTE DATA, MUSIC METRICS AND META-DATA

| ROLE | NOTE#'S | TIME UNIT (BEAT #1) | | | |
|---|---|---|---|---|---|
| | | | | | |
| | | | | | |
| | | | | | |
| | | | | | |
| | | | | | |
| | | | | | |
| | | | | | |
| | | | | | |
| | | * * * | | | |
| | | | | | |

METRICS, AND META-DATA

FIG. 29

EXEMPLARY MUSICAL COMPOSITION TO BE DIGITALLY PERFORMED BY A DIGITAL MUSICAL PERFORMANCE PERFORMED USING DEEPLY-SAMPLED VIRTUAL MUSICAL INSTRUMENTS SUPPORTED BY THE AUTOMATED MUSIC PEREORMANCE SYSTEM OF THE PRESENT INVENTION

MIDI PIANO ROLL SCORE REPRESENTATION

A SPECIFICATION OF MUSIC-THEORETIC STATE DESCRIPTORS AND MUSIC METRICS IN EACH MUSIC COMPOSITION TO BE PERFORMED BY DEEPLY-SAMPLED VIRTUAL MUSICAL INSTRUMENTS (DS-VMI) SELECTED FROM THE DEEPLY-SAMPLED VIRTUAL MUSICAL INSTRUMENT (DS-VMI) LIBRARY MANAGEMENT SUBSYSTEM

PRIMARY EVALUATION LEVEL:

. PHYTHMIC DENSITY BY TEMPO
. DURATION OF NOTES
. MIDI NOTE VALUE (A1, B2, ETC.)
. DYNAMICS

STATIC NOTE RELATIONSHIPS:

. POSITION OF NOTES IN A CHORD
. METER AND POSITION OF STRONG AND WEAK BEATS
. POSITION OF NOTES IN A MEASURE
. POSITION OF NOTES IN A PHRASE
. POSITION OF NOTES IN A SECTION
. POSITION OF NOTES IN A REGION

SITUATIONAL RELATIONSHIP:

. MIDI NOTE VALUE PRECEDENCE AND ANTECEDENCE
. POSITION OR EXISTENCE OF NOTES FROM OTHER INSTRUMENT LANES
. RELATION OF SECTIONS TO EACH OTHER
. ACCENTS
. TIMING BASED RHYTHM MODIFIERS

INSTRUMENT SELECTION :

. WHAT INSTRUMENTS ARE SPECIFIED
. WHAT INSTRUMENTS SHOULD OR MIGHT BE PLAYED

FIG. 32

SPECIFICATION ON EXEMPLARY MUSICAL ROLES (I.E. MUSICAL PARTS) OF EACH MUSIC COMPOSITION TO BE AUTOMATICALLY ANALYZED

INSTRUMENTS WITH THEIR ASSOCIATED PERFORMANCES CAN GET THE FOLLOWING ROLES: (NOTE: A SINGLE ROLE IS ASSIGNED TO AN INSTRUMENT, AND MULTIPLE ROLES CANNOT BE ASSIGNED TO A SINGLE INSTRUMENT, BUT MULTIPLE INSTRUMENTS CAN BE ASSIGNED A SINGLE ROLE)

ACCENT - THIS IS THE ROLE THAT PROVIDES INFORMATION ON WHEN LARGE MUSICAL ACCENTS SHOULD BE PLAYED
BACK BEAT - THIS IS THE ROLE THAT PROVIDES NOTE DATA THAT HAPPEN ON THE WEAKER BEATS OF A PIECE
BACKGROUND - LOWER DENSITY ROLE, NOTES THAT OFTEN ARE THE LOWEST ENERGY AND DENSITY THAT LIVES IN THE BACKGROUND OF A COMPOSITION
BIG HIT - NOTES THAT HAPPEN OUTSIDE OF ANY MEASUREMENT, USUALLY A SINGULAR NOTE THAT HAPPENS RARELY
COLOR - THIS IS THE ROLE RESERVED FOR SMALL MUSICAL SEGMENTS THAT PLAY SEMI-REGULAR BUT ADD SMALL MUSICAL PHRASES THROUGHOUT A PIECE
CONSISTENT - THIS IS THE ROLE THAT IS RESERVED FOR PARTS THAT LIVE OUTSIDE OF THE NORMAL STRUCTURE OF PHRASE
CONSTANT - THIS IS THE ROLE THAT IS OFTEN MONOPHONIC AND HAS CONSTANT SET OF NOTES OF THE SAME VALUE (E.G.: ALL 8TH NOTES PLAYED CONSECUTIVELY)
DECORATION - SIMILAR TO COLOR, THIS ROLE IS RESERVED FOR A SMALL FLOURISH OF NOTES THAT HAPPENS LESS REGULARLY THAN COLOR
HIGH LANE - VERY ACTIVE AND HIGH-NOTE DENSITY, USUALLY RESERVED FOR PERCUSSION
HIGH-MID LANE - MOSTLY ACTIVE AND MEDIUM-NOTE DENSITY, USUALLY RESERVED FOR PERCUSSION
LOW LANE - LOW ACTIVE, LOW NOTE-DENSITY INSTRUMENT, USUALLY RESERVED FOR PERCUSSION
LOW-MID LANE - MOSTLY LOW ACTIVITY, MOSTLY LOW NOTE-DENSITY INSTRUMENT, USUALLY RESERVED FOR PERCUSSION
MIDDLE - MIDDLE ACTIVITY, ABOVE THE BACKGROUND ROLE, BUT NOT PRIMARY OR SECONDARY INFORMATION.
ON BEAT - NOTES THAT HAPPEN ON STRONG BEATS
PAD - LONG HELD NOTES THAT PLAY AT EVERY CHORD CHANGE
PEDAL - LONG HELD NOTES, THAT HOLD THE SAME NOTE THROUGHOUT A SECTION
PRIMARY - ROLE THAT IS THE "LEAD" OR MAIN MELODIC PART
SECONDARY - ROLE THAT IS SECONDARY TO THE "LEAD" PART, OFTEN THE COUNTERPOINT TO THE PRIMARY ROLE
---
DRUM SET ROLES: (THIS IS A SINGLE PERFORMER THAT HAS MULTIPLE INSTRUMENTS WHICH ARE ASSIGNED MULTIPLE ROLES THAT ARE AWARE OF EACH OTHER)
HI-HAT - DRUM SET ROLE THAT DOES HI-HAT NOTES
SNARE - DRUM SET ROLE THAT DOES SNARE NOTES
CYMBAL - DRUM SET ROLE OF THAT DOES EITHER A CRASH OR A RIDE
TOM - DRUM SET ROLE THAT DOES THE TOM PARTS
KICK - DRUM SET ROLE THAT DOES KICK NOTES

FIG. 33A

SPECIFICATION MUSICAL ROLE ASSIGNMENT RULES
EMPLOYED IN THE SYSTEM OF THE SECOND ILLUSTRATIVE EMBODIMENT

ACCENT ROLE:
1. ROLE-TO-NOTE ASSIGNMENT RULE:
IF THE DENSITY OF NOTES ARE FAIRLY SPARSE AND FOLLOW ALONG A CONSISTENT STRONG BEAT TO WEAK BEAT PERIODICITY, OR/AND IF SEVERAL INSTRUMENT PARTS HAVE REGULAR PERIODICITY IN STRONG BEAT GROUPINGS, THEN ASSIGN TO THE ACCENT ROLE TO THESE NOTES.

2. ROLE-TO-INSTRUMENT-TYPE ASSIGNMENT RULE:
ASSIGN THE ACCENT ROLE TO INSTRUMENT_TYPES RESERVED FOR ACCENTS, WHICH ARE TYPICALLY PERCUSSIVE, (E.G. ".HIT()" ASPECT VALUE OF: AUX_PERC, BIG_HIT, CYMBAL, ETC.).

3. ROLE-TO-INSTRUMENT-PERFORMANCE-LOGIC ASSIGNMENT RULE:
ASSIGN THE ACCENT ROLE TO INSTRUMENT PERFORMANCE LOGIC OF OTHER ROLES BY THROUGH CHANGE IN VELOCITY OR NOT PLAY/PLAY NOTES IN CURRENT ASSIGNED ROLE (EX: AUGMENTING ROLE).

BACK BEAT ROLE:
1. ROLE-TO-NOTE ASSIGNMENT RULE:
IF NOTES HAVE A PERIODICITY OF PRIMARILY WEAK BEAT AND THAT ARE TONAL, THEN ASSIGN TO THE BACK BEAT ROLE TO THESE NOTES.

2. ROLE-TO-INSTRUMENT-TYPE ASSIGNMENT RULE:
ASSIGN THIS ROLE INSTRUMENT TYPES THAT PROVIDE A MORE RHYTHMIC AN PERCUSSIVE TONAL PERFORMANCE (MONO OR POLYPHONIC)

3. ROLE-TO-INSTRUMENT-PERFORMANCE-LOGIC ASSIGNMENT RULE:
ASSIGN THIS ROLE TO INSTRUMENT PERFORMANCES (I.E. INSTRUMENT PERFORMANCE LOGIC/RULES) SUCH AS, E.G. ACOUSTIC_PIANO WITH "TRIADIC CHORDS CLOSED VOICING", ACOUSTIC_GUITAR WITH "UP-STRUM TOP THREE STRINGS", ETC.

BACKGROUND ROLE:
1. ROLE-TO-NOTE ASSIGNMENT RULE:
IF NOTES HAVE A MEDIUM-LOW DENSITY (PLAYING SLIGHTLY MORE THAN ONCE PER CHORD, POLYTONAL), THEN ASSIGN THEBACKGROUND ROLE TO THESE NOTES.

2. ROLE-TO-INSTRUMENT-TYPE ASSIGNMENT RULE:
ASSIGN THE BACKGROUND ROLE TO INSTRUMENT TYPES THAT CAN SUPPORT POLYPHONIC (NOTE) PERFORMANCES.

3. ROLE-TO-PERFORMANCE-LOGIC ASSIGNMENT RULE:
PLAY POLYPHONIC CHORDS OR PARTS OF CHORDS IN INSTRUMENT TYPES (E.G. KEYBOARD, ACOUSTIC_PIANO, SYNTH_STRINGS, ETC.)

FIG. 33B1

SPECIFICATION MUSICAL ROLE ASSIGNMENT RULES
EMPLOYED IN THE SYSTEM OF THE SECOND ILLUSTRATIVE EMBODIMENT

BIG HIT ROLE:
1. ROLE-TO-NOTE ASSIGNMENT RULE:
IF NOTES HAPPEN WITH EXTREME IRREGULARITY AND ARE VERY SPARSE, AND/OR EITHER FALL WITH A NOTE IN THE ACCENT LANE OR OUTSIDE OF ANY TIME SIGNATURE, THEN ASSIGN THE BIG HIT ROLE TO THESE NOTES.

2. ROLE-TO-INSTRUMENT-TYPE ASSIGNMENT RULE:
ASSIGN THIS ROLE INSTRUMENT TYPE PRIMARILY TO SINGLE HIT, NON-TONAL, PERCUSSIVE INSTRUMENTS

3. ROLE-TO-INSTRUMENT-PERFORMANCE-LOGIC ASSIGNMENT RULE:
PERFORMANCE LOGIC IS PLAY A "HIT()" IN THE ASSIGNED INSTRUMENT TYPE (E.G. BIG_HIT, BASS_DRUM, ETC.)

COLOR ROLE:
1. ROLE-TO-NOTE ASSIGNMENT RULE:
IF NOTES HAPPEN IN SMALL CLUSTERS, WITH RESTS BETWEEN EACH SET OF CLUSTERS, AND HAVE SOME REGULAR PERIODICITY LESS THAN ONCE PER PHRASE, THEN ASSIGN THE COLOR ROLE TO THESE NOTES.

2. ROLE-TO-INSTRUMENT-TYPE ASSIGNMENT RULE:
ASSIGN THE COLOR ROLE TO INSTRUMENT TYPES THAT ARE EITHER PERCUSSIVE (IF NOTES ARE UNPITCHED) OR TONAL (IF NOTES FOLLOW PITCHES WITHIN THE KEY) AND CAN BE ASSIGNED TO TYPICALLY MONOPHONIC OR INSTRUMENTS WITH HARMONIC/RHYTHMIC TAGS (E.G. INSTRUMENTS WITH DELAY TAG, TICKIES, SYNTH_LEAD, ETC.)

3. ROLE-TO-INSTRUMENT-PERFORMANCE-LOGIC ASSIGNMENT RULE:
MAY ASSIGN PERFORMANCES THAT ARE SOFTER IN VELOCITY OR LIGHTER IN ARTICULATION ATTACK.

CONSISTENT ROLE:
1. ROLE-TO-NOTE ASSIGNMENT RULE:
IF NOTES ARE RELATIVELY DENSE, HAVE SOME PERIODICITY, AND CHANGE IN EITHER NOTE PATTERN ORGANIZATION, RHYTHMIC PATTERN ORGANIZATION MORE THAN ONCE PER A FEW BARS, THEN ASSIGN THE CONSISTENT ROLE TO THESE NOTES.

2. ROLE-TO-INSTRUMENT-TYPE ASSIGNMENT RULE:
ASSIGN THE COLOR ROLE TO INSTRUMENT TYPES THAT HAVE TYPICALLY MONOPHONIC PERFORMANCES (E.G. SYNTH_LEAD, GUITAR_LEAD).

3. ROLE-TO-INSTRUMENT-PERFORMANCE-LOGIC ASSIGNMENT RULE:
MAY ASSIGN PERFORMANCES THAT UTILIZE VARIOUS ARPEGGIATION PATTERNS (EG: LINE UP/DOWN, SAWTOOTH, ETC.)

FIG. 33B2

SPECIFICATION MUSICAL ROLE ASSIGNMENT RULES
EMPLOYED IN THE SYSTEM OF THE SECOND ILLUSTRATIVE EMBODIMENT

CONSTANT ROLE:
1. ROLE-TO-NOTE ASSIGNMENT RULE:
IF NOTES THAT ARE RELATIVELY DENSE, AND HAVE VERY STATIC RHYTHMIC INFORMATION WITH PERIODICITY, THEN ASSIGN THE CONSTANT ROLE TO THESE NOTES.

2. ROLE-TO-INSTRUMENT-TYPE ASSIGNMENT RULE:
ASSIGN THE CONSTANT ROLE TO EITHER TONAL (MONOPHONIC) OR PERCUSSIVE INSTRUMENT TYPES.

3. ROLE-TO-INSTRUMENT-PERFORMANCE-LOGIC ASSIGNMENT RULE:
ASSIGN THE CONSTANT ROLE TO INSTRUMENT PERFORMANCES THAT ARE TEMPO DEPENDENT (E.G. SHAKER WITH "FRONT()" ONLY, SYNTH_LEAD WITH "ARPEGGIATION UP", ETC.).)

DECORATION ROLE:
1. ROLE-TO-NOTE ASSIGNMENT RULE:
IF NOTES HAPPEN IN SMALL CLUSTERS, WITH RESTS BETWEEN EACH SET OF CLUSTERS, AND OCCUR ONE PER PHRASE OR LONGER, THEN ASSIGN THE DECORATION ROLE TO THESE NOTES.

2. ROLE-TO-INSTRUMENT-TYPE ASSIGNMENT RULE:
ASSIGN THE DECORATION ROLE TO INSTRUMENT TYPES THAT ARE EITHER PERCUSSIVE (IF NOTES ARE UNPITCHED) OR TONAL (IF NOTES FOLLOW PITCHES WITHIN THE KEY) AND CAN BE ASSIGNED TO TYPICALLY MONOPHONIC OR INSTRUMENTS WITH HARMONIC/RHYTHMIC TAGS (E.G. INSTRUMENTS WITH DELAY TAG, TICKIES, SYNTH_LEAD, ETC.)

3. ROLE-TO-INSTRUMENT-PERFORMANCE-LOGIC ASSIGNMENT RULE:
MAY ASSIGN PERFORMANCES THAT ARE SOFTER IN VELOCITY OR LIGHTER IN ARTICULATION ATTACK.

HIGH LANE ROLE:
1. ROLE-TO-NOTE ASSIGNMENT RULE:
IF NOTES THAT ARE UNPITCHED THAT HAPPEN IN USUALLY RAPID SUCCESSION OR HIGH DENSITY, THEN ASSIGN THE HIGH LANE ROLE TO THESE NOTES.

2. ROLE-TO-INSTRUMENT-TYPE ASSIGNMENT RULE:
UNLESS OTHERWISE DIRECTED BY AN EXTERNAL INPUT, USUALLY ASSIGN THE HIGH LANE ROLE TO HIGH-PITCHED IN TIMBRE PERCUSSION INSTRUMENTS (E.G. TICKIES, SHAKERS, AUX_DRUM ("RIM"), ETC.)

3. ROLE-TO-INSTRUMENT-PERFORMANCE-LOGIC ASSIGNMENT RULE:
CHOOSE PERFORMANCES THAT ACTIVATE ARTICULATIONS THAT ARE TAGGED WITH "HIGH" AND/OR "SHORT"

FIG. 33B3

SPECIFICATION MUSICAL ROLE ASSIGNMENT RULES
EMPLOYED IN THE SYSTEM OF THE SECOND ILLUSTRATIVE EMBODIMENT

HIGH-MID LANE ROLE:
1. ROLE-TO-NOTE ASSIGNMENT RULE:
IF NOTES THAT ARE UNPITCHED THAT HAPPEN IN MEDIUM-HIGH DENSITY, THEN ASSIGN THE HIGH-MID LANE ROLE TO THESE NOTES.

2. ROLE-TO-INSTRUMENT-TYPE ASSIGNMENT RULE:
UNLESS OTHERWISE DIRECTED BY AN EXTERNAL INPUT, USUALLY ASSIGN THIS ROLE TO HIGH-PITCHED OR MEDIUM IN TIMBRE PERCUSSION INSTRUMENTS (E.G. TICKIES, AUX_DRUM, HAND_DRUM, ETC.)

3. ROLE-TO-INSTRUMENT-PERFORMANCE-LOGIC ASSIGNMENT RULE:
CHOOSE PERFORMANCES THAT ACTIVATE ARTICULATIONS THAT ARE TAGGED WITH "MIDDLE" AND/OR "SHORT/MEDIUM"

LOW-MID LANE ROLE:
1. ROLE-TO-NOTE ASSIGNMENT RULE:
IF NOTES THAT ARE UNPITCHED THAT HAPPEN IN MEDIUM-LOW DENSITY, THEN ASSIGN THE LOW-MID LANE ROLE TO THESE NOTES.

2. ROLE-TO-INSTRUMENT-TYPE ASSIGNMENT RULE:
UNLESS OTHERWISE DIRECTED BY AN EXTERNAL INPUT, USUALLY ASSIGN THIS ROLE TO MEDIUM TO MEDIUM-LOW IN TIMBRE PERCUSSION INSTRUMENTS (E.G. AUX_DRUM, HAND_DRUM, TAIKO, ETC.)

3. ROLE-TO-INSTRUMENT-PERFORMANCE-LOGIC ASSIGNMENT RULE:
CHOOSE PERFORMANCES THAT ACTIVATE ARTICULATIONS THAT ARE TAGGED WITH "MIDDLE," "LOW," AND/OR "MEDIUM/LONG"

LOW LANE ROLE:
1. ROLE-TO-NOTE ASSIGNMENT RULE:
ASSIGN THE LOW LANE ROLE TO NOTES THAT ARE UNPITCHED THAT HAPPEN IN LOW DENSITY.

2. ROLE-TO-INSTRUMENT-TYPE ASSIGNMENT RULE:
UNLESS OTHERWISE DIRECTED BY AN EXTERNAL INPUT, ASSIGN THIS ROLE USUALLY TO INSTRUMENT TYPES THAT ARE LOW IN TIMBRE PERCUSSION (E.G. BASS_DRUM, SURDO, TAIKO, ETC.)

3. ROLE-TO-INSTRUMENT-PERFORMANCE-LOGIC ASSIGNMENT RULE:
CHOOSE PERFORMANCES THAT ACTIVATE ARTICULATIONS THAT ARE TAGGED WITH "LOW," AND/OR "LONG"

FIG. 33B4

SPECIFICATION MUSICAL ROLE ASSIGNMENT RULES
EMPLOYED IN THE SYSTEM OF THE SECOND ILLUSTRATIVE EMBODIMENT

MIDDLE ROLE:
1. ROLE-TO-NOTE ASSIGNMENT RULE:
IF NOTES HAVE A MEDIUM DENSITY (PLAYING MORE THAN ONCE PER CHORD, POLYTONAL, WITH OCCASIONAL RUNNING LINES), THEN ASSIGN THE MIDDLE ROLE TO THESE NOTES.

2. ROLE-TO-INSTRUMENT-TYPE ASSIGNMENT RULE:
TYPICALLY ASSIGN THIS ROLE TO INSTRUMENT TYPES THAT CAN SUPPORT POLYPHONIC PLAYBACK AND PERFORMANCE. (E.G. KEYBOARD, ACOUSTIC_PIANO, SYNTH_STRINGS, VIOLINS, ETC.).

3. ROLE-TO-INSTRUMENT- PERFORMANCE-LOGIC ASSIGNMENT RULE:
TYPICALLY ASSIGN THIS ROLE TO INSTRUMENT PERFORMANCES SUPPORT POLYPHONIC PERFORMANCE. (E.G. KEYBOARD, ACOUSTIC_PIANO, SYNTH_STRINGS, VIOLINS, ETC.).

ON BEAT ROLE:
1. ROLE-TO-NOTE ASSIGNMENT RULE:
IF NOTES HAVE A PERIODICITY OF PRIMARILY STRONG BEAT AND THAT ARE TONAL, THEN ASSIGN THE ON BEAT ROLE TO THESE NOTES.

2. ROLE-TO-INSTRUMENT-TYPE ASSIGNMENT RULE:
ASSIGN THIS ROLE TO INSTRUMENT TYPES THAT PRODUCE MORE RHYTHMIC AND PERCUSSIVE TONAL PERFORMANCES (MONO OR POLYPHONIC)

3. ROLE-TO-INSTRUMENT-PERFORMANCE-LOGIC ASSIGNMENT RULE:
ASSIGN THIS ROLE TO INSTRUMENT PERFORMANCES THAT HAVE "STRONG" PERFORMANCE TAG ASSOCIATION (EG: ACOUSTIC_BASS "ROOTS WITH 5THS", ACOUSTIC_GUITAR WITH "DOWN-STRUM POWER CHORD", ETC.)

PAD ROLE:
1. ROLE-TO-NOTE ASSIGNMENT RULE:
IF NOTES ARE SUSTAINED THROUGH THE DURATION OF A CHORD, THEN ASSIGN THE PAD ROLE TO THESE NOTES.

2. ROLE-TO-INSTRUMENT-TYPE ASSIGNMENT RULE:
TYPICALLY ASSIGN THIS ROLE TO POLYPHONIC INSTRUMENT TYPES THAT SUSTAIN NOTES (E.G. MID_PAD, SYNTH_STRING, SYNTH_BASS)

3. ROLE-TO-INSTRUMENT-PERFORMANCE-LOGIC ASSIGNMENT RULE:
TYPICALLY ASSIGN THIS ROLE TO INSTRUMENT PERFORMANCES INVOLVING POLYPHONIC PERFORMANCES THAT SUSTAIN NOTES DURING A CHORD, AND CHANGE NOTES ON CHORD CHANGE (E.G. MID_PAD, SYNTH_STRING, SYNTH_BASS)

FIG. 33B5

SPECIFICATION MUSICAL ROLE ASSIGNMENT RULES
EMPLOYED IN THE SYSTEM OF THE SECOND ILLUSTRATIVE EMBODIMENT

PEDAL ROLE:
1. ROLE-TO-NOTE ASSIGNMENT RULE:
IF NOTES SUSTAIN THROUGH CHORDS AND STAY ON ONE PITCH (OFTEN THE ROOT) OF AN ENTIRE PHRASE, THEN ASSIGN THE PEDAL ROLE TO THESE NOTES.

2. ROLE-TO-INSTRUMENT-TYPE ASSIGNMENT RULE:
ASSIGN THIS ROLE TYPICALLY TO MONOPHONIC INSTRUMENT TYPES SUCH AS, E.G. LOW_PAD, SYNTH_BASS, PULSE, ETC.

3. ROLE-TO-INSTRUMENT-PERFORMANCE-LOGIC ASSIGNMENT RULE:
ASSIGN THIS ROLE TYPICALLY TO INSTRUMENT PERFORMANCES SUPPORTING MONOPHONIC PERFORMANCES THAT EITHER SUSTAIN INDEFINITELY, OR CAN QUICKLY REATTACK CONSECUTIVELY TO CREATE A PULSE-LIKE PEDAL TONE (E.G. LOW_PAD, SYNTH_BASS, PULSE, ETC.)

PRIMARY ROLE:
1. ROLE-TO-NOTE ASSIGNMENT RULE:
IF NOTES ARE MOSTLY MONOPHONIC, PLAYED WITH MORE DENSITY, RHYTHMIC STRUCTURE VARIANCES, OFTEN WITH SOME REPETITION AND PERIODICITY, AND ARE ACCOMPANIED WITH EITHER GREAT DYNAMIC MARKINGS, HIGH VELOCITIES, AND/OR OTHER INDICATIONS DEPENDING ON THE MEDIUM READ, THEN ASSIGN THE PRIMARY ROLE TO THESE NOTES.

2. ROLE-TO-INSTRUMENT-TYPE ASSIGNMENT RULE:
ASSIGN THIS ROLE TYPICALLY TO INSTRUMENT TYPES OFTEN USED TO PERFORM AS LEAD INSTRUMENTS (E.G. VIOLIN, LEAD_SYNTH, LEAD_GUITAR, ETC.)

3. ROLE-TO-INSTRUMENT-PERFORMANCE-LOGIC ASSIGNMENT RULE: MAY CHOOSE LIMITED POLYPHONIC OR MONOPHONIC PERFORMANCE, THAT MAY UTILIZES A GREAT AMOUNT OF ARTICULATION CONTROL AND SWITCHING.

SECONDARY ROLE:
1. ROLE-TO-NOTE ASSIGNMENT RULE:
IF NOTES ARE MOSTLY MONOPHONIC, PLAY WITH MORE DENSITY, RHYTHMIC STRUCTURE VARIANCES, OFTEN WITH SOME REPETITION AND PERIODICITY, AND ARE ACCOMPANIED WITH EITHER GREAT DYNAMIC MARKINGS, HIGH VELOCITIES, ARE EITHER LOWER IN PITCH OR PLAY LESS DENSE THEN ANOTHER PART, AND/OR OTHER INDICATIONS DEPENDING ON THE MEDIUM READ, THEN ASSIGN THE SECONDARY ROLE TO THESE NOTES.

2. ROLE-TO-INSTRUMENT-TYPE ASSIGNMENT RULE:
ASSIGN THIS ROLE TO INSTRUMENT TYPES THAT OFTEN PERFORM AS LEAD INSTRUMENTS (E.G. VIOLIN, LEAD_SYNTH, LEAD_GUITAR, ETC.)

3. ROLE-TO-INSTRUMENT-PERFORMANCE-LOGIC ASSIGNMENT RULE:
MAY CHOOSE LIMITED POLYPHONIC OR MONOPHONIC PERFORMANCE, THAT MAY UTILIZES A GREAT AMOUNT OF ARTICULATION CONTROL AND SWITCHING.

FIG. 33B6

SPECIFICATION MUSICAL ROLE ASSIGNMENT RULES
EMPLOYED IN THE SYSTEM OF THE SECOND ILLUSTRATIVE EMBODIMENT

DRUM SET ROLES:
THESE ARE THE ROLES LISTED BELOW THAT ARE GIVEN SPECIFIC RHYTHMIC PARTS (NON-TONAL) THAT SHOULD BE ASSIGNED TO ONE ROLE-PERFORMER, BUT HAVE TO BE BROKEN OUT BECAUSE THE INSTRUMENTS USED ARE NATURALLY SEPARATED. NOTES WILL NEED TO BE PARSED INTO DIFFERENT ROLES, AND OFTEN CAN BE DETERMINED BY MIDI NOTE PITCH, STAFF POSITION, OR RHYTHMIC DENSITY.

HI-HAT DRUM SET ROLE:
1. ROLE-TO-NOTE ASSIGNMENT RULE:
ASSIGN THIS ROLE TO OFTEN REPEATED CONSECUTIVE NOTES, USUALLY A QUARTER NOTE OR FASTER.

2. ROLE-TO-INSTRUMENT-TYPE ASSIGNMENT RULE:
THIS ROLE MAY BE ASSIGNED TO INSTRUMENT TYPES SUCH RELATED TO HI-HATS.

3. ROLE-TO-INSTRUMENT-PERFORMANCE-LOGIC ASSIGNMENT RULE:
DEPENDING ON DENSITY OF PART, AND PERCEIVED STYLE, THIS ROLE WILL BE ASSIGNED A SPECIFIC PERFORMANCE THAT CAN DETERMINE HOW TO SWITCH ALL THE ARTICULATIONS CONTAINED WITHIN A HI-HAT. (E.G. CLOSED HIT WITH OPEN ON 4 AND)

SNARE DRUM SET ROLE:
1. ROLE-TO-NOTE ASSIGNMENT RULE:
THIS ROLE IS OFTEN ASSIGNED TO NOTES CLOSE TO OR AROUND THE WEAK BEATS.

2. ROLE-TO-INSTRUMENT-TYPE ASSIGNMENT RULE:
THIS ROLE MAY BE ASSIGNED TO BE INSTRUMENT TYPES RELATED TO SNARE (STICK_SNARE, BRUSH_SNARE, SYNTH_SNARE, ETC.).

3. ROLE-TO-INSTRUMENT-PERFORMANCE-LOGIC ASSIGNMENT RULE:
DEPENDING ON DENSITY OF PART, AND PERCEIVED STYLE, THIS ROLE WILL BE ASSIGNED A SPECIFIC PERFORMANCE THAT CAN DETERMINE HOW TO SWITCH ALL THE ARTICULATIONS CONTAINED WITHIN A SNARE DRUM.

CYMBAL DRUM SET ROLE:
1. ROLE-TO-NOTE ASSIGNMENT RULE:
THIS ROLE MAY BE ASSIGNED TO EITHER REPEATED CONSECUTIVE NOTES (RIDE) OR SINGLE NOTES ON DOWNBEATS OF MEASURES OR PHRASES (CRASH).

2. ROLE-TO-INSTRUMENT-TYPE ASSIGNMENT RULE:
THIS ROLE MAY BE ASSIGNED TO BE INSTRUMENT TYPES RELATED TO CYMBAL.

3. ROLE-TO-INSTRUMENT-PERFORMANCE-LOGIC ASSIGNMENT RULE:
DEPENDING ON DENSITY OF PART, AND PERCEIVED STYLE, THE CYMBAL DRUM SET ROLE WILL BE ASSIGNED TO A SPECIFIC PERFORMANCE THAT CAN DETERMINE HOW TO SWITCH ALL THE ARTICULATIONS CONTAINED WITHIN A CYMBAL.

FIG. 33B7

SPECIFICATION MUSICAL ROLE ASSIGNMENT RULES
EMPLOYED IN THE SYSTEM OF THE SECOND ILLUSTRATIVE EMBODIMENT

TOM DRUM SET ROLE:
1. ROLE-TO-NOTE ASSIGNMENT RULE:
THIS ROLE MAY BE ASSIGNED TO CLUSTERS OF NOTES THAT HAPPEN AT THE END OF MEASURES, OR THAT ARE DENSER, BUT THAT ARE LESS CONSISTENT THAN HI-HAT OR CYMBAL(RIDE).

2. ROLE-TO-INSTRUMENT-TYPE ASSIGNMENT RULE:
THIS ROLE MAY BE ASSIGNED TO INSTRUMENT TYPES RELATED TO A TOM DRUM SET

3. ROLE-TO-INSTRUMENT-PERFORMANCE-LOGIC ASSIGNMENT RULE:
THIS ROLE WILL BE ASSIGNED TO INSTRUMENT PERFORMANCES BASED ON DENSITY AND POSITION IN MEASURE THAT WILL DETERMINE WHICH TOMS PLAY WHICH PITCHES AND WHEN THE PITCHES SWITCH. (E.G. TOM "LOW PITCH ONLY", TOM "LOW TOM WITH LOW-MID TOM ACCENT")

KICK DRUM SET ROLE:
1. ROLE-TO-NOTE ASSIGNMENT RULE:
THIS ROLE IS ASSIGNED OFTEN TO NOTES CLOSE TO OR AROUND THE STRONG BEATS.

2. ROLE-TO-INSTRUMENT-TYPE ASSIGNMENT RULE:
THE KICK DRUM SET ROLE MAY BE ASSIGNED INSTRUMENT TYPES RELATED TO KICK.

3. ROLE-TO-INSTRUMENT-PERFORMANCE-LOGIC ASSIGNMENT RULE:
THE KICK DRUM SET ROLE MAY BE ASSIGNED TO INSTRUMENT PERFORMANCES RELATED TO KICK. DEPENDING ON DENSITY OF PART, AND PERCEIVED STYLE, THIS ROLE WILL BE ASSIGNED A SPECIFIC PERFORMANCE THAT CAN DETERMINE HOW TO SWITCH ALL THE ARTICULATIONS CONTAINED WITHIN A KICK.

FIG. 33B8

GRAPHICAL REPRESENTATION OF A MUSIC-THEORETIC STATE DESCRIPTOR DATA FILE AUTOMATICALLY PRODUCED FOR AN EXEMPLARY MUSIC COMPOSITION CONTAINING MUSIC COMPOSITION NOTE DATA, ROLES, METRICS AND META-DATA

| ROLE | NOTE#'S | TIME UNIT (BEAT #1) | | | |
|---|---|---|---|---|---|
| | | | | | |
| | | | | | |
| | | | | | |
| | | | | | |
| | | | | | |
| | | | | | |
| | | | | | |
| | | | | | |
| | | * * * | | | |
| | | | | | |

METRICS, AND META-DATA

FIG. 34

A SPECIFICATION OF MUSIC-THEORETIC STATE DESCRIPTORS AND MUSIC METRICS IN EACH MUSIC COMPOSITION TO BE PERFORMED BY DEEPLY-SAMPLED VIRTUAL MUSICAL INSTRUMENTS (DS-VMI) SELECTED FROM THE DEEPLY-SAMPLED VIRTUAL MUSICAL INSTRUMENT (DS-VMI) LIBRARY MANAGEMENT SUBSYSTEM

PRIMARY EVALUATION LEVEL:

. PHYTHMIC DENSITY BY TEMPO
. DURATION OF NOTES
. MIDI NOTE VALUE (A1, B2, ETC.)
. DYNAMICS

STATIC NOTE RELATIONSHIPS:

. POSITION OF NOTES IN A CHORD
. METER AND POSITION OF STRONG AND WEAK BEATS
. POSITION OF NOTES IN A MEASURE
. POSITION OF NOTES IN A PHRASE
. POSITION OF NOTES IN A SECTION
. POSITION OF NOTES IN A REGION

SITUATIONAL RELATIONSHIP:

. MIDI NOTE VALUE PRECEDENCE AND ANTECEDENCE
. POSITION OR EXISTENCE OF NOTES FROM OTHER INSTRUMENT LANES
. RELATION OF SECTIONS TO EACH OTHER
. ACCENTS
. TIMING BASED RHYTHM MODIFIERS

INSTRUMENT SELECTION :

. WHAT INSTRUMENTS ARE SPECIFIED
. WHAT INSTRUMENTS SHOULD OR MIGHT BE PLAYED

FIG. 37

SPECIFICATION ON EXEMPLARY MUSICAL ROLES (I.E. MUSICAL PARTS) OF EACH MUSIC COMPOSITION TO BE AUTOMATICALLY ANALYZED

INSTRUMENTS WITH THEIR ASSOCIATED PERFORMANCES CAN GET THE FOLLOWING ROLES: (NOTE: A SINGLE ROLE IS ASSIGNED TO AN INSTRUMENT, AND MULTIPLE ROLES CANNOT BE ASSIGNED TO A SINGLE INSTRUMENT, BUT MULTIPLE INSTRUMENTS CAN BE ASSIGNED A SINGLE ROLE)

ACCENT - THIS IS THE ROLE THAT PROVIDES INFORMATION ON WHEN LARGE MUSICAL ACCENTS SHOULD BE PLAYED
BACK BEAT - THIS IS THE ROLE THAT PROVIDES NOTE DATA THAT HAPPEN ON THE WEAKER BEATS OF A PIECE
BACKGROUND - LOWER DENSITY ROLE, NOTES THAT OFTEN ARE THE LOWEST ENERGY AND DENSITY THAT LIVES IN THE BACKGROUND OF A COMPOSITION
BIG HIT - NOTES THAT HAPPEN OUTSIDE OF ANY MEASUREMENT, USUALLY A SINGULAR NOTE THAT HAPPENS RARELY
COLOR - THIS IS THE ROLE RESERVED FOR SMALL MUSICAL SEGMENTS THAT PLAY SEMI-REGULAR BUT ADD SMALL MUSICAL PHRASES THROUGHOUT A PIECE
CONSISTENT - THIS IS THE ROLE THAT IS RESERVED FOR PARTS THAT LIVE OUTSIDE OF THE NORMAL STRUCTURE OF PHRASE
CONSTANT - THIS IS THE ROLE THAT IS OFTEN MONOPHONIC AND HAS CONSTANT SET OF NOTES OF THE SAME VALUE (E.G.: ALL 8TH NOTES PLAYED CONSECUTIVELY)
DECORATION - SIMILAR TO COLOR, THIS ROLE IS RESERVED FOR A SMALL FLOURISH OF NOTES THAT HAPPENS LESS REGULARLY THAN COLOR
HIGH LANE - VERY ACTIVE AND HIGH-NOTE DENSITY, USUALLY RESERVED FOR PERCUSSION
HIGH-MID LANE - MOSTLY ACTIVE AND MEDIUM-NOTE DENSITY, USUALLY RESERVED FOR PERCUSSION
LOW LANE - LOW ACTIVE, LOW NOTE-DENSITY INSTRUMENT, USUALLY RESERVED FOR PERCUSSION
LOW-MID LANE - MOSTLY LOW ACTIVITY, MOSTLY LOW NOTE-DENSITY INSTRUMENT, USUALLY RESERVED FOR PERCUSSION
MIDDLE - MIDDLE ACTIVITY, ABOVE THE BACKGROUND ROLE, BUT NOT PRIMARY OR SECONDARY INFORMATION.
ON BEAT - NOTES THAT HAPPEN ON STRONG BEATS
PAD - LONG HELD NOTES THAT PLAY AT EVERY CHORD CHANGE
PEDAL - LONG HELD NOTES, THAT HOLD THE SAME NOTE THROUGHOUT A SECTION
PRIMARY - ROLE THAT IS THE "LEAD" OR MAIN MELODIC PART
SECONDARY - ROLE THAT IS SECONDARY TO THE "LEAD" PART, OFTEN THE COUNTERPOINT TO THE PRIMARY ROLE
---
DRUM SET ROLES: (THIS IS A SINGLE PERFORMER THAT HAS MULTIPLE INSTRUMENTS WHICH ARE ASSIGNED MULTIPLE ROLES THAT ARE AWARE OF EACH OTHER)
HI-HAT - DRUM SET ROLE THAT DOES HI-HAT NOTES
SNARE - DRUM SET ROLE THAT DOES SNARE NOTES
CYMBAL - DRUM SET ROLE OF THAT DOES EITHER A CRASH OR A RIDE
TOM - DRUM SET ROLE THAT DOES THE TOM PARTS
KICK - DRUM SET ROLE THAT DOES KICK NOTES

FIG. 38A

SPECIFICATION MUSICAL ROLE ASSIGNMENT RULES
EMPLOYED IN THE SYSTEM OF THE THIRD ILLUSTRATIVE EMBODIMENT

ACCENT ROLE:
1. ROLE-TO-NOTE ASSIGNMENT RULE:
IF THE DENSITY OF NOTES ARE FAIRLY SPARSE AND FOLLOW ALONG A CONSISTENT STRONG BEAT TO WEAK BEAT PERIODICITY, OR/AND IF SEVERAL INSTRUMENT PARTS HAVE REGULAR PERIODICITY IN STRONG BEAT GROUPINGS, THEN ASSIGN TO THE ACCENT ROLE TO THESE NOTES.

2. ROLE-TO-INSTRUMENT-TYPE ASSIGNMENT RULE:
ASSIGN THE ACCENT ROLE TO INSTRUMENT_TYPES RESERVED FOR ACCENTS, WHICH ARE TYPICALLY PERCUSSIVE, (E.G. ".HIT()" ASPECT VALUE OF: AUX_PERC, BIG_HIT, CYMBAL, ETC.).

3. ROLE-TO-INSTRUMENT-PERFORMANCE-LOGIC ASSIGNMENT RULE:
ASSIGN THE ACCENT ROLE TO INSTRUMENT PERFORMANCE LOGIC OF OTHER ROLES BY THROUGH CHANGE IN VELOCITY OR NOT PLAY/PLAY NOTES IN CURRENT ASSIGNED ROLE (EX: AUGMENTING ROLE).

BACK BEAT ROLE:
1. ROLE-TO-NOTE ASSIGNMENT RULE:
IF NOTES HAVE A PERIODICITY OF PRIMARILY WEAK BEAT AND THAT ARE TONAL, THEN ASSIGN TO THE BACK BEAT ROLE TO THESE NOTES.

2. ROLE-TO-INSTRUMENT-TYPE ASSIGNMENT RULE:
ASSIGN THIS ROLE INSTRUMENT TYPES THAT PROVIDE A MORE RHYTHMIC AND PERCUSSIVE TONAL PERFORMANCE (MONO OR POLYPHONIC)

3. ROLE-TO-INSTRUMENT-PERFORMANCE-LOGIC ASSIGNMENT RULE:
ASSIGN THIS ROLE TO INSTRUMENT PERFORMANCES (I.E. INSTRUMENT PERFORMANCE LOGIC/RULES) SUCH AS, E.G. ACOUSTIC_PIANO WITH "TRIADIC CHORDS CLOSED VOICING", ACOUSTIC_GUITAR WITH "UP-STRUM TOP THREE STRINGS", ETC.

BACKGROUND ROLE:
1. ROLE-TO-NOTE ASSIGNMENT RULE:
IF NOTES HAVE A MEDIUM-LOW DENSITY (PLAYING SLIGHTLY MORE THAN ONCE PER CHORD, POLYTONAL), THEN ASSIGN THE BACKGROUND ROLE TO THESE NOTES.

2. ROLE-TO-INSTRUMENT-TYPE ASSIGNMENT RULE:
ASSIGN THE BACKGROUND ROLE TO INSTRUMENT TYPES THAT CAN SUPPORT POLYPHONIC (NOTE) PERFORMANCES.

3. ROLE-TO-PERFORMANCE-LOGIC ASSIGNMENT RULE:
PLAY POLYPHONIC CHORDS OR PARTS OF CHORDS IN INSTRUMENT TYPES (E.G. KEYBOARD, ACOUSTIC_PIANO, SYNTH_STRINGS, ETC.)

FIG. 38B1

SPECIFICATION MUSICAL ROLE ASSIGNMENT RULES
EMPLOYED IN THE SYSTEM OF THE THIRD ILLUSTRATIVE EMBODIMENT

BIG HIT ROLE:
1. ROLE-TO-NOTE ASSIGNMENT RULE:
IF NOTES HAPPEN WITH EXTREME IRREGULARITY AND ARE VERY SPARSE, AND/OR EITHER FALL WITH A NOTE IN THE ACCENT LANE OR OUTSIDE OF ANY TIME SIGNATURE, THEN ASSIGN THE BIG HIT ROLE TO THESE NOTES.

2. ROLE-TO-INSTRUMENT-TYPE ASSIGNMENT RULE:
ASSIGN THIS ROLE INSTRUMENT TYPE PRIMARILY TO SINGLE HIT, NON-TONAL, PERCUSSIVE INSTRUMENTS

3. ROLE-TO-INSTRUMENT-PERFORMANCE-LOGIC ASSIGNMENT RULE:
PERFORMANCE LOGIC IS PLAY A "HIT()" IN THE ASSIGNED INSTRUMENT TYPE (E.G. BIG_HIT, BASS_DRUM, ETC.)

COLOR ROLE:
1. ROLE-TO-NOTE ASSIGNMENT RULE:
IF NOTES HAPPEN IN SMALL CLUSTERS, WITH RESTS BETWEEN EACH SET OF CLUSTERS, AND HAVE SOME REGULAR PERIODICITY LESS THAN ONCE PER PHRASE, THEN ASSIGN THE COLOR ROLE TO THESE NOTES.

2. ROLE-TO-INSTRUMENT-TYPE ASSIGNMENT RULE:
ASSIGN THE COLOR ROLE TO INSTRUMENT TYPES THAT ARE EITHER PERCUSSIVE (IF NOTES ARE UNPITCHED) OR TONAL (IF NOTES FOLLOW PITCHES WITHIN THE KEY) AND CAN BE ASSIGNED TO TYPICALLY MONOPHONIC OR INSTRUMENTS WITH HARMONIC/RHYTHMIC TAGS (E.G. INSTRUMENTS WITH DELAY TAG, TICKIES, SYNTH_LEAD, ETC.)

3. ROLE-TO-INSTRUMENT-PERFORMANCE-LOGIC ASSIGNMENT RULE:
MAY ASSIGN PERFORMANCES THAT ARE SOFTER IN VELOCITY OR LIGHTER IN ARTICULATION ATTACK.

CONSISTENT ROLE:
1. ROLE-TO-NOTE ASSIGNMENT RULE:
IF NOTES ARE RELATIVELY DENSE, HAVE SOME PERIODICITY, AND CHANGE IN EITHER NOTE PATTERN ORGANIZATION, RHYTHMIC PATTERN ORGANIZATION MORE THAN ONCE PER A FEW BARS, THEN ASSIGN THE CONSISTENT ROLE TO THESE NOTES.

2. ROLE-TO-INSTRUMENT-TYPE ASSIGNMENT RULE:
ASSIGN THE COLOR ROLE TO INSTRUMENT TYPES THAT HAVE TYPICALLY MONOPHONIC PERFORMANCES (E.G. SYNTH_LEAD, GUITAR_LEAD).

3. ROLE-TO-INSTRUMENT-PERFORMANCE-LOGIC ASSIGNMENT RULE:
MAY ASSIGN PERFORMANCES THAT UTILIZE VARIOUS ARPEGGIATION PATTERNS (EG: LINE UP/DOWN, SAWTOOTH, ETC.)

FIG. 38B2

SPECIFICATION MUSICAL ROLE ASSIGNMENT RULES
EMPLOYED IN THE SYSTEM OF THE THIRD ILLUSTRATIVE EMBODIMENT

CONSTANT ROLE:
1. ROLE-TO-NOTE ASSIGNMENT RULE:
IF NOTES THAT ARE RELATIVELY DENSE, AND HAVE VERY STATIC RHYTHMIC INFORMATION WITH PERIODICITY, THEN ASSIGN THE CONSTANT ROLE TO THESE NOTES.

2. ROLE-TO-INSTRUMENT-TYPE ASSIGNMENT RULE:
ASSIGN THE CONSTANT ROLE TO EITHER TONAL (MONOPHONIC) OR PERCUSSIVE INSTRUMENT TYPES.

3. ROLE-TO-INSTRUMENT-PERFORMANCE-LOGIC ASSIGNMENT RULE:
ASSIGN THE CONSTANT ROLE TO INSTRUMENT PERFORMANCES THAT ARE TEMPO DEPENDENT (E.G. SHAKER WITH "FRONT()" ONLY, SYNTH_LEAD WITH "ARPEGGIATION UP", ETC.).

DECORATION ROLE:
1. ROLE-TO-NOTE ASSIGNMENT RULE:
IF NOTES HAPPEN IN SMALL CLUSTERS, WITH RESTS BETWEEN EACH SET OF CLUSTERS, AND OCCUR ONE PER PHRASE OR LONGER, THEN ASSIGN THE DECORATION ROLE TO THESE NOTES.

2. ROLE-TO-INSTRUMENT-TYPE ASSIGNMENT RULE:
ASSIGN THE DECORATION ROLE TO INSTRUMENT TYPES THAT ARE EITHER PERCUSSIVE (IF NOTES ARE UNPITCHED) OR TONAL (IF NOTES FOLLOW PITCHES WITHIN THE KEY) AND CAN BE ASSIGNED TO TYPICALLY MONOPHONIC OR INSTRUMENTS WITH HARMONIC/RHYTHMIC TAGS (E.G. INSTRUMENTS WITH DELAY TAG, TICKIES, SYNTH_LEAD, ETC.)

3. ROLE-TO-INSTRUMENT-PERFORMANCE-LOGIC ASSIGNMENT RULE:
MAY ASSIGN PERFORMANCES THAT ARE SOFTER IN VELOCITY OR LIGHTER IN ARTICULATION ATTACK.

HIGH LANE ROLE:
1. ROLE-TO-NOTE ASSIGNMENT RULE:
IF NOTES THAT ARE UNPITCHED THAT HAPPEN IN USUALLY RAPID SUCCESSION OR HIGH DENSITY, THEN ASSIGN THE HIGH LANE ROLE TO THESE NOTES.

2. ROLE-TO-INSTRUMENT-TYPE ASSIGNMENT RULE:
UNLESS OTHERWISE DIRECTED BY AN EXTERNAL INPUT, USUALLY ASSIGN THE HIGH LANE ROLE TO HIGH-PITCHED IN TIMBRE PERCUSSION INSTRUMENTS
(E.G. TICKIES, SHAKERS, AUX_DRUM ("RIM"), ETC.)

3. ROLE-TO-INSTRUMENT-PERFORMANCE-LOGIC ASSIGNMENT RULE:
CHOOSE PERFORMANCES THAT ACTIVATE ARTICULATIONS THAT ARE TAGGED WITH "HIGH" AND/OR "SHORT"

FIG. 38B3

SPECIFICATION MUSICAL ROLE ASSIGNMENT RULES
EMPLOYED IN THE SYSTEM OF THE THIRD ILLUSTRATIVE EMBODIMENT

HIGH-MID LANE ROLE:
1. ROLE-TO-NOTE ASSIGNMENT RULE:
IF NOTES THAT ARE UNPITCHED THAT HAPPEN IN MEDIUM-HIGH DENSITY, THEN ASSIGN THE HIGH-MID LANE ROLE TO THESE NOTES.

2. ROLE-TO-INSTRUMENT-TYPE ASSIGNMENT RULE:
UNLESS OTHERWISE DIRECTED BY AN EXTERNAL INPUT, USUALLY ASSIGN THIS ROLE TO HIGH-PITCHED OR MEDIUM IN TIMBRE PERCUSSION INSTRUMENTS (E.G. TICKIES, AUX_DRUM, HAND_DRUM, ETC.)

3. ROLE-TO-INSTRUMENT-PERFORMANCE-LOGIC ASSIGNMENT RULE:
CHOOSE PERFORMANCES THAT ACTIVATE ARTICULATIONS THAT ARE TAGGED WITH "MIDDLE" AND/OR "SHORT/MEDIUM"

LOW-MID LANE ROLE:
1. ROLE-TO-NOTE ASSIGNMENT RULE:
IF NOTES THAT ARE UNPITCHED THAT HAPPEN IN MEDIUM-LOW DENSITY, THEN ASSIGN THE LOW-MID LANE ROLE TO THESE NOTES.

2. ROLE-TO-INSTRUMENT-TYPE ASSIGNMENT RULE:
UNLESS OTHERWISE DIRECTED BY AN EXTERNAL INPUT, USUALLY ASSIGN THIS ROLE TO MEDIUM TO MEDIUM-LOW IN TIMBRE PERCUSSION INSTRUMENTS (E.G. AUX_DRUM, HAND_DRUM, TAIKO, ETC.)

3. ROLE-TO-INSTRUMENT-PERFORMANCE-LOGIC ASSIGNMENT RULE:
CHOOSE PERFORMANCES THAT ACTIVATE ARTICULATIONS THAT ARE TAGGED WITH "MIDDLE," "LOW," AND/OR "MEDIUM/LONG"

LOW LANE ROLE:
1. ROLE-TO-NOTE ASSIGNMENT RULE:
ASSIGN THE LOW LANE ROLE TO NOTES THAT ARE UNPITCHED THAT HAPPEN IN LOW DENSITY.

2. ROLE-TO-INSTRUMENT-TYPE ASSIGNMENT RULE:
UNLESS OTHERWISE DIRECTED BY AN EXTERNAL INPUT, ASSIGN THIS ROLE USUALLY TO INSTRUMENT TYPES THAT ARE LOW IN TIMBRE PERCUSSION (E.G. BASS_DRUM, SURDO, TAIKO, ETC.)

3. ROLE-TO-INSTRUMENT-PERFORMANCE-LOGIC ASSIGNMENT RULE:
CHOOSE PERFORMANCES THAT ACTIVATE ARTICULATIONS THAT ARE TAGGED WITH "LOW," AND/OR "LONG"

FIG. 38B4

SPECIFICATION MUSICAL ROLE ASSIGNMENT RULES
EMPLOYED IN THE SYSTEM OF THE THIRD ILLUSTRATIVE EMBODIMENT

MIDDLE ROLE:
1. ROLE-TO-NOTE ASSIGNMENT RULE:
IF NOTES HAVE A MEDIUM DENSITY (PLAYING MORE THAN ONCE PER CHORD, POLYTONAL, WITH OCCASIONAL RUNNING LINES), THEN ASSIGN THE MIDDLE ROLE TO THESE NOTES.

2. ROLE-TO-INSTRUMENT-TYPE ASSIGNMENT RULE:
TYPICALLY ASSIGN THIS ROLE TO INSTRUMENT TYPES THAT CAN SUPPORT POLYPHONIC PLAYBACK AND PERFORMANCE. (E.G. KEYBOARD, ACOUSTIC_PIANO, SYNTH_STRINGS, VIOLINS, ETC).

3. ROLE-TO-INSTRUMENT-PERFORMANCE-LOGIC ASSIGNMENT RULE:
TYPICALLY ASSIGN THIS ROLE TO INSTRUMENT PERFORMANCES SUPPORT POLYPHONIC PERFORMANCE. (E.G. KEYBOARD, ACOUSTIC_PIANO, SYNTH_STRINGS, VIOLINS, ETC).

ON BEAT ROLE:
1. ROLE-TO-NOTE ASSIGNMENT RULE:
IF NOTES HAVE A PERIODICITY OF PRIMARILY STRONG BEAT AND THAT ARE TONAL, THEN ASSIGN THE ON BEAT ROLE TO THESE NOTES.

2. ROLE-TO-INSTRUMENT-TYPE ASSIGNMENT RULE:
ASSIGN THIS ROLE TO INSTRUMENT TYPES THAT PRODUCE MORE RHYTHMIC AND PERCUSSIVE TONAL PERFORMANCES (MONO OR POLYPHONIC)

3. ROLE-TO-INSTRUMENT-PERFORMANCE-LOGIC ASSIGNMENT RULE:
ASSIGN THIS ROLE TO INSTRUMENT PERFORMANCES THAT HAVE "STRONG" PERFORMANCE TAG ASSOCIATION (EG: ACOUSTIC_BASS "ROOTS WITH 5THS", ACOUSTIC_GUITAR WITH "DOWN-STRUM POWER CHORD", ETC.)

PAD ROLE:
1. ROLE-TO-NOTE ASSIGNMENT RULE:
IF NOTES ARE SUSTAINED THROUGH THE DURATION OF A CHORD, THEN ASSIGN THE PAD ROLE TO THESE NOTES.

2. ROLE-TO-INSTRUMENT-TYPE ASSIGNMENT RULE:
TYPICALLY ASSIGN THIS ROLE TO POLYPHONIC INSTRUMENT TYPES THAT SUSTAIN NOTES (E.G. MID_PAD, SYNTH_STRING, SYNTH_BASS)

3. ROLE-TO-INSTRUMENT-PERFORMANCE-LOGIC ASSIGNMENT RULE:
TYPICALLY ASSIGN THIS ROLE TO INSTRUMENT PERFORMANCES INVOLVING POLYPHONIC PERFORMANCES THAT SUSTAIN NOTES DURING A CHORD, AND CHANGE NOTES ON CHORD CHANGE (E.G. MID_PAD, SYNTH_STRING, SYNTH_BASS)

FIG. 38B5

SPECIFICATION MUSICAL ROLE ASSIGNMENT RULES
EMPLOYED IN THE SYSTEM OF THE THIRD ILLUSTRATIVE EMBODIMENT

PEDAL ROLE:
1. ROLE-TO-NOTE ASSIGNMENT RULE:
IF NOTES SUSTAIN THROUGH CHORDS AND STAY ON ONE PITCH (OFTEN THE ROOT) OF AN ENTIRE PHRASE, THEN ASSIGN THE PEDAL ROLE TO THESE NOTES.

2. ROLE-TO-INSTRUMENT-TYPE ASSIGNMENT RULE:
ASSIGN THIS ROLE TYPICALLY TO MONOPHONIC INSTRUMENT TYPES SUCH AS, E.G. LOW_PAD, SYNTH_BASS, PULSE, ETC.

3. ROLE-TO-INSTRUMENT-PERFORMANCE-LOGIC ASSIGNMENT RULE:
ASSIGN THIS ROLE TYPICALLY TO INSTRUMENT PERFORMANCES SUPPORTING MONOPHONIC PERFORMANCES THAT EITHER SUSTAIN INDEFINITELY, OR CAN QUICKLY REATTACK CONSECUTIVELY TO CREATE A PULSE-LIKE PEDAL TONE (E.G. LOW_PAD, SYNTH_BASS, PULSE, ETC.)

PRIMARY ROLE:
1. ROLE-TO-NOTE ASSIGNMENT RULE:
IF NOTES ARE MOSTLY MONOPHONIC, PLAYED WITH MORE DENSITY, RHYTHMIC STRUCTURE VARIANCES, OFTEN WITH SOME REPETITION AND PERIODICITY, AND ARE ACCOMPANIED WITH EITHER GREAT DYNAMIC MARKINGS, HIGH VELOCITIES, AND/OR OTHER INDICATIONS DEPENDING ON THE MEDIUM READ, THEN ASSIGN THE PRIMARY ROLE TO THESE NOTES.

2. ROLE-TO-INSTRUMENT-TYPE ASSIGNMENT RULE:
ASSIGN THIS ROLE TYPICALLY TO INSTRUMENT TYPES OFTEN USED TO PERFORM AS LEAD INSTRUMENTS (E.G. VIOLIN, LEAD_SYNTH, LEAD_GUITAR, ETC.)

3. ROLE-TO-INSTRUMENT-PERFORMANCE-LOGIC ASSIGNMENT RULE:
MAY CHOOSE LIMITED POLYPHONIC OR MONOPHONIC PERFORMANCE, THAT MAY UTILIZES A GREAT AMOUNT OF ARTICULATION CONTROL AND SWITCHING.

SECONDARY ROLE:
1. ROLE-TO-NOTE ASSIGNMENT RULE:
IF NOTES ARE MOSTLY MONOPHONIC, PLAY WITH MORE DENSITY, RHYTHMIC STRUCTURE VARIANCES, OFTEN WITH SOME REPETITION AND PERIODICITY, AND ARE ACCOMPANIED WITH EITHER GREAT DYNAMIC MARKINGS, HIGH VELOCITIES, ARE EITHER LOWER IN PITCH OR PLAY LESS DENSE THEN ANOTHER PART, AND/OR OTHER INDICATIONS DEPENDING ON THE MEDIUM READ, THEN ASSIGN THE SECONDARY ROLE TO THESE NOTES.

2. ROLE-TO-INSTRUMENT-TYPE ASSIGNMENT RULE:
ASSIGN THIS ROLE TO INSTRUMENT TYPES THAT OFTEN PERFORM AS LEAD INSTRUMENTS (E.G. VIOLIN, LEAD_SYNTH, LEAD_GUITAR, ETC.)

3. ROLE-TO-INSTRUMENT-PERFORMANCE-LOGIC ASSIGNMENT RULE:
MAY CHOOSE LIMITED POLYPHONIC OR MONOPHONIC PERFORMANCE, THAT MAY UTILIZES A GREAT AMOUNT OF ARTICULATION CONTROL AND SWITCHING.

FIG. 38B6

SPECIFICATION MUSICAL ROLE ASSIGNMENT RULES
EMPLOYED IN THE SYSTEM OF THE THIRD ILLUSTRATIVE EMBODIMENT

DRUM SET ROLES:
THESE ARE THE ROLES LISTED BELOW THAT ARE GIVEN SPECIFIC RHYTHMIC PARTS (NON-TONAL) THAT SHOULD BE ASSIGNED TO ONE ROLE-PERFORMER, BUT HAVE TO BE BROKEN OUT BECAUSE THE INSTRUMENTS USED ARE NATURALLY SEPARATED. NOTES WILL NEED TO BE PARSED INTO DIFFERENT ROLES, AND OFTEN CAN BE DETERMINED BY MIDI NOTE PITCH, STAFF POSITION, OR RHYTHMIC DENSITY.

HI-HAT DRUM SET ROLE:
1. ROLE-TO-NOTE ASSIGNMENT RULE:
ASSIGN THIS ROLE TO OFTEN REPEATED CONSECUTIVE NOTES, USUALLY A QUARTER NOTE OR FASTER.

2. ROLE-TO-INSTRUMENT-TYPE ASSIGNMENT RULE:
THIS ROLE MAY BE ASSIGNED TO INSTRUMENT TYPES RELATED TO HI-HATS.

3. ROLE-TO-INSTRUMENT-PERFORMANCE-LOGIC ASSIGNMENT RULE:
DEPENDING ON DENSITY OF PART, AND PERCEIVED STYLE, THIS ROLE WILL BE ASSIGNED A SPECIFIC PERFORMANCE THAT CAN DETERMINE HOW TO SWITCH ALL THE ARTICULATIONS CONTAINED WITHIN A HI-HAT.
(E.G. CLOSED HIT WITH OPEN ON 4 AND)

SNARE DRUM SET ROLE:
1. ROLE-TO-NOTE ASSIGNMENT RULE:
THIS ROLE IS OFTEN ASSIGNED TO NOTES CLOSE TO OR AROUND THE WEAK BEATS.

2. ROLE-TO-INSTRUMENT-TYPE ASSIGNMENT RULE:
THIS ROLE MAY BE ASSIGNED TO BE INSTRUMENT TYPES RELATED TO SNARE (STICK_SNARE, BRUSH_SNARE, SYNTH_SNARE, ETC.).

3. ROLE-TO-INSTRUMENT-PERFORMANCE-LOGIC ASSIGNMENT RULE:
DEPENDING ON DENSITY OF PART, AND PERCEIVED STYLE, THIS ROLE WILL BE ASSIGNED A SPECIFIC PERFORMANCE THAT CAN DETERMINE HOW TO SWITCH ALL THE ARTICULATIONS CONTAINED WITHIN A SNARE DRUM.

CYMBAL DRUM SET ROLE:
1. ROLE-TO-NOTE ASSIGNMENT RULE:
THIS ROLE MAY BE ASSIGNED TO EITHER REPEATED CONSECUTIVE NOTES (RIDE) OR SINGLE NOTES ON DOWNBEATS OF MEASURES OR PHRASES (CRASH).

2. ROLE-TO-INSTRUMENT-TYPE ASSIGNMENT RULE:
THIS ROLE MAY BE ASSIGNED TO BE INSTRUMENT TYPES RELATED TO CYMBAL.

3. ROLE-TO-INSTRUMENT-PERFORMANCE-LOGIC ASSIGNMENT RULE:
DEPENDING ON DENSITY OF PART, AND PERCEIVED STYLE, THE CYMBAL DRUM SET ROLE WILL BE ASSIGNED TO A SPECIFIC PERFORMANCE THAT CAN DETERMINE HOW TO SWITCH ALL THE ARTICULATIONS CONTAINED WITHIN A CYMBAL.

FIG. 38B7

SPECIFICATION MUSICAL ROLE ASSIGNMENT RULES
EMPLOYED IN THE SYSTEM OF THE THIRD ILLUSTRATIVE EMBODIMENT

TOM DRUM SET ROLE:
1. ROLE-TO-NOTE ASSIGNMENT RULE:
THIS ROLE MAY BE ASSIGNED TO CLUSTERS OF NOTES THAT HAPPEN AT THE END OF MEASURES, OR THAT ARE DENSER, BUT THAT ARE LESS CONSISTENT THAN HI-HAT OR CYMBAL (RIDE).

2. ROLE-TO-INSTRUMENT-TYPE ASSIGNMENT RULE:
THIS ROLE MAY BE ASSIGNED TO INSTRUMENT TYPES RELATED TO A TOM DRUM SET

3. ROLE-TO-INSTRUMENT-PERFORMANCE-LOGIC ASSIGNMENT RULE:
THIS ROLE WILL BE ASSIGNED TO INSTRUMENT PERFORMANCES BASED ON DENSITY AND POSITION IN MEASURE THAT WILL DETERMINE WHICH TOMS PLAY WHICH PITCHES AND WHEN THE PITCHES SWITCH. (E.G. TOM "LOW PITCH ONLY", TOM "LOW TOM WITH LOW-MID TOM ACCENT")

KICK DRUM SET ROLE:
1. ROLE-TO-NOTE ASSIGNMENT RULE:
THIS ROLE IS ASSIGNED OFTEN TO NOTES CLOSE TO OR AROUND THE STRONG BEATS.

2. ROLE-TO-INSTRUMENT-TYPE ASSIGNMENT RULE:
THE KICK DRUM SET ROLE MAY BE ASSIGNED INSTRUMENT TYPES RELATED TO KICK.

3. ROLE-TO-INSTRUMENT-PERFORMANCE-LOGIC ASSIGNMENT RULE:
THE KICK DRUM SET ROLE MAY BE ASSIGNED TO INSTRUMENT PERFORMANCES RELATED TO KICK. DEPENDING ON DENSITY OF PART, AND PERCEIVED STYLE, THIS ROLE WILL BE ASSIGNED A SPECIFIC PERFORMANCE THAT CAN DETERMINE HOW TO SWITCH ALL THE ARTICULATIONS CONTAINED WITHIN A KICK.

FIG. 38B8

GRAPHICAL REPRESENTATION OF A MUSIC-THEORETIC STATE DESCRIPTOR DATA FILE AUTOMATICALLY PRODUCED FOR AN EXEMPLARY MUSIC COMPOSITION CONTAINING MUSIC COMPOSITION NOTE DATA, ROLES, METRICS AND META-DATA

| ROLE | NOTE#'S | TIME UNIT (BEAT #1) | | | |
|---|---|---|---|---|---|
| | | | | | |
| | | | | | |
| | | | | | |
| | | | | | |
| | | | | | |
| | | | | | |
| | | | | | |
| | | | | | |
| | | * * * | | | |
| | | | | | |

MUSIC METRICS, AND META-DATA

FIG. 39

FRAMEWORK FOR CLASSIFYING AND CATALOGING A GROUP OF REAL MUSICAL INSTRUMENTS, AND STANDARDIZING HOW SUCH MUSICAL INSTRUMENTS ARE SAMPLED, NAMED AND PERFORMED AS VIRTUAL MUSICAL INSTRUMENTS DURING A DIGITAL PERFORMANCE OF A PIECE OF COMPOSED MUSIC

TYPES OF MUSICAL INSTRUMENTS ARE CLASSIFIED BY THEIR PERFORMANCE BEHAVIORS, AND THEREFORE, MUSICAL INSTRUMENTS WITH COMMON PERFORMANCE BEHAVIORS ARE CLASSIFIED UNDER THE SAME OR COMMON INSTRUMENT TYPE (i.e. instrument_type). THIS ALLOWS LIKE MUSICAL INSTRUMENTS TO BE ORGANIZED AND CATALOGUED IN THE SAME CLASS (BY "TYPE") AND BE READILY AVAILABLE FOR SAMPLED NOTE SELECTION AND USE WHEN THE INSTRUMENTATION AND PERFORMANCE OF A COMPOSED PIECE OF MUSIC IS BEING DETERMINED.

MUSICAL INSTRUMENT CATALOG

INSTRUMENT TYPE #1:
BEHAVIORS: ASPECT VALUES:

***

INSTRUMENT TYPE #100:
BEHAVIORS: ASPECT VALUES:

FIG. 40

EXEMPLARY CATALOG OF DEEPLY-SAMPLED VIRTUAL MUSICAL INSTRUMENTS MAINTAINED IN THE DEEPLY-SAMPLED VIRTUAL MUSICAL INSTRUMENT LIBRARY MANAGEMENT SUBSYSTEM OF THE PRESENT INVENTION

| NAME/ TITLE | TYPE/ CATEGORY | BEHAVIORS/ASPECTS (VALUES)/NOTE RANGE |
|---|---|---|
| PIANO | KEY | SingleNote( ). PedalDown ( ) Notes (….) |
| DRUM | PERCUSSION | Hit ( ). Hit ( ) / Note Range |
| CLASSICAL GUITAR | STRING | Ornament ( ). Slide ( ). lv ( ). Long ( ). Up / Note |
| FEMALE SOPRANO | VOICE | |
| | | |
| | | |
| | | |
| | | |
| | | |
| | | |

FIG. 41

LIST OF EXEMPLARY INSTRUMENTS THAT ARE SUPPORTED BY THE AUTOMATED MUSIC PERFORMANCE SYSTEM OF THE PRESENT INVENTION

NAME:
INTERNAL NAME
UPRIGHT_PIANO
ROOMY_UPRIGHT_PIANO
POP_UPRIGHT_PIANO
CLASSICAL_UPRIGHT_PIANO
GARAGE_UPRIGHT_PIANO
DREAMY_UPRIGHT_PIANO
JAZZ_UPRIGHT_PIANO
OLD_UPRIGHT_PIANO
POP_YAMAHA_GRAND_PIANO_C6
JAZZ_YAMAHA_GRAND_PIANO_C6
AMBIENT_YAMAHA_GRAND_PIANO_C6
OLD_YAMAHA_GRAND_PIANO_C6
GARAGE_YAMAHA_GRAND_PIANO_C6
DREAMY_YAMAHA_GRAND_PIANO_C6
GRAND_PIANO
ROOMY_GRAND_PIANO
POP_GRAND_PIANO
CLASSICAL_GRAND_PIANO
GARAGE_GRAND_PIANO
DREAMY_GRAND_PIANO
JAZZ_GRAND_PIANO
OLD_GRAND_PIANO
CHINESE_TOM
MODERN_CHINESE_TOM
ROOMY_CHINESE_TOM
CLOSE_CHINESE_TOM
CLASSIC_CHINESE_TOM
OLD_CHINESE_TOM
FULL_GIG_SNAP
AIRY_GIG_SNAP
ROOMY_GIG_SNAP
CHAMBER_GIG_SNAP
MODERN_GIG_SNAP
CLOSE_GIG_SNAP
OLD_GIG_SNAP
GARAGE_GIG_SNAP
FULL_GIG_STOMP_THICK
AIRY_GIG_STOMP_THICK
ROOMY_GIG_STOMP_THICK
CHAMBER_GIG_STOMP_THICK
MODERN_GIG_STOMP_THICK
CLOSE_GIG_STOMP_THICK

FIG. 42A

LIST OF EXEMPLARY INSTRUMENTS THAT ARE SUPPORTED BY THE AUTOMATED MUSIC PERFORMANCE SYSTEM OF THE PRESENT INVENTION

NAME:

OLD_GIG_STOMP_THICK
GARAGE_GIG_STOMP_THICK
FULL_GIG_STOMP_THIN
AIRY_GIG_STOMP_THIN
ROOMY_GIG_STOMP_THIN
CHAMBER_GIG_STOMP_THIN
MODERN_GIG_STOMP_THIN
CLOSE_GIG_STOMP_THIN
OLD_GIG_STOMP_THIN
GARAGE_GIG_STOMP_THIN
FULL_GIG_STOMP_LARGE
AIRY_GIG_STOMP_LARGE
ROOMY_GIG_STOMP_LARGE
CHAMBER_GIG_STOMP_LARGE
MODERN_GIG_STOMP_LARGE
CLOSE_GIG_STOMP_LARGE
OLD_GIG_STOMP_LARGE
GARAGE_GIG_STOMP_LARGE
ANVIL
MODERN_ANVIL
ROOMY_ANVIL
CLOSE_ANVIL
CLASSIC_ANVIL
OLD_ANVIL
BRAZILIAN_DRUM
MODERN_BRAZILIAN_DRUM
ROOMY_BRAZILIAN_DRUM
CLOSE_BRAZILIAN_DRUM
CLASSIC_BRAZILIAN_DRUM
OLD_BRAZILIAN_DRUM
RADA
MODERN_RADA
ROOMY_RADA
CLOSE_RADA
CLASSIC_RADA
OLD_RADA
SIDE_DRUM
MODERN_SIDE_DRUM
ROOMY_SIDE_DRUM
CLOSE_SIDE_DRUM
CLASSIC_SIDE_DRUM
OLD_SIDE_DRUM
FULL_CAPTAIN_BLOCKS_HIGH

FIG. 42B

LIST OF EXEMPLARY INSTRUMENTS THAT ARE SUPPORTED BY THE AUTOMATED MUSIC PERFORMANCE SYSTEM OF THE PRESENT INVENTION

NAME:
AIRY_CAPTAIN_BLOCKS_HIGH
ROOMY_CAPTAIN_BLOCKS_HIGH
CHAMBER_CAPTAIN_BLOCKS_HIGH
MODERN_CAPTAIN_BLOCKS_HIGH
OLD_CAPTAIN_BLOCKS_HIGH
GARAGE_CAPTAIN_BLOCKS_HIGH
CLOSE_CAPTAIN_BLOCKS_HIGH
FULL_CAPTAIN_BLOCKS_LOW
AIRY_CAPTAIN_BLOCKS_LOW
ROOMY_CAPTAIN_BLOCKS_LOW
CHAMBER_CAPTAIN_BLOCKS_LOW
MODERN_CAPTAIN_BLOCKS_LOW
OLD_CAPTAIN_BLOCKS_LOW
GARAGE_CAPTAIN_BLOCKS_LOW
CLOSE_CAPTAIN_BLOCKS_LOW
EDM_ALIEN_CLAP
EDM_ALUMINUM_CLAP
EDM_BEDSTUY_CLAP
EDM_BEDROOM_CLAP
EDM_COBALT_CLAP
EDM_COPPER_CLAP
EDM_DIAMOND_CLAP
EDM_FETE_CLAP
EDM_GLASGOW_CLAP
EDM_HOLLYWOOD_CLAP
EDM_PLATINUM_CLAP
EDM_SILVER_CLAP
EDM_TITANIUM_CLAP
EDM_VANADIUM_CLAP
EDM_VEGAS_CLAP
EDM_BEDROOM_SNAP
EDM_PLATINUM_SNAP
HIP_AGGRO_CLAP
HIP_DARK_CLAP
HIP_DISTORTED_CLAP
HIP_DRY_TRAP_CLAP
HIP_GROUP_HI_CLAP
HIP_EDGY_CLAP
HIP_TENDER_SNAP
HIP_CHILL_SNAP
HIP_JAZZ_TAMBOURINE
PLASTIC_BLOCKS
STUDIO_PLASTIC_BLOCKS

FIG. 42C

LIST OF EXEMPLARY INSTRUMENTS THAT ARE SUPPORTED BY THE AUTOMATED MUSIC PERFORMANCE SYSTEM OF THE PRESENT INVENTION

NAME:

WOOD_BLOCKS
STUDIO_WOOD_BLOCKS
BIG_PLASTIC_BLOCKS
ROOMY_PLASTIC_BLOCKS
DD_PLASTIC_BLOCKS
GARAGE_PLASTIC_BLOCKS
BRIGHT_MONO_PLASTIC_BLOCKS
BIG_WOOD_BLOCKS
ROOMY_WOOD_BLOCKS
OLD_WOOD_BLOCKS
GARAGE_WOOD_BLOCKS
BRIGHT_MONO_WOOD_BLOCKS
CATHEDRAL_WOOD_BLOCKS
DISTANT_WOOD_BLOCKS
PINGPONG_WOOD_BLOCKS
CLAVE
STUDIO_CLAVE
BIG_CLAVE
ROOMY_CLAVE
OLD_CLAVE
GARAGE_CLAVE
BRIGHT_MONO_CLAVE
CATHEDRAL_CLAVE
DISTANT_CLAVE
SPIRAL_TRASH_CLOSE_MIX
SPIRAL_TRASH_OPEN_MIX
SPIRAL_TRASH_ROOM_MIX
SPIRAL_TRASH_PROCESSED
SPIRAL_TRASH_OVERHEADS
SPIRAL_TRASH_OLD
SPIRAL_TRASH_GARAGE
STUDIO_SLEIGH_BELLS
CLASSIC_SLEIGH_BELLS
BRIGHT_STEREO_SLEIGH_BELLS
ROOMY_SLEIGH_BELLS
OLD_SLEIGH_BELLS
GARAGE_SLEIGH_BELLS
BRIGHT_MONO_ SLEIGH_BELLS
STAND_TAMBOURINE
STUDIO_STAND_TAMBOURINE
BIG_STAND_TAMBOURINE
ROOMY_STAND_TAMBOURINE
OLD_STAND_TAMBOURINE

FIG. 42D

LIST OF EXEMPLARY INSTRUMENTS THAT ARE SUPPORTED BY THE AUTOMATED MUSIC PERFORMANCE SYSTEM OF THE PRESENT INVENTION

NAME:

GARAGE_STAND_TAMBOURINE
CATHEDRAL_STAND_TAMBOURINE
DISTANT_STAND_TAMBOURINE
FULL_GIG_TOMS_BRUSH
AIRY_GIG_TOMS_BRUSH
ROOMY_GIG_TOMS_BRUSH
CHAMBER_GIG_TOMS_BRUSH
MODERN_GIG_TOMS_BRUSH
CLOSE_GIG_TOMS_BRUSH
OLD_GIG_TOMS_BRUSH
GARAGE_GIG_TOMS_BRUSH
BASS_DRUM
MODERN_BASS_DRUM
ROOMY_BASS_DRUM
CLOSE_BASS_DRUM
CLASSIC_BASS_DRUM
OLD_BASS_DRUM
GROUP_BASS_DRUM
MODERN_GROUP_BASS_DRUM
ROOMY_GROUP_BASS_DRUM
CLOSE_GROUP_BASS_DRUM
CLASSIC_GROUP_BASS_DRUM
OLD_GROUP_BASS_DRUM
DI_PICKED_JBASS
CHORUS_PICKED_JBASS
THICK_PICKED_JBASS
WARM_PICKED_JBASS
DISTORTED_PICKED_JBASS
BRIGHT_BOWED_VIBRAPHONE
NICE_BOWED_VIBRAPHONE
AMBIENT_BOWED_VIBRAPHONE
OLD_BOWED_VIBRAPHONE
GARAGE_BOWED_VIBRAPHONE
FULL_AW_BLACK_SNARE_BRUSH
ROOMY_AW_BLACK_SNARE_BRUSH
MODERN_AW_BLACK_SNARE_BRUSH
CLOSE_AW_BLACK_SNARE_BRUSH
OLD_AW_BLACK_SNARE_BRUSH
CATHEDRAL_AW_BLACK_SNARE_BRUSH
FULL_CLASSIC_SNARE_BRUSH
ROOMY_CLASSIC_SNARE_BRUSH
MODERN_CLASSIC_SNARE_BRUSH
CLOSE_CLASSIC_SNARE_BRUSH

FIG. 42E

LIST OF EXEMPLARY INSTRUMENTS THAT ARE SUPPORTED BY THE AUTOMATED MUSIC PERFORMANCE SYSTEM OF THE PRESENT INVENTION

NAME:

OLD_CLASSIC_SNARE_BRUSH
CATHEDRAL_CLASSIC_SNARE_BRUSH
FULL_TAMA_BRASS_SNARE_BRUSH
AIRY_TAMA_BRASS_SNARE_BRUSH
ROOMY_TAMA_BRASS_SNARE_BRUSH
CHAMBER_TAMA_BRASS_SNARE_BRUSH
MODERN_TAMA_BRASS_SNARE_BRUSH
OLD_TAMA_BRASS_SNARE_BRUSH
GARAGE_TAMA_BRASS_SNARE_BRUSH
CLOSE_TAMA_BRASS_SNARE_BRUSH
FULL_BLACK_BEAUTY_ROCK_SNARE_BRUSH
AIRY_BLACK_BEAUTY_ROCK_SNARE_BRUSH
ROOMY_BLACK_BEAUTY_ROCK_SNARE_BRUSH
CHAMBER_BLACK_BEAUTY_ROCK_SNARE_BRUSH
MODERN_BLACK_BEAUTY_ROCK_SNARE_BRUSH
OLD_BLACK_BEAUTY_ROCK_SNARE_BRUSH
GARAGE_BLACK_BEAUTY_ROCK_SNARE_BRUSH
CLOSE_BLACK_BEAUTY_ROCK_SNARE_BRUSH
FULL_KEPLINGER_SNARE_BRUSH
AIRY_KEPLINGER_SNARE_BRUSH
ROOMY_KEPLINGER_SNARE_BRUSH
CHAMBER_KEPLINGER_SNARE_BRUSH
MODERN_KEPLINGER_SNARE_BRUSH
OLD_KEPLINGER_SNARE_BRUSH
GARAGE_KEPLINGER_SNARE_BRUSH
CLOSE_KEPLINGER_SNARE_BRUSH
FULL_SUPRAPHONIC_SNARE_BRUSH
AIRY_SUPRAPHONIC_SNARE_BRUSH
ROOMY_SUPRAPHONIC_SNARE_BRUSH
CHAMBER_SUPRAPHONIC_SNARE_BRUSH
MODERN_SUPRAPHONIC_SNARE_BRUSH
OLD_SUPRAPHONIC_SNARE_BRUSH
GARAGE_SUPRAPHONIC_SNARE_BRUSH
CLOSE_SUPRAPHONIC_SNARE_BRUSH
FULL_LUDWIG_PREPARED_SNARE_BRUSH
AIRY_LUDWIG_PREPARED_SNARE_BRUSH
ROOMY_LUDWIG_PREPARED_SNARE_BRUSH
CHAMBER_LUDWIG_PREPARED_SNARE_BRUSH
MODERN_LUDWIG_PREPARED_SNARE_BRUSH
OLD_LUDWIG_PREPARED_SNARE_BRUSH
GARAGE_LUDWIG_PREPARED_SNARE_BRUSH
CLOSE_LUDWIG_PREPARED_SNARE_BRUSH
FULL_CELESTE_SCHIEDMAYER

FIG. 42F

LIST OF EXEMPLARY INSTRUMENTS THAT ARE SUPPORTED
BY THE AUTOMATED MUSIC PERFORMANCE SYSTEM
OF THE PRESENT INVENTION

NAME:
BRIGHT_CELESTE_SCHIEDMAYER
NICE_CELESTE_SCHIEDMAYER
OLD_CELESTE_SCHIEDMAYER
GARAGE_CELESTE_SCHIEDMAYER
AMBIENT_CELESTE_SCHIEDMAYER
DREAMY_CELESTE_SCHIEDMAYER
NICE_SCORING_CELLOS
SWEET_SCORING_CELLOS
MODERN_SCORING_CELLOS
BIG_SCORING_CELLOS
OLD_SCORING_CELLOS
CLOSE_SCORING_CELLOS
CLAVINET
NICE_SCORING_BASSES
SWEET_SCORING_BASSES
MODERN_SCORING_BASSES
BIG_SCORING_BASSES
OLD_SCORING_BASSES
CLOSE_SCORING_BASSES
FULL_CAPTAIN_COWBELL
AIRY_CAPTAIN_COWBELL
ROOMY_CAPTAIN_COWBELL
CHAMBER_CAPTAIN_COWBELL
MODERN_CAPTAIN_COWBELL
OLD_CAPTAIN_COWBELL
GARAGE_CAPTAIN_COWBELL
CLOSE_CAPTAIN_COWBELL
COWBELLS
STUDIO_COWBELLS
GARAGE_COWBELLS
BIG_COWBELLS
ROOMY_COWBELLS
OLD_COWBELLS
BRIGHT_MONO_COWBELLS
FULL_CAPTAIN_BONGO
AIRY_CAPTAIN_BONGO
ROOMY_CAPTAIN_BONGO
CHAMBER_CAPTAIN_BONGO
MODERN_CAPTAIN_BONGO
OLD_CAPTAIN_BONGO
GARAGE_CAPTAIN_BONGO
CLOSE_CAPTAIN_BONGO
FULL_CAPTAIN_CONGA

FIG. 42G

LIST OF EXEMPLARY INSTRUMENTS THAT ARE SUPPORTED BY THE AUTOMATED MUSIC PERFORMANCE SYSTEM OF THE PRESENT INVENTION

NAME:

AIRY_CAPTAIN_CONGA
ROOMY_CAPTAIN_CONGA
CHAMBER_CAPTAIN_CONGA
MODERN_CAPTAIN_CONGA
OLD_CAPTAIN_CONGA
GARAGE_CAPTAIN_CONGA
CLOSE_CAPTAIN_CONGA
BONGOS
STUDIO_BONGOS
GARAGE_BONGOS
BIG_BONGOS
ROOMY_BONGOS
OLD_BONGOS
BRIGHT_MONO_BONGOS
CATHEDRAL_BONGOS
DISTANT_BONGOS
CONGAS
STUDIO_CONGAS
BIG_CONGAS
ROOMY_CONGAS
OLD_CONGAS
GARAGE_CONGAS
BRIGHT_MONO_CONGAS
CATHEDRAL_CONGAS
DISTANT_CONGAS
WIDE_BRASSY_FINGER_CYMBAL
ROOMY_BRASSY_FINGER_CYMBAL
GARAGE_BRASSY_FINGER_CYMBAL
BRIGHT_BRASSY_FINGER_CYMBAL
OLD_BRASSY_FINGER_CYMBAL
CATHEDRAL_BRASSY_FINGER_CYMBAL
DISTANT_BRASSY_FINGER_CYMBAL
DELAYED_BRASSY_FINGER_CYMBAL
WIDE_DARK_FINGER_CYMBAL
ROOMY_DARK_FINGER_CYMBAL
GARAGE_DARK_FINGER_CYMBAL
BRIGHT_DARK_FINGER_CYMBAL
OLD_DARK_FINGER_CYMBAL
CATHEDRAL_DARK_FINGER_CYMBAL
DISTANT_DARK_FINGER_CYMBAL
DELAYED_DARK_FINGER_CYMBAL
ROOMY_SIXTY_THREE_MARTIN_STEEL
XY_SIXTY_THREE_MARTIN_STEEL

FIG. 42H

LIST OF EXEMPLARY INSTRUMENTS THAT ARE SUPPORTED BY THE AUTOMATED MUSIC PERFORMANCE SYSTEM OF THE PRESENT INVENTION

NAME:

LIVE_SIXTY_THREE_MARTIN_STEEL
RIBBON_SIXTY_THREE_MARTIN_STEEL
GARAGE_SIXTY_THREE_MARTIN_STEEL
BRIGHT_SIXTY_THREE_MARTIN_STEEL
WARM_SIXTY_THREE_MARTIN_STEEL
NECK_SIXTY_THREE_MARTIN_STEEL
DREAMY_SIXTY_THREE_MARTIN_STEEL
DI_SIXTY_THREE_MARTIN_STEEL
WIDE_UKULELE_FINGER
BRIGHT_UKULELE_FINGER
GARAGE_UKULELE_FINGER
ROOMY_UKULELE_FINGER
OLD_UKULELE_FINGER
CATHEDRAL_UKULELE_FINGER
DISTANT_UKULELE_FINGER
LARGE_TAMTAM
MODERN_LARGE_TAMTAM
MEDIUM_TAMTAM
MODERN_MEDIUM_TAMTAM
ROOMY_LARGE_TAMTAM
CLOSE_LARGE_TAMTAM
CLASSIC_LARGE_TAMTAM
OLD_LARGE_TAMTAM
ROOMY_MEDIUM_TAMTAM
CLOSE_MEDIUM_TAMTAM
CLASSIC_MEDIUM_TAMTAM
OLD_MEDIUM_TAMTAM
DULCIMER
CATHEDRAL_DULCIMER
OPEN_SMALL_CAJON
ROOMY_SMALL_CAJON
MODERN_SMALL_CAJON
CLOSE_SMALL_CAJON
OLD_SMALL_CAJON
CATHEDRAL_SMALL_CAJON
DISTANT_SMALL_CAJON
OPEN_SNARED_CAJON
ROOMY_SNARED_CAJON
MODERN_SNARED_CAJON
CLOSE_SNARED_CAJON
OLD_SNARED_CAJON
CATHEDRAL_SNARED_CAJON
DISTANT_SNARED_CAJON

FIG. 42I

LIST OF EXEMPLARY INSTRUMENTS THAT ARE SUPPORTED BY THE AUTOMATED MUSIC PERFORMANCE SYSTEM OF THE PRESENT INVENTION

NAME:

CLOSE_SMALL_BALAFON
WIDE_SMALL_BALAFON
ROOMY_SMALL_BALAFON
OLD_SMALL_BALAFON
WARM_SMALL_BALAFON
GARAGE_SMALL_BALAFON
CATHEDRAL_SMALL_BALAFON
DELAYED_SMALL_BALAFON
CLOSE_BIG_BALAFON
WIDE_BIG_BALAFON
ROOMY_BIG_BALAFON
OLD_BIG_BALAFON
WARM_BIG_BALAFON
GARAGE_BIG_BALAFON
CATHEDRAL_BIG_BALAFON
DELAYED_BIG_BALAFON
CLOSE_GLASS_MARIMBA
WIDE_GLASS_MARIMBA
ROOMY_GLASS_MARIMBA
OLD_GLASS_MARIMBA
WARM_GLASS_MARIMBA
GARAGE_GLASS_MARIMBA
CATHEDRAL_GLASS_MARIMBA
DELAYED_GLASS_MARIMBA
CLOSE_XYLORIMBA
WIDE_XYLORIMBA
ROOMY_XYLORIMBA
OLD_XYLORIMBA
WARM_XYLORIMBA
CATHEDRAL_XYLORIMBA
DELAYED_XYLORIMBA
WURLITZER
DREAMY_WURLITZER
CHORUSED_WURLITZER
CLOSE_XYLOPHONE
WIDE_XYLOPHONE
ROOMY_XYLOPHONE
OLD_XYLOPHONE
WARM_XYLOPHONE
GARAGE_XYLOPHONE
CATHEDRAL_XYLOPHONE
DELAYED_XYLOPHONE

FIG. 42J

LIST OF EXEMPLARY INSTRUMENT TYPES (I.E. NEW CATEGORY) THAT ARE SUPPORTED BY THE AUTOMATED MUSIC PERFORMANCE SYSTEM OF THE PRESENT INVENTION

| TITLE | NAME | ID | INSTRUMENT TYPE (NEW CATEGORY) |
|---|---|---|---|
| LONG_TEXTURE | LONG_TEXTURE | 43 | AMBIENCE |
| SHORT_TEXTURE | SHORT_TEXTURE | 42 | AMBIENCE |
| CIMBASSO | CIMBASSO | 111 | BRASS |
| FRENCH_HORN_ENSEMBLE | FRENCH_HORN_ENSEMBLE | | BRASS |
| FRENCH_HORN_SOLO | FRENCH_HORN_SOLO | 108 | BRASS |
| SYNTH_BRAAAMS | SYNTH_BRAAAMS | | BRASS |
| SYNTH_BRASS | SYNTH_BRASS | 95 | BRASS |
| TROMBONE_ENSEMBLE | TROMBONE_ENSEMBLE | | BRASS |
| TROMBONE_SOLO | TROMBONE_SOLO | 110 | BRASS |
| TRUMPET_ENSEMBLE | TRUMPET_ENSEMBLE | | BRASS |
| TRUMPET_SOLO | TRUMPET_SOLO | 109 | BRASS |
| TUBA_ENSEMBLE | TUBA_ENSEMBLE | | BRASS |
| TUBA_SOLO | TUBA_SOLO | | BRASS |
| ACOUSTIC_PIANO | ACOUSTIC_PIANO | 36 | KEY |
| CELESTE | CELESTE | | KEY |
| CLAVINET | CLAVINET | | KEY |
| GLASS_HARMONICA | GLASS_HARMONICA | | KEY |
| GLOCKENSPIEL | GLOCKENSPIEL | | KEY |
| HAMMERED_DULCIMER | HAMMERED_DULCIMER | | KEY |
| HANDPAN | HANDPAN | | KEY |
| HIGH_PAD | HIGH_PAD | | KEY |
| HIGH_SYNTH_BED | HIGH_SYNTH_BED | | KEY |
| KEYBOARD | KEYBOARD | | KEY |
| LOW_PAD | LOW_PAD | 116 | KEY |
| LOW_SYNTH_BED | LOW_SYNTH_BED | | KEY |
| MID_PAD | MID_PAD | | KEY |
| MID_SYNTH_BED | MID_SYNTH_BED | 37 | KEY |
| ORGAN | ORGAN | 40 | KEY |
| SYNTH_FX | SYNTH_FX | 94 | KEY |
| SYNTH_LEAD | SYNTH_LEAD | 14 | KEY |
| SYNTH_MALLET | SYNTH_MALLET | 32 | KEY |
| SYNTH_PLUCK | SYNTH_PLUCK | 41 | KEY |
| SYNTH_PULSE | SYNTH_PULSE | | KEY |
| THUMB_PIANO | THUMB_PIANO | | KEY |
| TOY_PIANO | TOY_PIANO | | KEY |
| VIBRAPHONE | VIBRAPHONE | | KEY |
| WOOD_MALLET | WOOD_MALLET | | KEY |
| WURLITZER | WURLITZER | | KEY |
| XYLOPHONE | XYLOPHONE | | KEY |
| ELECTRIC_KEYS | ELECTRIC_KEYS | 57 | KEY |
| MALLET | MALLET | 38 | KEY |

FIG. 43A

LIST OF EXEMPLARY INSTRUMENT TYPES (I.E. NEW CATEGORY) THAT ARE SUPPORTED BY THE AUTOMATED MUSIC PERFORMANCE SYSTEM OF THE PRESENT INVENTION

| TITLE | NAME | INSTRUMENT TYPE | |
|---|---|---|---|
| PAD | PAD | 39 | KEY |
| SYNTH_KEYS | SYNTH_KEYS | 56 | KEY |
| MUSIC_BOX | MUSIC_BOX | | KEY |
| DRUM_KIT | DRUM_KIT | 51 | NONE |
| NONE | NONE | 32 | NONE |
| AUX_DRUM | AUX_DRUM | | PERCUSSION |
| AUX_PERC | AUX_PERC | | PERCUSSION |
| BASS_DRUM | BASS_DRUM | | PERCUSSION |
| BOWED_VIBRA PHONE | BOWED_VIBRA PHONE | | PERCUSSION |
| BRUSH_SNARE | BRUSH_SNARE | | PERCUSSION |
| COWBELL | COWBELL | | PERCUSSION |
| DRUM_PAIR | DRUM_PAIR | | PERCUSSION |
| FINGER_CYMBAL | FINGER_CYMBAL | | PERCUSSION |
| FLEXATONE | FLEXATONE | | PERCUSSION |
| FRAME_DRUM | FRAME_DRUM | | PERCUSSION |
| GONG | GONG | | PERCUSSION |
| HAND_DRUM | HAND_DRUM | | PERCUSSION |
| HAND_TAMBOURINE | HAND_TAMBOURINE | | PERCUSSION |
| HANDCLAP | HANDCLAP | | PERCUSSION |
| HOD_ROD_SNARE | HOD_ROD_SNARE | | PERCUSSION |
| JAW_HARP | JAW_HARP | | PERCUSSION |
| MARIMBA | MARIMBA | | PERCUSSION |
| MARK_TREE | MARK_TREE | | PERCUSSION |
| PERC_FX | PERC_FX | 50 | PERCUSSION |
| PIATTI | PIATTI | | PERCUSSION |
| PUILI | PUILI | | PERCUSSION |
| QUAD_TOM | QUAD_TOM | 17 | PERCUSSION |
| RAINSTICK | RAINSTICK | | PERCUSSION |
| GUIRO | GUIRO | | PERCUSSION |
| WASHBOARD | WASHBOARD | | PERCUSSION |
| SET_CYMBAL | SET_CYMBAL | | PERCUSSION |
| SET_HIT-HAT | SET_HIT-HAT | 173 | PERCUSSION |
| SET_KICK | SET_KICK | 20 | PERCUSSION |
| SHAKER | SHAKER | | PERCUSSION |
| SLIDE_WHISTLE | SLIDE_WHISTLE | | PERCUSSION |
| STICK_SNARE | STICK_SNARE | | PERCUSSION |
| SURDO | SURDO | | PERCUSSION |
| SWELL | SWELL | | PERCUSSION |
| SYNTH_CYMBAL | SYNTH_CYMBAL | | PERCUSSION |
| SYNTH_HI-HAT | SYNTH_HI-HAT | | PERCUSSION |
| SYNTH_KICK | SYNTH_KICK | | PERCUSSION |
| SYNTH_SNARE | SYNTH_SNARE | | PERCUSSION |
| SYNTH_TOM | SYNTH_TOM | | PERCUSSION |

FIG. 43B

LIST OF EXEMPLARY INSTRUMENT TYPES (I.E. NEW CATEGORY) THAT ARE SUPPORTED BY THE AUTOMATED MUSIC PERFORMANCE SYSTEM OF THE PRESENT INVENTION

| TITLE | NAME | | INSTRUMENT TYPE |
|---|---|---|---|
| TAIKO | TAIKO | | |
| TEMPLE_BLOCK | TEMPLE_BLOCK | | PERCUSSION |
| TICKIE | TICKIE | | PERCUSSION |
| TIMBALE | TIMBALE | | PERCUSSION |
| TIMPANI | TIMPANI | 230 | PERCUSSION |
| TOM_ENSEMBLE | TOM_ENSEMBLE | | PERCUSSION |
| TRIANGLE | TRIANGLE | | PERCUSSION |
| CYMBAL | CYMBAL | | PERCUSSION |
| PERCUSSION | PERCUSSION | 18 | PERCUSSION |
| SNARE | SNARE | 16 | PERCUSSION |
| CONCERT_HARP | CONCERT_HARP | 19 | PERCUSSION |
| BASS_GUITAR | BASS_GUITAR | | STRING |
| CELLO_ENSEMBLE | CELLO_ENSEMBLE | 186 | STRING |
| CELTIC_HARP | CELTIC_HARP | | STRING |
| CONTRABASS_ENSEMBLE | CONTRABASS_ENSEMBLE | | STRING |
| FINGER_GUITAR | FINGER_GUITAR | 187 | STRING |
| FINGER_UKULELE | FINGER_UKULELE | | STRING |
| LEAD_GUITAR | LEAD_GUITAR | 142 | STRING |
| MANDOLINE | MANDOLINE | | STRING |
| PICK_GUITAR | PICK_GUITAR | 93 | STRING |
| PICK_UKULELE | PICK_UKULELE | | STRING |
| STRING_FX | STRING_FX | | STRING |
| SYNTH_BASS | SYNTH_BASS | | STRING |
| SYNTH_STRING | SYNTH_STRING | 31 | STRING |
| UPRIGHT_BASS | UPRIGHT_BASS | | STRING |
| VIOLA_ENSEMBLE | VIOLA_ENSEMBLE | | STRING |
| VIOLIN_ENSEMBLE | VIOLIN_ENSEMBLE | 46 | STRING |
| ACOUSTIC_GUITAR | ACOUSTIC_GUITAR | 45 | STRING |
| ELECTRIC_BASS | ELECTRIC_BASS | 34 | STRING |
| ELECTRIC_GUITAR | ELECTRIC_GUITAR | 30 | STRING |
| SHOUT | SHOUT | 33 | STRING |
| VOCAL_FX | VOCAL_FX | | VOICE |
| | | 172 | VOICE |

FIG. 43C

SHORT LIST OF EXEMPLARY BEHAVIORS THAT ARE SUPPORTED BY THE AUTOMATED MUSIC PERFORMANCE SYSTEM OF THE PRESENT INVENTION

| BEHAVIOR | INSTRUMENT TYPE |
|---|---|
| acoustic_piano SingleNate().PedalDown()[21-108] | ACOUSTIC_PIANO |
| acoustic_piano SingleNate().PedalUp()[21-108] | ACOUSTIC_PIANO |
| acoustic_piano PedalFX(),Down() | ACOUSTIC_PIANO |
| acoustic_piano PedalFX(),Up() | ACOUSTIC_PIANO |
| aux_drum Hit().Hit() | AUX_DRUM |
| aux_drum Hit().ThreeStrokeHit() | AUX_DRUM |
| aux_drum Hit().Flam() | AUX_DRUM |
| aux_drum Hit().Rim() | AUX_DRUM |
| aux_perc Hit().Hit() | AUX_PERC |
| bass_drum Hit().Hit() | BASS_DRUM |
| bass_drum Hit().Mute() | BASS_DRUM |
| bass_drum Hit().Flam() | BASS_DRUM |
| bass_drum Hit().ThreeStrokeHit() | BASS_DRUM |
| bass_drum Hit().Cres500ms() | BASS_DRUM |
| bass_drum Hit().Cres1s() | BASS_DRUM |
| bass_drum Hit().Cres2s() | BASS_DRUM |
| bass_guitarSingleString().I().Regular().Down()[43-55] | BASS_GUITAR |
| bass_guitarSingleString().I().Regular().Up()[43-55] | BASS_GUITAR |
| bass_guitarSingleString().I().Mute().Down()[43-55] | BASS_GUITAR |
| bass_guitarSingleString().I().Mute().Up()[43-55] | BASS_GUITAR |
| bass_guitarSingleString().II().Regular().Down()[38-50] | BASS_GUITAR |
| bass_guitarSingleString().II().Regular().Up()[38-50] | BASS_GUITAR |
| bass_guitarSingleString().II().Mute().Down()[38-50] | BASS_GUITAR |
| bass_guitarSingleString().II().Mute().Up()[38-50] | BASS_GUITAR |
| bass_guitarSingleString().III().Regular().Down()[33-45] | BASS_GUITAR |
| bass_guitarSingleString().III().Regular().Up()[33-45] | BASS_GUITAR |
| bass_guitarSingleString().III().Mute().Down()[33-45] | BASS_GUITAR |
| bass_guitarSingleString().III().Mute().Up()[33-45] | BASS_GUITAR |
| bass_guitarSingleString().IV().Regular().Down()[24-40] | BASS_GUITAR |
| bass_guitarSingleString().IV().Regular().Up()[24-40] | BASS_GUITAR |
| bass_guitarSingleString().IV().Mute().Down()[24-40] | BASS_GUITAR |
| bass_guitarSingleString().IV().Mute().Up()[24-40] | BASS_GUITAR |
| bass_guitar FX().FX().Chug() | BASS_GUITAR |
| bass_guitar FXFingerNoise().FingerNoise().High().Short().Down() | BASS_GUITAR |
| bass_guitar FXFingerNoise().FingerNoise().High().Short().Up() | BASS_GUITAR |
| bass_guitar FXFingerNoise().FingerNoise().High().Medium().Down() | BASS_GUITAR |
| bass_guitar FXFingerNoise().FingerNoise().High().Medium().Up() | BASS_GUITAR |
| bass_guitar FXFingerNoise().FingerNoise().High().Long().Down() | BASS_GUITAR |
| bass_guitar FXFingerNoise().FingerNoise().High().Long().Up() | BASS_GUITAR |
| bass_guitar FXFingerNoise().FingerNoise().Low().Short().Down() | BASS_GUITAR |
| bass_guitar FXFingerNoise().FingerNoise().Low().Short().Up() | BASS_GUITAR |
| bass_guitar FXFingerNoise().FingerNoise().Low().Medium().Down() | BASS_GUITAR |

FIG. 44A

SHORT LIST OF EXEMPLARY BEHAVIORS THAT ARE SUPPORTED BY THE AUTOMATED MUSIC PERFORMANCE SYSTEM OF THE PRESENT INVENTION

| BEHAVIOR | INSTRUMENT TYPE |
|---|---|
| bass_guitar FXFingerNoise().FingerNoise().Low().Medium().Up() | BASS_GUITAR |
| bass_guitar FXFingerNoise().FingerNoise().Low().Long().Down() | BASS_GUITAR |
| bass_guitar FXFingerNoise().FingerNoise().Low().Long().Up() | BASS_GUITAR |
| bass_guitar Ornament().Slide().I().Short().Down()[44-55] | BASS_GUITAR |
| bass_guitar Ornament().Slide().I().Short().Up()[44-55] | BASS_GUITAR |
| bass_guitar Ornament().Slide().I().Long().Down()[44-55] | BASS_GUITAR |
| bass_guitar Ornament().Slide().I().Long().Up()[44-55] | BASS_GUITAR |
| bass_guitar Ornament().Slide().II().Short().Down()[39-50] | BASS_GUITAR |
| bass_guitar Ornament().Slide().II().Short().Up()[39-50] | BASS_GUITAR |
| bass_guitar Ornament().Slide().II().Long().Down()[39-50] | BASS_GUITAR |
| bass_guitar Ornament().Slide().II().Long().Up()[39-50] | BASS_GUITAR |
| bass_guitar Ornament().Slide().III().Short().Down()[34-45] | BASS_GUITAR |
| bass_guitar Ornament().Slide().III().Short().Up()[34-45] | BASS_GUITAR |
| bass_guitar Ornament().Slide().III().Long().Down()[34-45] | BASS_GUITAR |
| bass_guitar Ornament().Slide().III().Long().Up()[34-45] | BASS_GUITAR |
| bass_guitar Ornament().Slide().IV().Short().Down()[29-40] | BASS_GUITAR |
| bass_guitar Ornament().Slide().IV().Short().Up()[29-40] | BASS_GUITAR |
| bass_guitar Ornament().Slide().IV().Long().Down()[29-40] | BASS_GUITAR |
| bass_guitar Ornament().Slide().IV().Long().Up()[29-40] | BASS_GUITAR |
| bowed_vibraphone SingleNote().Short()[36-96] | BOWED_VIBRAPHONE |
| bowed_vibraphone SingleNote().Long()[36-96] | BOWED_VIBRAPHONE |
| brush_snare Hit().Slide() | BRUSH_SNARE |
| brush_snare Hit().Swirl() | BRUSH_SNARE |
| brush_snare Hit().Dead() | BRUSH_SNARE |
| brush_snare Hit().Push() | BRUSH_SNARE |
| brush_snare Hit().Hit() | BRUSH_SNARE |
| brush_snare Hit().Flam() | BRUSH_SNARE |
| brush_snare Hit().ThreeStrokeHit() | BRUSH_SNARE |
| celeste SingleNote().Regular() | CELESTE |
| celeste PedalFX().Down().FX() | CELESTE |
| celeste PedalFX().Up().FX() | CELESTE |
| cello_ensemble FlavorNote().Pizzicato()[36-72] | CELLO_ENSEMBLE |
| cello_ensemble FlavorNote().FortePiano()[36-72] | CELLO_ENSEMBLE |
| cello_ensemble FlavorNote().Sforzando()[36-72] | CELLO_ENSEMBLE |
| cello_ensemble FlavorNote().Harmonic()[48-84] | CELLO_ENSEMBLE |
| cello_ensemble FlavorNote().ConSordino()[36-72] | CELLO_ENSEMBLE |
| cello_ensemble FlavorNote().Tremelo()[36-72] | CELLO_ENSEMBLE |
| cello_ensemble FlavorNote().ColLegno()[36-72] | CELLO_ENSEMBLE |
| cello_ensemble FlavorNote().SulPonticello()[36-72] | CELLO_ENSEMBLE |
| cello_ensemble SingleNote().Spiccato().Down()[36-72] | CELLO_ENSEMBLE |
| cello_ensemble SingleNote().Spiccato().Down()[36-72] | CELLO_ENSEMBLE |
| cello_ensemble SingleNote().Spiccato().Up90[36-72] | CELLO_ENSEMBLE |

FIG. 44B

SHORT LIST OF EXEMPLARY BEHAVIORS THAT ARE SUPPORTED BY THE AUTOMATED MUSIC PERFORMANCE SYSTEM OF THE PRESENT INVENTION

| BEHAVIOR | INSTRUMENT TYPE |
|---|---|
| cello_ensemble SingleNote().Tenuto().Down()[36-72] | CELLO_ENSEMBLE |
| cello_ensemble SingleNote().Tenuto().Up()[36-72] | CELLO_ENSEMBLE |
| cello_ensemble SingleNote().NonVibrato().Down()[36-72] | CELLO_ENSEMBLE |
| cello_ensemble SingleNote().NonVibrato().Up()[36-72] | CELLO_ENSEMBLE |
| cello_ensemble SingleNote().Vibrato().Down()[36-72] | CELLO_ENSEMBLE |
| cello_ensemble SingleNote().Vibrato().Up()[36-72] | CELLO_ENSEMBLE |
| celtic_harp SingleNote().Regular()[36-96] | CELTIC_HARP |
| cimbasso | CIMBASSO |
| clavinet SingleNote().Regular()[30-88] | CLAVINET |
| clavinet SingleNote().Mute()[30-88] | CLAVINET |
| clavinet SingleNote().Short()[30-88] | CLAVINET |
| concert_harp SingleNote().Regular()[21-108] | CONCERT_HARP |
| contrabass_ensemble FlavorNote().Pizzicato()[24-48] | CONTRABASS_ENSEMBLE |
| contrabass_ensemble FlavorNote().FortePiano()[24-48] | CONTRABASS_ENSEMBLE |
| contrabass_ensemble FlavorNote().Sforzando()[24-48] | CONTRABASS_ENSEMBLE |
| contrabass_ensemble FlavorNote().Harmonic()[36-60] | CONTRABASS_ENSEMBLE |
| contrabass_ensemble FlavorNote().ConSordino()[24-48] | CONTRABASS_ENSEMBLE |
| contrabass_ensemble FlavorNote().Tremelo()[24-48] | CONTRABASS_ENSEMBLE |
| contrabass_ensemble FlavorNote().ColLegno()[24-48] | CONTRABASS_ENSEMBLE |
| contrabass_ensemble FlavorNote().SulPonticello()[24-48] | CONTRABASS_ENSEMBLE |
| contrabass_ensemble SingleNote().Spiccato().Down()[24-48] | CONTRABASS_ENSEMBLE |
| contrabass_ensemble SingleNote().Spiccato().Up()[24-48] | CONTRABASS_ENSEMBLE |
| contrabass_ensemble SingleNote().Staccato().Down()[24-48] | CONTRABASS_ENSEMBLE |
| contrabass_ensemble SingleNote().Staccato().Up()[24-48] | CONTRABASS_ENSEMBLE |
| contrabass_ensemble SingleNote().Tenuto().Down()[24-48] | CONTRABASS_ENSEMBLE |
| contrabass_ensemble SingleNote().Tenuto().Up()[24-48] | CONTRABASS_ENSEMBLE |
| contrabass_ensemble SingleNote().NonVibrato().Down()[24-48] | CONTRABASS_ENSEMBLE |
| contrabass_ensemble SingleNote().NonVibrato().Up()[24-48] | CONTRABASS_ENSEMBLE |
| cowbell Hit().Hit() | COWBELL |
| cowbell Hit().Dead() | COWBELL |
| cowbell Hit().Mute() | COWBELL |
| drum_kit | DRUM_KIT |
| drum_pair Hit().High().FingerSide() | DRUM_PAIR |
| drum_pair Hit().High().FingerCenter() | DRUM_PAIR |
| drum_pair Hit().High().HandSide() | DRUM_PAIR |
| drum_pair Hit().High().HandSlap() | DRUM_PAIR |
| drum_pair Hit().High().HandOpenCenter() | DRUM_PAIR |
| drum_pair Hit().High().HandClosedCenter() | DRUM_PAIR |
| drum_pair Hit().High().PalmCenter() | DRUM_PAIR |
| drum_pair Hit().High().HandMute() | DRUM_PAIR |
| drum_pair Hit().High().FlamRimSide() | DRUM_PAIR |
| drum_pair Hit().High().FlamCenter() | DRUM_PAIR |
| drum_pair Hit().High().ThreeStrokeHit() | DRUM_PAIR |

FIG. 44C

SHORT LIST OF EXEMPLARY BEHAVIORS THAT ARE SUPPORTED BY THE AUTOMATED MUSIC PERFORMANCE SYSTEM OF THE PRESENT INVENTION

| BEHAVIOR | INSTRUMENT TYPE |
|---|---|
| drum_pair Hit().High().Swipe() | DRUM_PAIR |
| drum_pair Hit().Low().FingerSide() | DRUM_PAIR |
| drum_pair Hit().Low().FingerCenter() | DRUM_PAIR |
| drum_pair Hit().Low().HandSide() | DRUM_PAIR |
| drum_pair Hit().Low().HandSlap() | DRUM_PAIR |
| drum_pair Hit().Low().HandOpenCenter() | DRUM_PAIR |
| drum_pair Hit().Low().HandClosedCenter() | DRUM_PAIR |
| drum_pair Hit().Low().PalmCenter() | DRUM_PAIR |
| drum_pair Hit().Low().HandMute() | DRUM_PAIR |
| drum_pair Hit().Low().FlamRimSide() | DRUM_PAIR |
| drum_pair Hit().Low().FlamCenter() | DRUM_PAIR |
| drum_pair Hit().Low().ThreeStrokeHit() | DRUM_PAIR |
| drum_pair Hit().Low().Swipe() | DRUM_PAIR |
| finger_cymbal Hit().Hit() | FINGER_CYMBAL |
| finger_cymbal Hit().Mute() | FINGER_CYMBAL |
| finger_cymbal Hit().ClapClosed() | FINGER_CYMBAL |
| finger_cymbal Hit().ClapOpen() | FINGER_CYMBAL |
| finger_cymbal Hit().FlangeOpen() | FINGER_CYMBAL |
| finger_cymbal Hit().SwipetoRing() | FINGER_CYMBAL |
| finger_cymbal Hit().Spin() | FINGER_CYMBAL |
| finger_guitar SingleString().VI().Dead()[40-45] | FINGER_GUITAR |
| finger_guitar SingleString().VI().Mute()[40-45] | FINGER_GUITAR |
| finger_guitar SingleString().VI().Regular()[40-45] | FINGER_GUITAR |
| finger_guitar SingleString().V().Dead()[45-50] | FINGER_GUITAR |
| finger_guitar SingleString().V().Mute()[45-50] | FINGER_GUITAR |
| finger_guitar SingleString().V().Regular()[45-50] | FINGER_GUITAR |
| finger_guitar SingleString().IV().Dead()[50-55] | FINGER_GUITAR |
| finger_guitar SingleString().IV().Mute()[50-55] | FINGER_GUITAR |
| finger_guitar SingleString().IV().Regular()[50-55] | FINGER_GUITAR |
| finger_guitar SingleString().II().Dead()[59-66] | FINGER_GUITAR |
| finger_guitar SingleString().II().Mute()[59-66] | FINGER_GUITAR |
| finger_guitar SingleString().II().Regular()[59-66] | FINGER_GUITAR |
| finger_guitar SingleString().III().Dead()[55-60] | FINGER_GUITAR |
| finger_guitar SingleString().III().Mute()[55-60] | FINGER_GUITAR |
| finger_guitar SingleString().III().Regular()[55-60] | FINGER_GUITAR |
| finger_guitar SingleString().I().Dead()[64-71] | FINGER_GUITAR |
| finger_guitar SingleString().I().Mute()[64-71] | FINGER_GUITAR |
| finger_guitar SingleString().I().Regular()[64-71] | FINGER_GUITAR |
| finger_guitar FXStrings().Dead().High() | FINGER_GUITAR |
| finger_guitar FXStrings().Dead().Low() | FINGER_GUITAR |
| finger_guitar FXFingerNoise().Noise().Long().Down() | FINGER_GUITAR |
| finger_guitar FXFingerNoise().Noise().Long().Up() | FINGER_GUITAR |
| finger_guitar FXFingerNoise().Noise().Short().Down() | FINGER_GUITAR |

FIG. 44D

SHORT LIST OF EXEMPLARY BEHAVIORS THAT ARE SUPPORTED BY THE AUTOMATED MUSIC PERFORMANCE SYSTEM OF THE PRESENT INVENTION

| BEHAVIOR | INSTRUMENT TYPE |
|---|---|
| finger_guitar FXFingerNoise().Noise().Short().Up() | FINGER_GUITAR |
| finger_guitar FXOther().Other().Fgrtp() | FINGER_GUITAR |
| finger_guitar FXOther().Other().Ekick() | FINGER_GUITAR |
| finger_guitar FXOther().Other().Thud() | FINGER_GUITAR |
| finger_guitar FXOther().Other().Neck() | FINGER_GUITAR |
| finger_guitar FXOther().Other().Palm() | FINGER_GUITAR |
| finger_ukulele SingleString().IV()[60-67] | FINGER_UKULELE |
| finger_ukulele SingleString().III()[64-71] | FINGER_UKULELE |
| finger_ukulele SingleString().II()[67-74] | FINGER_UKULELE |
| finger_ukulele SingleString().I()[69-76] | FINGER_UKULELE |
| flexatone Hit().Low() | FLEXATONE |
| flexatone Hit().High() | FLEXATONE |
| flexatone Hit().LowToHigh() | FLEXATONE |
| flexatone Hit().HighToLow() | FLEXATONE |
| flexatone Hit().Wiggle() | FLEXATONE |
| flexatone Hit().Swell500ms() | FLEXATONE |
| flexatone Hit().Swell1s() | FLEXATONE |
| flexatone Hit().Swell2s() | FLEXATONE |
| frame_drum Hit().ThumbCenter() | FRAME_DRUM |
| frame_drum Hit().FingerSide() | FRAME_DRUM |
| frame_drum Hit().FlamCenter() | FRAME_DRUM |
| frame_drum Hit().FlamRim() | FRAME_DRUM |
| frame_drum Hit().ThreeStrokeHitRim() | FRAME_DRUM |
| frame_drum Hit().ThreeStrokeHitCenter() | FRAME_DRUM |
| frame_drum Hit().Swipe() | FRAME_DRUM |
| frame_drum Hit().RollCenter() | FRAME_DRUM |
| frame_drum Hit().RollEdge() | FRAME_DRUM |
| frame_drum Hit().DeadRim() | FRAME_DRUM |
| frame_drum Hit().DeadCenter() | FRAME_DRUM |
| frame_drum Hit().HardMalletHit() | FRAME_DRUM |
| frame_drum Hit().SoftMalletHit() | FRAME_DRUM |
| french_horn_ensemble | FRENCH_HORN_ENSEMB |
| french_horn_solo | FRENCH_HORN_SOLO |
| glass_harmonica SingleNote().Short()[48-96] | GLASS_HARMONICA |
| glass_harmonica SingleNote().Long()[48-96] | GLASS_HARMONICA |
| glockenspiel SingleNote().Regular()[60-108] | GLOCKENSPIEL |
| gong Hit().Hit() | GONG |
| gong Hit().Cres2s() | GONG |
| guiro Hit().LongDown() | GUIRO |
| guiro Hit().LongUp() | GUIRO |
| guiro Hit().ShortDown() | GUIRO |
| guiro Hit().ShortUp() | GUIRO |
| hammered_dulcimer SingleNote().Regular()[55-98] | HAMMERED_DULCIMER |

FIG. 44E

| AUDIO SOUND SOURCES THAT CAN BE SAMPLED DURING A SAMPLING AND RECORDING SESSION TO PRODUCE A DEEPLY-SAMPLED VIRTUAL MUSICAL INSTRUMENT (DS-VMI) ACCORDING TO THE PRESENT INVENTION CAPABLE OF PRODUCING "SAMPLED AUDIO SOUNDS" |
|---|
| (i) REAL MUSICAL INSTRUMENTS TYPICALLY TUNED TO PRODUCE TONAL SOUNDS OR NOTES (E.G. PIANO, DRUMS, STRING INSTRUMENTS, HORNS, ETC.), |
| (ii) NATURAL ATONAL AUDIO SOUND SOURCES (E.G. OCEAN BREEZES, THUNDER STORMS, AIRSTREAMS, BABBLING BROOKS, DOORS CLOSING, AND ELECTRONIC SOUND SYNTHESIZERS) |
| (iii) HUMAN VOICE(S) SINGING OR SPEAKING |
| (iV) ANIMALS PRODUCING AUDIO SOUNDS |
| |

FIG. 45

SAMPLING TEMPLATE FOR ORGANIZING AND MANAGING AN AUDIO SAMPLING AND RECORDING SESSION INVOLVING THE DEEP SAMPLING OF A SPECIFIED TYPE OF REAL MUSICAL INSTRUMENT TO PRODUCE A DEEPLY-SAMPLED VIRTUAL MUSICAL INSTRUMENT (DS-VMI) LIBRARY

| REAL INSTRUMENT NAME | | | | | | **INSTRUMENT TYPE **** |
|---|---|---|---|---|---|---|
| RECORDING SESSION: PLACE, DATE, TIME, AND PEOPLE | | | | | | |
| CATEGORIZING ESSENTIAL ATTRIBUTES FOR EACH NOTE SAMPLE | | | | | | |
| MANUAL TYPE/STYLE | SAMPLE-HOLD TRIGGER STYLE | | | SAMPLE RELEASE TYPE | | |
| ARTICULATION TYPE | NUMBER OF ROUNDS IN ROUND ROBIN COUNT | | | **BEHAVIOR/ASPECTS**** | | |
| MICROPHONES AND POSITIONS | MIDI DYNAMIC/VELOCITY RANGE (0-127) | | | | | |
| MIDI NOTE RANGE (0-127) | 0 | 1 | 2 | 3 | • • • | 127 |
| 0 | | | | | | |
| 1 | | | | | | |
| 2 | | | | | | |
| 3 | | | | | | |
| • • • | | | | | | |
| 127 | | | | | | |
| ** EACH INSTRUMENT TYPE IS SAMPLED IN A DIFFERENT BUT PRINCIPLED MANNER BASED ON ITS CLASSIFIED BEHAVIOR WITHIN AN INSTRUMENT TYPE AND BEHAVIOR BASED SCHEMA | | | | | | |

FIG. 46

MUSICAL INSTRUMENT DATA FILE ORGANIZING AND MANAGING SAMPLE DATA RECORDED DURING AN AUDIO SAMPLING AND RECORDING SESSION INVOLVING THE DEEP SAMPLING OF A SPECIFIED TYPE OF REAL MUSICAL INSTRUMENT TO PRODUCE MUSICAL INSTRUMENT DATA FILE FOR A DEEPLY-SAMPLED VIRTUAL MUSICAL INSTRUMENT

| REAL INSTRUMENT NAME | | | | | INSTRUMENT TYPE (CATEGORY) | |
|---|---|---|---|---|---|---|
| RECORDING SESSION: PLACE, DATE, TIME, AND PEOPLE | | | | | | |
| CATEGORIZING ESSENTIAL ATTRIBUTES FOR EACH NOTE SAMPLE | | | | | | |
| MANUAL TYPE/STYLE | SAMPLE-HOLD TRIGGER STYLE | | | SAMPLE RELEASE TYPE | | |
| ARTICULATION TYPE | NUMBER OF ROUNDS IN ROUND ROBIN COUNT | | | BEHAVIOR/ASPECTS | | |
| MICROPHONES AND POSITIONS | MIDI DYNAMIC/VELOCITY RANGE (0-127) | | | | | |
| MIDI NOTE RANGE (0-127) | 0 | 1 | 2 | 3 | • • • | 127 |
| 0 | | | | | | |
| 1 | | | | | | |
| 2 | | | | | | |
| 3 | | | | | | |
| • • • | | | | | | |
| 127 | | | | | | |

FIG. 47

| DEFINING A VIRTUAL MUSICAL INSTRUMENT<br>VIRTUAL MUSICAL INSTRUMENT DATA SET CONTAINING ALL DATA FILES FOR THE SETS OF SAMPLED NOTES PERFORMED BY A SPECIFIED TYPE OF REAL MUSICAL INSTRUMENT DEEPLY-SAMPLED DURING AN AUDIO SAMPLING SESSION AND MAPPED TO NOTE/VELOCITY/MICROPHONE/ROUND-ROBIN DESCRIPTORS<br>**MUSICAL INSTRUMENT SAMPLE DATA FILE** | | | | | | |
|---|---|---|---|---|---|---|
| VIRTUAL INSTRUMENT NAME | | | **INSTRUMENT TYPE (CATEGORY)** | | | |
| RECORDING SESSION: PLACE, DATE, TIME, AND PEOPLE | | | | | | |
| CATEGORIZING ATTRIBUTES FOR EACH NOTE SAMPLE | | | | | | |
| MANUAL TYPE/STYLE | NUMBER OF ROUNDS IN ROUND ROBIN COUNT | | | SAMPLE RELEASE TYPE | | |
| ARTICULATION TYPE | SAMPLE-HOLD TRIGGER STYLE | | | **BEHAVIOR/ASPECTS** | | |
| MICROPHONES AND POSITIONS | MIDI DYNAMIC/VELOCITY RANGE (0-127) | | | | | |
| MIDI NOTE RANGE (0-127) | 0 | 1 | 2 | 3 | . . . | 127 |
| 0 | | | | | | |
| 1 | | | | | | |
| 2 | | | | | | |
| 3 | | | | | | |
| . . . | | | | | | |
| 127 | | | | | | |
| MUSICAL INSTRUMENT PERFORMANCE LOGIC (RULES): f(TYPE) | | | | | | |

FIG. 48

MUSIC-THEORETIC STATE (MTS) RESPONSIVE VIRTUAL MUSICAL INSTRUMENT (VMI) CONTRACTING/SELECTION LOGIC FOR AUTOMATICALLY SELECTING SPECIFIC DEEPLY-SAMPLED VIRTUAL MUSICAL INSTRUMENTS TO PERFORM IN THE DIGITAL PERFORMANCE OF A MUSIC COMPOSITION

VIRTUAL MUSICAL INSTRUMENT
VM INSTRUMENT ID #
INSTRUMENT DATA SAMPLE FILE:
INSTRUMENT DEFINITION:
TYPE: XXX
BEHAVIORS: XXX
ASPECTS: XXX

MUSIC-THEORETIC STATE (I.E. MUSIC META-DATA) RESPONSIVE VMI CONTACTING/SELECTION LOGIC

RULE FORMAT: IF X (MUSIC-THEORETIC STATE {Si} EXISTS OR IS SATISFIED, THEN SELECT DS-VMI # XXX)

FIG. 49

MUSIC-THEORETIC STATE (MTS) RESPONSIVE PERFORMANCE LOGIC FOR CONTROLLING SPECIFIC TYPES OF PERFORMANCE OF EACH DEEPLY-SAMPLED VIRTUAL MUSICAL INSTRUMENT SUPPORTED IN THE DEEPLY-SAMPLED VIRTUAL MUSICAL INSTRUMENT (DS-VMI) LIBRARY MANAGEMENT SUBSYSTEM OF THE PRESENT INVENTION

VIRTUAL MUSICAL INSTRUMENT
VM INSTRUMENT ID #
INSTRUMENT DATA SAMPLE FILE:
INSTRUMENT DEFINITION:
TYPE: XXX
BEHAVIORS: XXX
ASPECTS: XXX

MUSIC-THEORETIC STATE (I.E. MUSIC META-DATA) RESPONSIVE PERFORMANCE LOGIC (I.E. RULES) FOR PROCESSING SAMPLES SELECTED FROM A DEEPLY-SAMPLED VIRTUAL MUSICAL INSTRUMENT

RULE FORMAT: IF X (MUSIC-THEORETIC STATE {Si} EXISTS OR IS SATISFIED, THEN DO Y)

EXAMPLE PERFORMANCE RULES:
1. IF Sj, THEN [PLAY A SIMPLE HIT AT {X} VELOCITY ]
2. IF Sk, THEN [STRUM A GUITAR WITH 6 STRINGS, MUTING THE FIRST TWO, PLAYING AN UPSTROKE ON ALL 6 STRINGS, ASSEMBLING THIS POSITION OF A CHORD ]
3. IF Sn, THEN DO Yn
4. …

FIG. 50

METHOD OF SAMPLING, RECORDING AND CATALOGING REAL MUSICAL INSTRUMENTS FOR USE IN DEVELOPING CORRESPONDING DEEPLY-SAMPLED VIRTUAL MUSICAL INSTRUMENTS FOR DEPLOYMENT IN THE DEEPLY-SAMPLED VIRTUAL MUSICAL INSTRUMENT (DS-VMI) LIBRARY MANAGEMENT SYSTEM OF PRESENT INVENTION

METHOD OF OPERATING THE AUTOMATED MUSIC PERFORMANCE SYSTEM OF THE PRESENT INVENTION

STEP A: USING THE MUSIC COMPOSITION META-DATA ABSTRACTION SUBSYSTEM TO AUTOMATICALLY PARSE AND ANALYZE EACH TIME-UNIT (I.E. BEAT/MEASURE) IN A MUSIC COMPOSITION TO BE DIGITALLY PERFORMED SO AS TO AUTOMATICALLY ABSTRACT AND PRODUCE A SET OF TIME-LINE INDEXED MUSIC-THEORETIC STATE DESCRIPTOR DATA (I.E. MUSIC COMPOSITION META-DATA) SPECIFYING THE MUSIC-THEORETIC STATES OF THE MUSIC COMPOSITION INCLUDING NOTE AND COMPOSITION META-DATA

↓

STEP B: USING THE AUTOMATED DEEPLY-SAMPLED VIRTUAL MUSICAL INSTRUMENT (DS-VMI) SELECTION AND PERFORMANCE SUBSYSTEM AND THE AUTOMATED VMI CONTRACTING SUBSYSTEM, WITH THE SET OF MUSIC-THEORETIC STATE DESCRIPTOR DATA (I.E. MUSIC COMPOSITION META-DATA) AND THE VIRTUAL MUSICAL INSTRUMENT CONTRACTING/SELECTION LOGIC (I.E. RULES), TO AUTOMATICALLY SELECT, FOR EACH TIME-UNIT IN THE MUSIC COMPOSITION, ONE OR MORE DEEPLY-SAMPLED VIRTUAL MUSICAL INSTRUMENTS FROM THE DS-VMI LIBRARY SUBSYSTEM TO PERFORM THE SAMPLED NOTES OF A DIGITAL MUSIC PERFORMANCE OF THE MUSIC COMPOSITION

↓

STEP C: USING THE AUTOMATED DEEPLY-SAMPLED VIRTUAL MUSICAL INSTRUMENT (DS-VMI) SELECTION AND PERFORMANCE SUBSYSTEM AND THE SET OF MUSIC-THEORETIC STATE DESCRIPTOR DATA (I.E. MUSIC COMPOSITION META-DATA) TO AUTOMATICALLY ASSIGN AT LEAST ONE VIRTUAL MUSICAL INSTRUMENT TO EACH ROLE, AND FOR EACH TIME-UNIT IN THE MUSIC COMPOSITION, EVALUATE THE MUSIC COMPOSITION STATE DATA TO SELECT SAMPLED NOTES FROM DEEPLY -SAMPLED VIRTUAL MUSICAL INSTRUMENT LIBRARIES FOR A DIGITAL MUSIC PERFORMANCE OF THE MUSIC COMPOSITION

↓

STEP D: USING THE AUTOMATED DEEPLY-SAMPLED VIRTUAL MUSICAL INSTRUMENT (DS-VMI) SELECTION AND PERFORMANCE SUBSYSTEM AND MUSIC-THEORETIC STATE RESPONSIVE PERFORMANCE LOGIC (I.E. RULES) IN THE DEEPLY-SAMPLED VIRTUAL MUSICAL INSTRUMENT LIBRARIES TO PROCESS AND PERFORM THE SAMPLED NOTES SELECTED FOR THE DIGITAL MUSIC PERFORMANCE OF THE MUSIC COMPOSITION

↓

STEP E: ASSEMBLING AND FINALIZING THE PROCESSED SAMPLES SELECTED FOR THE DIGITAL PERFORMANCE OF THE MUSIC COMPOSITION FOR PRODUCTION, REVIEW AND EVALUATION BY HUMAN LISTENERS

FIG. 53

FOURTH EMBODIMENT

WEB-BASED AUTOMATED DIGITAL PERFORMANCE GENERATION SYSTEM PLATFORM ACCESSIBLE USING WEB-ENABLED MOBILE AND DESKTOP CLIENT MACHINES

WIRE-FRAME MODEL OF A GUI SCREEN OF THE SYSTEM USER INTERFACE OF THE AUTOMATED MUSIC PERFORMANCE SYSTEM OF THE FOURTH ILLUSTRATIVE EMBODIMENT

TRANSFORM THE MUSICAL ARRANGEMENT AND PERFORMANCE STYLE OF A MUSIC COMPOSITION BEFORE AUTOMATED DIGITAL PERFORMANCE

(1) SELECT THE FORMAT FOR A MUSIC COMPOSITION TO BE DIGITALLY PERFORMED BY THE SYSTEM:

. SHEET MUSIC FORMAT

. MIDI MUSIC FORMAT

. MUSIC RECORDING FORMAT (2) UPLOAD THE MUSIC COMPOSITION (3) SELECT A MUSICAL ARRANGEMENT DESCRIPTOR FROM THE MENU BELOW:

. MUSICAL ARRANGEMENT NO. 01

. MUSICAL ARRANGEMENT NO. 02

. MUSICAL ARRANGEMENT NO. 03

. . . .

(4) SELECT A MUSICAL INSTRUMENT PERFORMANCE STYLE DESCRIPTOR FROM THE MENU BELOW:

. MUSICAL INSTRUMENT PERFORMANCE STYLE NO. 01

. MUSICAL INSTRUMENT PERFORMANCE STYLE NO. 02

. MUSICAL INSTRUMENT PERFORMANCE STYLE NO. 03

. . . .

(5) GENERATE A DIGITAL MUSIC PERFORMANCE OF THE MUSIC COMPOSITION

FIG. 56

MUSICAL ARRANGEMENT DESCRIPTORS SUPPORTED BY THE AUTOMATED MUSIC PERFORMANCE SYSTEM OF THE FOURTH ILLUSTRATIVE EMBODIMENT

MUSIC ARRANGEMENT NO. 01

MUSIC ARRANGEMENT NO. 02

MUSIC ARRANGEMENT NO. 03

MUSIC ARRANGEMENT NO. 04

MUSIC ARRANGEMENT NO. 05

MUSIC ARRANGEMENT NO. 06

MUSIC ARRANGEMENT NO. 07

*

*

*

*

MUSIC ARRANGEMENT NO. 10

FIG. 57

MUSICAL INSTRUMENT PERFORMANCE STYLE DESCRIPTORS SUPPORTED BY THE AUTOMATED MUSIC PERFORMANCE SYSTEM OF THE FOURTH ILLUSTRATIVE EMBODIMENT

MUSICAL INSTRUMENT PERFORMANCE STYLE NO. 01

MUSICAL INSTRUMENT PERFORMANCE STYLE NO. 02

MUSICAL INSTRUMENT PERFORMANCE STYLE NO. 03

MUSICAL INSTRUMENT PERFORMANCE STYLE NO. 04

MUSICAL INSTRUMENT PERFORMANCE STYLE NO. 05

MUSICAL INSTRUMENT PERFORMANCE STYLE NO. 06

*

*

*

*

MUSICAL INSTRUMENT PERFORMANCE STYLE NO. 10

FIG. 58

AUTOMATED PROCESS OF TRANSFORMING THE MUSICAL ARRANGEMENT AND PERFORMANCE STYLE OF A MUSIC COMPOSITION BEING DIGITALLY PERFORMED USING THE AUTOMATED MUSIC PERFORMANCE SYSTEM OF THE FOURTH ILLUSTRATIVE EMBODIMENT OF THE PRESENT INVENTION

METHOD OF AUTOMATED INSTRUMENT AND NOTE SELECTION AND PERFORMANCE USING DEEPLY-SAMPLED VIRTUAL MUSIC INSTRUMENT (DS-VMI) LIBRARIES TO GENERATE A DIGITAL PERFORMANCE OF A MUSIC COMPOSITION

METHOD OF AUTOMATED MUSIC ARRANGEMENT AND MUSICAL INSTRUMENT PERFORMANCE STYLE TRANSFORMATION WITHIN THE AUTOMATED MUSIC PERFORMANCE SYSTEM OF THE FOURTH ILLUSTRATIVE EMBODIMENT OF THE PRESENT INVENTION

A: ENABLING AN AUTOMATED MUSIC ARRANGEMENT FUNCTION WITHIN THE AUTOMATED MUSIC PERFORMANCE SYSTEM BY REMAPPING AND EDITING OF ROLES, NOTES, MUSIC METRICS AND META-DATA AUTOMATICALLY ABSTRACTED AND COLLECTED DURING MUSIC COMPOSITION ANALYSIS

↓

B: ENABLING AN AUTOMATED MUSICAL INSTRUMENT PERFORMANCE STYLE TRANSFORMATION FUNCTION IN THE SYSTEM BY SELECTING INSTRUMENT PERFORMANCE LOGIC PROVIDED FOR GROUPS OF NOTE AND INSTRUMENTS IN THE DEEPLY-SAMPLED VIRTUAL MUSICAL INSTRUMENT (DS-VMI) LIBRARIES OF THE AUTOMATED MUSIC PERFORMANCE SYSTEM, THAT ARE INDEXED WITH THE MUSICAL INSTRUMENT PERFORMANCE STYLE DESCRIPTORS SELECTED BY THE SYSTEM USER

FIG. 62

SPECIFICATION ON EXEMPLARY MUSICAL ROLES (I.E. MUSICAL PARTS) OF EACH MUSIC COMPOSITION TO BE AUTOMATICALLY ANALYZED

INSTRUMENTS WITH THEIR ASSOCIATED PERFORMANCES CAN GET THE FOLLOWING ROLES: (NOTE: A SINGLE ROLE IS ASSIGNED TO AN INSTRUMENT, AND MULTIPLE ROLES CANNOT BE ASSIGNED TO A SINGLE INSTRUMENT, BUT MULTIPLE INSTRUMENTS CAN BE ASSIGNED A SINGLE ROLE)

ACCENT - THIS IS THE ROLE THAT PROVIDES INFORMATION ON WHEN LARGE MUSICAL ACCENTS SHOULD BE PLAYED
BACK BEAT - THIS IS THE ROLE THAT PROVIDES NOTE DATA THAT HAPPEN ON THE WEAKER BEATS OF A PIECE
BACKGROUND - LOWER DENSITY ROLE, NOTES THAT OFTEN ARE THE LOWEST ENERGY AND DENSITY THAT LIVES IN THE BACKGROUND OF A COMPOSITION
BIG HIT - NOTES THAT HAPPEN OUTSIDE OF ANY MEASUREMENT, USUALLY A SINGULAR NOTE THAT HAPPENS RARELY
COLOR - THIS IS THE ROLE RESERVED FOR SMALL MUSICAL SEGMENTS THAT PLAY SEMI-REGULAR BUT ADD SMALL MUSICAL PHRASES THROUGHOUT A PIECE
CONSISTENT - THIS IS THE ROLE THAT IS RESERVED FOR PARTS THAT LIVE OUTSIDE OF THE NORMAL STRUCTURE OF PHRASE
CONSTANT - THIS IS THE ROLE THAT IS OFTEN MONOPHONIC AND HAS CONSTANT SET OF NOTES OF THE SAME VALUE (E.G.: ALL 8TH NOTES PLAYED CONSECUTIVELY)
DECORATION - SIMILAR TO COLOR, THIS ROLE IS RESERVED FOR A SMALL FLOURISH OF NOTES THAT HAPPENS LESS REGULARLY THAN COLOR
HIGH LANE - VERY ACTIVE AND HIGH-NOTE DENSITY, USUALLY RESERVED FOR PERCUSSION
HIGH-MID LANE - MOSTLY ACTIVE AND MEDIUM-NOTE DENSITY, USUALLY RESERVED FOR PERCUSSION
LOW LANE - LOW ACTIVE, LOW NOTE-DENSITY INSTRUMENT, USUALLY RESERVED FOR PERCUSSION
LOW-MID LANE - MOSTLY LOW ACTIVITY, MOSTLY LOW NOTE-DENSITY INSTRUMENT, USUALLY RESERVED FOR PERCUSSION
MIDDLE - MIDDLE ACTIVITY, ABOVE THE BACKGROUND ROLE, BUT NOT PRIMARY OR SECONDARY INFORMATION.
ON BEAT - NOTES THAT HAPPEN ON STRONG BEATS
PAD - LONG HELD NOTES THAT PLAY AT EVERY CHORD CHANGE
PEDAL - LONG HELD NOTES, THAT HOLD THE SAME NOTE THROUGHOUT A SECTION
PRIMARY - ROLE THAT IS THE "LEAD" OR MAIN MELODIC PART
SECONDARY - ROLE THAT IS SECONDARY TO THE "LEAD" PART, OFTEN THE COUNTERPOINT TO THE PRIMARY ROLE

---

DRUM SET ROLES: (THIS IS A SINGLE PERFORMER THAT HAS MULTIPLE INSTRUMENTS WHICH ARE ASSIGNED MULTIPLE ROLES THAT ARE AWARE OF EACH OTHER)
HI-HAT - DRUM SET ROLE THAT DOES HI-HAT NOTES
SNARE - DRUM SET ROLE THAT DOES SNARE NOTES
CYMBAL - DRUM SET ROLE OF THAT DOES EITHER A CRASH OR A RIDE
TOM - DRUM SET ROLE THAT DOES THE TOM PARTS
KICK - DRUM SET ROLE THAT DOES KICK NOTES

FIG. 63

GRAPHICAL REPRESENTATION OF A TRANSFORMED MUSIC-THEORETIC STATE DESCRIPTOR DATA FILE AUTOMATICALLY PRODUCED FOR AN EXEMPLARY MUSIC COMPOSITION CONTAINING ROLES, NOTE DATA, MUSIC METRICS AND META-DATA, AND TRANSFORMED IN RESPONSE TO MUSICAL ARRANGEMENT DESCRIPTORS PROVIDED TO THE SYSTEM USER INTERFACE

| ROLE | NOTE#'S | TIME UNIT (BEAT #1) | | | |
|---|---|---|---|---|---|
| | | | | | |
| | | | | | |
| | | | | | |
| | | | | | |
| | | | | | |
| | | | | | |
| | | | | | |
| | | | | | |
| | | * * * | | | |
| | | | | | |
| METRICS, AND META-DATA | | | | | |

FIG. 64

SPECIFICATION OF A DEEPLY-SAMPLED VIRTUAL MUSICAL INSTRUMENT (DS-VMI) LIBRARY PROVIDED WITH MUSIC INSTRUMENT PERFORMANCE LOGIC RESPONSIVE TO MUSIC PERFORMANCE STYLE DESCRIPTORS PROVIDED TO THE SYSTEM USER INTERFACE

| **MUSICAL INSTRUMENT SAMPLE DATA FILE** | | | | | | |
|---|---|---|---|---|---|---|
| VIRTUAL INSTRUMENT NAME | | | **INSTRUMENT TYPE (CATEGORY)** | | | |
| RECORDING SESSION: PLACE, DATE, TIME, AND PEOPLE | | | | | | |
| CATEGORIZING ATTRIBUTES FOR EACH NOTE SAMPLE | | | | | | |
| MANUAL TYPE/STYLE | NUMBER OF ROUNDS IN ROUND ROBIN COUNT | | | SAMPLE RELEASE TYPE | | |
| ARTICULATION TYPE | SAMPLE-HOLD TRIGGER STYLE | | | **BEHAVIOR/ASPECTS** | | |
| MICROPHONES AND POSITIONS | MIDI DYNAMIC/VELOCITY RANGE (0-127) | | | | | |
| MIDI NOTE RANGE (0-127) | 0 | 1 | 2 | 3 | • • • | 127 |
| 0 | | | | | | |
| 1 | | | | | | |
| 2 | | | | | | |
| • • • | | | | | | |
| 127 | | | | | | |
| MUSICAL INSTRUMENT PERFORMANCE LOGIC (I.E. RULES) INDEXED/TAGGED WITH ONE OR MORE MUSIC INSTRUMENT PERFORMANCE STYLE DESCRIPTORS LISTED IN FIG. 58 | | | | | | |

FIG. 66

TRANSFORMED MUSIC-THEORETIC STATE DATA DESCRIPTORS AUTOMATICALLY EVALUATED BY THE AUTOMATED MUSIC PERFORMANCE SYSTEM SO AS TO GENERATE A DIGITAL PERFORMANCE OF THE MUSIC COMPOSITION, HAVING A MUSICAL ARRANGEMENT AND A MUSICAL INSTRUMENT PERFORMANCE STYLE REFLECTED BY THE MUSIC ARRANGEMENT AND PERFORMANCE STYLE DESCRIPTORS PROVIDED TO THE SYSTEM USER INTERFACE OF THE SYSTEM

PRIMARY EVALUATION LEVEL:
. RHYTHMIC DENSITY BY TEMPO
. DURATION OF NOTES
. MIDI NOTE VALUE (A1, B2, ETC.
. DYNAMICS

STATIC NOTE RELATIONSHIPS:
. POSITION OF NOTES IN A CHORD
. METER AND POSITION OF STRONG AND WEAK BEATS
. POSITION OF NOTES IN A MEASURE
. POSITION OF NOTES IN A PHRASE
. POSITION OF NOTES IN A SECTION
. POSITION OF NOTES IN A REGION

NOTE MODIFIER (ALTERNATE SAMPLE SELECTION, AFTER BEHAVIOR SELECTION) EVALUATION LEVEL:
SITUATIONAL RELATIONSHIP:
. MIDI NOTE VALUE PRECEDENCE AND ANTECEDENCE
. POSITION OR EXISTENCE OF NOTES FROM OTHER INSTRUMENT LANES
. RELATION OF SECTIONS TO EACH OTHER
. ACCENTS
. TIMING BASED RHYTHM MODIFIERS

INSTRUMENT SELECTION (SAMPLE BANK / PERFORMANCE ASSIGNMENT):
. WHAT INSTRUMENTS ARE AVAILABLE
. WHAT INSTRUMENTS ARE PLAYING
. WHAT INSTRUMENTS SHOULD OR MIGHT BE PLAYED
. WHAT INSTRUMENTS ARE ASSIGNED TO A ROLE (E.G. PLAY IN BACKGROUND, PLAY AS A BED, PLAY BASS, ETC.)
. HOW MANY INSTRUMENTS ARE AVAILABLE

FIG. 68

METHOD OF AND SYSTEM FOR AUTOMATICALLY GENERATING DIGITAL PERFORMANCES OF MUSIC COMPOSITIONS USING NOTES SELECTED FROM VIRTUAL MUSICAL INSTRUMENTS BASED ON THE MUSIC-THEORETIC STATES OF THE MUSIC COMPOSITIONS

BACKGROUND OF INVENTION

Field of Invention

The present invention is directed to new and improved methods of and apparatus for producing libraries of sampled and/or synthesized virtual musical instruments that can be used to produce automated digital performances of music compositions having greater degree of uniqueness, expressiveness and realism, in diverse end-user applications.

Brief Description of the State of Art

Applicant's mission is to enable anyone to express themselves creatively through music regardless of their background, expertise, or access to resources. With this goal in mind, Applicant has been inventing and building tools powered by innovative technology designed to help people create and customize original music. As part of this process, Applicant has been bringing human know-how to automated music composition, performance, and production technology. This has involved creating sound sample libraries and datasets, for use in automatically composing, performing and producing high quality music through the fusion of advanced music theory and technological innovation. To date, Applicant's commercial AI-based music composition and production system, marketed under the brand name AMPER SCORE™, supports over one million individual samples and thousands of unique virtual musical instruments capable of producing a countless number of unique audio sounds to express and amplify human creative expression. Recorded by hand, every audio sound sample in Applicant's virtual musical instrument (VMI) sound sample libraries is sculpted with meticulous attention to detail and quality.

In view of the above, Applicant seeks to significantly improve upon and advance the art and technology of sampling sounds from diverse sources including (i) real musical instruments, (ii) natural sound sources found in nature, as well as (iii) artificial audio sources created by synthesis methods of one kind or another. Applicant also seeks to improve upon and advance the art of constructing and operating virtual musical instrument (VMI) libraries maintaining deeply audio-sampled and/or sound-synthesized virtual musical instruments that are designed for providing the notes and sounds required to perform virtual musical instruments and produce a digital performance of a music composition.

To appreciate the problems addressed and effectively solved by Applicant's inventions disclosed herein, it will be helpful to provide a brief overview on the art of sound sampling, and the surrounding music technology conventions that have supported this field and advanced music performance and production to its current state of the art, using virtual musical instrument libraries developed today around the world. At the same time, this overview will help set the stage for understanding why the same conventional music technology that has helped the industry reach its current state, also now hinders the industry in meeting the challenges of the present, moving into the future, and realizing the benefits this creative technology promises to bring to humanity.

Sound sampling (also known simply as "sampling") is the process of recording small bits of audio sound for immediate playback via some form of a trigger. Historically, the sampling process has been around since the early days of Musique Concrete (in the 1940s) and came to commercial success with the invention of the Mellotron (1963). There are two main approaches to sampling, instrument sampling and loop sampling. Loop sampling is the art of recording slices of audio from pre-recorded music, such as a drum loop or other short audio samples (historically from vinyl). Amper Music uses the instrument sampling methodology in its SCORE™ AI Music Composition and Generation System. The instrument sampling process is to record and audio capture single note performances to replicate an instrument with any combination of notes.

In the early days (1960s-2000ish), the process of sampling was largely unchanged until the invention of computerized digital reproduction that enabled larger and deeper sampling methodologies, supporting highly complex sample instrument libraries in which each instrument is performed and recorded across its range of playable notes. As random-access memory (RAM) and hard drive storage sizes increased, libraries became more complex, and performance of these samples became extremely difficult to both perform and program via MIDI. Some companies developed solutions to help mitigate the time it takes to select these samples in real time.

Samplers differ from synthesizers in that the fundamental method of sound production begins with a sound sample or audio recording of an acoustic sound or instrument, electronic sound or instrument, ambient field recording, or virtually any other acoustical event. Each sample is typically realized as a separate sound file created in a suitable data file format, which is accessed and read when called during a performance. Typically, samples are triggered by some sort of MIDI input such as a note on a keyboard, an event produced by a MIDI-controlled instrument, or note generated by a computer software program running on a digital audio workstation.

In prior art sound sampling instruments, each sample is contained in a separate data file maintained in a sample library supported in a computer-based system. Most prior art sample libraries have several samples for the same note or event to create a more realistic sense of variation or humanization. Each time a note is triggered, the samples may cycle through the series before repeating or be played randomly.

Typically, the audio samples in a sample library system are organized and managed using relational database management technology (RDBMS). Modern sampling instruments require many Terrabytes of digital data storage for library data storage management capabilities, and large amounts of RAM for program memory support. In a prior art computer-based sound sample library system, the audio samples are typically stored in a zone (or other addressable region of memory) which is an indexed location in the sample library system, where a single sample is loaded and stored. In a sample library system, an audio sample can be mapped across a range of notes on a keyboard or other musical reference system. In general, there will be a Root key associated with each sample which, if triggered, will playback the sample at the same speed and pitch at which it was recorded. Playing other keys in the mapped range of a particular zone, will either speed up or slow down the sample, resulting in a change in pitch associated with the key.

Depending on the sample library system, zones may occupy just one or many keys, a could contain separate sample for each pitch. Some samplers allow the pitch or time/speed components to be maintained independent for a specific zone. For instance, if the sample has a rhythmic component that is synced to tempo, rhythmic part of the sound can be maintained fixed while playing other keys for pitch changes. Likewise, pitch can be fixed in certain circumstances.

In most conventional sound sample libraries, there will be an envelope section to control amplitude attack, decay, sustain and release (ADSR) parameters. This envelope may also be linked to other controls simultaneously such as, for example, the cutoff frequency of a low-pass filter used in sound production.

Typically, sound samples are either (i) One Shots, which play just once regardless of how long a key trigger is sustained, or (ii) Loops which can have several different loop settings, such as Forward, Backward, Bi-Directional, and Number of Repeats (where loops can be set to repeat as long as a note is sustained or for a specified number of times).

The effect of the Release stage on Loop playback can be to continue the repeat during the release or may cause a jump to a release portion of the sample. In more complex sampler instruments, there are often Release Samples specific to the type of sound and usually intended to create a better sense of realism. Like any synthesizer, most samplers will have controls for pitch bend range, polyphony, transposition and MIDI settings.

The energy spectrum as well as the amplitude of the sounds produced by sampled musical instruments will depend on the speed at which a piano key is hit, or the loudness of a horn note or a cymbal hit. Developers of virtual musical instrument libraries consider such factors and record each note at a variety of dynamics from pianissimo tofortissimo. These audio samples are then mapped to zones which are then be triggered by a certain range of MIDI note velocities. Some prior art sampling engines such as Kontakt from Native Instruments, allow for crossfading between velocity layers to make transitions smoother and less noticeable.

Grouping zones with common attributes expands the functionality of prior art sampling instruments. A common application of zone grouping is string articulations because there are numerous ways to play a note on a violin, for example: Legato bowing, spiccato, pizzicato, up/down bowing, sul tasto, sulponticello, or as a harmonic. In advanced prior art string libraries, zone groupings based on articulations have been superimposed over the same range on the keyboard. Also, a Key Trigger or a MIDI controller have been used to activate a certain group of samples.

Most prior art samplers have on-board effects processing such as filtering, EQ, dynamic processing, saturation and spatialization. This makes it possible to drastically change the sonic result and/or customize existing presets to meet the needs of a given application. Prior art sound sampling instruments have employed many of the same methods of modulation found in most synthesizers for the purpose of affecting parameters. These methods have included low frequency oscillators (LFOs) and envelopes. Also, signal processing methods and paths, automation, complex sequencing engines, etc. have been developed and deployed within prior art sampling instruments as well.

Beyond the prior art sampling instruments described above, there is a great volume of prior art technology relating to the field of sampled virtual musical instrument design. The following prior art map is provided to help clearly describe the various conventional technologies which are considered prior art to Applicant's present inventions:

Prior Art Methods of Capturing and Recording Sound Samples from Real Musical Instruments:

1. Capturing Audio Sample via Sound Recording
   a. Notes
   b. Velocities (dynamics)
   c. Transitional sampling (Legato Sampling)
      i. This is recording one note to the next in sequence to capture the change between two notes.
   d. Round-Robin
      i. This is the process of recording the same note performance at the same velocity with the purpose of creating a slight, but natural variation in the sound.
   e. Alternate Articulations
      i. Various way to perform and instrument (bowed vs plucked)
      ii. Using various attack types
      iii. Using various release types
      iv. Ornamentation of a note
   f. Alternate Mix or Mic Placement
   g. Offset sampling
      i. Timing of how to cut samples to allow for consistent performance with maintaining pre-transients
      ii. Piano in Blue via Cinesamples—2012.
2. Triggering of Sound Samples (Playback)
   a. Programming MIDI to trigger samples usually via MIDI
      i. Setting up instruments on MIDI Channels
      ii. Setting up articulations to playback based on MIDI Program Changes.
         1. Can also be set to change via "key-switches"
            a. MIDI Notes that are assigned to switch layer states of an instrument that provide alternate set of samples (Sustained Violin vs Pizzicato Violin)
   b. Using some basic scripting level to listen to the MIDI that is programmed by the composer (user).
      i. Automation data
         1. Expression (blending of dynamics of samples)
         2. Modulation (often vibrato)
         3. Volume (how loud the instrument is)
         4. Breath (shape of samples being attacked)
      ii. Note-listen buffers
         1. Listens to a set of notes to make choices on which transitional samples to play
         2. Listens to a set of notes to apply orchestration (which instruments to play at which times)
      iii. Note-Off information
         1. Do samples trigger on Note-Off events?
         2. This helps with making "releases"
         3. "release based on time"—2008.
3. Modulation of Sound Samples
   a. Low-Frequency Oscillation
      i. Applying various waveforms to, overtime, speed and amplitude, control the following:
         1. Pitch
         2. Volume
         3. Filter (timbre)

b. Envelop development: Attack, Hold, Decay, Sustain, Release
   i. These are the points drawn that occur over a period of time to allow a sound to change applied to:
      1. Pitch
      2. Volume
      3. Filter (timbre)
      4. Mixing/DSP of Sound Samples
a. The process of applying various effects to change the sound on a digital signal level.
   i. Includes: Reverbs, Filters, Compressors, Distortion, Bit Rate reducers, etc.
b. Volume adjustments and bus routing of the instruments to blend well in a mix.

Primary Problems Addressed by the Present Invention

Other than the MIDI Standard set in 1983, there are no real standards governing the instrument sampling industry, other than the assignment of MIDI Note Numbers to notes having a Note Name and a particular Pitch Frequency based on 12-EDO tuning, as illustrated in FIGS. 1A through 1E.

The decisions of where to split a velocity of a musical instrument being sampled, how deeply should a musical instrument be sampled (e.g. how many round robins, how many microphones, how many velocities, which notes, etc.), and which MIDI data controls should be sent to select samples, have been choices left up to the sample-based musical instrument designer. While this provides an "art" to instrument sample design, it does not help when you need to know exactly how an instrument will perform and predict what it should do. This has provided "camps" of composers who prefer some approaches of sampled instruments (usually dictated by the company/person making the samples).

The MIDI data communications protocol was originally designed for hardware/physical instruments. MIDI is largely used/designed for musical devices to playback music in real-time. Because MIDI was a convention when software technology came into play, sending out data messages to outboard gear from the computer adapted the MIDI standard. Now that the music industry is largely software driven in most applications (and entirely software driven in others), the types of devices communicating are now much more sophisticated. Using MIDI, the industry is stuck in a 36 year-old technology.

MIDI's 127 data control point resolution is extremely limited. Much greater resolution is required to express things like "controller" data, "program change" (i.e. articulation switching). Consequently, MIDI has placed constraints on modern musical notation during both composition and performance stages.

Some performance constraints are known, and some are unknown. As programming logic is not inherent in the MIDI protocol, and instruments are not standardized across all the commercial parties involved, the "unknown" is more of a by-product of not having good work arounds, or having a system that is too antiquated to deliver the needed standards in a given application. A big issue with MIDI is that while the MIDI communication protocol is standardized, applications using MIDI are not. Thus, a device will know what value to send on a MIDI controller lane, but it is up to the manufacturer to specify what function it will actually perform. For example, CC1 (Continuous Controller #1) is set by MIDI as the "Modulation" controller. It is a standard physical "wheel" controller that goes from 0-127 in value that exists on nearly every physical musical keyboard. The initial intent was to add "vibrato" modulation to a sound and control how wide or fast that vibrato should happen. Nearly every modern software instrument developer uses CC1 to control dynamic expression or even filter a sustained sound, and some software synths still use it to control vibrato. For reference, CC11 is supposed to be used for Expression, and CC71 would typically be used to control filter.

Such conventional approaches provide a "wild west" approach to the challenge of how to implement MIDI based on "ease-of-access" on a physical controller. For example, physical MIDI controllers are typically Keyboards that range widely on what knobs, faders and wheels they were manufactured with, but 90% of keyboards always have a pitch and modulation wheel. Modulation wheel is set to CC1 so most software developers use this controller as the primary controller to manipulate samples. MIDI is only a communications protocol between musical devices.—the methods used, while initially designed to be standardized, were not.

Articulation switching (sample set switching) and Continuous Controller assignments are two areas that has not been standardized. Many software developers have hacked MIDI in a way to help switch articulations either by a key switch (using a MIDI note to change a set of sounds), or by program changes (less common, but was the designed controller to do instrument or sound set switching.)

With computerized score notation, these switches in articulation and controller data could be reflected, if the notation software had knowledge of the keyswitches or program changes, but if the score software did not have knowledge of what the software sampling company designed, how would you know when to write a staccato or marcato marking? For example, if the software knew that MIDI note=01, was switch to pizzacatto, then "pizz" could be written on the score. Same goes for MIDI controller data, if you had three different sources of controller data numbers, commonly used for dynamic (piano/forte) control, how do you determine a "dynamic" on a score based on velocity or CC1 (modulation), CC11 (expression) or CC7 (volume)?

As there is no standardization in the music industry on what articulations go where, what velocities happen, and how to trigger samples, etc.) conventional MIDI files are almost useless in the process of creating finalized audio music tracks.

The only music-theoretic states in a music composition that the MIDI Standard can reliably send to any notation software application is note placement (e.g. time and pitch) and duration, key, time signature, and tempo.

In response to the shortcomings and drawbacks of the MIDI Standard and its continuous controller codes (CC #s), there is a great need in the art to depart from conventions and create new methods and apparatus that will provide increased levels of control, quality, speed and performance desired in most musical production applications.

Also, there is a great need in the art to address and overcome the shortcomings and limitations of the outdated MIDI Standard while trying to meet the growing needs of an industry which is seeking to provide artificial intelligence (AI) based support in the field of musical composition, generation and performance, while overcoming the shortcomings and drawbacks of prior art methods and technologies.

OBJECTS AND SUMMARY OF THE PRESENT INVENTION

Accordingly, a primary object of the present invention is to provide a new and improved automated method of and system for producing digital performances of musical compositions, however generated, using a new and improved virtual musical instrument (VMI) library management system that supports the automated playback of sampled notes and/or audio sounds produced by audio sampling, and/or synthesized sounds created by sound synthesis methods and not by audio sampling, and the automated selection of such notes and sounds for playback from such virtual musical instrument (VMI) libraries, using an automated selection and performance subsystem that employs ruled-based instrument performance logic to predict what samples should be performed based on the music-theoretic states of the music composition, while overcoming the shortcomings and drawbacks of prior art MIDI systems and methods.

Another object of the present invention is to provide a new level of artificial musical intelligence and awareness to automated music performance systems so that such machines demonstrate the capacity of appearing aware of (i) the virtual musical instrument types being used, (ii) the notes and sounds recorded or synthesized by each virtual musical instrument, and (iii) how to control those sampled and/or synthesized notes and audio sounds given all of the music-theoretic states contained in the music composition to be digitally performed by an ensembled of deeply-sampled virtual musical instruments automatically selected for music performance and production.

Another object of the present invention is to provide a new and improved method of producing a digital music performance comprising: (a) providing a music composition to an automated music performance system supporting virtual musical instrument (VMI) libraries provided with instrument performance logic; and (b) processing the music composition so as to automatically abstract music-theoretic state data for driving the automated music performance system and the instrument performance logic, including automated selection of instruments and sampled (and/or synthesized) notes and sounds from the VMI libraries so as to produce a digital music performance of the music composition.

Another object of the present invention is to provide a new and improved method of producing a digital music performance comprising: (a) providing a music sound recording to an automated music performance system supporting deeply-sampled virtual musical instrument (DS-VMI) libraries provided with instrument performance logic; and (b) processing the music sound recording so as to automatically abstract music-theoretic state data for driving the automated music performance system and the instrument performance logic, including automated selection of instruments and sampled and/or synthesized notes from the DS-VMI libraries so as to produce a digital music performance of the music performance recording.

Another object of the present invention is to provide a new and improved automated music performance system driven by music-theoretic state descriptors, including roles, notes and music metrics, automatically abstracted from a musical structure however composed or performed, for generating a unique digital performance of the musical structure, wherein the automated music performance system comprises: a plurality of deeply-sampled virtual musical instrument (DS-VSI) libraries, wherein each deeply-sampled virtual music instrument (DS-VMI) library supports a set of music-theoretic state (MTS) responsive performance rules automatically triggered by the music theoretic state descriptors, including roles, notes and music metrics, automatically abstracted from the music structure to be digitally performed by the automated music performance system; and an automated deeply-sampled virtual music instrument (DS-VMI) library selection and performance subsystem for managing the deeply-sampled virtual musical instrument (DS-VMI) libraries, including automated selection of virtual musical instruments and sampled and/or synthesized notes to be performed during a digital performance of said musical structure, in response to the abstracted music-theoretic state descriptors.

Another object of the present invention is to provide such an automated music performance system via the virtual musical instrument (VMI) libraries, which integrated with at least one of a digital audio workstation (DAW), a virtual studio technology (VST) plugin, a cloud-based information network, and an automated AI-driven music composition and generation system.

Another object of the present invention is to provide a new and improved automated music production system supporting a complete database of information on what sampled and/or synthesized notes and sounds are maintained and readily available in the system, and supported by an automated music performance system that is capable of automatically determining how the notes and sounds are accessed, tagged, and how they need to be triggered for final music assembly, based upon the full music-theoretic state of the music composition being digitally performed, characterized by the music-theoretic state data (i.e. music composition meta-data) transmitted with role, note, music metric and meta data to the automated music performance system, and by doing so, provide the system with the capacity to revival a human composer's ability to search, choose, and make artistic decisions on instrument articulations and sample libraries.

Another object of the present invention is to provide a new musical instrument sampling method and improved automated music performance system configured for audio sample playback using deeply-sampled virtual musical instruments (DS-VMIs), and/or digitally-synthesized virtual musical instruments (DS-VMI), that are controlled by performance logic responsive to the music-theoretic states of the music composition being digitally performed by the virtual musical instruments of the present invention, so as to produce musical sounds that are contextually-consistent with the actual music-theoretic states of music reflected in the music composition, and represented in the music-theoretic state descriptor data file automatically generated by the automated music performance system of the present invention to drive its operation on a music composition time-unit by time-unit basis.

Another object of the present invention is to provide a next generation automated music production system and method that supports a richer and more flexible system of music performance that enables better and higher-quality automated performances of virtual musical instrument libraries, not otherwise possible using conventional MIDI technologies.

Another object of the present invention is to provide a new method of producing a digital music performance based on a music composition or a music sound recording, processed to automatically abstract music-theoretic state data, and then provided to an automated music performance subsystem supporting libraries of deeply-sampled and/or digitally-synthesized virtual musical instrument (DS-VMI), capable of producing the notes and sounds for the digital music performance system.

Another object of the present invention is to provide an automated music performance system, wherein each deeply-sampled and/or digitally-synthesized virtual musical instrument libraries are maintained in a VMI library management subsystem that is provided with instrument performance logic (i.e. logical performance rules) based on a set of known standards for the corresponding (real) musical instrument, specifying what note performances are possible with each specific deeply-sampled and/or digitally-synthesized virtual musical instrument, so that the automated music performance subsystem can reliably notate the digital performance of a music composition prior to music production, and reliably perform the virtual musical instruments during the digital music performance of the music composition, with expression and vibrance beyond that achievable by conventional performance scripting technologies.

Another object of the present invention is to provide an automated music performance system, wherein for each deeply-sampled and/or digitally-synthesized virtual musical instrument library maintained in the system, its associated performance logic (i.e. performance rules), responsive to the music-theoretic state of the analyzed music composition, are programmed to fully capture what notes change with a dynamic shift, what articulation is intended, whether or not a specified note should be played/performed in a staccato or a pizzicato, and how the note samples should be triggered during final assembly given the music-theoretic state of the music composition being digitally performed by the deeply-sampled and/or digitally-synthesized virtual musical instruments.

Another object of the present invention is to provide a new and improved automated music production system, wherein a human being composes an orchestrated piece of music expressed in a music-theoretic (score) representation and provides the music composition to the automated musical performance system to digitally perform the music composition using an automated selection of one or more of the virtual musical instruments supported by the automated music performance system, controlled by the state-based performance logic created for each of the virtual musical instruments maintained in the automated music performance system, and responsive to role-organized note data abstracted from the music composition to be digitally performed.

Another object of the present invention is to provide a new and improved automated music performance system for generating digital performances of music compositions containing notes selected from virtual musical instrument (VMI) libraries based on the music-theoretic states of the music compositions being digitally performed.

Another object of the present invention is to provide a new and improved method of automatically selecting sampled notes from deeply-sampled and/or digitally-synthesized virtual musical instrument (DS-VMI) libraries using music theoretic-state descriptor data automatically abstracted from a music composition to be digitally performed, and processing selected notes using music-theoretic state responsive performance rules to produce the notes for the digital performance of the music composition.

Another object of the present invention is to provide a new and improved automated music performance system for producing a digital performance of a music composition using deeply-sampled virtual musical instrument (DS-VMI) libraries, from which sampled notes are predictively selected using timeline-indexed music-theoretic state descriptor data, including roles and music note metrics, automatically abstracted from the music composition.

Another object of the present invention is to provide a new and improved automated music composition and performance system and method employing deeply-sampled virtual musical instruments for producing digital music performances of music compositions using music-theoretic state descriptor data, including roles, notes and note metrics, automatically abstracted from the music compositions before automated generation of the digital performances.

Another object of the present invention is to provide a new and improved method of automatically generating digital music performances of music compositions using deeply-sampled and/or digitally-synthesized virtual musical instrument libraries supporting music-theoretic state responsive performance rules executed within an automated music performance and production system.

Another object of the present invention is to provide a new and improved predictive process for automatically selecting sampled notes from deeply-sampled virtual musical instrument (DS-VMI) libraries, and processing the selected sampled notes using performance logic, so as to produce sampled notes in a digital performance of a music composition that are musically consistent with the music-theoretic states of the music composition being digitally performed.

Another object of the present invention is to provide a new and improved system and process for automatically abstracting role, note, performance and other music-theoretic state data from along the timeline of a music composition to be digitally performed by an automated music performance system supported by deeply-sampled and/or digitally-synthesized virtual musical instrument (DS-VMI) libraries, and automatically producing music-theoretic state descriptor data characterizing the music composition for use in driving the automated music performance system.

Another object of the present invention is to provide new and improved methods of automatically processing music compositions in sheet music or MIDI-format and automatically producing digital music performances using an automated music performance system supporting deeply-sampled and/or digitally-synthesized virtual musical instrument (DS-VMI) libraries employing instrument performance logic triggered by music-theoretic state data abstracted from the music composition to be digitally performed, using abstracted roles as the logical linkage of such automated instrument performance.

Another object of the present invention is to provide a new and improved methods of automatically producing digital music performances based on music compositions, in either sheet music or MIDI-format, supplied to a cloud-based network via an application programming interface (API) to drive an automated music performance process.

Another object of the present invention is to provide a new and improved system for classifying and cataloging a group of real musical instruments, deeply sampling the real musical instrument, and naming and performing deeply-sampled virtual musical instrument (DS-VMI) libraries created for such deeply-sampled real musical instruments.

Another object of the present invention is to provide a new and improved an automated music performance system in the form of digital audio workstation (DAW) integrated with a deeply-sampled virtual musical instrument (DS-VMI) library management system for cataloging deeply-sampled virtual musical instrument (DS-VMI) libraries used to produce the sampled notes for a digital music performance of a music composition, and supporting logical performance rules for processing the sampled notes in a manner musically consistent with the music-theoretic states of the music composition being digitally performed.

Another object of the present invention is to provide a new and improved sound sampling and recording system employing sampling templates to produce a musical instrument data file for organizing and managing the sample notes recorded during an audio sampling and recording session involving the deep sampling and recording of a specified type of real musical instrument so as to produce a deeply-sampled virtual musical instrument (DS-VMI) library containing information items such as real instrument name, recording session, instrument type, and instrument behavior, and sampled notes performed with specified articulations and mapped to note/velocity/microphone/round-robin descriptors.

Another object of the present invention is to provide a new and improved deeply-sampled virtual music instrument (DS-VMI) library management system including data files storing sets of sampled notes performed by a specified type of real musical instrument deeply-sampled during an audio sampling session and mapped to note/velocity/microphone/round-robin descriptors, and supporting music-theoretic state responsive performance logic for processing the sampled notes that can be performed by the deeply-sampled virtual musical instrument.

Another object of the present invention is to provide a new and improved method of classifying deeply-sampled virtual musical instruments (DS-VMI) supported in a deeply-sampled virtual musical instrument (DS-VMI) library management subsystem using instrument definitions based on attributes including instrument types, instrument behaviors during performance, aspects (values), release types, offset values, microphone type, position and timbre tags used during recording.

Another object of the present invention is to provide a new and improved method of sampling, recording, and cataloging real musical instruments for use in developing corresponding deeply-sampled virtual musical instrument (DS-VMI) libraries for deployment in a deeply-sampled virtual musical instrument (DS-VMI) library management system.

Another object of the present invention is to provide a new and improved method of operating an automated music performance system employing a digital audio workstation (DAW) interfaced with a deeply-sampled virtual musical instrument (DS-VMI) library management subsystem controlled by an automated deeply-sampled virtual musical instrument (DS-VMI) library selection and performance subsystem.

Another object of the present invention is to provide a new and improved method of creating a deeply-sampled virtual musical instrument (DS-VMI) library using an instrument sampling template process.

Another object of the present invention is to provide a new and improved system for notating or documenting the digital performance of a music composition performed using a set of deeply-sampled virtual musical instrument (DS-VMI) libraries controlled using logical music performance rules operating upon sampled notes selected from the deeply-sampled virtual musical instrument (DS-VMI) libraries when the music-theoretic states determined in the music composition match conditions set in the logical music performance rules.

Another object of the present invention is to provide a new and improved automated music performance system, comprising: (i) a system user interface subsystem for a system user using a digital audio workstation (DAW) provided with music composition and notation software programs to produce a music composition to be digitally performed, and (ii) an automated music performance engine (AMPE) subsystem interfaced with the system user interface subsystem, for producing a digital performance based on the music composition, wherein the system user interface subsystem transfers a music composition to the automated music performance engine subsystem, wherein the automated music performance engine subsystem includes: (i) an automated music-theoretic state (MTS) data abstraction subsystem for automatically processing the music composition and abstracting all music-theoretic states contained in the music composition and producing a set of music-theoretic state descriptors data (i.e. notes, roles, metrics and metadata) representative thereof; (ii) a deeply-sampled virtual musical instrument (DS-VMI) library management subsystem for managing the sample libraries supporting the deeply-sampled virtual musical instruments to be selected for performance of notes specified in the music composition; and (iii) an automated deeply-sampled virtual musical instrument (DS-VMI) selection and performance subsystem for selecting deeply-sampled virtual musical instruments in the DS-VMI library management subsystem and processing the sampled notes selected from selected deeply-sampled virtual musical instrument (DS-VMI) libraries using music-theoretic state (MTS) responsive performance rules (i.e. logic), to automatically produce the sampled notes selected for a digital performance of the music composition, and wherein the automated music performance engine (AMPE) subsystem transfers the digital performance to the system user interface subsystem for production, review and evaluation.

Another object of the present invention is to provide a new and improved automated music performance system supported by a hardware platform comprising various components including multi-core CPU, multi-core GPU, program memory (DRAM), video memory (VRAM), hard drive (SATA), LCD/touch-screen display panel, microphone/speaker, keyboard interface, WIFI/Bluetooth network adapters, and power supply and distribution circuitry, integrated around a system bus architecture.

Another object of the present invention is to provide a new and improved method of automated digital music performance generation using deeply-sampled virtual musical instrument (DS-VMI) libraries and contextually-aware (i.e. music state aware) performance logic supported in the automated music performance system.

Another object of the present invention is to provide a new and improved method of automated digital music performance generation using deeply-sampled virtual musical instrument (DS-VMI) libraries and contextually-aware (i.e. music state aware) performance logic supported in the automated music performance system, comprising the steps of: (a) selecting real musical instruments to be sampled, recorded, and catalogued for use in the deeply-sampled virtual musical instrument (DS-VMI) library management subsystem; (b) using an instrument type and behavior based schema (i.e. plan) for sampling, recording and cataloguing the selected real musical instruments in the virtual musical instrument sample library management system of present invention; (c) using the instrument type and behavior based schema to develop the action part of music-theoretic state (MTS) responsive performance rules for processing sampled notes in deeply-sampled virtual musical instrument (DS-VMI) libraries being managed in the library management system, during the automated music performance process; (d) loading the DS-VMI libraries and associated music-theoretic state (MTS) responsive performance rules into the automated performance system before the automated music performance generation process, (e) during a music composition process, producing and recording the musical notes in a composed piece of music; (f) providing the music composition to the automated music performance engine (AMPE) subsystem for automated processing and generating timeline-indexed music-theoretic state descriptor data (i.e. music composition meta-data) for the music composition, (g) providing the music-theoretic state descriptors (i.e. music composition meta-data) to the automated music performance engine (AMPE) subsystem for use in selecting sampled notes from deeply-sampled virtual musical instrument libraries maintained in DS-VMI library management system, and using music-theoretic state (MTS) responsive performance rules (i.e. logic) for processing the selected sampled notes to produce the notes of digital music performance of the music composition, (h) assembling and finalizing the processed sampled notes in the digital performance of the music composition, and (i) producing the performed notes of the digital performance of the music composition, for review and evaluation by human listeners.

Another object of the present invention is to provide a new and improved method of generating a digital performance of a composed piece of music (i.e. a musical composition) using the automated music composition and performance system, comprising the steps of (a) producing a digital representation of an automatically composed piece of music to be orchestrated and arranged for a digital performance using selected deeply-sampled and/or digitally-synthesized virtual musical instrument (DS-VMI) libraries performed using music-theoretic state (MTS) responsive performance rules, (b) automatically determining the music-theoretic states of music in a music composition along its timeline, and producing a set of timeline-indexed music-theoretic state descriptor data (i.e. roles, notes, metrics and meta-data) for use in the automated music performance system, (c) based on the roles abstracted from the music composition, selecting types of virtual musical instruments available for digital performance of the music composition in a deeply-sampled and/or digitally-synthesized virtual musical instrument (DS-VMI) library management system, (d) using the set of music theoretic-state meta-data descriptor data to automatically select notes from virtual musical instrument libraries, and using music-theoretic state responsive performance rules to process the selected notes to generate the processed notes for a digital performance of the music composition, (e) assembling and finalizing the processed selected notes in the generated digital performance of the music composition, and (f) producing the performed notes in the digital performance of the music composition, for review and evaluation by human listeners.

Another object of the present invention is to provide a new and improved process of automated selection of sampled notes in virtual musical instrument (VMI) libraries to produce the notes for the digital performance of a composed piece of music in accordance with the principles of the present invention, involving (a) the parsing and analyzing the music composition to abstract music-theoretic state descriptor data (i.e. role, notes, metrics and meta data), (b) formatting the music-theoretic state descriptor data (i.e. music composition meta-data) abstracted from the music composition, (c) using music-theoretic state descriptor data (i.e. music composition meta-data) to select notes from the virtual musical instrument (VMI) libraries and processing the selected notes using music-theoretic state (MTS) responsive performance logic maintained in the VMI library management subsystem, to produce the notes in the digital performance of the music composition, and (d) assembling and finalizing the processed notes for the digital performance of the music composition, for subsequent production, review and evaluation.

Another object of the present invention is to provide a new and improved method of automated selection and performance of notes in virtual instrument (VMI) libraries to generate a digital performance of a composed piece of music, comprising the steps of (a) capturing or producing a digital representation of a music composition to be orchestrated and arranged for a digital performance using a set of virtual musical instrument (VMI) libraries performed using music-theoretic state performance logic (i.e. rules) constructed and assigned to each virtual musical instrument (VMI), (b) automatically determining the music-theoretic states of music in a music composition along its timeline, and producing a set of timeline-indexed music-theoretic state descriptor data (i.e. roles, notes, metrics and meta-data) for use in the automated music performance system, (c) based on the roles abstracted from the music composition, selecting types of virtual musical instruments available for digital performance of the music composition in a virtual musical instrument (VMI) library management system, (d) using the set of music theoretic-state meta-data descriptor data to automatically select (e.g. filter, tag, and/or trigger) the notes from deeply-sampled virtual musical instrument libraries, and using music-theoretic state responsive performance rules to process the selected notes to generate the notes for a digital performance of the music composition, selected sampled notes to generate notes for a digital performance of the music composition, (e) assembling and finalizing the process notes in the digital performance of the music composition, and (f) producing the performed notes in the digital performance of the music composition, for review and evaluation by human listeners.

Another object of the present invention is to provide a new and improved automated music performance system comprising (i) a system user interface subsystem for a system user using digital audio workstation (DAW) supported by a keyboard and/or MIDI devices, to produce a music composition for digital performance, and (ii) an automated music performance engine (AMPE) subsystem interfaced with the system user interface subsystem, for producing a digital performance based on the music composition, wherein the system user interface subsystem transfers a music composition to the automated music performance engine, wherein the automated music performance engine includes (i) an automated music-theoretic state (MTS) data abstraction subsystem for automatically abstracting all music-theoretic states contained in the music composition and producing a set of music-theoretic state descriptors representative thereof, (ii) a deeply-sampled virtual musical instrument (DS-VMI) library management subsystem for managing deeply-sampled and/or digitally-synthesized virtual musical instruments to be selected for performance of notes specified in the music composition, and (iii) an automated virtual musical instrument selection and performance subsystem for selecting deeply-sampled and/or digitally-synthesized virtual musical instruments in the DS-VMI library management subsystem and performing notes from selected virtual musical instruments using music-theoretic state (MTS) responsive performance rules, to automatically produce a digital performance of the music composition, wherein the automated music performance engine (AMPE) subsystem transfers the digital performance to the system user interface subsystem for production, review and evaluation.

Another object of the present invention is to provide a new and improved method of automatically generating a digital performance of a music composition, comprising the steps of (a) selecting real musical instruments to be sampled, recorded, and catalogued for use in the deeply-sampled virtual musical instrument library management subsystem, (b) using an instrument type and behavior based schema (i.e. plan) for sampling, recording and cataloguing the selected real musical instruments in the virtual musical instrument sample library management system; (c) using the instrument-type and behavior based schema to develop the action part of music-theoretic state (MTS) responsive performance rules for processing sampled notes in virtual musical instrument sample libraries being managed in the library management system, during the automated music performance process, (d) loading the DS-VMI libraries and associated music-theoretic state (MTS) responsive performance rules into the automated performance system before the automated music performance generation process, (e) during a music composition process, producing and recording the musical notes in a music composition, (f) providing the music composition to the automated music performance engine (AMPE) subsystem and generating timeline-indexed music-theoretic state descriptor data (i.e. music composition meta-data) for the music composition, (g) providing the music-theoretic state descriptor data (i.e. music composition meta-data) to the automated music performance system to automatically select sampled notes from deeply-sampled virtual musical instrument libraries maintained in DS-VMI library management system, (h) using the music-theoretic state (MTS) responsive performance logic (i.e. rules) in the deeply-sampled virtual musical instrument libraries to process the selected sampled notes to produce the sampled notes of the digital music performance of the music composition, (i) assembling and finalizing the processed sampled notes in the digital performance of the composed piece of music, and (j) producing the performed notes of a digital performance of the composed piece of music for review and evaluation by human listeners.

Another object of the present invention is to provide a new and improved method of generating a digital performance of a composed piece of music (i.e. a musical composition) using the automated music composition and performance system, comprising the steps of (a) producing a digital representation of an automatically composed piece of music to be orchestrated and arranged for a digital performance using selected deeply-sampled virtual musical instruments performed using music-theoretic state (MTS) responsive performance rules, (b) automatically determining the music-theoretic states of music in a music composition along its timeline, and producing a set of timeline-indexed music-theoretic state descriptor data (i.e. roles, notes, metrics and meta-data) for use in the automated music performance system, (c) based on the roles abstracted from the music composition, selecting types of deeply-sampled virtual musical instruments available for digital performance of the music composition in a deeply-sampled virtual musical instrument (DS-VMI) library management system, (d) using the set of music theoretic-state meta-data descriptor data to automatically select sampled notes from deeply-sampled virtual musical instrument libraries, and using music-theoretic state responsive performance rules to process the selected sampled notes to generate the notes for a digital performance of the music composition, (e) assembling and finalizing the processed sampled notes in the generated digital performance of the music composition, and (f) producing the performed notes in the digital performance of the music composition, for review and evaluation by human listeners.

Another object of the present invention is to provide a new and improved process of automated selection of sampled notes in deeply-sampled virtual musical instrument (DS-VMI) libraries to produce the notes for the digital performance of a composed piece of music in accordance with the principles of the present invention, involving (a) the parsing and analyzing the music composition to abstract music-theoretic state descriptor data (i.e. notes, roles, metrics and meta data), (b) formatting the music-theoretic state descriptor data (i.e. music composition meta-data) abstracted from the music composition, (c) using music-theoretic state descriptor data to select sampled notes from deeply-sampled virtual musical instruments (DS-VMI) and processing the sampled notes using music-theoretic state (MTS) responsive performance logic maintained in the DS-VMI library management subsystem, to produce sampled notes in the digital performance of the music composition, and (d) assembling and finalizing the notes for the digital performance of the music composition, for subsequent production, review and evaluation.

Another object of the present invention is to provide a new and improved method of automated selection and performance of notes stored in deeply-sampled virtual music instrument (DS-VMI) libraries to generate a digital performance of a composed piece of music, comprising the steps of (a) capturing or producing a digital representation of a music composition to be orchestrated and arranged for a digital performance using a set of deeply-sampled virtual musical instruments performed using music-theoretic state performance logic (i.e. rules) constructed and assigned to each deeply-sampled virtual musical instrument (DS-VMI) library supporting its corresponding virtual musical instrument, (b) automatically determining the music-theoretic states of music in a music composition along its timeline, and producing a set of timeline-indexed music-theoretic state descriptor data (i.e. roles, notes, metrics and meta-data) for use in the automated music performance system, (c) based on the roles abstracted from the music composition, selecting types of deeply-sampled virtual musical instruments available for digital performance of the music composition in a deeply-sampled virtual musical instrument (DS-VMI) library management system, (d) using the set of music theoretic-state meta-data descriptor data to automatically select sampled notes from deeply-sampled virtual musical instrument libraries, and using music-theoretic state responsive performance rules to process the selected sampled notes to generate the notes for a digital performance of the music composition, (e) assembling and finalizing the notes in the digital performance of the music composition; and (f) producing the notes in the digital performance of the music composition, for review and evaluation by human listeners.

Another object of the present invention is to provide a new and improved automated music composition, performance and production system comprising (i) a system user interface subsystem for a system user to provide the emotion-type, style-type musical experience (MEX) descriptors and timing parameters for a piece of a music to be automatically composed, performed and produced, (ii) an automated music composition engine (AMCE) subsystem interfaced with the system user interface subsystem to receive MEX descriptors and timing parameters, and (ii) an automated music performance engine (AMPE) subsystem interfaced with the automated music composition engine subsystem and the system user interface subsystem, for automatically producing a digital performance based on the music composition produced by the automated music composition engine subsystem, wherein the automated music composition engine subsystem transfers a music composition to the automated music performance engine, wherein the automated music performance engine includes (i) an automated music-theoretic state (MTS) data abstraction subsystem for automatically abstracting all music-theoretic states contained in the music composition and producing a set of music-theoretic state descriptors representative thereof, (ii) a deeply-sampled virtual musical instrument (DS-VMI) library management subsystem for managing deeply-sampled virtual musical instruments to be selected for performance of notes specified in the music composition, and (iii) an automated deeply-sampled virtual musical instrument (DS-VMI) selection and performance subsystem for selecting deeply-sampled virtual musical instruments in the DS-VMI library management subsystem and performing notes from selected deeply-sampled virtual musical instruments using music-theoretic state (MTS) responsive performance rules, to automatically produce a digital performance of the music composition, and wherein the automated music performance engine (AMPE) subsystem ultimately transfers the digital performance to the system user interface subsystem for production, review and evaluation;

Another object of the present invention is to provide a new and improved enterprise-level internet-based music composition, performance and generation system supported by a data processing center with web servers, application servers and database (RDBMS) servers operably connected to the infrastructure of the Internet, and accessible by a network of web-enabled client machines, social network servers, and web-based communication servers, and allowing anyone with a web-based browser on a mobile computing device to access automated music composition, performance and generation services on websites to musically-score videos, images, slide-shows, podcasts, and other events with automatically composed, performed and produced music using deeply-sampled virtual musical instrument (DS-VMI) methods of the present invention as disclosed and taught herein.

Another object of the present invention is to provide a new and improved method of automated digital music performance generation using deeply-sampled virtual musical instrument (DS-VMI) libraries and contextually-aware (i.e. music state aware) driven performance principles practiced within an automated music composition, performance and production system, comprising the steps of: (a) selecting real musical instruments to be sampled, recorded, and catalogued for use in the deeply-sampled virtual musical instrument library management subsystem, (b) using an instrument type and behavior based schema (i.e. plan) for sampling, recording and cataloguing the selected real musical instruments in the virtual musical instrument sample library management system of present invention; (c) using the instrument-type and behavior based schema to develop the action part of music-theoretic state (MTS) responsive performance rules for processing sampled notes in the deeply-stored virtual musical instrument (DS-VMI) libraries being managed in the library management system, during the automated music performance process, (d) loading the DS-VML libraries and associated music-theoretic state (MTS) responsive performance rules into the automated performance system before the automated music performance generation process, (e) during an automated music composition process, the system user providing emotion and style type musical experience (MEX) descriptors and timing parameters to the system, then the system transforming MEX descriptors and timing parameters into a set of music-theoretic system operating parameters for use during the automated music composition and generation process, (f) providing the music-theoretic system operating parameters (MT-SOP descriptors) to the automated music composition engine (ACME) subsystem for use in automatically composing a music composition, (g) providing the music composition to the automated music performance engine (AMPE) subsystem and producing a timeline indexed music-theoretic state descriptors data (i.e. music composition meta-data), (h) the automated music performance engine (AMPE) subsystem using the music-theoretic state descriptor data to automatically select instrument types and sampled notes from deeply-sampled virtual musical instrument libraries, and using music-theoretic state descriptor responsive performance rules to process selected sampled notes, and generate the notes for the digital performance of the music composition, (i) assembling and finalizing the processed sampled notes in the digital performance of the music composition, and ( ) producing performed the notes of a digital performance of the music composition for review and evaluation by human listeners.

Another object of the present invention is to provide a new and improved method of generating a digital performance of a composed piece of music (i.e. a musical composition) using the automated music composition and performance system, comprising the steps of (a) producing a digital representation of an automatically composed piece of music to be orchestrated and arranged for a digital performance using selected deeply-sampled virtual musical instruments performed using music-theoretic state (MTS) responsive performance rules, (b) automatically determining the music-theoretic states of music in a music composition along its timeline, and producing a set of timeline-indexed music-theoretic state descriptor data (i.e. roles, notes, metrics and meta-data) for use in the automated music performance system, (c) based on the roles abstracted from the music composition, selecting types of deeply-sampled virtual musical instruments available for digital performance of the music composition in a deeply-sampled virtual musical instrument (DS-VMI) library management system, (d) using the set of music theoretic-state meta-data descriptor data to automatically select sampled notes from deeply-sampled virtual musical instrument libraries, and using music-theoretic state responsive performance rules to process the selected sampled notes to generate the notes for a digital performance of the music composition, (e) assembling and finalizing the processed sampled notes in the generated digital performance of the music composition, and (f) producing the performed notes in the digital performance of the music composition, for review and evaluation by human listeners.

Another object of the present invention is to provide a new and improved process of automated selection of sampled notes in deeply-sampled virtual musical instrument (DS-VMI) libraries to produce the notes for the digital performance of a music composition, comprising (a) the parsing and analyzing the music composition to abstract music-theoretic state descriptor data (i.e. music composition meta data), (b) formatting the music-theoretic state descriptor data (i.e. music composition meta-data) abstracted from the music composition, (c) using music-theoretic state descriptor data (i.e. music composition meta-data) to select sampled notes from deeply-sampled virtual musical instrument (DS-VMI) libraries and processing sampled notes using music-theoretic state (MTS) responsive performance logic maintained in the DS-VMI library management subsystem, to produce processed sampled notes in the digital performance of the music composition, and (d) assembling and finalizing the processed sampled notes for the digital performance of the music composition, for subsequent production, review and evaluation.

Another object of the present invention is to provide a new and improved method of automated selection and performance of notes in deeply-sampled virtual instrument libraries to generate a digital performance of a composed piece of music, comprising the steps of (a) capturing or producing a digital representation of a music composition to be orchestrated and arranged for a digital performance using a set of libraries of deeply-sampled and/or digitally-synthesized virtual musical instruments (DS-VMI) selected and performed using music-theoretic state performance logic (i.e. rules) constructed and assigned to each virtual musical instrument (VMI), (b) automatically determining the music-theoretic states of music in a music composition along its timeline, and producing a set of timeline-indexed music-theoretic state descriptor data (i.e. roles, notes, metrics and meta-data) for use in the automated music performance system, (c) based on the roles abstracted from the music composition, selecting types virtual musical instruments available for digital performance of the music composition in a virtual musical instrument (VMI) library management system, (d) using the set of music theoretic-state meta-data descriptor data to automatically select notes from virtual musical instrument libraries, and using music-theoretic state responsive performance rules to process the selected notes to generate the notes for a digital performance of the music composition, (e) assembling and finalizing the processed notes in the digital performance of the music composition; and (f) producing the performed notes in the digital performance of the music composition, for review and evaluation by human listeners.

Another object of the present invention is to provide a new and improved process of automatically abstracting the music-theoretic states as well as note data from a music composition to be digitally performed by an automated music performance system, and automatically producing music-theoretic state descriptor data (i.e. music composition meta-data) along the timeline of the music composition, for driving the automated music performance system to produce music that is contextually consistent with the music-theoretic states contained in the music composition.

Another object of the present invention is to provide a new and improved method of generating a set of music-theoretic state descriptors for a music composition, during the preprocessing state of an automated music performance process, wherein the exemplary set of music-theoretic state descriptors include, but are not limited to, MIDI Note Value (A1, B2, etc.), Duration of Notes, Position of Notes in a Measure, Position of Notes in a Phrase, Position of Notes in a Section, Position of Notes in a Chord, Note Modifiers (Accents), Dynamics, MIDI Note Value Precedence and Antecedence, What Instruments are Available, What Instruments are Playing, and What Instruments Should or Might Be Played, Position of Notes from Other Instruments, Relation of Sections to Each Other, Meter and Position of Downbeats and Beats, Tempo Based Rhythms, What Instruments are assigned to a role (e.g. play in background, play as a bed, play bass, etc.), and how many instruments are available.

Another object of the present invention is to provide a new and improved framework for classifying and cataloging a group of real musical instruments, and standardizing how such musical instruments are sampled, named and performed as virtual musical instruments during a digital performance of a piece of composed music, wherein musical instruments are classified by their performance behaviors, and musical instruments with common performance behaviors are classified under the same or common instrument type, thereby allowing like musical instruments to be organized and catalogued in the same class and be readily available for selection and use when the instrumentation and performance of a composed piece of music in being determined.

Another object of the present invention is to provide a new and improved catalog of deeply-sampled virtual musical instruments maintained in the deeply-sampled virtual musical instrument (DS-VMI) library management subsystem of the present invention.

Another object of the present invention is to provide a new and improved sampling template for organizing and managing an audio sampling and recording session involving the deep sampling of a specified type of real musical instrument to produce a deeply-sampled virtual musical instrument (DS-VMI) library, including information items such as real instrument name, instrument type, recording session—place, date, time, and people, categorizing essential attributes of each note sample to be captured from the real instrument or sample sound to be captured from an audio sound source during the sampling session, etc.

Another object of the present invention is to provide a new and improved musical instrument data file, structured using the sampling template of the present invention, and organizing and managing sample data recorded during an audio sampling and recording session involving the deep sampling of a specified type of real musical instrument to produce musical instrument data file for a deeply-sampled virtual musical instrument (DS-VMI) library.

Another object of the present invention is to provide a new and improved definition of a deeply-sampled virtual music instrument (DS-VMI) library according to the principles of the present invention, showing a virtual musical instrument data set containing (i) all data files for the sets of sampled notes performed by a specified type of real musical instrument deeply-sampled during an audio sampling session and mapped to note/velocity/microphone/round-robin descriptors, and (ii) MTS-responsive performance logic (i.e. performance rules) for use with samples in the deeply-sampled virtual musical instrument.

Another object of the present invention is to provide a new and improved music-theoretic state (MTS) responsive performance logic (i.e. set of logical performance rules) written to a specific deeply-sampled or digitally-synthesized virtual musical instrument (DS-VMI) library, for controlling specific types of performance for the virtual musical instruments supported in the deeply-sampled and/or digitally-synthesized virtual musical instrument (DS-VMI) library management subsystem of the present invention.

Another object of the present invention is to provide a new and improved classification scheme for deeply-sampled virtual musical instruments (DS-VMI) that are cataloged in the DS-VMI library management subsystem, using Instrument Definitions based on one or more of the following attributes: instrument behaviors during performance, aspects (Values), release types, offset values, microphone type, microphone position and timbre tags used during recording, and MTS responsive performance rules created for a given DS-VMI library.

Another object of the present invention is to provide a new and improved method of sampling, recording, and cataloging real musical instruments for use in developing corresponding deeply-sampled virtual musical instrument (DS-VMI) libraries for deployment in the deeply-sampled virtual musical instrument (DS-VMI) library management system of present invention, comprising (a) classifying the type of real musical instrument to be sampled and added to the sample virtual musical instrument library, (b) based on the instrument type, assigning a behavior and note range to the real musical instrument to be sampled, (c) based on behavior and note range, creating a sample instrument template for the real musical instrument to be sampled, indicating what notes to sample on the instrument based on its type, as well as a note range that is associated with the real instrument, (d) using the sample instrument template, sampling the real musical instrument and record all samples (e.g. sampled notes) and assign file names to each sample according to a naming structure, (e) cataloging the deeply-sampled virtual musical instrument in the DS-VMI library management system, (f) writing logical instrument contractor rules for each virtual musical instrument and groups of virtual musical instruments, specifying conditions under which the specified virtual musical instrument will be automatically selected and contracted to perform in the digital performance of a music composition, and (g) writing performance logic (i.e. performance rules) for each deeply-sampled virtual musical instrument, specifying the conditions under which specified sampled notes will be automatically and predictively selected from the deeply-sampled virtual musical instrument and used in the digital performance of a music composition.

Another object of the present invention is to provide a new and improved method of operation of the automated music performance system, comprising (a) the music composition meta-data abstraction subsystem automatically parsing and analyzing a music composition to be digitally performed so as to automatically abstract and produce a set of timeline indexed music-theoretic state descriptor data (i.e. music composition meta-data) specifying the music-theoretic states of the music composition, (b) automated deeply-sampled virtual musical instrument (DS-VMI) selection and performance subsystem uses the set of music-theoretic state descriptors (i.e. music composition meta-data) to (i) select sampled notes from deeply-sampled virtual musical instruments in the library subsystem, (ii) use the music-theoretic state (MTS) responsive performance logic to process sampled notes selected from DS-VMI libraries, and (iii) assemble and finalize the processed sampled notes selected for a digital performance of the music composition, and (c) the automated music performance system producing the performed notes selected for the digital performance of the music composition, for review and evaluation by human listeners.

Another object of the present invention is to teach a new method of creating new deeply-sampled virtual musical instrument (DS-VMI) libraries using a new instrument template process, wherein what articulations to record and how to tag and represent those recorded articulations are specified in great detail, better supporting the recording, cataloging, developing and defining the deeply-sampled virtual musical instruments according to the present Invention.

Another object of the present invention is to provide a novel system of virtual musical instrument performance logic supported by an automated performance system employing a set of deeply-sampled virtual musical instruments (DS-VMIs) developed to capture and express in the music performance logic (e.g. a set of logical music performance rules) which a e is used to operate the deeply-sampled virtual musical instruments to provide instrument performances that are contextually-aware and consistent with all or certain music-theoretic states contained in the music composition that is driving the musical instrumentation, orchestration and performance process.

Another object of the present invention is to provide a new and improved method of and system for automatically transforming the instrumental arrangement and/or performance style of a music composition during automated generation of digital performances of the music composition, using virtual musical instruments and sampled notes selected from deeply-sampled virtual musical instrument (DS-VMI) libraries, based on the music-theoretic states of the music composition being digitally performed.

Another object of the present invention is to provide a new and improved method of and system for automatically transforming the instrumental arrangement and/or performance style of a music composition to be digitally performed by providing instrumental arrangement and performance style descriptors to an automated music performance system supporting deeply-sampled virtual musical instrument (DS-VMI) libraries that produce sampled notes in a digital performance of the music composition.

Another object of the present invention is to provide a Web-based system and method that supports (i) Automated Musical (Re)Arrangement and (ii) Musical Instrument Performance Style Transformation of a music composition to be digitally performed, by way of (i) selecting Musical Arrangement Descriptors and Musical Instrument Performance Style Descriptors from a GUI-bases system user interface, (ii) providing the user-selected Musical Arrangement Descriptors and Musical Instrument Performance Style Descriptors to the automated music performance system, (iii) then remapping/editing the Musical Roles abstracted from the given music composition, and (iv) modifying the Musical Instrument Performance Logic supported in the DS-VMI Libraries, that is indexed/tagged with the Music Instrument Performance Style Descriptors selected by the system user.

Another object of the present invention is to provide a new and improved method of and system for automatically generating digital performances of music compositions or digital music recordings using deeply-sampled virtual musical instrument (DS-VMI) libraries driven by data automatically abstracted from the music compositions or digital music recordings.

Another object of the present invention is to provide a new and improved method of and system for automatically generating deeply-sampled virtual musical instrument (DS-VMI) libraries having artificial intelligence (AI) driven instrument selection and performance capabilities.

Another object of the present invention is to provide a new and improved deeply-sampled virtual musical instrument (DS-MI) library management system having artificial intelligence (AI) driven instrument performance capabilities and adapted for use with digital audio workstations (DAWs) and cloud-based information services.

These and other benefits and advantages to be gained by using the features of the present invention will become more apparent hereinafter and in the appended Claims to Invention.

BRIEF DESCRIPTION OF THE DRAWINGS

The following Objects of the Present Invention will become more fully understood when read in conjunction of the Detailed Description of the Illustrative Embodiments, and the appended Drawings, wherein:

FIGS. 1A through 1E is a prior art table illustrating aspects of the Musical Instrument Digital Interface (MIDI) Standardized Specification showing the MIDI Note Number associated with each note along the audio Frequency spectrum, along with Note Name, MIDI-octave, and frequency assignment based on standard 12-EDO (12-tone equal temperament) tuning;

FIG. 8 is a set of music-theoretic state descriptors (e.g. parameters) that are automatically evaluated within each music theoretic state descriptor file (for a given music composition) by the automated music performance subsystem of the present invention so as to automatically select at least one instrument for each Role abstracted from the music composition, and also to automatically select and cue for reproduction in the audio engine of the system, the sampled sound files (e.g. notes) for the selected instrument type represented in the deeply-sampled virtual musical instrument library (DS-VMI) subsystem of the present invention;

FIG. 16 is a set of music-theoretic state descriptors (e.g. parameters) that are automatically evaluated within each music theoretic state descriptor file (for a given music composition) by the automated music performance subsystem of the present invention so as to automatically select at least one instrument for each Role abstracted from the music composition, and also to automatically select and sample the sampled sound files (e.g. notes) for the selected instrument type represented in the deeply-sampled virtual musical instrument library (DS-VMI) subsystem of the present invention;

FIG. 18 provides a flow chart describing a method of automated digital music performance generation using deeply-sampled virtual musical instrument libraries and contextually-aware (i.e. music state aware) driven performance principles practiced within an automated music composition, performance and production system shown in FIG. 12, comprising the steps of a) selecting real musical instruments to be sampled, recorded, and catalogued for use in the deeply-sampled virtual musical instrument library management subsystem, (b) using an instrument type and behavior based schema (i.e. plan) for sampling, recording and cataloguing the selected real musical instruments in the virtual musical instrument sample library management system of present invention; (c) using the instrument-type and behavior based schema to develop the action part of music-theoretic state (MTS) responsive performance rules for processing sampled notes in virtual musical instrument sample libraries being managed in the library management system, during the automated music performance process, (d) loading the DS-VML libraries and associated music-theoretic state (MTS) responsive performance rules into the automated performance system before the automated music performance generation process, (e) during an automated music composition process, the system user providing emotion and style type musical experience (MEX) descriptors and timing parameters to the system, then the system transforming MEX descriptors and timing parameters into a set of music-theoretic system operating parameters for use during the automated music composition and generation process, (f) providing the music-theoretic system operating parameters (MT-SOP descriptors) to the automated music composition engine (AMCE) subsystem for use in automatically composing a music composition, (g) providing the music composition to the automated music performance (AMCE) engine subsystem and producing a timeline indexed music-theoretic state descriptors data (i.e. music composition meta-data), (h) the automated music performance engine (AMPE) subsystem using the music-theoretic state descriptor data to automatically select sampled notes from deeply-sampled virtual musical instrument libraries, and using music-theoretic state descriptor responsive performance rules to process selected sampled notes, and generate the notes for the digital performance of the music composition, (i) assembling and finalizing the sampled notes in the digital performance of the music composition, and (j) producing the notes of a digital performance of the music composition for review and evaluation by human listeners;

FIG. 23 is a set of music-theoretic state descriptors (e.g. parameters) that are automatically evaluated within each music theoretic state descriptor file (for a given music composition) by the automated music performance subsystem of the present invention so as to automatically select at least one instrument for each Role abstracted from the music composition, and also to automatically select and sample the sampled sound files (e.g. notes) for the selected instrument type represented in the deeply-sampled virtual musical instrument library (DS-VMI) subsystem of the present invention;

FIG. 27 is a table providing a specification of all music-theoretic state descriptors generated from the analyzed music composition (including notes, metrics and meta-data) that might be automatically abstracted/determined from a MIDI-type music composition during the preprocessing state of the automated music performance process of the present invention, wherein the exemplary set of music-theoretic state descriptors include, but are not limited to, Role (or Part of Music) to be performed, MIDI Note Value (A1, B2, etc.), Duration of Notes, and Music Metrics including Position of Notes in a Measure, Position of Notes in a Phrase, Position of Notes in a Section, Position of Notes in a Chord, Note Modifiers (Accents), Dynamics, MIDI Note Value Precedence and Antecedence, What Instruments are Playing, Position of Notes from Other Instruments, Relation of Sections to Each Other, Meter and Position of Downbeats and Beats, Tempo Based Rhythms, What Instruments are assigned to a Role (e.g. Accent, Background, etc.);

FIG. 28A is a table that provides a specification of exemplary Musical Roles ("Roles") or Musical Parts of each MIDI-type music composition to be automatically analyzed by the automated music performance system of the present invention, wherein instruments with the associated performances can be assigned any of the Roles listed in this table, and a single role is assigned to an instrument, multiple roles cannot be assigned to a single instrument, but multiple instruments can be assigned a single role, and wherein Accent—a Role assigned to note that provide information on when large musical accents should be played; Back Beat—a Role that provides note data that happen on the weaker beats of a piece; Background—is a lower density role, assigned to notes that often are the lowest energy and density that lives in the background of a composition; Big Hit—a Role assigned to notes that happen outside of any measurement, usually a singular note that happens rarely; Color—a role reserved for small musical segments that play semi-regular but add small musical phrases throughout a piece; Consistent—a Role that is reserved for parts that live outside of the normal structure of phrase; Constant—a Role that is often monophonic and has constant set of notes of the same value (e.g.: all 8th notes played consecutively); Decoration—a Role similar to Color, but this role is reserved for a small flourish of notes that happens less regularly than color; High Lane—a Role assigned to very active and high-note density, usually reserved for percussion; High-Mid Lane—a Role assigned to mostly active and medium-note density, usually reserved for percussion; Low Lane—a Role assigned to low active, low note-density instrument, usually reserved for percussion; Low-Mid Lane—a Role assigned to mostly low activity, mostly low note-density instrument, usually reserved for percussion; Middle—a Role assigned to middle activity, above the background Role, but not primary or secondary information; On Beat—a Role assigned to notes that happen on strong beats; Pad—a Role assigned to long held notes that play at every chord change; Pedal—Long held notes, that hold the same note throughout a section; Primary—Role that is the "lead" or main melodic part; Secondary—a Role that is secondary to the "lead" part, often the counterpoint to the Primary role; Collected set of Drum set Roles: (this is a single performer that has multiple instruments which are assigned multiple roles that are aware of each other), Hi-Hat—Drum set role that does hi-hat notes, Snare—Drum set role that does snare notes, Cymbal—Drum set role of that does either a crash or a ride, Tom—Drum set role that does the tom parts, and Kick—Drum set role that does kick notes;

FIGS. 28B1 through 28B8 provide a set of exemplary rules for use during automated role assignment processes carried out by the system (i) when processing and evaluating a music composition (or recognized music recording), (ii) when selecting instrument types and sample instrument libraries, and (iii) when selecting and processing samples during instrument performances within the DS-VMI library subsystem, in accordance with the principles of the present invention;

FIG. 29 is a table providing a specification of all music-theoretic state descriptors (including notes, metrics and meta-data) that might be automatically abstracted/determined from a sheet-type music composition during the preprocessing state of the automated music performance process of the present invention, wherein the exemplary set of music-theoretic state descriptors include, but are not limited to, Role (or Part of Music) to be performed, MIDI Note Value (A1, B2, etc.), Duration of Notes, and Music Metrics including Position of Notes in a Measure, Position of Notes in a Phrase, Position of Notes in a Section, Position of Notes in a Chord, Note Modifiers (Accents), Dynamics, MIDI Note Value Precedence and Antecedence, What Instruments are Playing, Position of Notes from Other Instruments, Relation of Sections to Each Other, Meter and Position of Downbeats and Beats, Tempo Based Rhythms, What Instruments are assigned to a Role (e.g. Accent, Background, etc.);

FIG. 32 is a table providing a specification of all music-theoretic state descriptors generated from the analyzed music composition (including notes, metrics and meta-data) that might be automatically abstracted/determined from a MIDI-type music composition during the preprocessing state of the automated music performance process of the present invention, wherein the exemplary set of music-theoretic state descriptors include, but are not limited to, Role (or Part of Music) to be performed, MIDI Note Value (A1, B2, etc.), Duration of Notes, and Music Metrics including Position of Notes in a Measure, Position of Notes in a Phrase, Position of Notes in a Section, Position of Notes in a Chord, Note Modifiers (Accents), Dynamics, MIDI Note Value Precedence and Antecedence, What Instruments are Playing, Position of Notes from Other Instruments, Relation of Sections to Each Other, Meter and Position of Downbeats and Beats, Tempo Based Rhythms, What Instruments are assigned to a Role (e.g. Accent, Background, etc.);

FIG. 33A is a table that provides a specification of exemplary Musical Roles ("Roles") or Musical Parts of each MIDI-type music composition to be automatically analyzed by the automated music performance system of the present invention, wherein instruments with the associated performances can be assigned any of the Roles listed in this table, and a single role is assigned to an instrument, multiple roles cannot be assigned to a single instrument, but multiple instruments can be assigned a single role, and wherein Accent—a Role assigned to note that provide information on when large musical accents should be played; Back Beat—a Role that provides note data that happen on the weaker beats of a piece; Background—is a lower density role, assigned to notes that often are the lowest energy and density that lives in the background of a composition; Big Hit—a Role assigned to notes that happen outside of any measurement, usually a singular note that happens rarely; Color—a role reserved for small musical segments that play semi-regular but add small musical phrases throughout a piece; Consistent—a Role that is reserved for parts that live outside of the normal structure of phrase; Constant—a Role that is often monophonic and has constant set of notes of the same value (e.g.: all 8th notes played consecutively); Decoration—a Role similar to Color, but this role is reserved for a small flourish of notes that happens less regularly than color; High Lane—a Role assigned to very active and high-note density, usually reserved for percussion; High-Mid Lane—a Role assigned to mostly active and medium-note density, usually reserved for percussion; Low Lane—a Role assigned to low active, low note-density instrument, usually reserved for percussion; Low-Mid Lane—a Role assigned to mostly low activity, mostly low note-density instrument, usually reserved for percussion; Middle—a Role assigned to middle activity, above the background Role, but not primary or secondary information; On Beat—a Role assigned to notes that happen on strong beats; Pad—a Role assigned to long held notes that play at every chord change; Pedal—Long held notes, that hold the same note throughout a section; Primary—Role that is the "lead" or main melodic part; Secondary—a Role that is secondary to the "lead" part, often the counterpoint to the Primary role; Drum set Roles: (this is a single performer that has multiple instruments which are assigned multiple roles that are aware of each other), Hi-Hat—Drum set role that does hi-hat notes, Snare—Drum set role that does snare notes, Cymbal—Drum set role of that does either a crash or a ride, Tom—Drum set role that does the tom parts, and Kick—Drum set role that does kick notes;

FIGS. 33B1 through 33B8 provide tables describing a set of exemplary rules for use during automated role assignment processes carried out by the system (i) when processing and evaluating a music composition (or recognized music recording), (ii) when selecting instrument types and sample instrument libraries, and (iii) when selecting and processing samples during instrument performances within the DS-VMI library subsystem, in accordance with the principles of the present invention;

FIG. 34 is a schematic representation of an exemplary graphical representation of a music-theoretic state descriptor data file automatically produced for an exemplary music composition containing music composition note data, roles, metrics and meta-data;

FIG. 37 is a table that provides a specification of all music-theoretic state descriptors (including notes, metrics and meta-data) that might be automatically abstracted/determined from a music composition during the preprocessing state of the automated music performance process of the present invention, wherein the exemplary set of music-theoretic state descriptors include, but are not limited to, Role (or Part of Music) to be performed, MIDI Note Value (A1, B2, etc.), Duration of Notes, and Music Metrics including Position of Notes in a Measure, Position of Notes in a Phrase, Position of Notes in a Section, Position of Notes in a Chord, Note Modifiers (Accents), Dynamics, MIDI Note Value Precedence and Antecedence, What Instruments are Playing, Position of Notes from Other Instruments, Relation of Sections to Each Other, Meter and Position of Downbeats and Beats, Tempo Based Rhythms, What Instruments are assigned to a Role (e.g. Accent, Background, etc.);

FIG. 38A is a table provide a specification of exemplary Musical Roles ("Roles") or Musical Parts of each MIDI-type music composition to be automatically analyzed by the automated music performance system of the present invention, wherein instruments with the associated performances can be assigned any of the Roles listed in this table, and a single role is assigned to an instrument, multiple roles cannot be assigned to a single instrument, but multiple instruments can be assigned a single role, and wherein Accent—a Role assigned to note that provide information on when large musical accents should be played; Back Beat—a Role that provides note data that happen on the weaker beats of a piece; Background—is a lower density role, assigned to notes that often are the lowest energy and density that lives in the background of a composition; Big Hit—a Role assigned to notes that happen outside of any measurement, usually a singular note that happens rarely; Color—a role reserved for small musical segments that play semi-regular but add small musical phrases throughout a piece; Consistent—a Role that is reserved for parts that live outside of the normal structure of phrase; Constant—a Role that is often monophonic and has constant set of notes of the same value (e.g.: all 8th notes played consecutively); Decoration—a Role similar to Color, but this role is reserved for a small flourish of notes that happens less regularly than color; High Lane—a Role assigned to very active and high-note density, usually reserved for percussion; High-Mid Lane—a Role assigned to mostly active and medium-note density, usually reserved for percussion; Low Lane—a Role assigned to low active, low note-density instrument, usually reserved for percussion; Low-Mid Lane—a Role assigned to mostly low activity, mostly low note-density instrument, usually reserved for percussion; Middle—a Role assigned to middle activity, above the background Role, but not primary or secondary information; On Beat—a Role assigned to notes that happen on strong beats; Pad—a Role assigned to long held notes that play at every chord change; Pedal—Long held notes, that hold the same note throughout a section; Primary—Role that is the "lead" or main melodic part; Secondary—a Role that is secondary to the "lead" part, often the counterpoint to the Primary role; Drum set Roles: (this is a single performer that has multiple instruments which are assigned multiple roles that are aware of each other), Hi-Hat—Drum set role that does hi-hat notes, Snare—Drum set role that does snare notes, Cymbal—Drum set role of that does either a crash or a ride, Tom—Drum set role that does the tom parts, and Kick—Drum set role that does kick notes;

FIGS. 38B1 through 38B8 provide tables describing a set of exemplary rules for use during automated role assignment processes carried out by the system (i) when processing and evaluating a music composition (or recognized music recording), (ii) when selecting instrument types and sample instrument libraries, and (iii) when selecting and processing samples during instrument performances within the DS-VMI library subsystem, in accordance with the principles of the present invention;

FIG. 39 is a graphical representation of a music-theoretic state descriptor data file automatically-produced for an exemplary music composition containing music composition note data, roles, metrics, and meta-data;

FIG. 40 is a framework for classifying and cataloging a group of real musical instruments, and standardizing how such musical instruments are sampled, named and performed as virtual musical instruments during a digital performance of a piece of composed music, wherein musical instruments are classified by their performance behaviors, and musical instruments with common performance behaviors are classified under the same or common instrument type, thereby allowing like musical instruments to be organized and catalogued in the same class and be readily available for selection and use when the instrumentation and performance of a composed piece of music in being determined;

FIG. 41 is a schematic representation of an exemplary catalog of deeply-sampled virtual musical instruments maintained in the deeply-sampled virtual musical instrument library (DS-VMI) management subsystem of the present invention, with assigned Instrument Types and the instrument type's names of variables (e.g. Behavior and Aspect values) to be used in the automated music performance engine of the present invention;

FIGS. 42A through 42J taken together provide a list of exemplary Instruments that are supported by the automated music performance system of the present invention;

FIGS. 43A through 43C taken together provide list of exemplary Instrument Types that are supported by the automated music performance system of the present invention;

FIGS. 44A through 44E taken together short list of exemplary Behaviors and Aspect values formula assigned to Instrument Types that are supported by the automated music performance system of the present invention;

FIG. 45 is a table illustrating exemplary audio sound sources that can be sampled during a sampling and recording session to produce a deeply-sampled virtual musical instrument (DS-VMI) library according to the present invention capable of producing sampled audio sounds;

FIG. 46 is a schematic representation of a sampling template for organizing and managing an audio sampling and recording session involving the deep sampling of a specified type of real musical instrument to produce a deeply-sampled virtual musical instrument (DS-VMI) library, including information items such as real instrument name, instrument type, recording session —place, date, time, and people, categorizing essential attributes of each note sample to be captured from the real instrument during the sampling session, etc.;

FIG. 47 is a schematic representation of musical instrument data file, structured using the sampling template of FIG. 45, and organizing and managing sample data recorded during an audio sampling and recording session involving the deep sampling of a specified type of real musical instrument to produce musical instrument data file for a deeply-sampled virtual musical instrument;

FIG. 48 is a schematic representation illustrating the definition of a deeply-sampled virtual music instrument (DS-VMI) according to the principles of the present invention, showing a virtual musical instrument data set containing (i) all data files for the sets of sampled notes performed by a specified type of real musical instrument deeply-sampled during an audio sampling session and mapped to note/velocity/microphone/round-robin descriptors, and (ii) MTS-responsive performance logic (i.e. performance rules) for use with samples in the deeply-sampled virtual musical instrument;

FIG. 49 is a schematic representation of music-theoretic state (MTS) responsive virtual musical instrument (VMI) contracting/selection logic for automatically selecting a specific deeply-sampled virtual musical instrument to perform in the digital performance of a music composition;

FIG. 50 is a schematic representation of music-theoretic state (MTS) responsive performance logic for controlling specific types of performance of each deeply-sampled virtual musical instrument supported in the deeply-sampled virtual musical instrument (DS-VMI) library management subsystem of the present invention;

FIG. 53 is a schematic representation illustrating the primary steps involved in the method of operation of the automated music performance system of the present invention, involving (a) using the music composition meta-data abstraction subsystem to automatically parse and analyze each time-unit (i.e. beat/measure) in a music composition to be digitally performed so as to automatically abstract and produce a set of time-line indexed music-theoretic state descriptor data (i.e. music composition meta-data) specifying the music-theoretic states of the music composition including note and composition meta-data, (b) using the automated deeply-sampled virtual musical instrument (DS-VMI) selection and performance subsystem and the automated VMI contracting subsystem, with the set of music-theoretic state descriptor data (i.e. music composition meta-data) and the virtual musical instrument contracting/selection logic (i.e. rules), to automatically select, for each time-unit in the music composition, one or more deeply-sampled virtual musical instruments from the DS-VMI library subsystem to perform the sampled notes of a digital music performance of the music composition, (c) using the automated deeply-sampled virtual musical instrument (DS-VMI) selection and performance subsystem and the set of music-theoretic state descriptor data (i.e. music composition meta-data) to automatically select, for each time-unit in the music composition, sampled notes from deeply-sampled virtual musical instrument libraries for a digital music performance of the music composition, (d) using the automated deeply-sampled virtual musical instrument (DS-VMI) selection and performance subsystem and music-theoretic state responsive performance logic (i.e. rules) in the deeply-sampled virtual musical instrument libraries to process and perform the sampled notes selected for the digital music performance of the music composition, and (e) assembling and finalizing the processed samples selected for the digital performance of the music composition for production, review and evaluation by human listeners;

FIG. 56 is a schematic representation of graphical user interface (GUI) screen of the system user interface of the automated music performance system of the fourth illustrative embodiment indicating how to transform the musical arrangement and instrument performance style of a music composition before an automated digital performance of the music composition, wherein the GUI-based system user interface shown in FIGS. 54 through 55 supports invites a system user to select (i) an Automated Musical (Re)Arrangement and/or (ii) Musical Instrument Performance Style Transformation of a music composition to be digitally performed by the system, through a simple end-user process involving (i) selecting Musical Arrangement Descriptors and Musical Instrument Performance Style Descriptors from a GUI-bases system user interface, and (ii) then providing the user-selected Musical Arrangement Descriptors and Musical Instrument Performance Style Descriptors to the automated music performance system, whereupon (iii) the Musical Roles abstracted from the given music composition are automatically remapped/edited to achieve the selected musical arrangement, and (iv) the Musical Instrument Performance Logic supported in the DS-VMI Libraries, and indexed/tagged with the Music Instrument Performance Style Descriptors selected by the system user, are automatically selected for modification during the digital performance process;

FIG. 57 is an exemplary generic customizable list of musical arrangement descriptors supported by the automated music performance system of the fourth illustrative embodiment;

FIG. 58 is an exemplary generic customizable list of musical instrument performance style descriptors supported by the automated music performance system of the fourth illustrative embodiment;

FIG. 62 is a flow chart describing the high-level steps performed in a method of automated music arrangement and musical instrument performance style transformation supported within the automated music performance system of the fourth illustrative embodiment of the present invention, wherein an automated music arrangement function is enabled within the automated music performance system by remapping and editing of roles, notes, music metrics and meta-data automatically abstracted and collected during music composition analysis, and an automated musical instrument performance style transformation function is enabled by selecting instrument performance logic provided for groups of note and instruments in the deeply-sampled virtual musical instrument (DS-VMI) libraries of the automated music performance system, that are indexed with the musical instrument performance style descriptors selected by the system user;

FIG. 63 is a table provide a specification of exemplary Musical Roles ("Roles") or Musical Parts of each music composition to be automatically analyzed and abstracted (i.e. identified) by the automated music performance system of the fourth-illustrative embodiment;

FIG. 64 is a table providing a specification of a transformed music-theoretic state descriptor data file generated from the analyzed music composition, including notes, metrics and meta-data automatically abstracted/determined from a music composition and then transformed during the preprocessing state of the automated music performance process of the present invention, wherein the exemplary set of transformed music-theoretic state descriptors include, but are not limited to, Role (or Part of Music) to be performed, MIDI Note Value (A1, B2, etc.), Duration of Notes, and Music Metrics including Position of Notes in a Measure, Position of Notes in a Phrase, Position of Notes in a Section, Position of Notes in a Chord, Note Modifiers (Accents), Dynamics, MIDI Note Value Precedence and Antecedence, What Instruments are Playing, Position of Notes from Other Instruments, Relation of Sections to Each Other, Meter and Position of Downbeats and Beats, Tempo Based Rhythms, What Instruments are assigned to a Role (e.g. Accent, Background, etc.);

FIG. 66 is a schematic representation of a deeply-sampled virtual musical instrument (DS-VMI) library provided with music instrument performance logic (e.g. performance logic rules indexed with music performance style descriptors) responsive to music performance style descriptors provided to the system user interface;

FIG. 68 is a table providing a specification of a set of transformed music-theoretic state descriptors (including notes, metrics and meta-data) automatically abstracted/determined from a music composition during the preprocessing, and transformed to support the musical rearrangement and musical instrument performance style modifications requested by the system user, wherein the exemplary transformed set of music-theoretic state descriptors include, but are not limited to, Role (or Part of Music) to be performed, MIDI Note Value (A1, B2, etc.), Duration of Notes, and Music Metrics including Position of Notes in a Measure, Position of Notes in a Phrase, Position of Notes in a Section, Position of Notes in a Chord, Note Modifiers (Accents), Dynamics, MIDI Note Value Precedence and Antecedence, What Instruments are Playing, Position of Notes from Other Instruments, Relation of Sections to Each Other, Meter and Position of Downbeats and Beats, Tempo Based Rhythms, What Instruments are assigned to a Role (e.g. Accent, Background, etc.).

DETAILED DESCRIPTION OF THE ILLUSTRATIVE EMBODIMENTS OF THE PRESENT INVENTION

Figure 2:
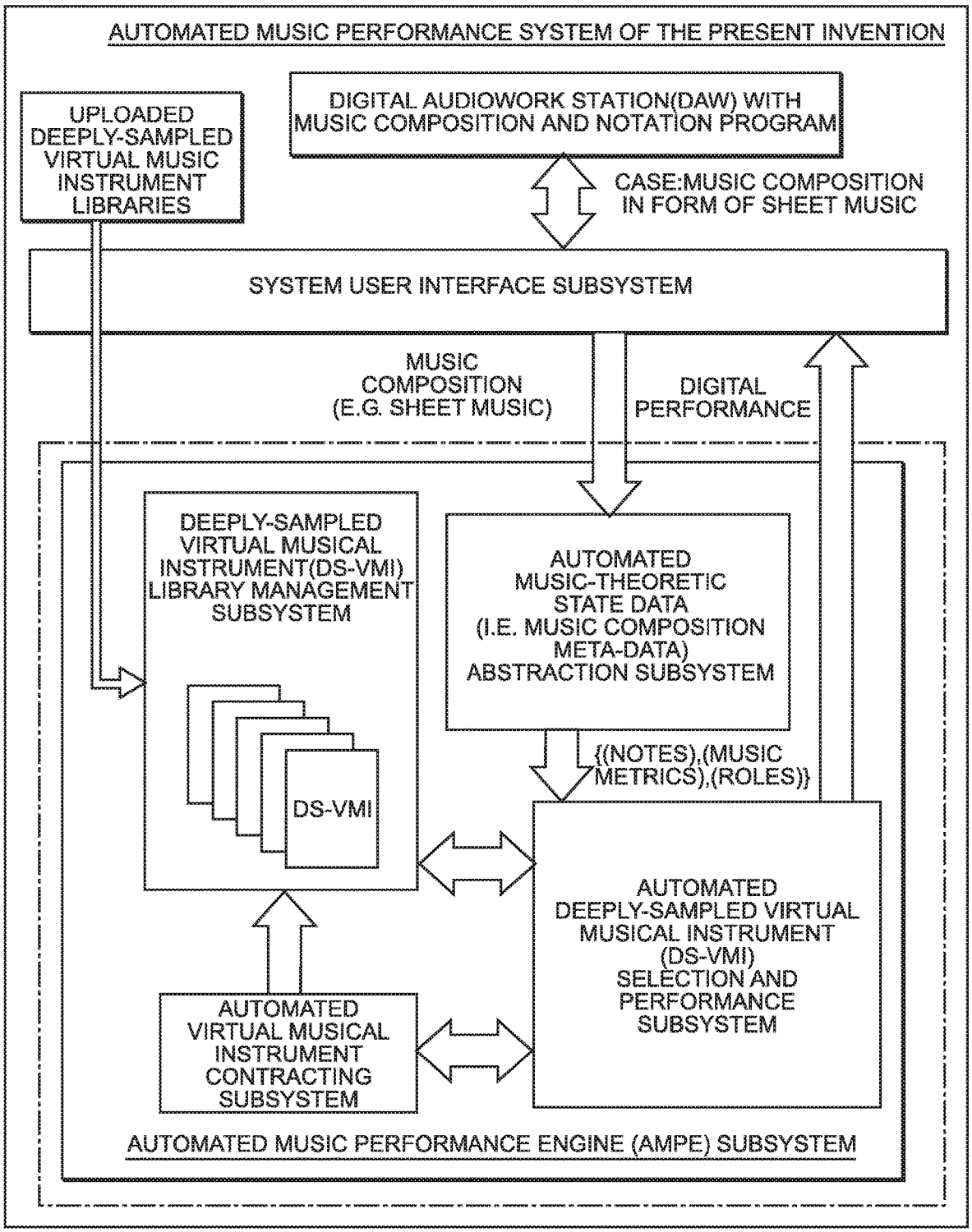
FIG. 2 shows the automated music performance system of the first illustrative embodiment of the present invention. As shown, the system comprises: (i) a system user interface subsystem for a system user using digital audio workstation (DAW) provided with music composition and notation software programs to produce a music composition, and (ii) an automated music performance engine (AMPE) subsystem interfaced with the system user interface subsystem, for producing a digital performance based on the music composition, wherein the system user interface subsystem transfers a music composition to the automated music performance engine subsystem, wherein the automated music performance engine subsystem includes: (i) an automated music-theoretic state (MTS) data abstraction subsystem for automatically abstracting all music-theoretic states contained in the music composition and producing a set of music-theoretic state descriptors data (i.e. music composition meta-data) representative thereof; (ii) a deeply-sampled virtual musical instrument (DS-VMI) library management subsystem for managing the sample libraries supporting the deeply-sampled virtual musical instruments to be selected for performance of notes specified in the music composition; and (iii) an automated deeply-sampled virtual musical instrument (DS-VMI) selection and performance subsystem for selecting deeply-sampled virtual musical instruments in the DS-VMI library management subsystem and processing the sampled notes selected from selected deeply-sampled virtual musical instruments using music-theoretic state (MTS) responsive performance rules (i.e. logic), to automatically produce the sampled notes selected for a digital performance of the music composition, and wherein the automated music performance engine (AMPE) subsystem transfers the digital performance to the system user interface subsystem for production, review and evaluation.

Referring to the accompanying Drawings, like structures and elements shown throughout the figures thereof shall be indicated with like reference numerals.

The present Application relates to and improves upon Applicant's inventions disclosed prior US Patent Applications and US Granted Patents, specifically: co-pending patent application Ser. No. 16/253,854 filed Jan. 22, 2019; U.S. Pat. No. 10,163,429; and U.S. patent application Ser. No. 14/869,911 filed Sep. 29, 2015, now U.S. Pat. No. 9,721,551 granted on Apr. 1, 2017. Each of these US Patent Applications and US Patents are commonly and owned by Amper Music, Inc., and are incorporated herein by reference in their entirety as if fully set forth herein.

Glossary of Terms

Articulations: Variants of ways of playing a note on an instrument, for example: violin sustained (played with a bow) vs violin pizzicato (played with fingers as a pluck)
Descriptor: A Style and Mood pairing to reflect a specific type of music (Happy Classic Rock).
MIDI: Musical Instrument Digital Interface—universally accepted Standards format developed in 1983 to facilitate the communication between many different manufacturers of digital music instruments.
Mix: This is the processing of selecting and balancing microphones through various digital signal processes. This can include microphone position in a room and proximity to an instrument, microphone pickup patterns, outboard equipment (reverbs, compressors, etc.) and brand-type of microphones used.
Performance Notation System: The method of describing how musical notes are performed.
Round Robin: A set of samples that are recorded all at the same dynamic and same note. This provides some slight alterations to the sound so that in fast repetition the sound does not sound static and can provide a more realistic performance.
Sampling: The method of recording single performances (often single notes or strikes) from any instrument for the purposes of reconstructing that instrument for realistic playback.
Sample Instrument Library: A collection of samples assembled into virtual musical instrument(s) for organization and playback.
Sample Release Type: After a sample is triggered by a note-on event, a note-off event can trigger a sample to provide a more realistic "end" to a note. For example: Hitting a cymbal and then immediately muting it with the hand (also known as "choking"). There are three categories of Sample Releases: Short, a sample that triggers if a note-off event occurs before a given threshold; Long, a sample that triggers if a note-off event occurs after a given threshold (or no threshold).
Performance, an alternate performance of a Long or Short sample.
Sample Trigger Style: This is the type of sample that is to be played. One-Shot: A Sample that does not require a note-off event and will play its full amount whenever triggered (example: snare drum hit). Sustain: A sample that is looped and will play indefinitely until a note-off is given.
Legato: A special type of sample that contains a small performance from a starting note to a destination note.

Figure 9:
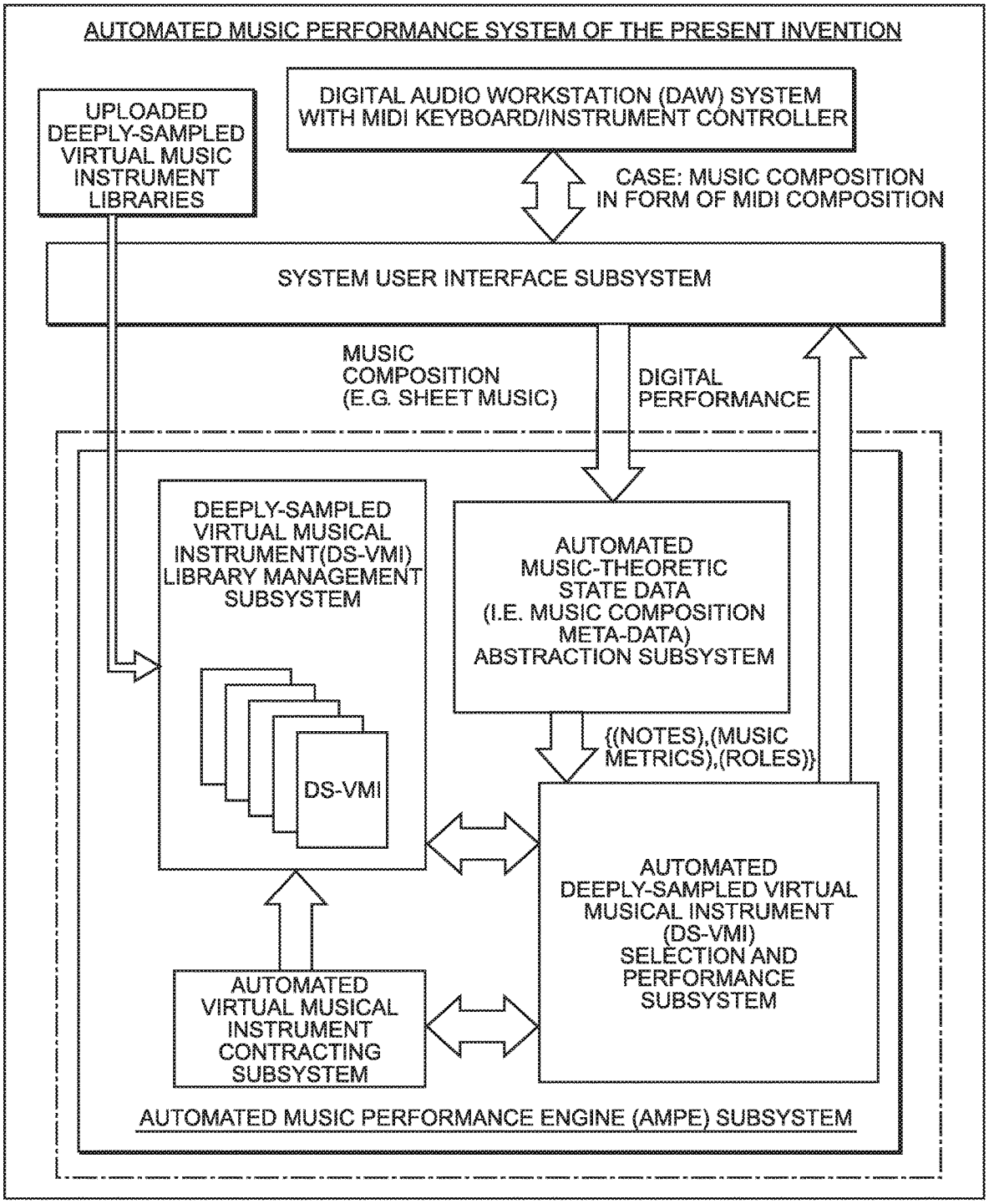
FIG. 9 is a schematic system diagram of the automated music performance system of second illustrative embodiment of the present invention comprising (i) a system user interface subsystem for a system user using digital audio workstation (DAW) supported by a keyboard and/or other MIDI devices, to produce a music composition for digital performance, and (ii) an automated music performance engine (AMPE) subsystem interfaced with the system user interface subsystem, for producing a digital performance based on the music composition, wherein the system user interface subsystem transfers a music composition to the automated music performance engine, wherein the automated music performance engine includes (i) an automated music-theoretic state (MTS) data abstraction subsystem for automatically abstracting all music-theoretic states contained in the music composition and producing a set of music-theoretic state descriptors representative thereof, (ii) a deeply-sampled virtual musical instrument (DS-VMI) library management subsystem for managing deeply-sampled virtual musical instruments to be selected for performance of notes specified in the music composition, and (iii) an automated deeply-sampled virtual musical instrument (DS-VMI) selection and performance subsystem for selecting deeply-sampled virtual musical instruments in the DS-VMI library management subsystem and performing notes from selected deeply-sampled virtual musical instruments using music-theoretic state (MTS) responsive performance rules, to automatically produce a digital performance of the music composition, wherein the automated music performance engine (AMPE) subsystem transfers the digital performance to the system user interface subsystem for production, review and evaluation.
Figure 10A:
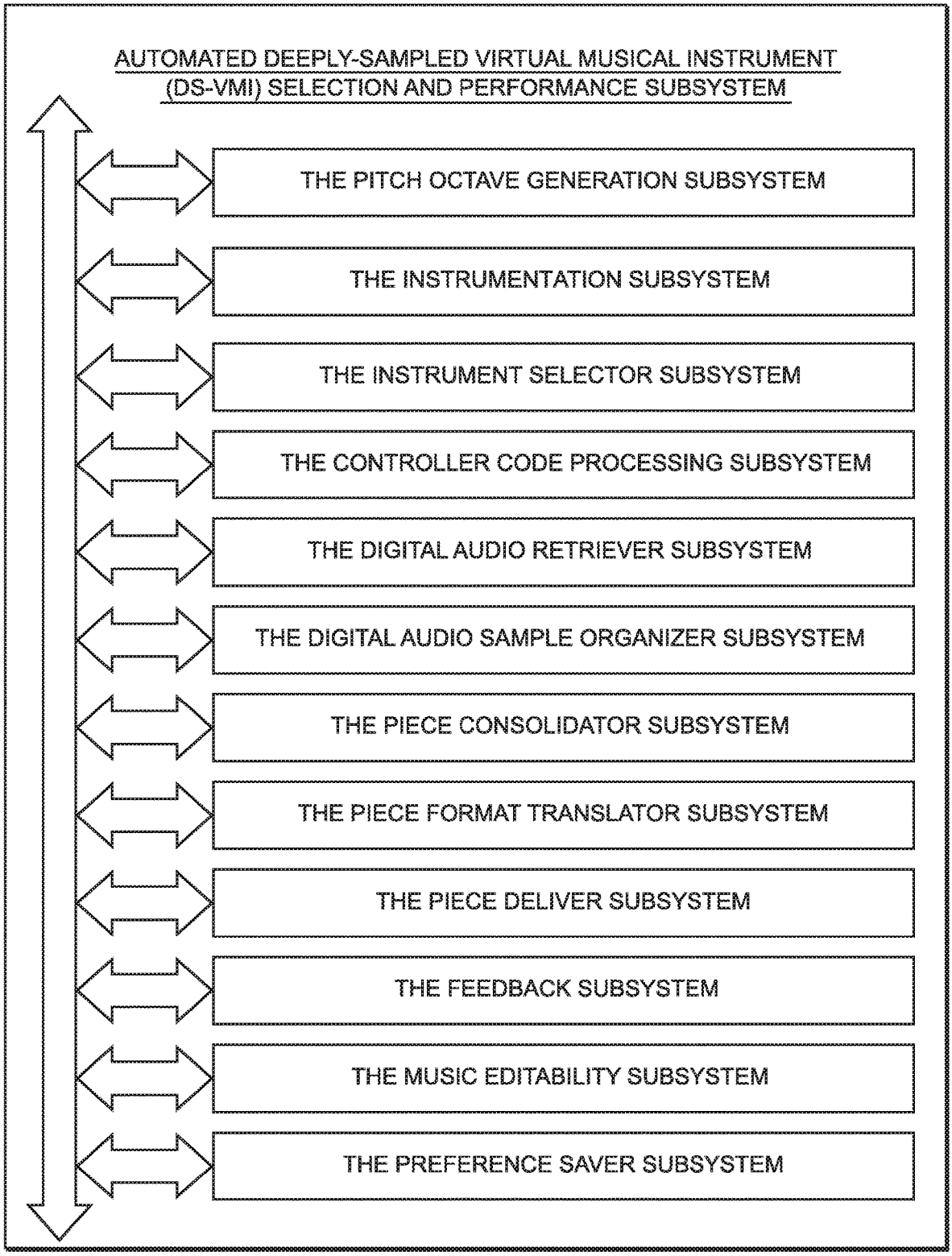
FIG. 10A is a schematic block representation of the subsystem architecture of the Automated Deeply-Sampled Virtual Musical Instrument (DS-VMI) Selection and Performance Subsystem employed in the automated music performance system of the present invention, shown comprising the Pitch Octave Generation Subsystem, the Instrumentation Subsystem, the Instrument Selector Subsystem, the Digital Audio Retriever Subsystem, the Digital Audio Sample Organizer Subsystem, the Piece Consolidator Subsystem, the Piece Format Translator Subsystem, the Piece Deliver Subsystem, the Feedback Subsystem, and the Music Editability Subsystem, interfaced as shown with the other subsystems deployed within the Automated Music Performance System of the present invention.
Figure 10B:
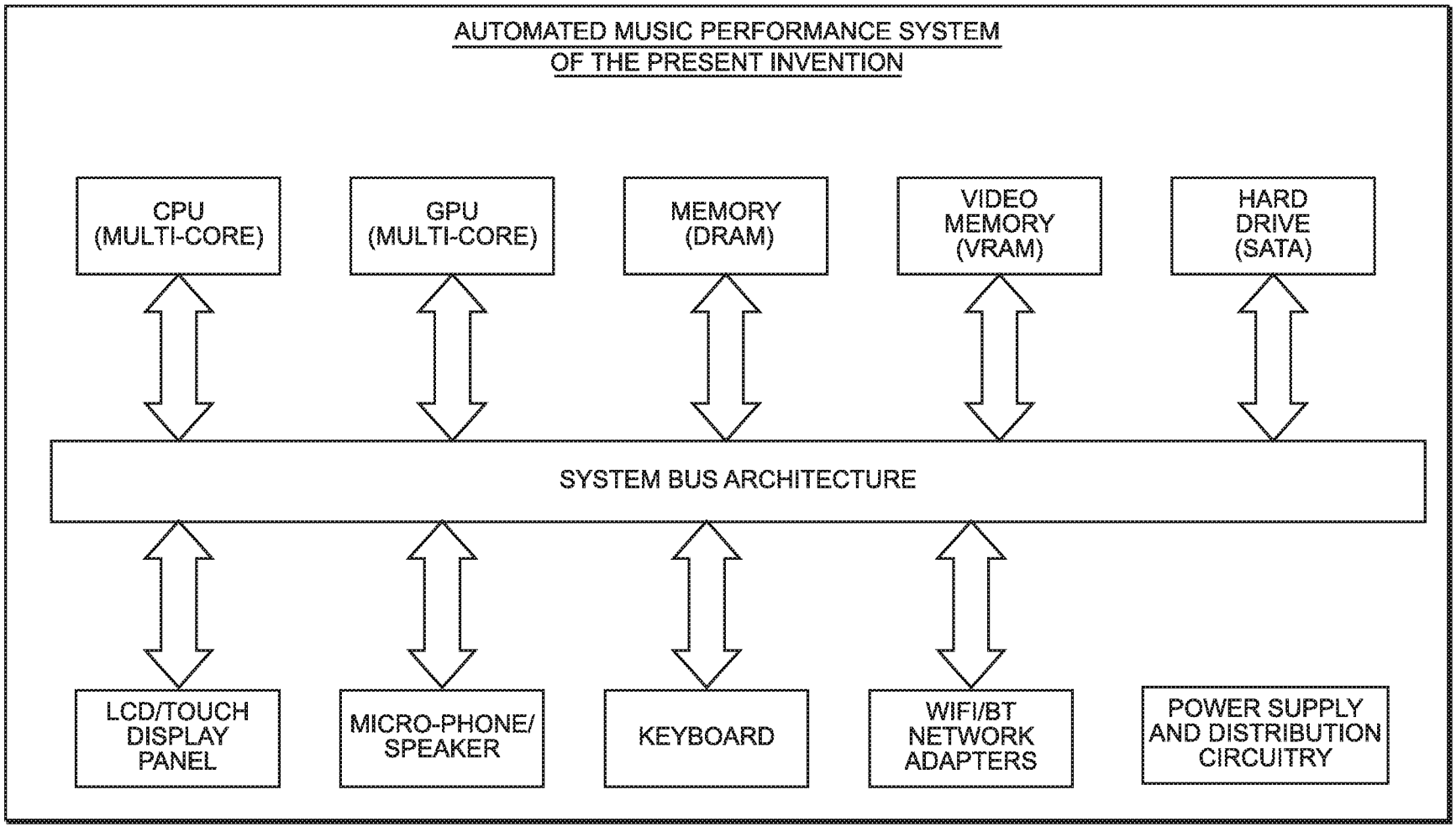
FIG. 10B is a schematic block system diagram for the first illustrative embodiment of the automated music performance system of the present invention, shown comprising a keyboard interface, showing the various components, such as multi-core CPU, multi-core GPU, program memory (DRAM), video memory (VRAM), hard drive (SATA), LCD/touch-screen display panel, microphone/speaker, keyboard, WIFI/Bluetooth network adapters, and power supply and distribution circuitry, integrated around a system bus architecture.
Figure 17:
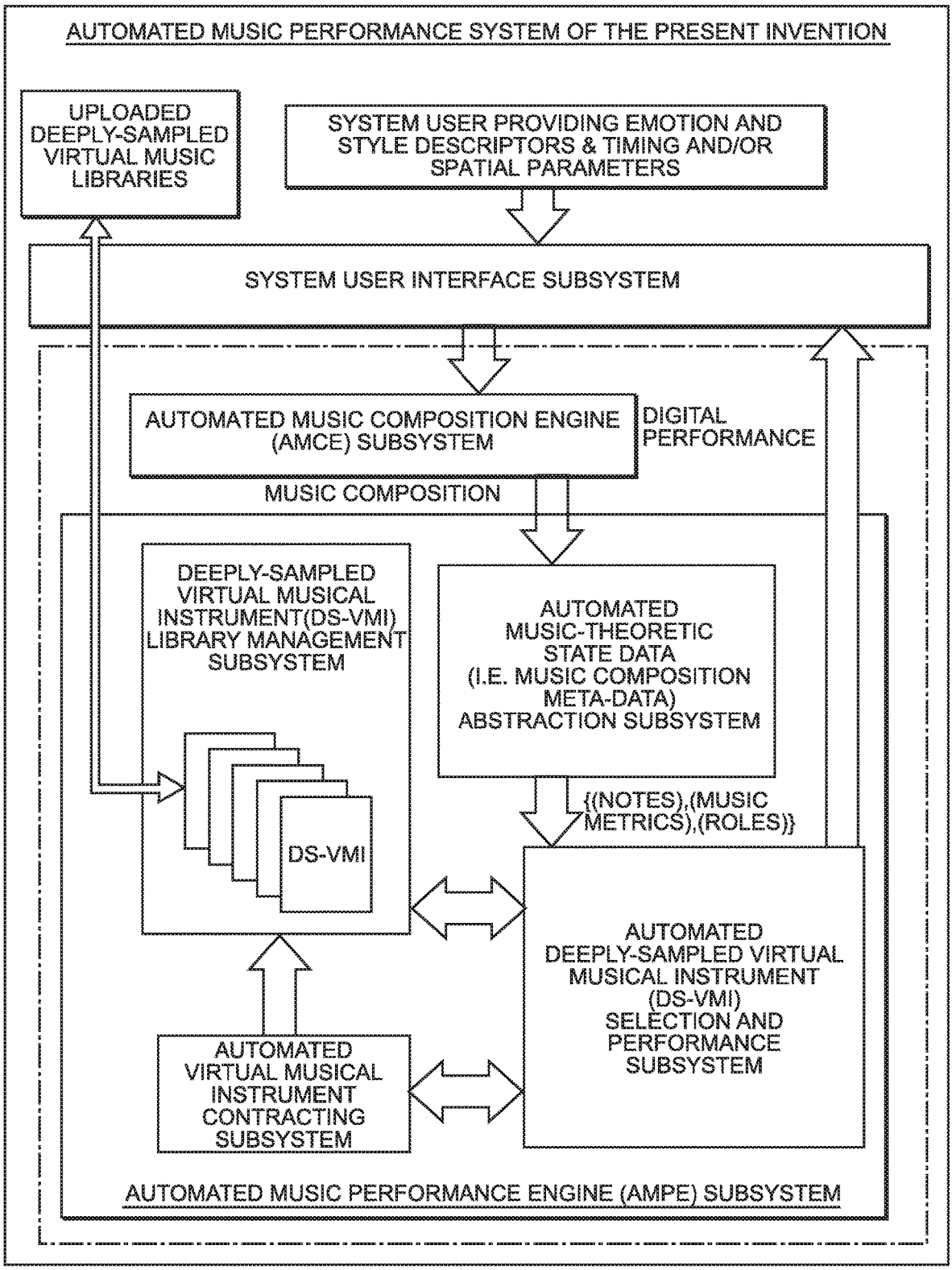
FIG. 17 is a schematic system diagram of the automated music composition, performance and production system of third illustrative embodiment of the present invention comprising (i) a system user interface subsystem for a system user to provide the emotion-type, style-type musical experience (MEX) descriptors (MXD) and timing parameters for a piece of a music to be automatically composed, performed and produced, (ii) an automated music composition engine (AMCE) subsystem interfaced with the system user interface subsystem to receive MEX descriptors and timing parameters, and (ii) an automated music performance engine (AMPE) subsystem interfaced with the automated music composition engine subsystem and the system user interface subsystem, for automatically producing a digital performance based on the music composition produced by the automated music composition engine subsystem, wherein the automated music composition engine subsystem transfers a music composition to the automated music performance engine, wherein the automated music performance engine includes (i) an automated music-theoretic state (MTS) data abstraction subsystem for automatically abstracting all music-theoretic states contained in the music composition and producing a set of music-theoretic state descriptors representative thereof, (ii) a deeply-sampled virtual musical instrument (DS-VMI) library management subsystem for managing deeply-sampled virtual musical instruments to be selected for performance of notes specified in the music composition, and (iii) an automated deeply-sampled virtual musical instrument (DS-VMI) selection and performance subsystem for selecting deeply-sampled virtual musical instruments in the DS-VMI library management subsystem and performing notes from selected deeply-sampled virtual musical instruments using music-theoretic state (MTS) responsive performance rules, to automatically produce a digital performance of the music composition, and wherein the automated music performance engine (AMPE) subsystem ultimately transfers the digital performance to the system user interface subsystem for production, review and evaluation.

Overview on the Automated Music Performance System of the Present Invention, and the Employment of its Automated Music Performance Engine in Diverse Applications FIGS. 2, 9 and 17 show three high-level system architectures for the automated music performance (AMPE) system of the present invention, each supporting the use of deeply-sampled virtual musical instrument (DS-VMI) libraries and/or digitally-synthesized virtual musical instrument (DS-VMI) libraries driven by music compositions that may be produced or otherwise rendered in any flexible manner as end-user applications may require.

As shown and described through the present Patent Specification, a music composition, provided in either sheet music or MIDI-music format or by other means, is supplied by the system user as input through the system user input output (IO) interface, and used by the Automated Music Performance Engine Subsystem (AMPE) of the present invention, illustrated and described in great technical detail in FIGS. 2 through 39, to automatically perform and produce contextually-relevant music, in a composite music file, that is then supplied back to the system user via the system user (I/O) interface. The details of this novel system and its supporting information processes will be described in great technical detail hereinafter.

While the illustrative embodiments shown and described herein employ deeply-sampled virtual musical instruments (DS-VMI) containing data files representing notes and sounds produced by audio-sampling techniques described herein, it is understood that such notes and sounds can also be produced or created using digital sound synthesis and modeling methods supported by commercially available software tools including, but not limited to, MOTU® MX4 Synthesis Engine and/or MACHFIVE 3 software products, both by MOTU, Inc. of Cambridge, Mass.

In general, and preferably, the automated music performance system of the various illustrative embodiments of the present invention disclosed herein will be realized as an industrial-strength, carrier-class Internet-based network of object-oriented system design, deployed over a global data packet-switched communication network comprising numerous computing systems and networking components, as shown. The system user interface may be supported by a portable, mobile or desktop Web-based client computing system, while the other system components of the network are realized using a global information network architecture. Alternatively, the entire automated music performance system may be realized on a single portable or desktop computing system, as the application may require. In the case of using a global information network to deploy the automated music performance system, the information network of the present invention can be referred to as an Internet-based system network. The Internet-based system network can be implemented using any object-oriented integrated development environment (IDE) such as for example: the Java Platform, Enterprise Edition, or Java EE (formerly J2EE); IBM Websphere; Oracle Weblogic; a non-Java IDE such as Microsoft's NET IDE; or other suitably configured development and deployment environments well known in the art. Preferably, although not necessary, the entire system of the present invention would be designed according to object-oriented systems engineering (OOSE) methods using UML-based modeling tools such as ROSE by Rational Software, Inc. using an industry-standard Rational Unified Process (RUP) or Enterprise Unified Process (EUP), both well known in the art. Implementation programming languages can include C, Objective C, C, Java, PHP, Python, Haskell, and other computer programming languages known in the art. Preferably, the system network is deployed as a three-tier server architecture with a double-firewall, and appropriate network switching and routing technologies well known in the art. In some deployments, private/public/hybrid cloud service providers, such Amazon Web Services (AWS), may be used to deploy Kubernetes, an open-source software container/cluster management/orchestration system, for automating deployment, scaling, and management of containerized software applications, such as the enterprise-level applications, as described herein.

The innovative system architecture of the automated music performance system of the present invention is inspired by the co-inventors' real-world experience (i) composing musical scores for diverse kinds of media including movies, video-games and the like, (ii) performing music using real and virtual musical instruments of all kinds from around the world, and (iii) developing virtual musical instruments by sampling the sounds produced by real instruments, as well as natural and synthetic audio sound sources identified above, and also synthesizing digital notes and sounds using digital synthesis methods, to create the note/sound sample libraries that support such virtual musical instruments (VMIs) maintained in the automated music performance systems of the present invention.

As used herein, the term "virtual musical instrument (VMI)" refers to any sound producing instrument that is capable of producing a musical piece (i.e. a music composition) on a note-by-note and chord-by-chord basis, using (i) a sound sample library of digital audio sampled notes, chords and sequences of notes, recorded from real musical instruments or synthesized using digital sound synthesis methods described above, and/or (ii) a sound sample library of digital audio sounds generated from natural sources (e.g. wind, ocean waves, thunder, babbling brook, etc.) as well as human voices (singing or speaking) and animals producing natural sounds, and sampled and recorded using the sound/audio sampling techniques disclosed herein. Alternatively, such notes and sounds in a virtual musical instrument (VMI) can also be designed, created and produced using digital sound synthesis methods supported using modern sound synthesis software products including, but not limited to, MOTU MX4 and MACHFIVE software products, and the Synclavier® synthesizer systems from Synclavier Digital, and other note/sound design tools, well known in the art.

Notably, the methods of music note/sound sampling and synthesis used to building virtual musical instruments (VMIs) for use with the automated music performance system of the present invention, are fundamentally different from prior art loop synthesis methods where many loops, and tracks, of music are pre-recorded and stored in a memory storage device (e.g. a database) and subsequently accessed and combined together, to create a piece of music, and where there is no underlying music theoretic characterization/specification of the notes and chords in the components of music used in such prior art Loop synthesis methods.

In marked contrast, strict musical-theoretic specification of each musical event (e.g. note, chord, phrase, sub-phrase, rhythm, beat, measure, melody, and pitch) within a piece of music being automatically composed and generated by the system/machine of the present invention, must be maintained by the system during the entire music composition/generation process in order to practice the virtual music instrument (VMI) synthesis methods in accordance with the principles of the present invention.

The automated music performance system of the present invention is a complex system comprised of many subsystems, wherein advanced computational machinery is used to support highly specialized generative processes that support the automated music performance and production process of the present invention. Each of these components serves a vital role in a specific part of the automated music performance engine (AMPE) system of the present invention, and the combination of each component into the automated music composition and generation engine creates a value that is truly greater than the sum of any or all of its parts. A concise and detailed technical description of the structure and functional purpose of each of these subsystem components is provided hereinafter.

Regarding the overall timing and control of the subsystems within the system, reference should be made to flow chart set forth in FIG. 53, illustrating that the timing of each subsystem during each execution of the automated music performance process for a given music composition provided to the system via its system user interface (e.g. touch-screen GUI, keyboard, application programming interface (API), computer communication interface, etc.).

As shown in FIG. 53, the first step of the automated music performance process involves receiving a music composition (e.g. in the form of sheet music produced from a music composition or notation system running on a DAW or like system, or a MIDI music composition file generated by a MIDI-enabled instrument, DAW or like system) which the system user wishes to be automatically composed and generated by machine of the present invention. Typically, the music composition data file will be provided through a GUI-based system user system interface subsystem, although it is understood that this system user interface need not be GUI-based, and could use EDI, XML, XML-HTTP and other types information exchange techniques, including APIs (e.g. JASON), where machine-to-machine, or computer-to-computer communications are required to support system users which are machines, or computer-based machines, request automated music composition and generation services from machines practicing the principles of the present invention, disclosed herein. The other steps of the automated music performance process will be described in great detail hereinafter with reference to FIG. 53.

However, it is to be pointed out at this juncture that various three alternative system architectures have been disclosed and taught herein to illustrate various ways of and means for supplying "music compositions" to the automated music performance engine subsystem of the present invention, for the purpose of automatically generating a nearly infinite variety of possible digital music performances, for each music composition supplied as input to the system via its system interface (e.g. API, GUI-based interface, XML, etc.).

The first illustrative embodiment teaches providing sheet-music type music compositions to the automated music performance system of the present invention, and supporting OCR/OMR software techniques to read graphically expressed music performance notation. The second illustrative embodiment teaches providing MIDI-type music compositions to the automated music performance system of the present invention. The third illustrative embodiment teaches providing music experience (MEX) descriptors to an automated music composition engine, and automatically processing the generated music composition to the automatically generate a digital music performance of the music composition. These three illustrative embodiments will be described in great technical detail hereinafter.

However, it should be pointed out that there are other sources for providing "music composition" input to the automated music performance engine system of the present invention, accessible of a local area network (LAN) or over a cloud-based wide area network (WAN) as the application may require. For example, a sound recording of a music composition performance can be supplied to an audio-processor programmed for automatically recognizing the notes performed in the performance and generating a music notation of the musical performance recording. Commercially available automatic music transcription software, such as AnthemScore by Lunsversus, Inc., can be adapted to support this illustrative embodiment of the present invention. The output of the automatic music transcription software system can be provided to the music composition pre-processor supported by the first illustrative embodiment of the present invention, to generate music-theoretic state descriptor data (including roles, notes, music metrics and meta data) that is then supplied to the automated music performance system of the present invention.

Alternatively, the music composition input can be a sound recording of a tune sung vocally, and this song can be audio-processed and transcribed into a music composition with notes and other performance notation. This music composition can be provided to the music composition pre-processor supported by the first illustrative embodiment of the present invention, to generate music-theoretic state descriptor data (including roles, notes, music metrics and meta data) that is then supplied to the automated music performance system of the present invention.

These and other methods of providing a piece of composed music, or performed music, to the automated music performance system of the present invention, will become more apparent hereinafter in view of the present invention disclosure and Claims to Invention appended hereto.

First Illustrative Embodiment of the Automated Music Performance System of the Present Invention, where a Human Composer Composes an Orchestrated "Music Composition" Expressed in a Sheet-Music Format Kind of Music-Theoretic Representation and Wherein the Music Composition is Provided to the Automated Musical Performance System of the Present Invention so that this System can Select Deeply-Sampled Virtual Musical Instruments Supported by the Automated Music Performance System Based on Roles Abstracted During Music Composition Processing, and Digitally Perform the Music Composition Using Automated Selection of Notes from Deeply-Sampled Virtual Musical Instrument Libraries FIG. 2 shows the automated music performance system of the first illustrative embodiment of the present invention. In general, the music composition provided as input is sheet music produced (i) by hand, (ii) by sheet music notation software (e.g. Sibelius® or Finale® software) running on a computer system, or (iii) by using conventional music composition and notation software running on a digital audio workstation (DAW) installed on a computer system, as shown in FIG. 2. Suitable digital audio workstation (DAW) may include commercial products, such as: Pro Tools from Avid Technology; Digital Performer from Mark of the Unicorn (MOTU); Cubase from Steinberg Media Technologies GmbH; and Logic Pro X from Apple Computer; each running any suitable music composition and score notation software program such as, for example: Sibelius Scorewriter Program by Sibelius Software Limited; Finale Music Notation and Scorewriter Software by MakeMusic, Inc.; MuseScore Composition and Notation Program by MuseScore BVBA www.musescore.org; Capella Music Notation or Scorewriter Program by Capella Software AG.

As shown in FIG. 2, the system comprises: (i) a system user interface subsystem for a system user using a digital audio workstation (DAW) provided with music composition and notation software programs, described above, to produce a music composition in sheet music format; and (ii) an automated music performance engine (AMPE) subsystem interfaced with the system user interface subsystem, for producing a digital performance based on the music composition, wherein the system user interface subsystem transfers a music composition to the automated music performance engine subsystem. The automated music performance engine subsystem includes: (i) an automated music-theoretic state (MTS) data abstraction subsystem for automatically abstracting all music-theoretic states contained in the music composition and producing a set of music-theoretic state descriptors data (i.e. music composition meta-data) representative thereof; (ii) a deeply-sampled virtual musical instrument (DS-VMI) library management subsystem for managing the sample libraries supporting the deeply-sampled virtual musical instruments to be selected for performance of notes specified in the music composition; and (iii) an automated deeply-sampled virtual musical instrument (DS-VMI) selection and performance subsystem for selecting deeply-sampled virtual musical instruments in the DS-VMI library management subsystem and processing the sampled notes selected from selected deeply-sampled virtual musical instruments using music-theoretic state (MTS) responsive performance rules (i.e. logic), to automatically produce the sampled notes selected for a digital performance of the music composition. The automated music performance engine (AMPE) subsystem transfers the digital performance to the system user interface subsystem for production, review and evaluation.

Figure 2A:
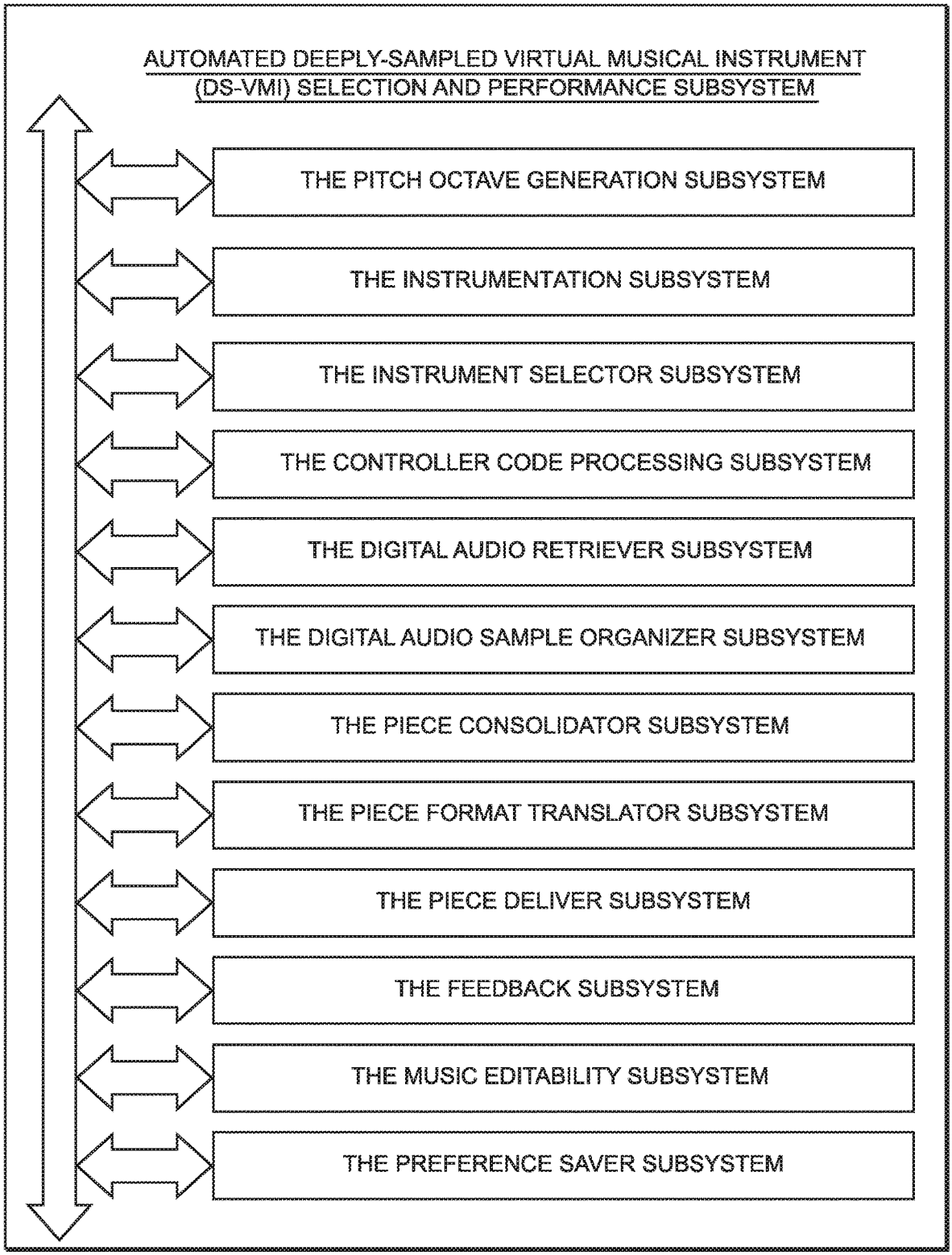
FIG. 2A is a schematic block representation of the subsystem architecture of the Automated Deeply-Sampled Virtual Musical Instrument (DS-VMI) Selection and Performance Subsystem employed in the Automated Music Performance (and Production) System of the present invention, shown comprising a Pitch Octave Generation Subsystem, an Instrumentation Subsystem, an Instrument Selector Subsystem, a Digital Audio Retriever Subsystem, a Digital Audio Sample Organizer Subsystem, a Piece Consolidator Subsystem, a Piece Format Translator Subsystem, the Piece Deliver Subsystem, a Feedback Subsystem, and a Music Editability Subsystem, interfaced as shown with the other subsystems (e.g. an Automated Music-Theoretic State Data (i.e. Music Composition Meta-Data) Abstraction Subsystem, a Deeply-Sampled Virtual Musical Instrument (DS-VMI) Library Management Subsystem, and an Automated Virtual Musical Instrument Contracting Subsystem) deployed within the Automated Music Performance System of the present invention.

As shown in FIG. 2A, the automated music performance system comprises various components, namely: a multi-core CPU, a multi-core GPU, program memory (DRAM), video memory (VRAM), hard drive (SATA), LCD/touch-screen display panel, microphone/speaker, keyboard, WIFI/Bluetooth network adapters, and power supply and distribution circuitry, integrated around a system bus architecture.

Figure 2B:
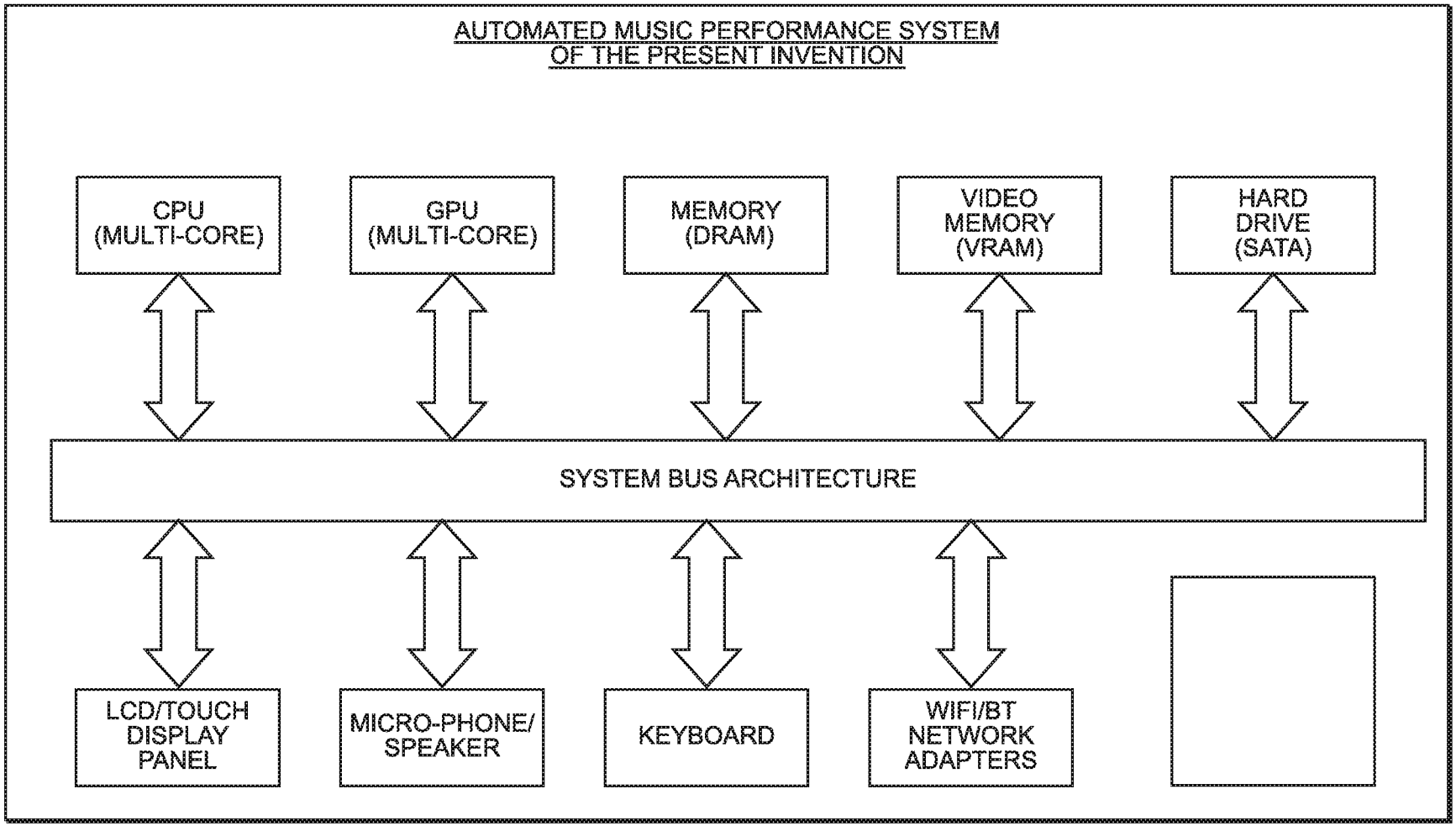
FIG. 2B is a schematic block system diagram for the first illustrative embodiment of the automated music performance system of the present invention, shown comprising a keyboard interface, showing the various components, such as multi-core CPU, multi-core GPU, program memory (DRAM), video memory (VRAM), hard drive (SATA), LCD/touch-screen display panel, microphone/speaker, keyboard, WIFI/Bluetooth network adapters, and power supply and distribution circuitry, integrated around a system bus architecture.
Figure 3:
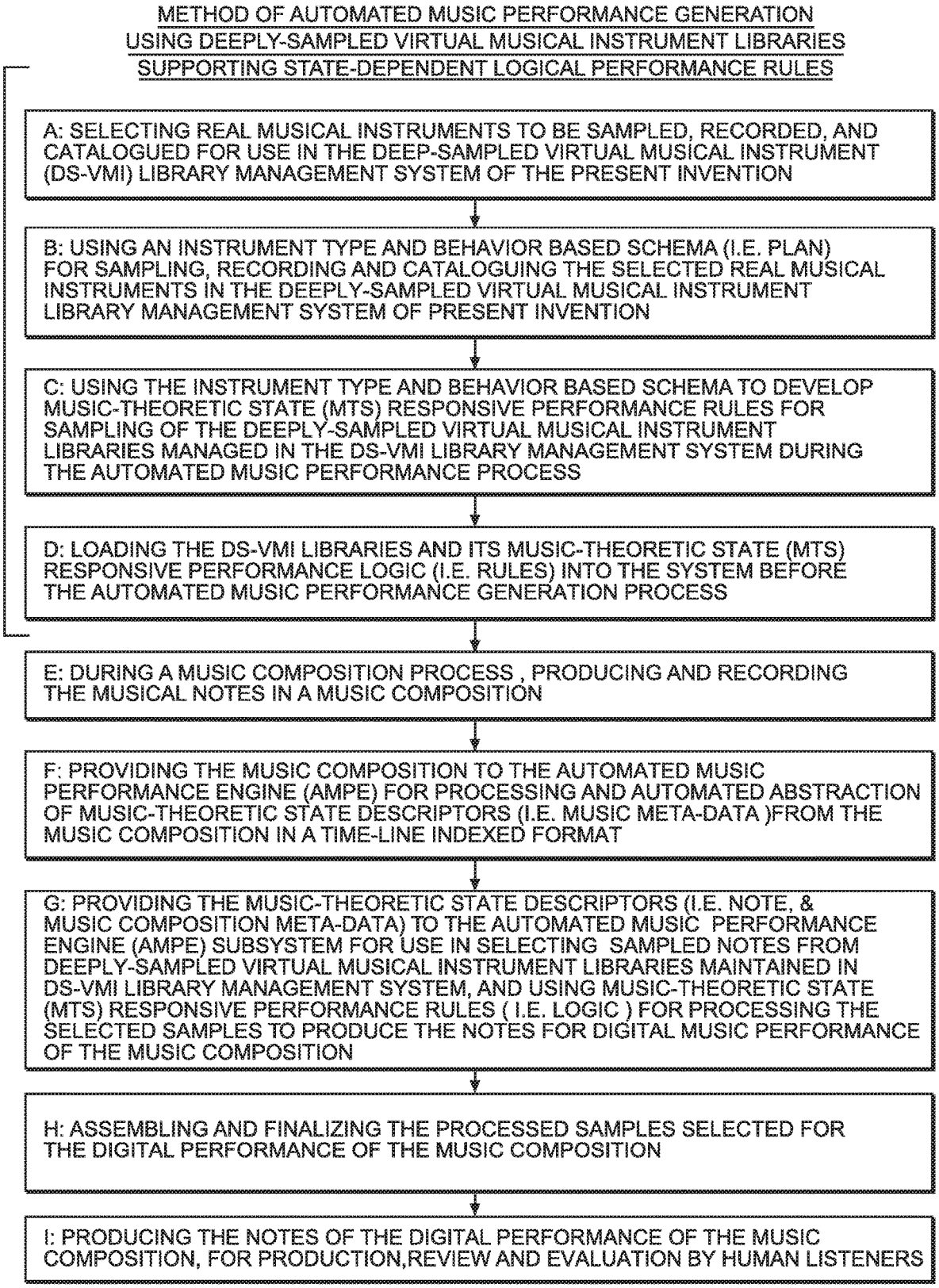
FIG. 3 describes a method of automated digital music performance generation using deeply-sampled virtual musical instrument libraries and contextually-aware (i.e. music state aware) performance logic supported in the automated music performance system shown in FIG. 1, comprising the steps of: (a) selecting real musical instruments to be sampled, recorded, and catalogued for use in the deeply-sampled virtual musical instrument library management subsystem; (b) using an instrument type and behavior based schema (i.e. plan) for sampling, recording and cataloguing the selected real musical instruments in the virtual musical instrument sample library management system of present invention; (c) using the instrument type and behavior based schema to develop the action part of music-theoretic state (MTS) responsive performance rules for processing sampled notes in virtual musical instrument sample libraries being managed in the library management system, during the automated music performance process; (d) loading the DS-VMI libraries and associated music-theoretic state (MTS) responsive performance rules into the automated performance system before the automated music performance generation process, (e) during a music composition process, producing and recording the musical notes in a composed piece of music; (f) providing the music composition to the automated music performance engine (AMPE) subsystem for automated processing and generating timeline-indexed music-theoretic state descriptor data (i.e. music composition meta-data) for the music composition, (g) providing the music-theoretic state descriptors (i.e. music composition meta-data) to the automated music performance engine (AMPE) subsystem for use in selecting sampled notes from deeply-sampled virtual musical instrument libraries maintained in DS-VMI library management system, and using music-theoretic state (MTS) responsive performance rules (i.e. logic) for processing the selected sampled notes to produce the notes of digital music performance of the music composition, (h) assembling and finalizing the processed sampled notes in the digital performance of the music composition, and (i) producing the performed notes of the digital performance of the music composition, for review and evaluation by human listeners.

Specification of the First Illustrative Embodiment of the Automated Music Performance System of the Present Invention FIGS. 2, 2A and 2B show an automated music composition and generation instrument system according to a first illustrative embodiment of the present invention, supporting deeply-sampled virtual musical instrument (DS-VMI) music synthesis and the use of music compositions produced in music score format, well known in the art.

In general, the automatic or automated music performance system shown in FIG. 2, including all of its intercooperating subsystems shown in FIGS. 2A through 8, and FIGS. 40 through 52 and specified above, can be implemented using digital electronic circuits, analog electronic circuits, or a mix of digital and analog electronic circuits specially configured and programmed to realize the functions and modes of operation to be supported by the automatic music composition and generation system.

For purpose of illustration, the digital circuitry implementation of the system is shown as an architecture of components configured around SOC or like digital integrated circuits. As shown, the system comprises the various components, comprising: SOC sub-architecture including a multi-core CPU, a multi-core GPU, program memory (DRAM), and a video memory (VRAM); a hard drive (SATA); a LCD/touch-screen display panel; a microphone/speaker; a keyboard; WIFI/Bluetooth network adapters;

pitch recognition module/board; and power supply and distribution circuitry; all being integrated around a system bus architecture and supporting controller chips, as shown.

The primary function of the multi-core CPU is to carry out program instructions loaded into program memory (e.g. micro-code), while the multi-core GPU will typically receive and execute graphics instructions from the multi-core CPU, although it is possible for both the multi-core CPU and GPU to be realized as a hybrid multi-core CPU/GPU chip where both program and graphics instructions can be implemented within a single IC device, wherein both computing and graphics pipelines are supported, as well as interface circuitry for the LCD/touch-screen display panel, microphone/speaker, keyboard or keypad device, as well as WIFI/Bluetooth (BT) network adapters and the pitch recognition module/circuitry. The purpose of the LCD/touch-screen display panel, microphone/speaker, keyboard or keypad device, as well as WIFI/Bluetooth (BT) network adapters and the pitch recognition module/circuitry will be to support and implement the functions supported by the system interface subsystem, as well as other subsystems employed in the system.

Specification of the Automated Music Performance System of the Present Invention, and its Supporting Subsystems Including the Automated Music Performance Engine (AMPE) Subsystem FIG. 2A illustrates the subsystem architecture of the Automated Deeply-Sampled Virtual Musical Instrument (DS-VMI) Selection and Performance Subsystem employed in the automated music performance system of the present invention, As shown, the Automated Deeply-Sampled Virtual Musical Instrument (DS-VMI) Selection and Performance Subsystem comprises the following subsystems: a Pitch Octave Generation Subsystem; an Instrumentation Subsystem; an Instrument Selector Subsystem; an Digital Audio Retriever Subsystem; a Digital Audio Sample Organizer Subsystem; a Piece Consolidator Subsystem; a Piece Format Translator Subsystem; a Piece Deliver Subsystem; a Feedback Subsystem; and a Music Editability Subsystem. As shown these subsystems are interfaced with the other subsystems deployed within the Automated Music Performance System of the present invention. As will be described in detail below, these subsystems perform specialized functions employed during the automated music performance and production process of the present invention.

Specification of the Pitch Octave Generation Subsystem

FIG. 2A shows the Pitch Octave Generation Subsystem used in the Automated Music Performance Engine of the present invention. Frequency, or the number of vibrations per second of a musical pitch, usually measured in Hertz (Hz), is a fundamental building block of any musical performance. The Pitch Octave Generation Subsystem determines the octave, and hence the specific frequency of the pitch, of each note and/or chord in the musical piece. This information is based on either the musical composition state data inputs, computationally-determined value(s), or a combination of both.

A melody note octave table can be used in connection with the loaded set of notes to determines the frequency of each note based on its relationship to the other melodic notes and/or harmonic structures in a musical piece. In general, there can be anywhere from 0 to just-short-of infinite number of melody notes in a piece. The system automatically determines this number each music composition and generation cycle.

For example, for a note "C," there might be a one third probability that the C is equivalent to the fourth C on a piano keyboard, a one third probability that the C is equivalent to the fifth C on a piano keyboard, or a one third probability that the C is equivalent to the fifth C on a piano keyboard.

The resulting frequencies of the pitches of notes and chords in the musical piece are used during the automated music performance process so as to generate a part of the piece of music being composed.

Specification of the Instrumentation Subsystem

FIG. 2A shows the Instrumentation Subsystem used in the Automated Music Performance Engine of the present invention. The Instrumentation Subsystem determines and tracks the instruments and other musical sources catalogued in the DS-VMI library management subsystem that may be utilized in the music performance of any particular music composition. This information is based on either music composition state inputs, compute-determined value(s), or a combination of both, and is a fundamental building block of any musical performance.

This subsystem is supported by instrument tables indicating all possibilities of instruments, typically not probabilistic-based, but rather plain tables, providing an inventory of instrument options that may be selected by the system).

The parameter programming tables employed in the subsystem will used during the automated music performance process of the present invention. For example, if the music composition state data reflects a "Pop" style, the subsystem might load data sets including Piano, Acoustic Guitar, Electric Guitar, Drum Kit, Electric Bass, and/or Female Vocals.

The instruments and other musical sounds selected for the musical piece are used during the automated music performance process of the present invention so as to generate a part of the music composition being digitally performed.

Specification of the Instrument Selector Subsystem

FIG. 2A shows the Instrument Selector Subsystem used in the Automated Music Performance Engine of the present invention. The Instrument Selector Subsystem determines the instruments and other musical sounds and/or devices that will be utilized in the musical piece. This information is based on either user inputs (if given), computationally-determined value(s), or a combination of both, and is a fundamental building block of any musical performance.

The Instrument Selector Subsystem is supported by an instrument selection table, and parameter selection mechanisms (e.g. random number generator, or another parameter based parameter selector). Using the Instrument Selector Subsystem, instruments may be selected for each piece of music being composed, as follows. Each Instrument group in the instrument selection table has a specific probability of being selected to participate in the piece of music being composed, and these probabilities are independent from the other instrument groups. Within each instrument group, each style of instrument and each instrument has a specific probability of being selected to participate in the piece and these probabilities are independent from the other probabilities. As described herein, other methods of instrument selection may be used during the automated music composition performance process.

The instruments and other musical sounds selected by Instrument Selector Subsystem for the musical piece are used during the automated music performance process of the present invention so as to generate a part of the music composition being digitally performed using the DS-VMI library.

Specification of the Continuous Controller Processing Subsystem

FIG. 2A shows the Continuous Controller Processing Subsystem used in the Automated Music Performance Engine of the present invention. Continuous Controllers, or musical instructions including, but not limited to, modulation, breath, sustain, portamento, volume, pan position, expression, legato, reverb, tremolo, chorus, frequency cutoff, are a fundamental building block of the digital performance of any music composition provided to the automated music performance system of the present invention. Notably, Continuous Controller (CC) codes are used to control various properties and characteristics of an orchestrated musical composition that fall outside scope of control of instrument orchestration during the music composition process, over the notes and musical structures present in any given piece of orchestrated music. Therefore, the Continuous Controller Processing Subsystem employs models (e.g. including probabilistic parameter tables) that control the characteristics of a digitally performed piece of orchestrated music, namely, modulation, breath, sustain, portamento, volume, pan position, expression, legato, reverb, tremolo, chorus, frequency cutoff, and other characteristics.

In general, the Continuous Controller Processing Subsystem automatically determines the controller code and/or similar information of each note to be performed in the digital performance of a music composition, and the automated music performance engine will automatically process selected samples of note to carry out the processing instructions associated with the controller code data reflected in the music-theoretic state data file of the music composition. During operation, the controller code processing subsystem processes the "controller code" information for the notes and chords of the music composition being digitally performed by the DS-VMIs selected from the DS-VMI library management system. This information is based on either music composition inputs, computationally-determined value(s), or a combination of both.

The Continuous Controller Processing Subsystem is supported by controller code parameter tables, and parameter selection mechanisms (e.g. random number generator). The form of controller code data is typically given on a scale of 0-127, following the MIDI Standard. Volume (CC 7) of 0 means that there is minimum volume, whereas volume of 127 means that there is maximum volume. Pan (CC 10) of 0 means that the signal is panned hard left, 64 means center, and 127 means hard right.

Each instrument, instrument group, and music performance has specific instructions for different processing effects, controller code data, and/or other audio/MIDI manipulating tools being selected for use. With each of the selected manipulating tools, the controller code processing subsystem automatically determines: (i) how detected controller codes expressed in the input music composition will be performed on sampled notes selected from the DS-VMI libraries to affect and/or change the performance of notes in the musical piece, section, phrase, or other structure(s); and how to specifically process selected note samples from the DS-VMI libraries to carry out the controller code performance instructions reflected in the music composition, or more specifically, reflected in the music-theoretic state data file automatically generated for the music composition being digitally performed.

The Continuous Controller Processing Subsystem uses the instrument, instrument group and piece-wide controller code parameter tables and data sets loaded into the system. For example, instrument and piece-wise continuous controller code (CC) tables (i.e. containing performance rules) for the violin instrument has processing rules for controlling parameters such as: reverb; delay; panning; tremolo, etc. As described herein, other processing methods may be employed during the automated music composition performance process.

In general, controller code information expressed in any music composition informs how the music composition is intended to be performed or played during the digital music performance. For example, a piece of composed music orchestrated in a Rock style might have a heavy dose of delay and reverb, whereas a Vocalist might incorporate tremolo into the performance. However, the controller code information expressed in the music composition may be unrelated to the emotion and style characteristics of the music performance, and provided solely to effect timing requests. For example, if a music composition needs to accent a certain moment, regardless of the controller code information thus far, a change in the controller code information, such as moving from a consistent delay to no delay at all, might successfully accomplish this timing request, lending itself to a more musical orchestration in line with the user requests. As it is expected that Controller code will be used frequently in a MIDI-music representation of a music composition to be digitally performed, the Continuous Controller Processing Subsystem will be very useful in many digital music performances using the automated music performance system of the present invention. During operation of the Continuous Controller Processing Subsystem, any continuous controller (CC) code expressed in a music composition for instrumentation purposes will be automatically detected and processed on selected samples from the DS-VMI libraries during the automated music performance process, as described in greater detail hereinbelow.

Specification of the Deeply-Sampled Virtual Musical Instrument (DS-VMI) Library Management Subsystem (i.e. Digital Audio Sample Producing Subsystem) and its Use in the Automated Music Performance System As shown in FIGS. 2 and 2A, the Automatic Music Performance (and Production) System of the present invention described herein utilizes the libraries of deeply-sampled virtual musical instruments (DS-VMI), to produce digital audio samples of individual notes or audio sounds specified in the musical score representation for each piece of composed music. These digital-sample-synthesized virtual musical instruments shall be referred to as the DS-VMI library management subsystem, which may be thought of as a Digital Audio Sample Producing Subsystem, regardless of the actual audio-sampling and/or digital-sound-synthesis techniques that might be used to produce each digital audio sample (i.e. data file) that represents an individual note or sound to be expressed in any music composition to be digitally performed.

In general, to generate music from any piece of composed music, the system needs musical instrument libraries for acoustically realizing the musical events (e.g. pitch events such as notes, rhythm events, and audio sounds) played by virtual instruments and audio sound sources specified in the musical score representation of the piece of composed music. There are many different techniques available for creating, designing and maintaining virtual music instrument libraries, and musical sound libraries, for use with the automated music composition and generation system of the present invention, namely: Digital Audio Sampling Synthesis Methods; Partial Timbre Synthesis Methods, Frequency Modulation (FM) Synthesis Methods; Methods of Sonic Reproduction; and other forms and techniques of Virtual Instrument Synthesis.

The preferred method, though not exclusive method, is the Digital Audio Sampling Synthesis Method which involves recording a sound source (such as a real instrument or other audio event) and organizing these samples in an intelligent manner for use in the system of the present invention. In particular, each audio sample contains a single note, or a chord, or a predefined set of notes. Each note, chord and/or predefined set of notes is recorded at a wide range of different volumes, different velocities, different articulations, and different effects, etc. so that a natural recording of every possible use case is captured and available in the sampled instrument library. Each recording is manipulated into a specific audio file format and named and tagged with meta-data with identifying information. Each recording is then saved and stored, preferably, in a database system maintained within or accessible by the automatic music composition and generation system. For example, on an acoustical piano with 88 keys (i.e. notes), it is not unexpected to have over 10,000 separate digital audio samples which, taken together, constitute the fully digitally-sampled piano instrument. During music production, these digitally sampled notes are accessed in real-time to generate the music composed by the system. Within the system of the present invention, these digital audio samples function as the digital audio files that are retrieved and organized by subsystems B33 and B34, as described in detail below.

Using the Partial Timbre Synthesis Method, popularized by New England Digital's SYNCLAVIER Partial-Timbre Music Synthesizer System in the 1980's, each note along the musical scale that might be played by any given instrument being model (for partial timbre synthesis library) is sampled, and its partial timbre components are stored in digital memory. Then during music production/generation, when the note is played along in a given octave, each partial timbre component is automatically read out from its partial timbre channel and added together, in an analog circuit, with all other channels to synthesize the musical note. The rate at which the partial timbre channels are read out and combined determines the pitch of the produced note. Partial timbre-synthesis techniques are taught in U.S. Pat. Nos. 4,554,855; 4,345,500; and 4,726,067, incorporated by reference.

Using state-of-the-art Virtual Instrument Synthesis Methods, such as supported by MOTU's MachFive 3 Universal Sampler and Virtual Music Instrument Design Tools, musicians can also use digital synthesis methods to design and create custom audio sound libraries for almost any virtual instrument, or sound source, real or imaginable, to support music performance and production in the systems of the present invention.

There are other techniques that have been developed for musical note and instrument synthesis, such as FM synthesis, and these technologies can be found employed in various commercial products for virtual instrument design and music production.

Specification of the Digital Audio Sample Retriever Subsystem

FIG. 2A shows the Digital Audio Sample Retriever Subsystem used in the Automated Music Performance Engine of the present invention. Digital audio samples, or discrete values (numbers) which represent the amplitude of an audio signal taken at different points in time, are a fundamental building block of any musical performance. The Digital Audio Sample Retriever Subsystem retrieves the individual digital audio samples that are specified in the orchestrated music composition. The Digital Audio Retriever Subsystem is used to locate and retrieve digital audio files in the DS-VMI libraries for the sampled notes specified in the music composition. Various techniques known in the art can be used to implement this subsystem.

Specification of the Digital Audio Sample Organizer Subsystem

FIG. 2A shows the Digital Audio Sample Organizer Subsystem used in the Automated Music Performance Engine of the present invention. The Digital Audio Sample Organizer Subsystem organizes and arranges the digital audio samples—digital audio instrument note files —retrieved by the digital audio sample retriever subsystem, and organizes (i.e. assembles) these files in the correct time and space order along the timeline of the music performance, according to the music composition, such that, when consolidated (i.e. finalized) and performed or played from the beginning of the timeline, the entire music composition will be accurately and audibly transmitted and can be heard by others. In short, the digital audio sample organizer subsystem determines the correct placement in time and space of each audio file along the timeline of the musical performance of a music composition. When viewed cumulatively, these audio files create an accurate audio representation of the music performance that has been created or composed/generated. An analogy for this subsystem is the process of following a very specific blueprint (for the musical piece) and creating the physical structure(s) that match the diagram(s) and figure(s) of the blueprint.

Specification of the Piece Consolidator Subsystem

FIG. 2A shows the Piece Consolidator Subsystem used in the Automated Music Performance Engine of the present invention. A digital audio file, or a record of captured sound that can be played back, is a fundamental building block of any recorded sound sample. The Piece Consolidator Subsystem collects the digital audio samples from an organized collection of individual audio files obtained from subsystem and consolidates or combines these digital audio files into one or more digital audio file(s) that contain the same or greater amount of information. This process involves examining and determining methods to match waveforms, continuous controller code and/or other manipulation tool data, and additional features of audio files that must be smoothly connected to each other. This digital audio samples to be consolidated by the Piece Consolidator Subsystem are based on either user inputs (i.e. the music composition), computationally-determined value(s), or a combination of both.

Specification of the Piece Format Translator Subsystem

FIG. 2A shows the Piece Format Translator Subsystem used in the Automated Music Performance Engine of the present invention. The Piece Format Translator subsystem analyzes the audio representation of the digital performance, and creates new formats of the piece as requested by the system user. Such new formats may include, but are not limited to, MIDI, Video, Alternate Audio, Image, and/or Alternate Text format. This subsystem translates the completed music performance into desired alterative formats requested during the automated music performance process of the present invention.

Specification of the Piece Deliver Subsystem

FIG. 2A shows the Piece Deliver Subsystem used in the Automated Music Performance Engine of the present invention. The Piece Deliverer Subsystem transmits the formatted digital audio file(s), representing the music performance, from the system to the system user (either human or computer) requesting the information and/or file(s), typically through the system interface subsystem.

Specification of the Feedback Subsystem

FIG. 2A show the Feedback Subsystem used in the Automated Music Performance Engine of the present invention. The primary purpose of the Feedback Subsystem is to accept user and/or computer feedback to improve, on a real-time or quasi-real-time basis, the quality, accuracy, musicality, and other elements of the music performance that is automatically created by the system using the automated music performance automation technology of the present invention.

In general, during system operation, the Feedback Subsystem allows for inputs ranging from very specific to very vague, and acts on this feedback accordingly. For example, a user might provide information, or the system might determine on its own accord, that the digital music performance should, for example: (i) include a specific musical instrument or instruments or audio sound sources supported in the DS-VMI libraries; (ii) use a particular performance style or method controlled by performance logic supported in the system; and/or (iii) reflect performance features desired by the or music producer or end-listener. This feedback can be provided through a previously populated list of feedback requests, or an open-ended feedback form, and can be accepted as any word, image, or other representation of the feedback.

As shown, the Feedback Subsystem receives various kinds of data which is autonomously analyzed by a Piece Feedback Analyzer supported within Subsystem. In general, the Piece Feedback Analyzer considers all available input, including, but not limited to, autonomous or artificially intelligent measures of quality and accuracy and human or human-assisted measures of quality and accuracy, and determines a suitable response to an analyzed music performance of a music composition. Data outputs from the Piece Feedback Analyzer can be limited to simple binary responses and can be complex, such as dynamic multi-variable and multi-state responses. The analyzer then determines how best to modify a music performance's rhythmic, harmonic, and other values based on these inputs and analyses. Using the system-feedback architecture of the present invention, the data in any music performance can be transformed after the creation of the music performance.

Preferably, the Feedback Subsystem is capable of performing Autonomous Confirmation Analysis, which is a quality assurance (QA)/self-checking process, whereby the system examines the digital performance of a music composition that was generated, compares the music performance against the original system inputs (i.e. input music composition and abstracted music-theoretic state data), and confirms that all attributes of the digital performance that were requested, have been successfully created and delivered in the music performance, and that the resultant digital performance is unique. This process is important to ensure that all music performances that are sent to a user are of sufficient quality and will match or surpass any user's performance expectations.

As shown, the Feedback Subsystem analyzes the digital audio file and additional performance formats to determine and confirm (i) that all attributes of the requested music performance are accurately delivered, (ii) that digital audio file and additional performance formats are analyzed to determine and confirm "uniqueness" of the musical performance, and (iii) the system user analyzes the audio file and/or additional performance formats, during the automated music performance process of the present invention. A unique music performance of a particular music composition is one that is different from all other music performance of the particular music composition. Uniqueness can be measured by comparing all attributes of a music performance to all attributes of all other music performances in search of an existing musical performance that nullifies the new performance's uniqueness.

If music performance uniqueness is not successfully confirmed, then the feedback subsystem modifies the inputted musical experience descriptors and/or subsystem music-theoretic parameters, and then restarts the automated music performance process to recreate the digital music performance. If musical performance uniqueness is successfully confirmed, then the feedback subsystem performs a User Confirmation Analysis, which is a feedback and editing process, whereby a user receives the music performance produced by the system and determines what to do next, for example: accept the current music performance; request a new music performance based on the same inputs; or request a new or modified music performance based on modified inputs. This is the point in the system's operation that allows for editability of a created music performance, equal to providing feedback to a human performer (or music conductor) and setting him/her off to enact the change requests.

Thereafter, the system user (e.g. human listener or automated machine analyzer) analyzes the audio file and/or additional performance formats and determines whether or not feedback is necessary. To perform this analysis, the system user can (i) listen to the music performance in part or in whole, (ii) view the music composition score file (represented with standard MIDI conventions) supporting the music performance, and/or (iii) interact with the music performance so that the user can fully experience the music performance and decide on how it might be changed in particular ways during the music performance regeneration process.

In the event that feedback is not determined to be necessary for a particular music performance, then the system user either (i) continues with the current music performance, or (ii) uses the exact same user-supplied music composition and associated parameters to create a new music performance for the music composition using the system. In the event that feedback is determined to be necessary, then the system user provides/supplied desired feedback to the system, and regenerates the music performance using the automated music performance system.

In the event the system users desires to provide feedback to the system via the GUI of the system interface subsystem, then a number of feedback options will be typically made available to the system user through a system menu supporting, for example, a set of pull-down menus designed to solicit user input in a simple and intuitive manner.

Specification of the Music Editability Subsystem

FIG. 2A shows the Music Editability Subsystem used in the Automated Music Performance Engine of the present invention. The Music Editability Subsystem allows the digital music performance to be edited and modified until the end user or computer is satisfied with the result. The subsystem or user can change the inputs, and in response, input and output results and data from subsystem can modify the digital performance music of the music composition. The Music Editability Subsystem incorporates the information from subsystem, and also allows for separate, non-feedback related information to be included. For example, the system user might change the volume of each individual instrument and/or change the instrumentation of the digital music performance, and further tailor the performance of selected instruments as desired. The system user may also request to restart, rerun, modify and/or recreate the digital music performance during the automated music performance process of the present invention.

Specification of the Preference Saver Subsystem

FIG. 2A shows the Preference Saver Subsystem used in the Automated Music Performance Engine of the present invention. The Preference Saver Subsystem modifies and/or changes, and then saves data elements used within the system, and distributes this data to the subsystems of the system, in order or to better reflect the preferences of any given system user. This allows the music performance to be regenerated following the desired changes and to allow the subsystems to adjust the data sets, data tables, and other information to more accurately reflect the user's musical and non-music performance preferences moving forward.

Specification of the Method of Automated Digital Music Performance Generation Using Deeply-Sampled Virtual Musical Instrument Libraries and Contextually-Aware (I.E. Music State Aware) Performance Logic Supported in the Automated Music Performance System FIG. 3 describes a method of automated digital music performance generation using deeply-sampled virtual musical instrument libraries and contextually-aware (i.e. music state aware) performance logic supported in the automated music performance system shown in FIG. 2. As shown, the method comprising the steps of: (a) selecting real musical instruments to be sampled, recorded, and catalogued for use in the deeply-sampled virtual musical instrument library management subsystem; (b) using an instrument type and behavior based schema (i.e. plan) for sampling, recording and cataloguing the selected real musical instruments in the virtual musical instrument sample library management system of present invention; (c) using the instrument type and behavior based schema to develop the action part of music-theoretic state (MTS) responsive performance rules for processing sampled notes in virtual musical instrument sample libraries being managed in the library management system, during the automated music performance process; (d) loading the DS-VMI libraries and associated music-theoretic state (MTS) responsive performance rules into the automated performance system before the automated music performance generation process, (e) during a music composition process, producing and recording the musical notes in a composed piece of music; (f) providing the music composition to the automated music performance engine (AMPE) subsystem for automated processing and generating timeline-indexed music-theoretic state descriptor data (i.e. music composition meta-data) for the music composition; (g) providing the music-theoretic state descriptors (i.e. music composition meta-data) to the automated music performance engine (AMPE) subsystem for use in selecting sampled notes from deeply-sampled virtual musical instrument libraries maintained in DS-VMI library management system, and using music-theoretic state (MTS) responsive performance rules (i.e. logic) for processing the selected sampled notes to produce the notes of digital music performance of the music composition, (h) assembling and finalizing the processed sampled notes in the digital performance of the music composition, and (i) producing the performed notes of the digital performance of the music composition, for review and evaluation by human listeners.

Figure 4:
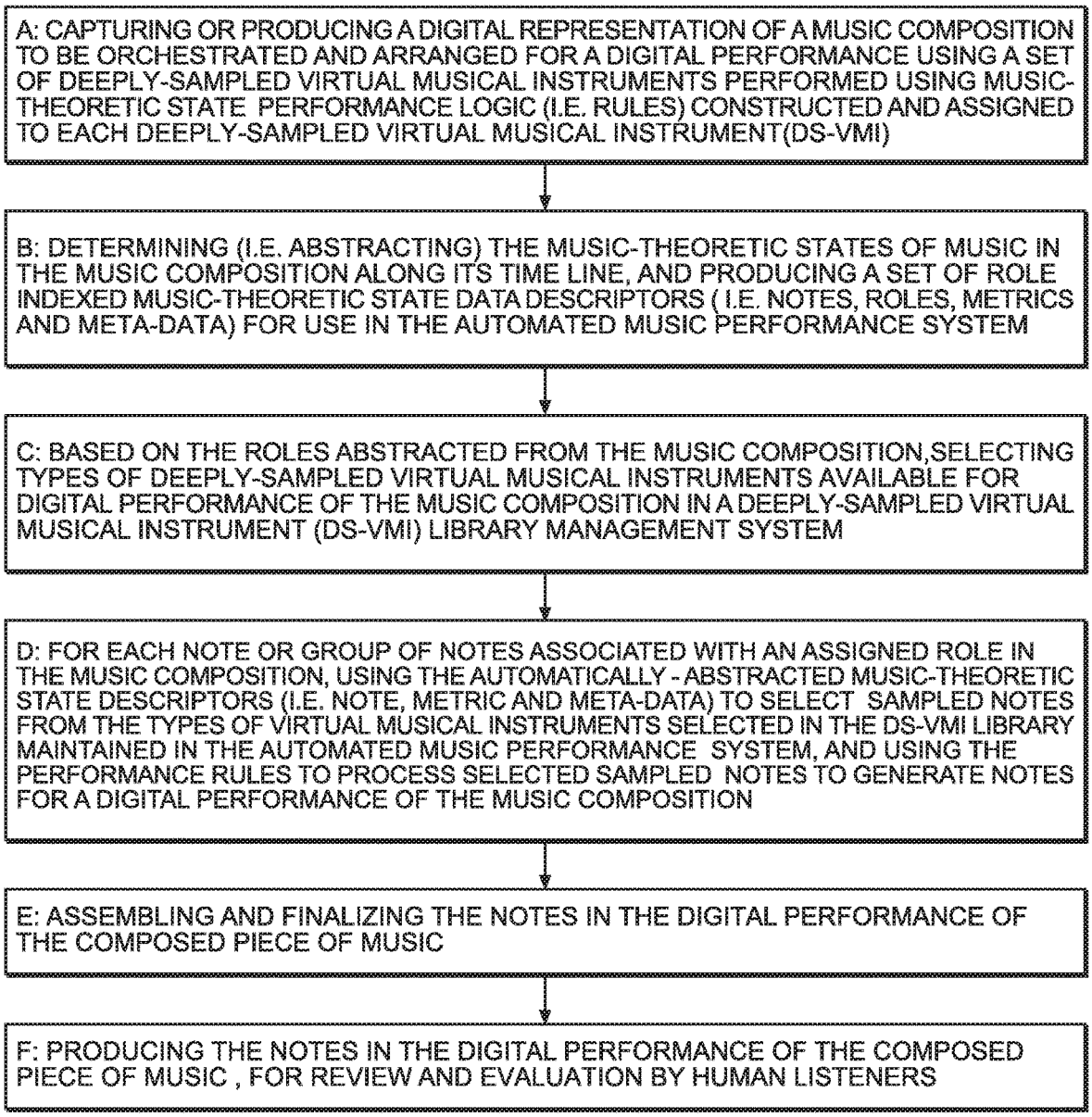
FIG. 4 a flow chart describing a method of generating a digital performance of a composed piece of music (i.e. a musical composition) using the automated music composition and performance system, comprising the steps of (a) producing a digital representation of a piece of composed music (i.e. a music composition) to be orchestrated and arranged for a digital performance using selected deeply-sampled virtual musical instruments performed using music-theoretic state (MTS) responsive performance rules, (b) automatically determining the music-theoretic states of music in a music composition along its timeline, and producing a set of timeline-indexed music-theoretic state descriptor data (i.e. roles, notes, metrics and meta-data) for use in the automated music performance system, (c) based on the roles abstracted from the music composition, selecting types of deeply-sampled virtual musical instruments available for digital performance of the music composition in a deeply-sampled virtual musical instrument (DS-VMI) library management system, (d) using the set of music theoretic-state meta-data descriptor data to automatically select sampled notes from deeply-sampled virtual musical instrument libraries, and using music-theoretic state responsive performance rules to process the selected sampled notes to generate the notes for a digital performance of the music composition, (e) assembling and finalizing the processed sampled notes in the generated digital performance of the music composition, and (f) producing performed sampled notes in the digital performance of the music composition, for review and evaluation by human listeners.

Specification of the Method of Generating a Digital Performance of a Musical Composition Using the Automated Music Composition and Performance System FIG. 4 describes a method of generating a digital performance of a composed piece of music (i.e. a musical composition) using the automated music composition and performance system shown in FIGS. 2, 2A and 2B. As shown, the method comprising the steps of (a) producing a digital representation of an automatically composed piece of music to be orchestrated and arranged for a digital performance using selected deeply-sampled virtual musical instruments performed using music-theoretic state (MTS) responsive performance rules, (b) automatically determining the music-theoretic states of music in a music composition along its timeline, and producing a set of timeline-indexed music-theoretic state descriptor data (i.e. roles, notes, metrics and meta-data) for use in the automated music performance system, (c) based on the roles abstracted from the music composition, selecting types of deeply-sampled virtual musical instruments available for digital performance of the music composition in a deeply-sampled virtual musical instrument (DS-VMI) library management system, (d) using the set of music theoretic-state meta-data descriptor data to automatically select sampled notes from deeply-sampled virtual musical instrument libraries, and using music-theoretic state responsive performance rules to process the selected sampled notes to generate the notes for a digital performance of the music composition, (e) assembling and finalizing the processed sampled notes in the generated digital performance of the music composition, and (f) producing the performed sampled notes in the digital performance of the music composition, for review and evaluation by human listeners.

Figure 5:
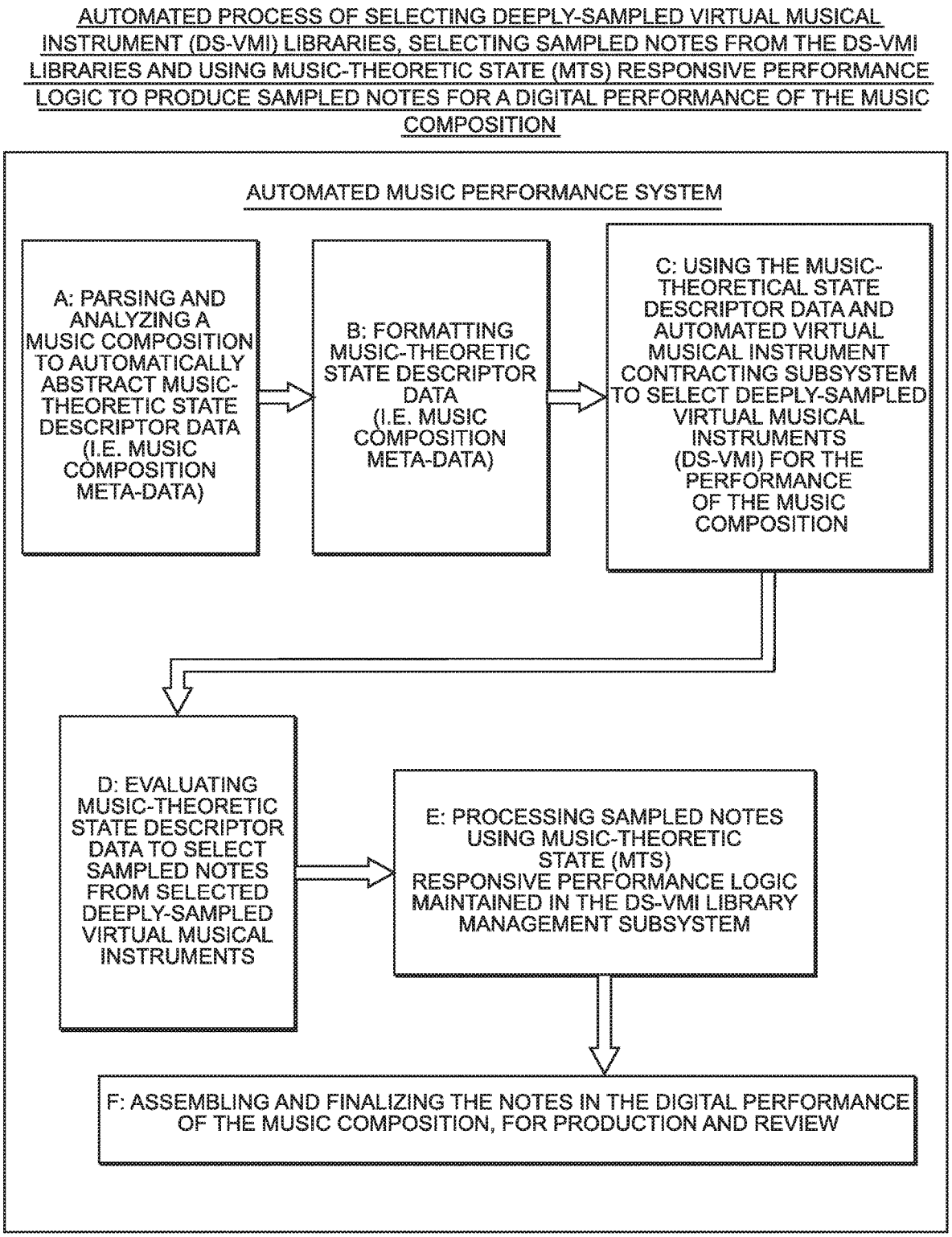
FIG. 5. illustrates the process of automated selection of sampled notes in deeply-sampled virtual musical instrument (DS-VMI) libraries to produce the notes for the digital performance of a composed piece of music in accordance with the principles of the present invention, involving (a) the parsing and analyzing the music composition to abstract music-theoretic state descriptor data (i.e. music composition meta data), (b) formatting the music-theoretic state descriptor data (i.e. music composition meta-data) abstracted from the music composition, (c) using music-theoretic state descriptor data and automated virtual musical instrument contracting subsystem to select deeply-sampled virtual musical instruments (DS-VMI) for the performance of the music composition, (d) using music-theoretic state descriptor data to select sampled notes (or other audio files) from selected deeply-sampled virtual musical instrument (DS-VMI) libraries, (e) processing samples using music-theoretic state (mts) responsive performance logic maintained in the DS-VMI library management subsystem so as to produce note samples for the digital performance, and (f) assembling and finalizing the notes in the digital performance of the music composition, for production and review.

Specification of the Process of Automated Selection of Sampled Notes in Deeply-Sampled Virtual Musical Instrument (DS-VMI) Libraries to Produce the Sampled Notes for the Digital Performance of a Composed Piece of Music FIG. 5. illustrates the process of automated selection of sampled notes in deeply-sampled virtual musical instrument (DS-VMI) libraries to produce the notes for the digital performance of a composed piece of music in accordance with the principles of the present invention, involving (a) the parsing and analyzing the music composition to abstract music-theoretic state descriptor data (i.e. music composition meta data), (b) formatting the music-theoretic state descriptor data (i.e. music composition meta-data) abstracted from the music composition (or transforming the music-theoretic state descriptor data and music instrument performance rules in the DS-VMI library management subsystem, to support musical arrangement and/or performance style transformations as described in the fourth system embodiment of the present invention, (c) using music-theoretic state descriptor data and automated virtual musical instrument contracting subsystem to select deeply-sampled virtual musical instruments (DS-VMI) for the performance of the music composition, (d) using music-theoretic state descriptor data to select sampled from selected deeply-sampled virtual musical instruments, (e) processing samples using music-theoretic state (MTS) responsive performance logic maintained in the DS-VMI library management subsystem so as to produce note samples for the digital performance, and (f) assembling and finalizing the notes in the digital performance of the music composition, for production and review.

Figure 6:
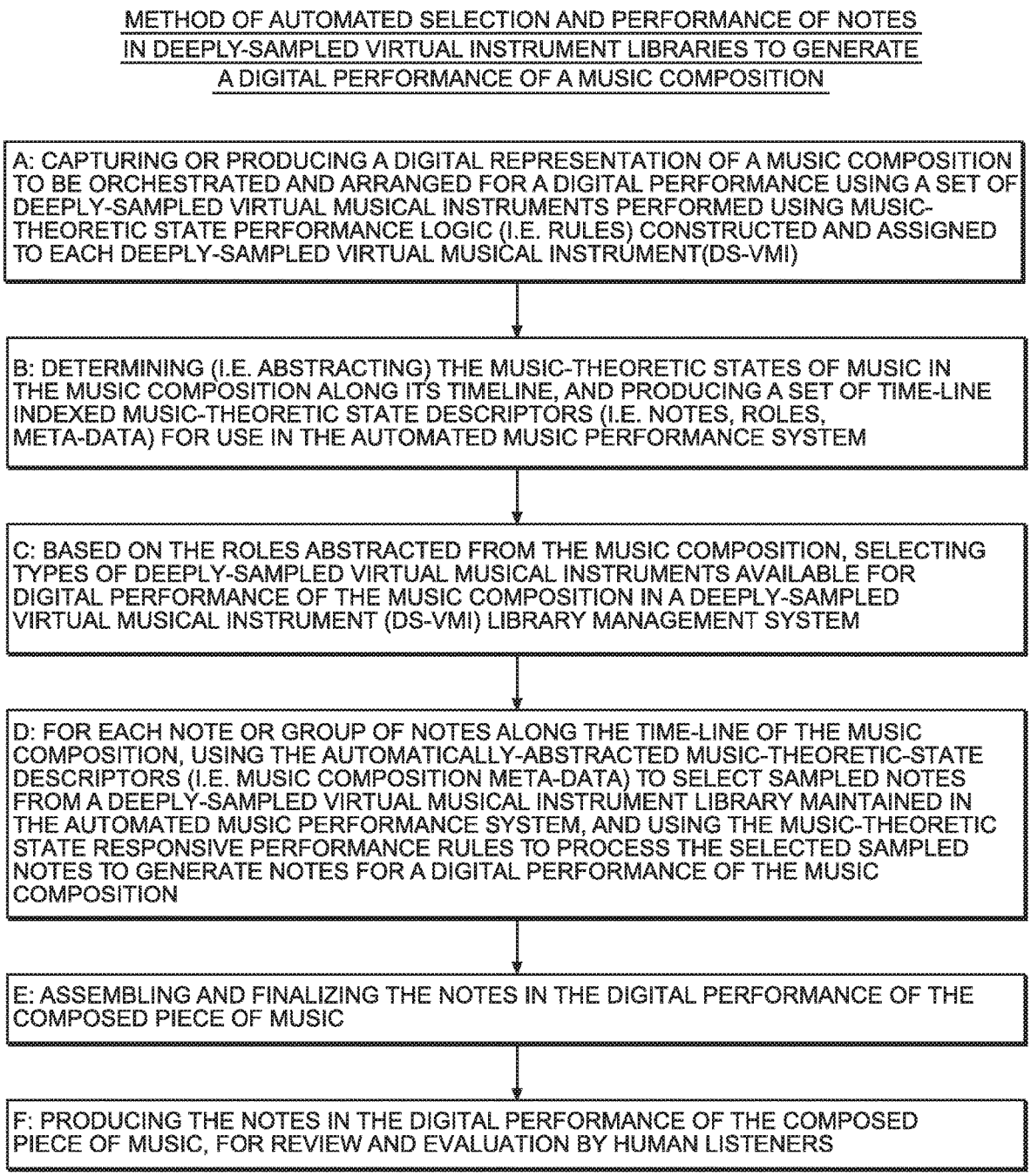
FIG. 6 is a flow chart describing method of automated selection and performance of notes in deeply-sampled virtual instrument libraries to generate a digital performance of a composed piece of music, comprising the steps of (a) capturing or producing a digital representation of a music composition to be orchestrated and arranged for a digital performance using a set of deeply-sampled virtual musical instruments performed using music-theoretic state performance logic (i.e. rules) constructed and assigned to each deeply-sampled virtual musical instrument (DS-VMI), (b) automatically determining the music-theoretic states of music in a music composition along its timeline, and producing a set of timeline-indexed music-theoretic state descriptor data (i.e. roles, notes, metrics and meta-data) for use in the automated music performance system, (c) based on the roles abstracted from the music composition, selecting types of deeply-sampled virtual musical instruments available for digital performance of the music composition in a deeply-sampled virtual musical instrument (DS-VMI) library management system, (d) using the set of music theoretic-state meta-data descriptor data to automatically select sampled notes from deeply-sampled virtual musical instrument libraries, and using music-theoretic state responsive performance rules to process the selected sampled notes to generate the notes for a digital performance of the music composition, (e) assembling and finalizing the processed sampled notes in the digital performance of the music composition; and (f) producing the performed notes in the digital performance of the music composition, for review and evaluation by human listeners.

Specification of the Method of Automated Selection and Performance of Notes in Deeply-Sampled Virtual Musical Instrument Libraries to Generate a Digital Performance of a Composed Piece of Music FIG. 6 describes method of automated selection and performance of notes in deeply-sampled virtual musical instrument libraries to generate a digital performance of a composed piece of music, comprising the steps of: (a) capturing or producing a digital representation of a music composition to be orchestrated and arranged for a digital performance using a set of deeply-sampled virtual musical instruments performed using music-theoretic state performance logic (i.e. rules) constructed and assigned to each deeply-sampled virtual musical instrument (DS-VMI); (b) automatically determining the music-theoretic states of music in a music composition along its timeline, and producing a set of timeline-indexed music-theoretic state descriptor data (i.e. roles, notes, metrics and meta-data) for use in the automated music performance system; (c) based on the roles abstracted from the music composition, selecting types of deeply-sampled virtual musical instruments available for digital performance of the music composition in a deeply-sampled virtual musical instrument (DS-VMI) library management system; (d) using the set of music theoretic-state meta-data descriptor data to automatically select sampled notes from deeply-sampled virtual musical instrument libraries, and using music-theoretic state responsive performance rules to process the selected sampled notes to generate the notes for a digital performance of the music composition; (e) assembling and finalizing the processed sampled notes in the digital performance of the music composition; and (f) producing the performed notes in the digital performance of the music composition, for review and evaluation by human listeners.

Figure 7:
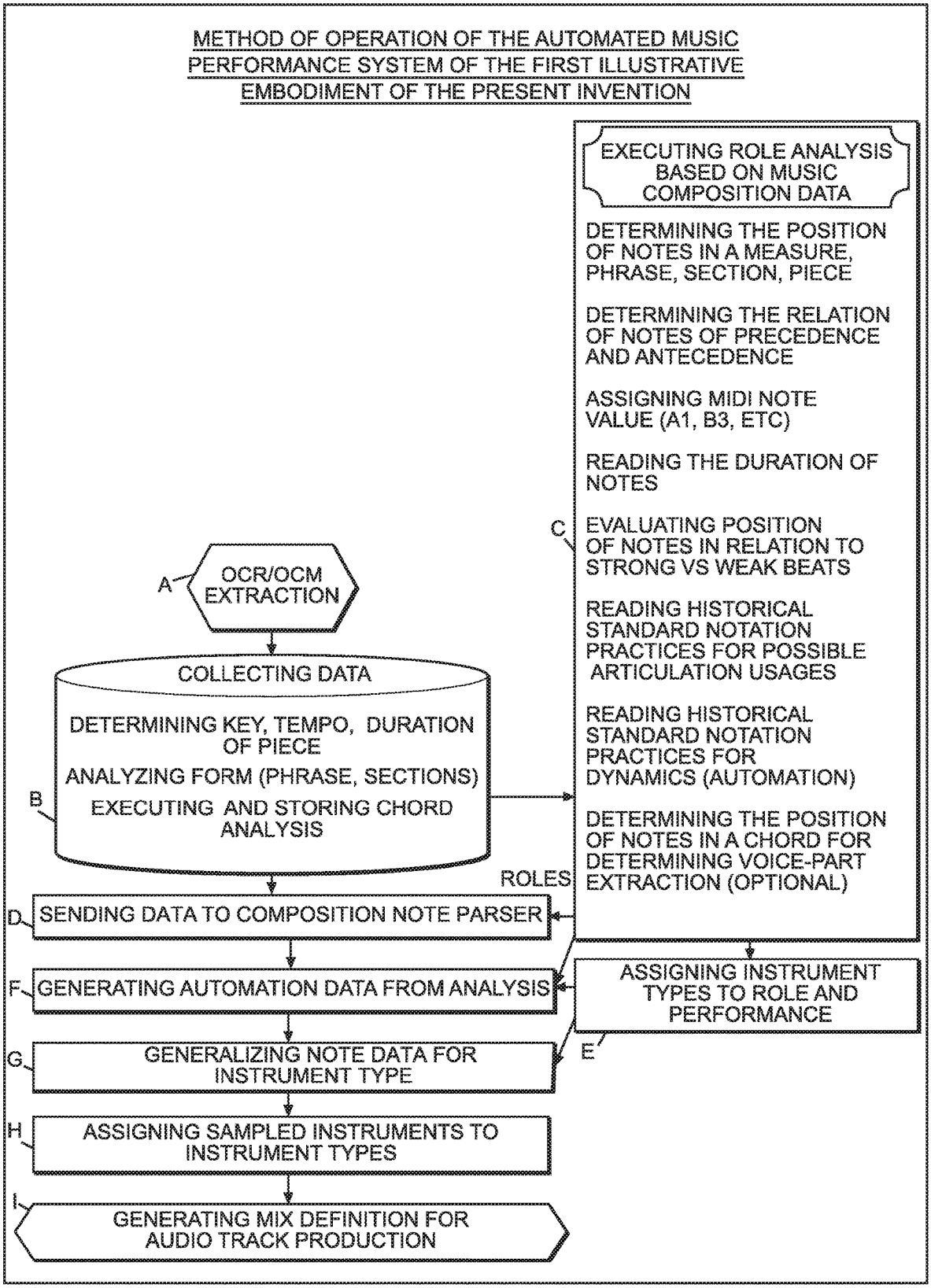
FIG. 7 is a flow chart specification of the method of operation of the automated music performance system of the first illustrative embodiment of the present invention, shown in FIGS. 2 through 6.

Method of Operation of the Automated Music Performance System of the First Illustrative Embodiment of the Present Invention FIG. 7 describes the method of operation of the automated music performance system of the first illustrative embodiment of the present invention, shown in FIGS. 2 through 6.

As shown in Block A of FIG. 7, the process involves receives a sheet-based music composition as system input, and extracts musical information from the sheet music using OCR (Optical Character Recognition) and/or OMR (Optical Music Recognition) processing techniques well known in the art and described in WIKI link https://en.wikipedia.org/wiki/Optical_music_recognition incorporated herein by reference. In general, each sheet-type music composition to be provided as input to the system can be formatted in any suitable format and language for OCR and other OMR processing in accordance with the principles of the present invention.

Suitable OCR/OMR-enabled commercial music score composition programs such as Sibelius Scorewriter Program by Sibelius Software Limited; Finale Music Notation and Scorewriter Software by MakeMusic, Inc.; MuseScore Composition and Notation Program by MuseScore BVBA www.musescore.org; and Capella Music Notation or Scorewriter Program by Capella Software AG; can be used to scan and read sheet music and generate an electronic file format that can be subsequently processed by the automated music performance system in accordance with the principles of the present invention disclosed and taught herein.

As shown in Block B of FIG. 7, the method involves collecting music composition state data from Block A to determine music-theoretic information from the music composition, such as the key, tempo, duration of the musical piece, and analyze form (e.g. phrases and sections) and execute and store chord analysis.

FIG. 8 describes an exemplary set of music-theoretic state descriptors (e.g. parameters) that are automatically evaluated during Block B within each music theoretic state descriptor file (for a given music composition) by the automated music performance subsystem of the present invention. The purpose of this automated data evaluation is to automatically select at least one instrument type for each Role abstracted from the music composition, and also to automatically select the sampled sound files (e.g. sampled notes) for the selected instrument type represented in the deeply-sampled virtual musical instrument library (DS-VMI) subsystem of the present invention, and process them as required by the performance logic developed for the sampled notes in the selected DS-VMI libraries.

As shown in Block C of FIG. 7, the method involves processing the music-theoretic state data collected at Block B and executing a Role Analysis comprising: (a) Determining the Position of notes in a measure, phrase, section, piece; (b) Determining the Relation of Notes of Precedence and Antecedence; (c) Determining Assigned MIDI Note Values (A1, B2, etc.); (d) Reading the duration of Notes; (e) Evaluating the position of Notes in relation to strong vs weak beats; (f) Reading historical standard notation practices for possible articulation usages; (g) Reading historical standard notation practices for dynamics (i.e. automation); and (h) Determining the Position of Notes in a chord for determining voice-part extraction (optional). The output of the Role Analyzer are Roles assigned to group of Notes contained in the music composition.

As shown in Block D of FIG. 7, the method involves sending music-theoretic state data collected at Block B to a composition note parser to parse out the time-indexed notes contained in the music composition.

As shown in Block E of FIG. 7, the method involves assigning Instrument Types to abstracted Roles and Notes to be performed (i.e. "Performances").

As shown in Block F of FIG. 7, the method involves using the Roles and Note Performance obtained at Blocks C and E to generate performance automation from the analysis.

As shown in Block G of FIG. 7, the method involves generalizing the Note Data for the Instrument Type and Note Performance selected by the automated music performance subsystem.

As shown in Block H of FIG. 7, the method involves assigning sampled instruments (i.e. DS-VMI sample libraries) to the selected Instrument Types required by the Roles identified for the digital performance of the input music composition.

As shown in Block I of FIG. 7, the process involves generating a mix definition for audio track production to produce the final digital performance for all notes and roles specified in the music composition. For purposes of the present invention, a mix definition is the instruction set for the audio engine in the system to play the correct samples at a specified time with DSP, Velocity, Volume, CC, etc. and combine all the audio together to generate an audio track(s).

Music-Theoretic State Descriptors Automatically Evaluated by the Automated Music Performance System of the First Illustrative Embodiment During Automated Selection of Musical Instruments and Sampled Notes During Each Digital Performance FIG. 8 describes a set of music-theoretic state descriptors (e.g. parameters) that are automatically evaluated within each music-theoretic state descriptor file (for a given music composition) by the automated music performance subsystem of the present invention deployed in the system of FIG. 2, so as to (i) automatically select at least one instrument for each Role abstracted from the music composition, and also (ii) automatically select and sample the sound files (e.g. sampled notes) for the selected instrument type represented in and supported by the deeply-sampled virtual musical instrument library (DS-VMI) subsystem of the present invention.

The function of DS-VMI behavior-sample selection/choosing supported by the automated DS-VMI Selection and Performance Subsystem shown in FIG. 2 involves automated evaluation of all of the Role-indexed/organized note data, music metric data, and music meta-data collected during automated analysis of the music composition to be digitally performed. In the preferred embodiment, this automated intelligent evaluation of music state data associated with any given music composition to be digitally performed will be realized using the rich set of instrument performance rules (i.e. performance logic) written and deployed within each DS-VMI Library supported within the automated music performance engine of the present invention.

When carrying out this automated data evaluation process, for the purpose of automatically selecting/choosing instrument types and sampled notes and appropriate sample note processing, the music-theoretic state data descriptor file schematically depicted in FIG. 29 will be supplied as subsystem input, the Automated DS-VMI Selection and Performance Subsystem and the Automated Virtual Musical Instrument Contracting Subsystem of FIG. 2 will (i) review each Performance Rule in the DS-VMI Library and (ii) check the music data states reflected in the input music-theoretic data descriptor file depicted in FIG. 29 to automatically determine Instrument Performance Rules (i.e. Logic) to execute in order to generate the rendered notes of a digital music performance to be produced from the automated music performance subsystem. This data evaluation process will be carried out in a syllogistic manner, to determine when and where "If X, then Y" performance rule conditions are satisfied and instrument and note selections should be made in a real-time manner. Below are the various levels of data evaluation performed by this intelligent process within the automated music performance system during automated instrument and note selection and modification.

1. Primary Evaluation Level—this is the initial level of processing supported by which DS-VMI library management system which commences the evaluation of note data.
   a. Rhythmic density by tempo—Initial step to determine selections of behavior and articulation types based on how dense the notes are in a given tempo. For example, if a tempo was at 140 and $16^{th}$ notes were detected, then performances of a shaker may ignore every other $16^{th}$ note, or choose a sample set that can articulate fast enough to perform those note samples.
   b. Duration of notes—determine how long each rhythmic assignment should hold out (sustain) for, important for determining release samples, intestinal samples, guitar string relationships, etc.
   c. MIDI note value—determination of the pitch assignments of the duration of notes
   d. Dynamics—determination of what velocity to play the note at (and select the correct timbre/volume of a sample)
2. Static Note Relationships—this is the process of analyzing where the notes come in relation to time and space
   a. Position of notes in a chord—where the note is in relation to the root, third, fifth, etc.
   b. Meter and position of strong and weak beats—determine if compound or simple meter, where the strong and weak beats are
   c. Position of notes in a measure—determine where the notes are in relation to the strong and weak beats based on meter
   d. Position of notes in a phrase—determine where the notes are in relation to a phrase (a group of measures)
   e. Position of notes in a section—determine where the notes are in relation to a section (a group of phrases)
   f. Position of notes in a region—determine where the notes are in relation to a region (a group of sections)
3. Situational Relationship—this establishes the modifiers (behaviors of an instrument) that allow for alternate sample selections (hit vs rim-shot, staccato vs spiccato, etc.)
   a. MIDI note value precedence and antecedence—evaluate what notes come before and after the current note and choose to alter the sample selection with a difference behavior type
   b. Position or existence of notes from other roles—determine the other notes written in other instrument parts (roles) and alter sample selection (or don't play) ex: instruments are snare, kick and hi-hat, if kick is playing don't play the snare hit sample and only play a closed rim hit on the hi-hat
   c. Relation of sections to each other—evaluate what has been played before in a previous section and either copy or alter the sample selection.
   d. Accents—evaluate any system-wide musical accents and alter samples (velocity or sample selection) based on this modifier.
   e. Timing based rhythms—based on 1.a resolve any samples that may not be able to perform the rhythms properly and choose an approved sample set, or not play.
4. Instrument Selection—this is the actual sample bank (i.e. DS-VMI library) that makes up a selected virtual music instrument. Note that the Instruments are assigned to the Role before notes are sent from the above automated evaluation stage. This stage in the process allows the system to be aware or cognizant of the Instruments chosen and to make sample Behavior modifications as Instruments are added or taken away.
   a. What Instruments are available—all Instruments that exist in a "band" different notes may be sent to other instruments if some instruments don't exist so important parts are covered, this can change register of the instrument as well as sample selection
   b. What Instruments are playing—all Instruments that are playing, this determines if certain Instruments should not play, not play as much, or play the same as another Instrument
   c. What Instruments should/might play—all the Instruments available that are not playing, but could help double another instrument.
   d. What Instruments are assigned to a Role—this is the music composition part that the Instrument is playing, e.g. "am I a Background instrument", "do I only play a pedal note", "am I a lead"
   e. How many Instruments are available—determines density of parts, volume, panning and other automation considerations to a sample performance.

Second Illustrative Embodiment of the Automated Music Performance System of the Present Invention, Wherein a Digital Audio Workstation (DAW) System Produces an Orchestrated Musical Composition in Digital Form and Wherein the Music Composition is Provided to the Automated Musical Performance System of the Present Invention so that this System can Select Deeply-Sampled Virtual Musical Instruments Supported by the Automated Music Performance System Based on Roles Abstracted During Music Composition Processing, and Digitally Perform the Music Composition Using Automated Selection of Notes from Deeply-Sampled Virtual Musical Instrument Libraries FIG. 9 describes the automated music performance system of second illustrative embodiment of the present invention. In this embodiment, a music composition is typically a MIDI-based music composition, such a MIDI piano roll produced from a music composition program or MIDI keyboard/instrument controller interfaced with a digital audio workstation (DAW). Suitable MIDI composition and performance instruments, such as MIDI keyboard/instrument controllers, might include, for example: the Arturia KeyLab 88 MKII Weighted Keyboard Controller; Native Instruments Komplete Kontrol S88 MK2; or Korg D1 88-key Stage Piano/Controller. Suitable digital audio workstation (DAWs) software might include, for example: Pro Tools from Avid Technology; Digital Performer from Mark of the Unicorn (MOTU); Cubase from Steinberg Media Technologies GmbH; and Logic Pro X from Apple Computer; each running any suitable music composition and score notation software program such as, for example: Sibelius Scorewriter Program by Sibelius Software Limited; Finale Music Notation and Scorewriter Software by MakeMusic, Inc.; MuseScore Composition and Notation Program by MuseScore BVBA www.musescore.org; Capella Music Notation or Scorewriter Program by Capella Software AG.

As shown, the system comprises: (i) a system user interface subsystem for a system user using digital audio workstation (DAW) supported by a keyboard and/or MIDI devices, to produce a music composition for digital performance, and (ii) an automated music performance engine (AMPE) subsystem interfaced with the system user interface subsystem, for producing a digital performance based on the music composition. As shown, the system user interface subsystem transfers a music composition to the automated music performance engine. Also, the automated music performance engine includes: (i) an automated music-theoretic state (MTS) data abstraction subsystem for automatically abstracting all music-theoretic states contained in the music composition and producing a set of music-theoretic state descriptors representative thereof; (ii) a deeply-sampled virtual musical instrument (DS-VMI) library management subsystem for managing deeply-sampled virtual musical instruments to be selected for performance of notes specified for each Role in the music composition; and (iii) an automated deeply-sampled virtual musical instrument (DS-VMI) selection and performance subsystem for selecting deeply-sampled virtual musical instruments in the DS-VMI library management subsystem and performing for the Roles, notes from selected deeply-sampled virtual musical instruments using music-theoretic state (MTS) responsive performance rules, to automatically produce a digital performance of the music composition. As shown, the automated music performance engine (AMPE) subsystem transfers the digital performance to the system user interface subsystem for production, review and evaluation.

As shown in FIG. 9A, the automated music performance system comprises: a keyboard interface, showing the various components, such as multi-core CPU, multi-core GPU, program memory (DRAM), video memory (VRAM), hard drive (SATA), LCD/touch-screen display panel, microphone/speaker, keyboard, WIFI/Bluetooth network adapters, and power supply and distribution circuitry, integrated around a system bus architecture.

Specification of the Second Illustrative Embodiment of the Automated Music Performance System of the Present Invention FIGS. 9 and 9A show an automated music composition and generation instrument system according to a second illustrative embodiment of the present invention, supporting deeply-sampled virtual musical instrument (DS-VMI) libraries and the use of music compositions produced in music score format, well known in the art.

In general, the automatic or automated music performance system shown in FIG. 9 including all of its intercooperating subsystems shown in FIGS. 10A through 16, and FIGS. 40 through 52 and specified above, can be implemented using digital electronic circuits, analog electronic circuits, or a mix of digital and analog electronic circuits specially configured and programmed to realize the functions and modes of operation to be supported by the automatic music composition and generation system. Such implementations can also include an Internet-based network implementation, as well as workstation-based implementations of the present invention.

For purpose of illustration, the automated music performance system comprises the various components, comprising: SOC sub-architecture including a multi-core CPU, a multi-core GPU, program memory (DRAM), and a video memory (VRAM); a hard drive (SATA); a LCD/touch-screen display panel; a microphone/speaker; a keyboard; WIFI/Bluetooth network adapters; pitch recognition module/board; and power supply and distribution circuitry; all being integrated around a system bus architecture and supporting controller chips, as shown.

The primary function of the multi-core CPU is to carry out program instructions loaded into program memory (e.g. micro-code), while the multi-core GPU will typically receive and execute graphics instructions from the multi-core CPU, although it is possible for both the multi-core CPU and GPU to be realized as a hybrid multi-core CPU/GPU chip where both program and graphics instructions can be implemented within a single IC device, wherein both computing and graphics pipelines are supported, as well as interface circuitry for the LCD/touch-screen display panel, microphone/speaker, keyboard or keypad device, as well as WIFI/Bluetooth (BT) network adapters and the pitch recognition module/circuitry. The purpose of the LCD/touch-screen display panel, microphone/speaker, keyboard or keypad device, as well as WIFI/Bluetooth (BT) network adapters and the pitch recognition module/circuitry will be to support and implement the functions supported by the system interface subsystem, as well as other subsystems employed in the system.

Figure 11:
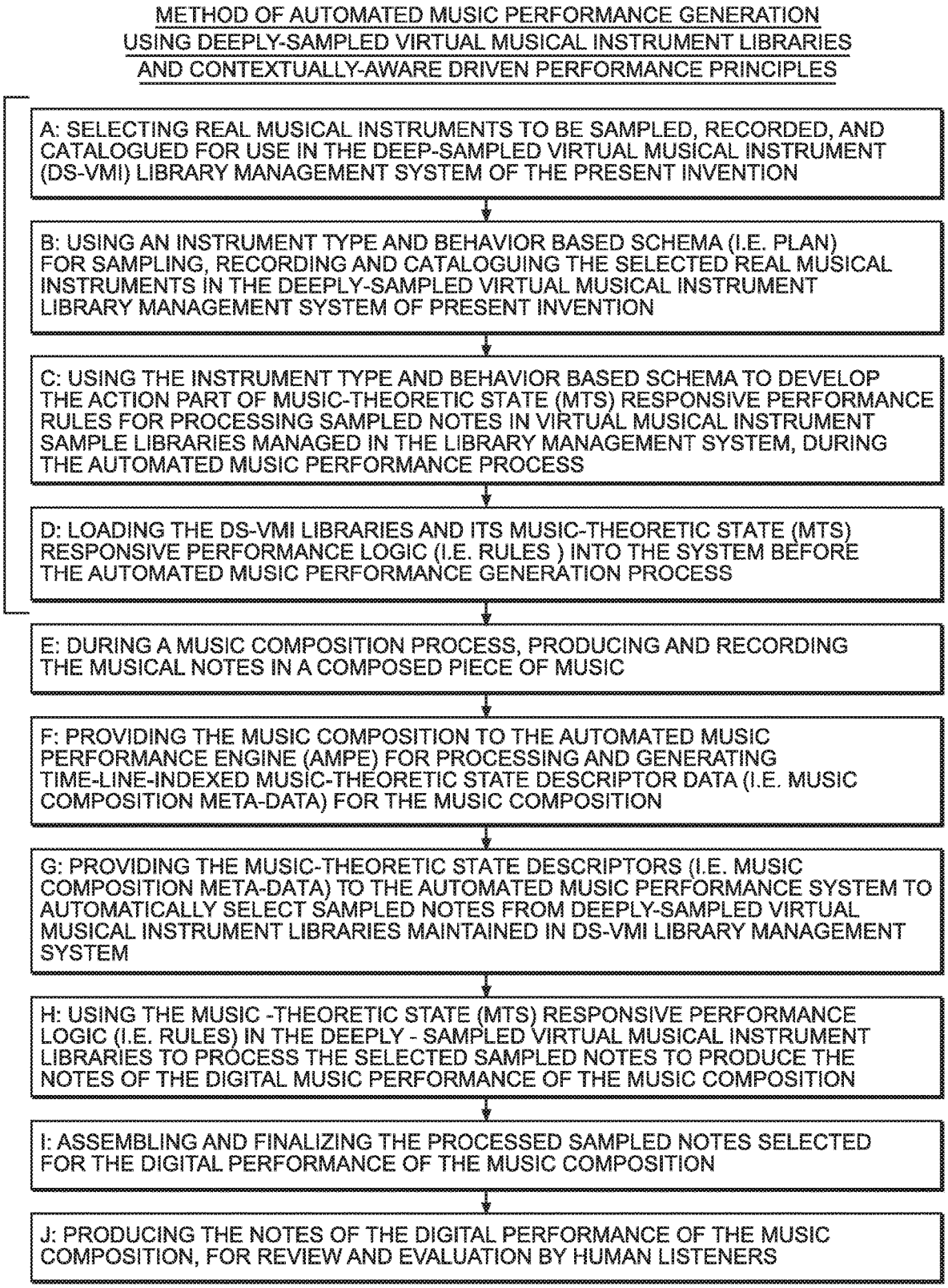
FIG. 11 provides a flow chart describing a method of automatically generating a digital performance of a music composition, comprising the steps of (a) selecting real musical instruments to be sampled, recorded, and catalogued for use in the deeply-sampled virtual musical instrument library management subsystem, (b) using an instrument type and behavior based schema (i.e. plan) for sampling, recording and cataloguing the selected real musical instruments in the virtual musical instrument sample library management system of present invention; (c) using the instrument type and behavior based schema to develop the action part of music-theoretic state (MTS) responsive performance rules for processing sampled notes in virtual musical instrument sample libraries being managed in the library management system, during the automated music performance process, (d) loading the DS-VML libraries and associated music-theoretic state (MTS) responsive performance rules into the automated performance system before the automated music performance generation process, (e) during a music composition process, producing and recording the musical notes in a music composition, (f) providing the music composition to the automated music performance engine (AMPE) and generating timeline-indexed music-theoretic state descriptor data (i.e. music composition meta-data) for the music composition, (g) providing the music-theoretic state descriptor data (i.e. music composition meta-data) to the automated music performance system to automatically select sampled notes from deeply-sampled virtual musical instrument libraries maintained in DS-VMI library management system, (h) using the music-theoretic state (MTS) responsive performance logic (i.e. rules) in the deeply-sampled virtual musical instrument libraries to process the selected sampled notes to produce the notes of the digital music performance of the music composition, (i) assembling and finalizing the processed sampled notes in the digital performance of the composed piece of music, and ( ) producing the performed notes of a digital performance of the composed piece of music for review and evaluation by human listeners.
Figure 12:
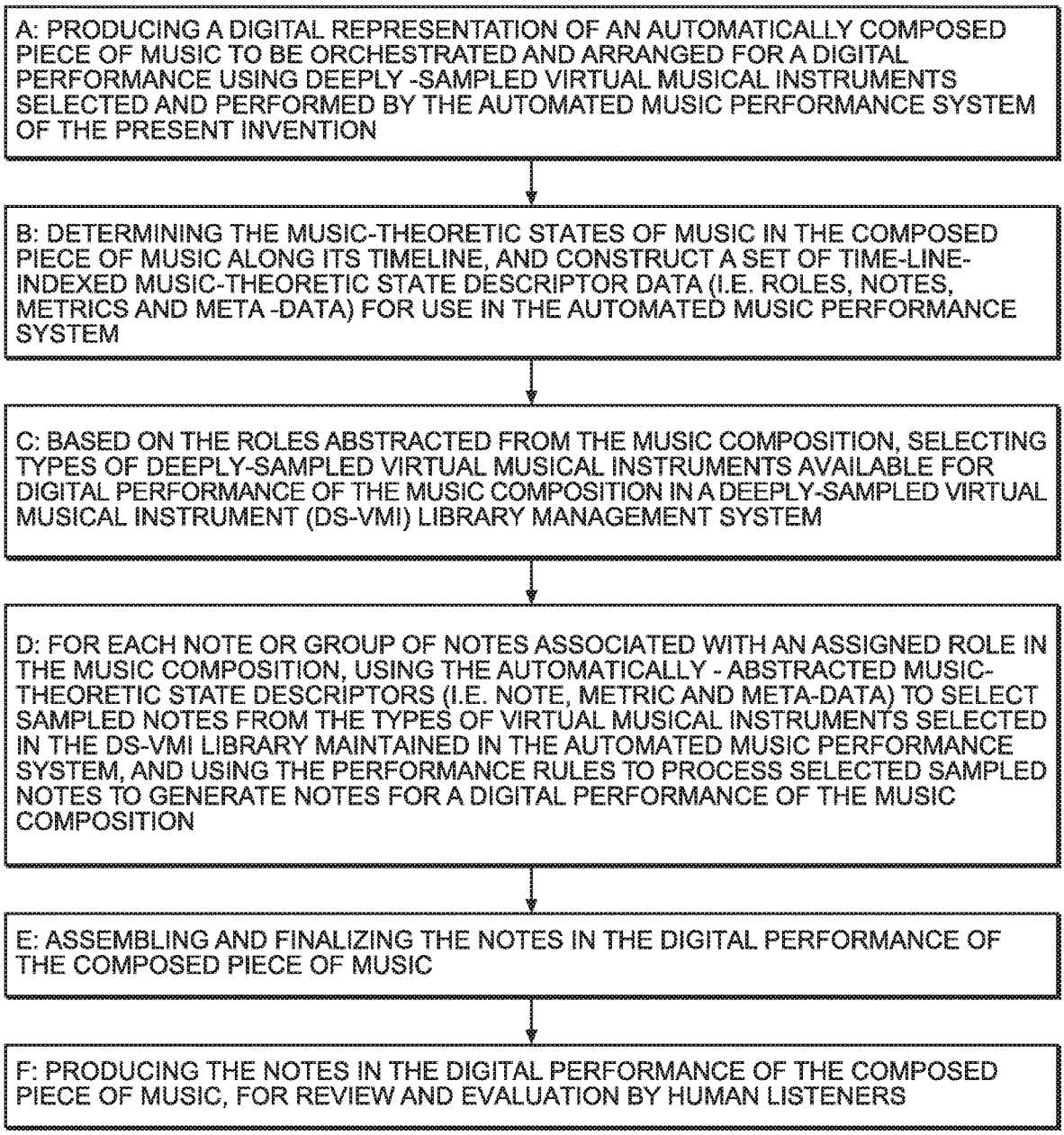
FIG. 12 a flow chart describing a method of generating a digital performance of a composed piece of music (i.e. a musical composition) using the automated music composition and performance system, comprising the steps of (a) producing a digital representation of a music composition to be orchestrated and arranged for a digital performance using selected deeply-sampled virtual musical instruments performed using music-theoretic state (MTS) responsive performance rules, (b) automatically determining the music-theoretic states of music in a music composition along its timeline, and producing a set of timeline-indexed music-theoretic state descriptor data (i.e. roles, notes, metrics and meta-data) for use in the automated music performance system, (c) based on the roles abstracted from the music composition, selecting types of deeply-sampled virtual musical instruments available for digital performance of the music composition in a deeply-sampled virtual musical instrument (DS-VMI) library management system, (d) using the set of music theoretic-state meta-data descriptor data to automatically select sampled notes from deeply-sampled virtual musical instrument libraries, and using music-theoretic state responsive performance rules to process the selected sampled notes to generate the notes for a digital performance of the music composition, (e) assembling and finalizing the sampled notes in the generated digital performance of the music composition, and (f) producing the sampled notes in the digital performance of the music composition, for review and evaluation by human listeners.

Specification of the Method of Automatically Generating a Digital Performance of a Music Composition FIG. 11 describes a method of automatically generating a digital performance of a music composition using the system shown in FIGS. 9, 9A and 9B. As shown, the method comprises the steps of: (a) selecting real musical instruments to be sampled, recorded, and catalogued for use in the deeply-sampled virtual musical instrument library management subsystem; (b) using an instrument type and behavior based schema (i.e. plan) for sampling, recording and cataloguing the selected real musical instruments in the virtual musical instrument sample library management system of present invention; (c) using the instrument-type and behavior based schema to develop the action part of music-theoretic state (MTS) responsive performance rules for processing sampled notes in virtual musical instrument sample libraries being managed in the library management system, during the automated music performance process, (d) loading the DS-VML libraries and associated music-theoretic state (MTS) responsive performance rules into the automated performance system before the automated music performance generation process; (e) during a music composition process, producing and recording the musical notes in a music composition; (f) providing the music composition to the automated music performance engine (AMPE) and generating timeline-indexed music-theoretic state descriptor data (i.e. music composition meta-data) for the music composition; (g) providing the music-theoretic state descriptor data (i.e. music composition meta-data) to the automated music performance system to automatically select sampled notes from deeply-sampled virtual musical instrument libraries maintained in DS-VMI library management system; (h) using the music-theoretic state (MTS) responsive performance logic (i.e. rules) in the deeply-sampled virtual musical instrument libraries to process the selected sampled and/or synthesized notes (or sounds) to produce the notes of the digital music performance of the music composition; (i) assembling and finalizing the processed sampled notes in the digital performance of the composed piece of music; and ( ) producing the notes of a digital performance of the composed piece of music for review and evaluation by human listeners.

Specification of the Digital Performance of a Composed Piece of Music (I.E. A Musical Composition) Using the Automated Music Composition and Performance System FIG. 12 describes a method of generating a digital performance of a composed piece of music (i.e. a musical composition) using the automated music composition and performance system. As shown, the system comprises the steps of: (a) producing a digital representation of an automatically composed piece of music to be orchestrated and arranged for a digital performance using selected deeply-sampled virtual musical instruments performed using music-theoretic state (MTS) responsive performance rules; (b) automatically determining the music-theoretic states of music in a music composition along its timeline, and producing a set of timeline-indexed music-theoretic state descriptor data (i.e. roles, notes, metrics and meta-data) for use in the automated music performance system; (c) based on the roles abstracted from the music composition, selecting types of deeply-sampled virtual musical instruments available for digital performance of the music composition in a deeply-sampled virtual musical instrument (DS-VMI) library management system; (d) using the set of music theoretic-state meta-data descriptor data to automatically select sampled notes from deeply-sampled virtual musical instrument libraries, and using music-theoretic state responsive performance rules to process the selected sampled notes to generate the notes for a digital performance of the music composition; (e) assembling and finalizing the processed sampled notes in the generated digital performance of the music composition; and (f) producing the performed sampled notes in the digital performance of the music composition, for review and evaluation by human listeners.

Figure 13:
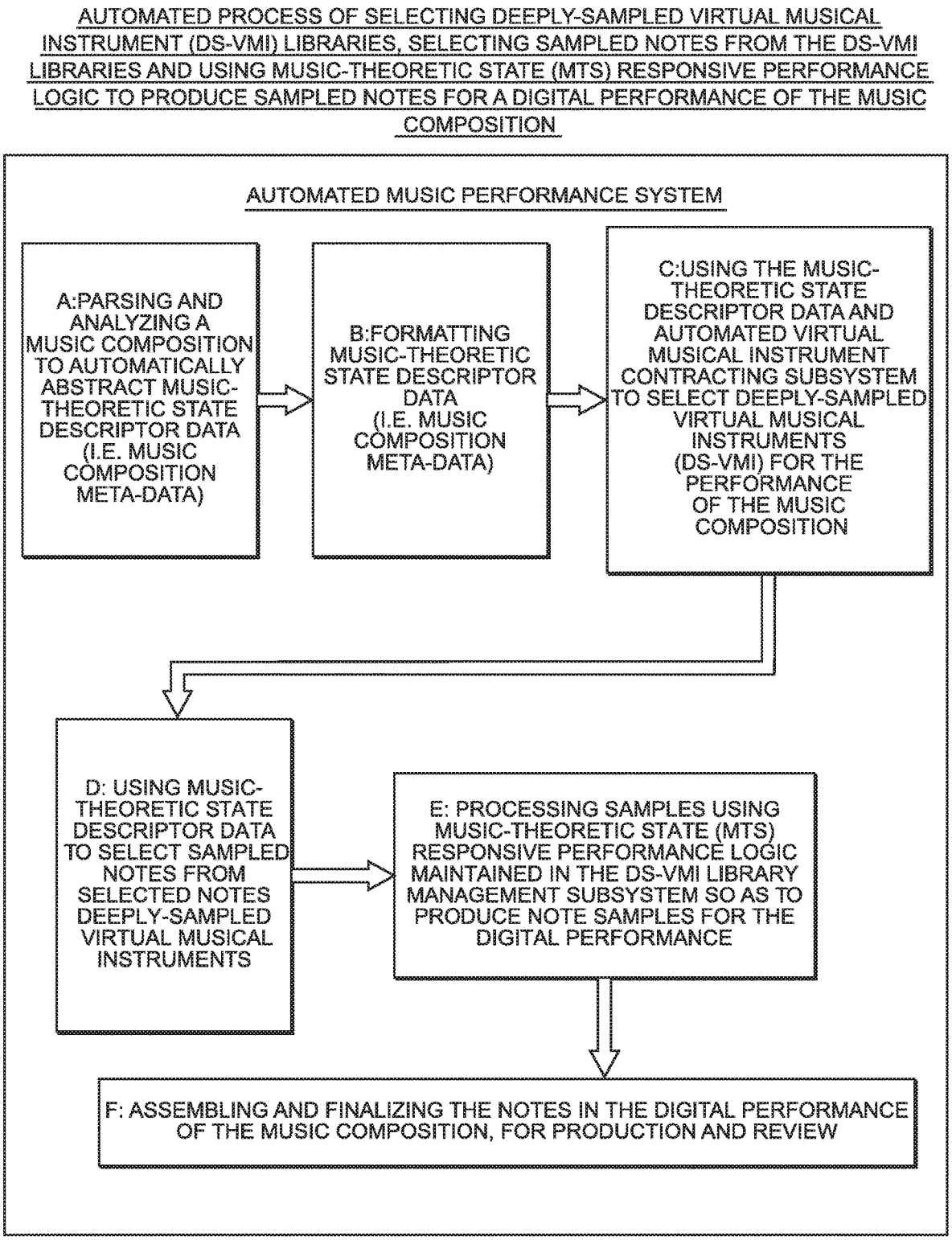
FIG. 13 illustrates the process of automated selection of sampled notes in deeply-sampled virtual musical instrument (DS-VMI) libraries to produce the notes for the digital performance of a composed piece of music in accordance with the principles of the present invention, involving (a) the parsing and analyzing the music composition to abstract music-theoretic state descriptor data (i.e. music composition meta data), (b) formatting the music-theoretic state descriptor data (i.e. music composition meta-data) abstracted from the music composition, (c) using music-theoretic state descriptor data and automated virtual musical instrument contracting subsystem to select deeply-sampled virtual musical instruments (DS-VMI) for the performance of the music composition, (d) using music-theoretic state descriptor data to select sampled notes audio files from selected deeply-sampled virtual musical instrument (DS-VMI) libraries, (e) processing samples using music-theoretic state (MTS) responsive performance logic maintained in the DS-VMI library management subsystem so as to produce note samples for the digital performance, and (f) assembling and finalizing the notes in the digital performance of the music composition, for production and review.

FIG. 13. illustrates the process of automated selection of sampled notes in deeply-sampled virtual musical instrument (DS-VMI) libraries to produce the notes for the digital performance of a composed piece of music in accordance with the principles of the present invention. As shown, the process comprises: (a) the parsing and analyzing the music composition to abstract music-theoretic state descriptor data (i.e. music composition meta data); (b) formatting the music-theoretic state descriptor data (i.e. music composition meta-data) abstracted from the music composition; (c) using music-theoretic state descriptor data (i.e. music composition meta-data) to select sampled notes from deeply-sampled virtual musical instruments (DS-VMI) and processing sampled notes using music-theoretic state (MTS) responsive performance logic maintained in the DS-VMI library management subsystem, to produce processed sampled notes in the digital performance of the music composition; and (d) assembling and finalizing the processed sampled notes for the digital performance of the music composition, for subsequent production, review and evaluation.

Figure 14:
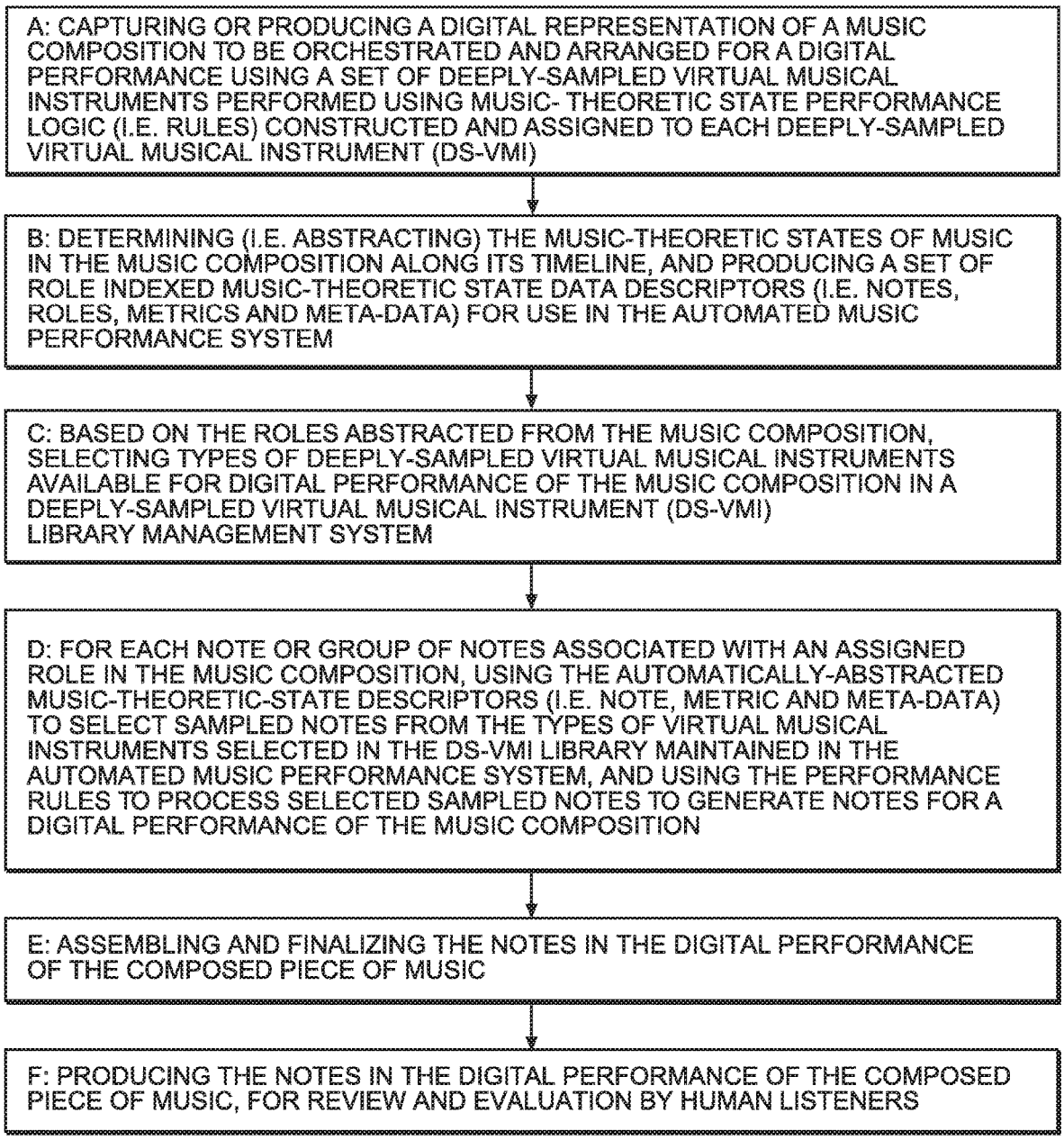
FIG. 14 a flow chart describing method of automated selection and performance of notes in deeply-sampled virtual instrument libraries to generate a digital performance of a composed piece of music, comprising the steps of (a) capturing or producing a digital representation of a music composition to be orchestrated and arranged for a digital performance using a set of deeply-sampled virtual musical instruments performed using music-theoretic state performance logic (i.e. rules) constructed and assigned to each deeply-sampled virtual musical instrument (DS-VMI), (b) determining (i.e. abstracting) the music-theoretic states of music in the music composition along its timeline, and producing a set of timeline-indexed music-theoretic state descriptor data (i.e. roles, notes, metrics and meta-data) for use in the automated music performance system, (c) based on the roles abstracted from the music composition, selecting types of deeply-sampled virtual musical instruments available for digital performance of the music composition in a deeply-sampled virtual musical instrument (DS-VMI) library management system, (d) for each note or group of notes along the timeline of the music composition, using the automatically-abstracted music-theoretic-state descriptors (i.e. music composition meta-data) to select sampled notes from a deeply-sampled virtual musical instrument library maintained in the automated music performance system, and using the music-theoretic state responsive performance rules to process the selected sampled notes to generate notes for a digital performance of the music composition; (e) assembling and finalizing the notes in the digital performance of the music composition; and (f) producing the notes in the digital performance of the music composition, for review and evaluation by human listeners.

Specification of the Method of Automated Selection and Performance of Notes in Deeply-Sampled Virtual Instrument Libraries to Generate a Digital Performance of a Composed Piece of Music FIG. 14 describes a method of automated selection and performance of notes in deeply-sampled virtual instrument libraries to generate a digital performance of a composed piece of music. As shown, the method comprises the steps of: (a) capturing or producing a digital representation of a music composition to be orchestrated and arranged for a digital performance using a set of deeply-sampled virtual musical instruments performed using music-theoretic state performance logic (i.e. rules) constructed and assigned to each deeply-sampled virtual musical instrument (DS-VMI); (b) determining (i.e. abstracting) the music-theoretic states of music in the music composition along its timeline, and producing a set of timeline-indexed music-theoretic state descriptor data (i.e. roles, notes, metrics and meta-data) for use in the automated music performance system; (c) based on the roles abstracted from the music composition, selecting types of deeply-sampled virtual musical instruments available for digital performance of the music composition in a deeply-sampled virtual musical instrument (DS-VMI) library management system; (d) for each note or group of notes along the timeline of the music composition, using the automatically-abstracted music-theoretic-state descriptors (i.e. music composition meta-data) to select sampled notes from a deeply-sampled virtual musical instrument library maintained in the automated music performance system, and using the music-theoretic state responsive performance rules to process the selected sampled (and/or synthesized) notes to generate notes for a digital performance of the music composition; (e) assembling and finalizing the processed sampled notes in the digital performance of the music composition; and (f) producing the performed sampled notes in the digital performance of the music composition, for review and evaluation by human listeners.

Figure 15:
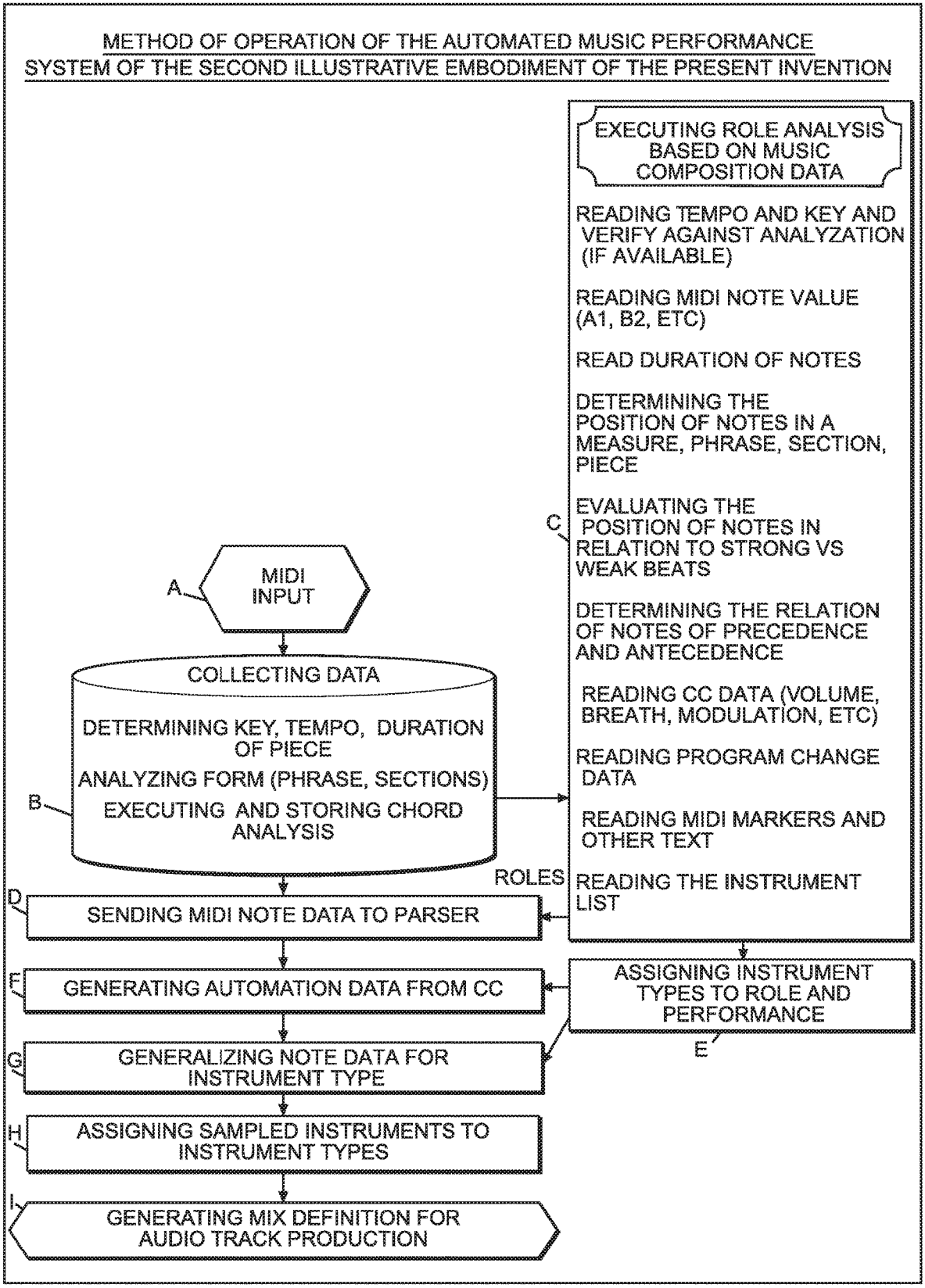
FIG. 15 is a flow chart specification of the method of operation of the automated music performance system of the first illustrative embodiment of the present invention, shown in FIGS. 9 through 14.

Method of Operation of the Automated Music Performance System of the Second Illustrative Embodiment of the Present Invention FIG. 15 describes the method of operation of the automated music performance system of the first illustrative embodiment of the present invention, shown in FIGS. 9 through 14.

As shown in Block A of FIG. 15, the method involves receiving a MIDI-based music composition as system input, which can be formatted in any suitable MIDI file structure for processing in accordance with the principles of the present invention. Suitable MIDI file formats will include file formats supported by commercial music score composition programs such as Sibelius Scorewriter Program by Sibelius Software Limited; Finale Music Notation and Scorewriter Software by MakeMusic, Inc.; MuseScore Composition and Notation Program by MuseScore BVBA www.musescore.org; Capella Music Notation or Scorewriter Program by Capella Software AG; open-source Lillypond™ music notation engraving program; and generate a file format that can be subsequently processed by the automated music performance system of the present invention As shown in Block B of FIG. 15, the method involves processing the MIDI music file FIG. 16 describes an exemplary set of music-theoretic state descriptors (e.g. parameters) that are automatically evaluated within each music theoretic state descriptor file (for a given music composition) by the automated music performance subsystem of the present invention so as to automatically select at least one instrument for each Role abstracted from the music composition, and also to automatically select and sample the sampled sound files (e.g. notes) for the selected instrument type represented in the deeply-sampled virtual musical instrument library (DS-VMI) subsystem of the present invention.

As shown in Block C of FIG. 15, the method involves processing the music-theoretic state data collected at Block B and executing a Role Analysis comprising: (a) Reading Tempo and Key and verifying against analyzation (if available); (b) Reading MIDI note values (A1, B2, etc.); (c) Reading the duration of Notes; (d) Determining the Position of Notes in a measure, phrase, section, piece; (e) Evaluating the position of notes in relation to strong vs weak beats; (f) Determining the Relation of notes of precedence and antecedence; (g) Reading Control Code (CC) data (e.g. Volume, Breath, Modulation, etc.); (h) Reading program change data; (i) Reading MIDI markers and other text; and ( ) Reading the Instrument List. The output of the Role Analyzer are the Roles assigned to group of Notes contained in the MIDI-based music composition.

As shown in Block D of FIG. 15, the method involves sending MIDI note data collected at Block B to a note parser to parse out the time-indexed notes contained in the MIDI music composition, and assigning parsed out notes to abstracted Roles.

As shown in Block E of FIG. 15, the method involves assigning Instrument Types to abstracted Roles and Notes to be performed (i.e. "Performances").

As shown in Block F of FIG. 15, the method involves generating automation data from MIDI continuous controller (CC) codes abstracted from the music composition and assigning the automation data to specific instrument types and note performances.

As shown in Block G of FIG. 15, the method involves generalizing the Note Data for the Instrument Type and Note Performance selected by the automated music performance subsystem.

As shown in Block H of FIG. 15, the method involves assigning sampled instruments (i.e. DS-VMI sample libraries) to the selected Instrument Types required by the Roles identified for the digital performance of the input music composition.

As shown in Block I of FIG. 15, the process involves generating a mix definition for audio track production to produce the final digital performance for all Notes and Roles specified in the music composition.

Music-Theoretic State Descriptors Automatically Evaluated by the Automated Music Performance System of the Second Illustrative Embodiment—During Automated Selection of Musical Instruments and Sampled Notes During Each Digital Performance FIG. 16 describes a set of music-theoretic state descriptors (e.g. parameters) that are automatically evaluated within each music-theoretic state descriptor file (for a given music composition) by the automated music performance subsystem of the present invention deployed in the system of FIG. 9, so as to (i) automatically select at least one instrument for each Role abstracted from the music composition, and also (ii) automatically select and sample the sound files (e.g. sampled notes) for the selected instrument type represented in and supported by the deeply-sampled virtual musical instrument library (DS-VMI) subsystem of the present invention.

The function of DS-VMI behavior-sample choosing supported by the automated DS-VMI Selection and Performance Subsystem shown in FIG. 9 involves automated evaluation of all of the Role-indexed/organized note data, music metric data, and music meta-data collected during automated analysis of the music composition to be digitally performed. In the preferred embodiment, this automated intelligent evaluation of music state data associated with any given music composition to be digitally performed will be realized using the rich set of instrument performance rules (i.e. performance logic) written and deployed within each DS-VMI Library supported within the automated music performance engine of the present invention.

When carrying out this automated data evaluation process, for the purpose of automatically selecting/choosing instrument types and sampled notes and appropriate sample note processing, the music-theoretic state data descriptor file schematically depicted in FIG. 34 will be supplied as subsystem input, the Automated DS-VMI Selection and Performance Subsystem and the Automated Virtual Musical Instrument Contracting Subsystem of FIG. 9 will (i) review each Performance Rule in the DS-VMI Library and (ii) check the music data states reflected in the input music-theoretic data descriptor file depicted in FIG. 34 to automatically determine Instrument Performance Rules (i.e. Logic) to execute in order to generate the rendered notes of a digital music performance to be produced from the automated music performance subsystem. This data evaluation process will be carried out in a syllogistic manner, to determine when and where "If X, then Y" performance rule conditions are satisfied and instrument and note selections should be made in a real-time manner. Below are the various levels of data evaluation performed by this intelligent process within the automated music performance system during automated instrument and note selection and modification.

5. Primary Evaluation Level—this is the initial level of processing supported by which DS-VMI library management system which commences the evaluation of note data.
   a. Rhythmic density by tempo—Initial step to determine selections of behavior and articulation types based on how dense the notes are in a given tempo. For example, if a tempo was at 140 and $16^{th}$ notes were detected, then performances of a shaker may ignore every other $16^{th}$ note, or choose a sample set that can articulate fast enough to perform those note samples.
   b. Duration of notes—determine how long each rhythmic assignment should hold out (sustain) for, important for determining release samples, intestinal samples, guitar string relationships, etc.
   c. MIDI note value—determination of the pitch assignments of the duration of notes
   d. Dynamics—determination of what velocity to play the note at (and select the correct timbre/volume of a sample)
6. Static Note Relationships—this is the process of analyzing where the notes come in relation to time and space
   a. Position of notes in a chord—where the note is in relation to the root, third, fifth, etc.
   b. Meter and position of strong and weak beats—determine if compound or simple meter, where the strong and weak beats are c. Position of notes in a measure—determine where the notes are in relation to the strong and weak beats based on meter
d. Position of notes in a phrase—determine where the notes are in relation to a phrase (a group of measures)
e. Position of notes in a section—determine where the notes are in relation to a section (a group of phrases)
f. Position of notes in a region—determine where the notes are in relation to a region (a group of sections)

7. Situational Relationship—this establishes the modifiers (behaviors of an instrument) that allow for alternate sample selections (hit vs rim-shot, staccato vs spiccato, etc.)
   a. MIDI note value precedence and antecedence—evaluate what notes come before and after the current note and choose to alter the sample selection with a difference behavior type
   b. Position or existence of notes from other roles—determine the other notes written in other instrument parts (roles) and alter sample selection (or don't play) ex: instruments are snare, kick and hi-hat, if kick is playing don't play the snare hit sample and only play a closed rim hit on the hi-hat
   c. Relation of sections to each other—evaluate what has been played before in a previous section and either copy or alter the sample selection.
   d. Accents—evaluate any system-wide musical accents and alter samples (velocity or sample selection) based on this modifier.
   e. Timing based rhythms—based on 1.a resolve any samples that may not be able to perform the rhythms properly and choose an approved sample set, or not play.
8. Instrument Selection—this is the actual sample bank (i.e. DS-VMI library) that makes up a selected virtual music instrument. Note that the Instruments are assigned to the Role before notes are sent from the above automated evaluation stage. This stage in the process allows the system to be aware or cognizant of the Instruments chosen and to make sample Behavior modifications as Instruments are added or taken away.
   a. What Instruments are available—all Instruments that exist in a "band" different notes may be sent to other instruments if some instruments don't exist so important parts are covered, this can change register of the instrument as well as sample selection
   b. What Instruments are playing—all Instruments that are playing, this determines if certain Instruments should not play, not play as much, or play the same as another Instrument
   c. What Instruments should/might play—all the Instruments available that are not playing, but could help double another instrument.
   d. What Instruments are assigned to a Role—this is the music composition part that the Instrument is playing, e.g. "am I a Background instrument", "do I only play a pedal note", "am I a lead"
   e. How many Instruments are available—determines density of parts, volume, panning and other automation considerations to a sample performance.

Third Illustrative Embodiment of the Automated Music Composition and Performance System of the Present Invention, Wherein an Automated Music Composition System Automatically Produces an Orchestrated Music Composition, and Wherein the Music Composition is Provided to the Automated Musical Performance System of the Present Invention so that this System can Select Deeply-Sampled Virtual Musical Instruments Supported by the Automated Music Performance System Based on Roles Abstracted During Music Composition Processing, and Digitally Perform the Music Composition Using Automated Selection of Notes from Deeply-Sampled Virtual Musical Instrument Libraries As shown in FIG. 17, the automated music composition, performance and production system of the present invention comprises: (i) a system user interface subsystem for a system user to provide the emotion-type, style-type musical experience descriptors (MEX) and timing parameters for a piece of a music to be automatically composed, performed and produced, (ii) an automated music composition engine (AMCE) subsystem interfaced with the system user interface subsystem to receive MEX descriptors and timing parameters, and (ii) an automated music performance engine (AMPE) subsystem interfaced with the automated music composition engine subsystem and the system user interface subsystem, for automatically producing a digital performance based on the music composition produced by the automated music composition engine subsystem.

The automated music composition engine subsystem transfers a music composition to the automated music performance engine. The automated music performance engine includes: (i) an automated music-theoretic state (MTS) data abstraction subsystem for automatically abstracting all music-theoretic states contained in the music composition and producing a set of music-theoretic state descriptors representative thereof; (ii) a deeply-sampled virtual musical instrument (DS-VMI) library management subsystem for managing deeply-sampled virtual musical instruments to be selected for performance of notes specified in the music composition; and (iii) an automated deeply-sampled virtual musical instrument (DS-VMI) selection and performance subsystem for selecting deeply-sampled virtual musical instruments in the DS-VMI library management subsystem and performing notes from selected deeply-sampled virtual musical instruments using music-theoretic state (MTS) responsive performance rules, to automatically produce a digital performance of the music composition. The automated music performance engine (AMPE) subsystem ultimately transfers the digital performance to the system user interface subsystem for production, review and evaluation.

Figure 17A:
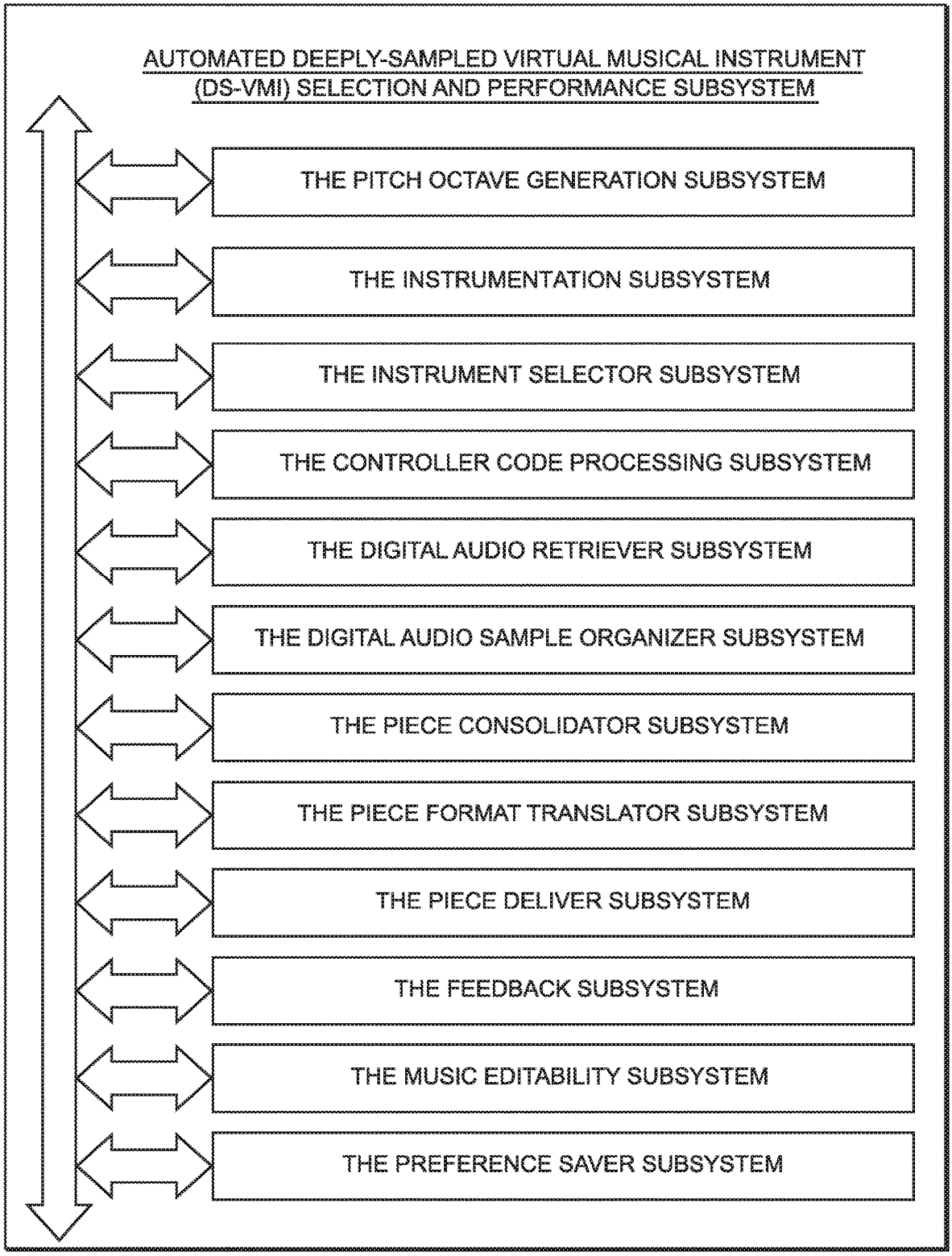
FIG. 17A is a schematic block representation of the subsystem architecture of the Automated Deeply-Sampled Virtual Musical Instrument (DS-VMI) Selection and Performance Subsystem employed in the automated music performance system of the present invention, shown comprising the Pitch Octave Generation Subsystem, the Instrumentation Subsystem, the Instrument Selector Subsystem, the Digital Audio Retriever Subsystem, the Digital Audio Sample Organizer Subsystem, the Piece Consolidator Subsystem, the Piece Format Translator Subsystem, the Piece Deliver Subsystem, the Feedback Subsystem, and the Music Editability Subsystem, interfaced as shown with the other subsystems deployed within the Automated Music Performance System of the present invention.
Figure 17B:
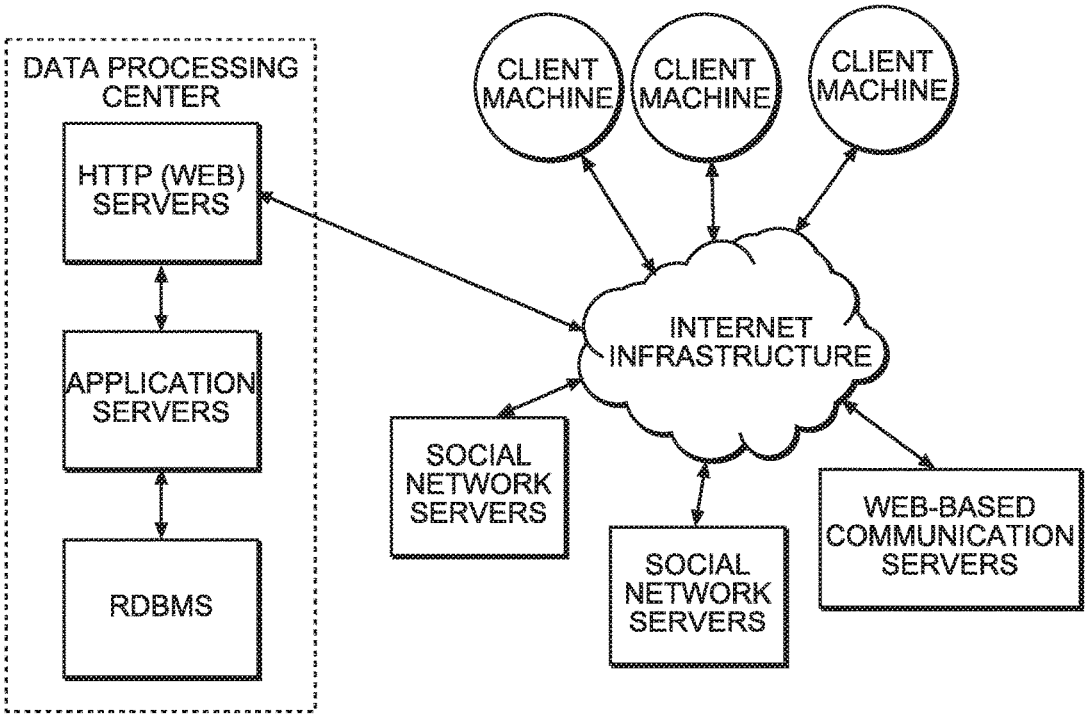
FIG. 17B a schematic representation of the enterprise-level internet-based music composition, performance and generation system of the present invention, supported by a data processing center with web servers, application servers and database (RDBMS) servers operably connected to the infrastructure of the Internet, and accessible by client machines, social network servers, and web-based communication servers, and allowing anyone with a web-based browser to access automated music composition, performance and generation services on websites to score videos, images, slide-shows, podcasts, and other events with music using deeply-sampled virtual musical instrument (DS-VMI) synthesis methods of the present invention disclosed and taught herein.

In FIG. 17A, the enterprise-level internet-based music composition, performance and generation system of the present invention is shown supported by a data processing center with web servers, application servers and database (RDBMS) servers operably connected to the infrastructure of the Internet, and accessible by client machines, social network servers, and web-based communication servers, and allowing anyone with a web-based browser to access automated music composition, performance and generation services on websites to score videos, images, slide-shows, podcasts, and other events with music using deeply-sampled virtual musical instrument (DS-VMI) synthesis methods of the present invention disclosed and taught herein.

Specification of the Third Illustrative Embodiment of the Automated Music Production System of the Present Invention FIGS. 17 through 23 shows the Automated Music Performance System according to a third illustrative embodiment of the present invention. In this illustrative embodiment, an Internet-based automated music composition and generation platform that is deployed so that mobile and desktop client machines, alike, using text, SMS and email services supported on the Internet, can be augmented by the addition of automatically composed and/or performed music by users using an Automated Music Composition and Generation Engine such as taught and disclosed in Applicant's U.S. Pat. No. 9,721,551, incorporated herein by reference, and graphical user interfaces supported by the client machines while creating text, SMS and/or email documents (i.e. messages). Using these interfaces and supported functionalities, remote system users can easily select graphic and/or linguistic based emotion and style descriptors for use in generating composed music pieces for insertion into text, SMS and email messages, as well as diverse document and file types.

FIG. 17A shows that both mobile are desktop client machines (e.g. Internet-enabled smartphones, tablet computers, and desktop computers) are deployed in the system network illustrated in FIG. 17A, where the client machine is realized a mobile computing machine having a touch-screen interface, a memory architecture, a central processor, graphics processor, interface circuitry, network adapters to support various communication protocols, and other technologies to support the features expected in a modern smartphone device (e.g. Apple iPhone, Samsung Android Galaxy, et al), and wherein a first exemplary client application is running that provides the user with a virtual keyboard supporting the creation of (i) video capture and editing applications of short duration (e.g. 15 seconds) or long duration (60 seconds or more), (ii) a text or SMS message, and the creation and insertion of a piece of composed music created by selecting linguistic and/or graphical-icon based emotion-type musical experience (MEX) descriptors, and style-type MEX descriptors, from a touch-screen menu screen, as taught in U.S. Pat. No. 9,721,551.

Specification of the Method of Automated Digital Music Performance Generation Using Deeply-Sampled Virtual Musical Instrument Libraries and Contextually-Aware (I.E. Music State Aware) Driven Performance Principles FIG. 18 describes a method of automated digital music performance generation using deeply-sampled virtual musical instrument libraries and contextually-aware (i.e. music state aware) driven performance principles practiced within an automated music composition, performance and production system shown in FIG. 17. As shown, the method comprises the steps of: (a) selecting real musical instruments to be sampled, recorded, and catalogued for use in the deeply-sampled virtual musical instrument library management subsystem; (b) using an instrument type and behavior based schema (i.e. plan) for sampling, recording and cataloguing the selected real musical instruments in the virtual musical instrument sample library management system of present invention; (c) using the instrument type and behavior based schema to develop the action part of music-theoretic state (MTS) responsive performance rules for processing sampled notes in virtual musical instrument sample libraries being managed in the library management system, during the automated music performance process; (d) loading the DS-VML libraries and associated music-theoretic state (MTS) responsive performance rules into the automated performance system before the automated music performance generation process; (e) during an automated music composition process, the system user providing emotion and style type musical experience (MEX) descriptors and timing parameters to the system, then the system transforming MEX descriptors and timing parameters into a set of music-theoretic system operating parameters for use during the automated music composition and generation process; (f) providing the music-theoretic system operating parameters (MT-SOP descriptors) to the automated music composition engine (AMCE) subsystem for use in automatically composing a music composition; (g) providing the music composition to the automated music performance (AMCE) engine subsystem and producing a timeline indexed music-theoretic state descriptors data (i.e. music composition meta-data); (h) the automated music performance engine (AMPE) subsystem using the music-theoretic state descriptor data to automatically select sampled notes from deeply-sampled virtual musical instrument libraries, and using music-theoretic state descriptor responsive performance rules to process selected sampled notes, and generate the notes for the digital performance of the music composition; (i) assembling and finalizing the processed sampled notes in the digital performance of the music composition; and ( ) producing the performed sampled notes of a digital performance of the music composition for review and evaluation by human listeners.

Figure 19:
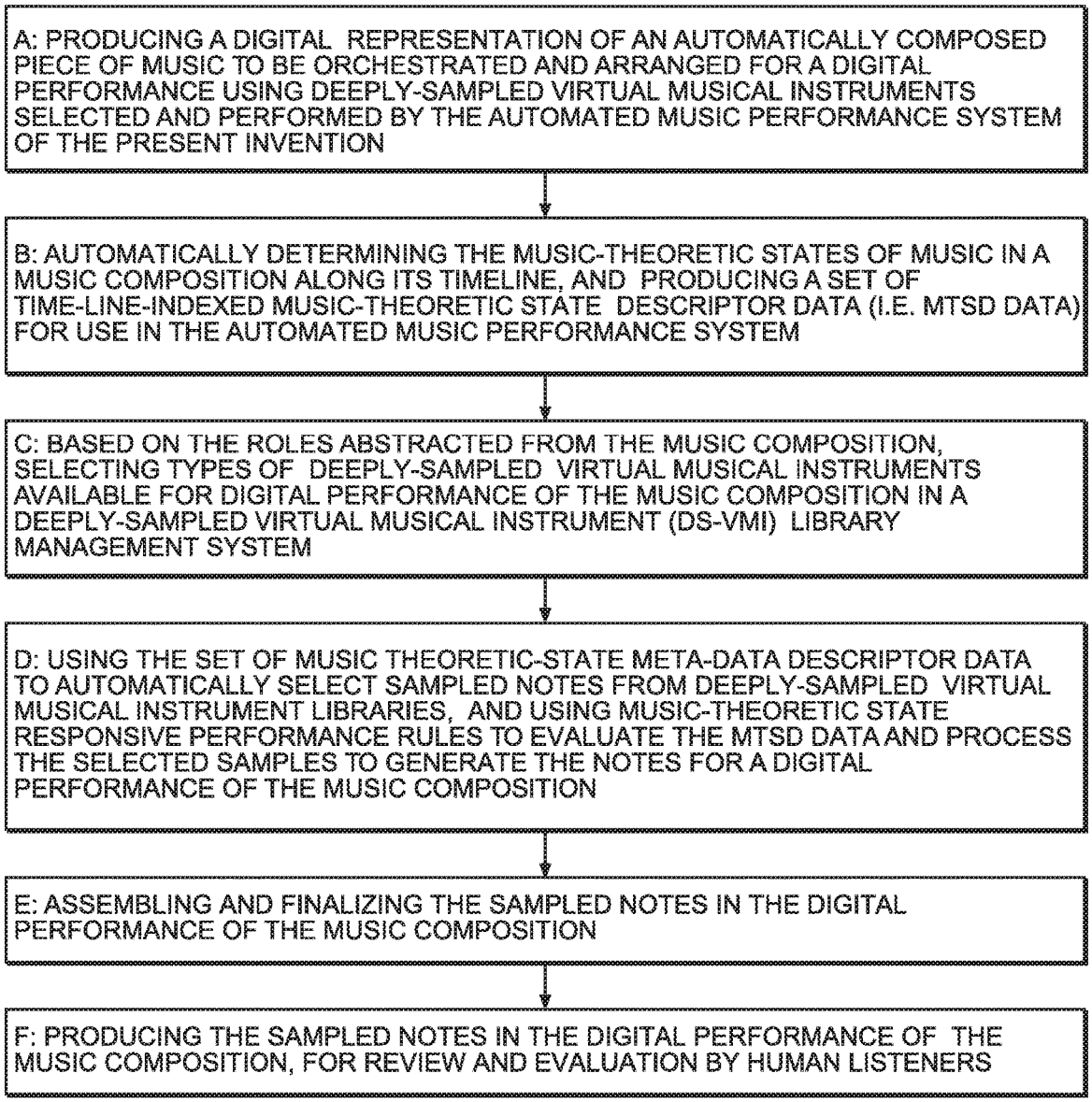
FIG. 19 is a flow chart describing a method of generating a digital performance of a composed piece of music (i.e. a musical composition) using the automated music composition and performance system, comprising the steps of (a) producing a digital representation of an automatically composed piece of music to be orchestrated and arranged for a digital performance using selected deeply-sampled virtual musical instruments performed using music-theoretic state (MTS) responsive performance rules, (b) automatically determining the music-theoretic states of music in a music composition along its timeline, and producing a set of timeline-indexed music-theoretic state descriptor data (i.e. roles, notes, metrics and meta-data) for use in the automated music performance system, (c) based on the roles abstracted from the music composition, selecting types of deeply-sampled virtual musical instruments available for digital performance of the music composition in a deeply-sampled virtual musical instrument (DS-VMI) library management system, (d) using the set of music theoretic-state meta-data descriptor data to automatically select sampled notes from deeply-sampled virtual musical instrument libraries, and using music-theoretic state responsive performance rules to process the selected sampled notes to generate the notes for a digital performance of the music composition, (e) assembling and finalizing the sampled notes in the generated digital performance of the music composition, and (f) producing the sampled notes in the digital performance of the music composition, for review and evaluation by human listeners.

Specification for the Method of Generating a Digital Performance of a Musical Composition Using the Automated Music Composition and Performance System FIG. 19 describes a method of generating a digital performance of a composed piece of music (i.e. a musical composition) using the automated music composition and performance system shown in FIG. 17. As shown, the method comprises the steps of: (a) producing a digital representation of an automatically composed piece of music to be orchestrated and arranged for a digital performance using selected deeply-sampled virtual musical instruments performed using music-theoretic state (MTS) responsive performance rules; (b) automatically determining the music-theoretic states of music in a music composition along its timeline, and producing a set of timeline-indexed music-theoretic state descriptor data (i.e. roles, notes, metrics and meta-data) for use in the automated music performance system; (c) based on the roles abstracted from the music composition, selecting types of deeply-sampled virtual musical instruments available for digital performance of the music composition in a deeply-sampled virtual musical instrument (DS-VMI) library management system; (d) using the set of music theoretic-state meta-data descriptor data to automatically select sampled notes from deeply-sampled virtual musical instrument libraries, and using music-theoretic state responsive performance rules to process the selected sampled notes to generate the notes for a digital performance of the music composition; (e) assembling and finalizing the processed sampled notes in the generated digital performance of the music composition; and (f) producing the performed sampled notes in the digital performance of the music composition, for review and evaluation by human listeners.

Figure 20:
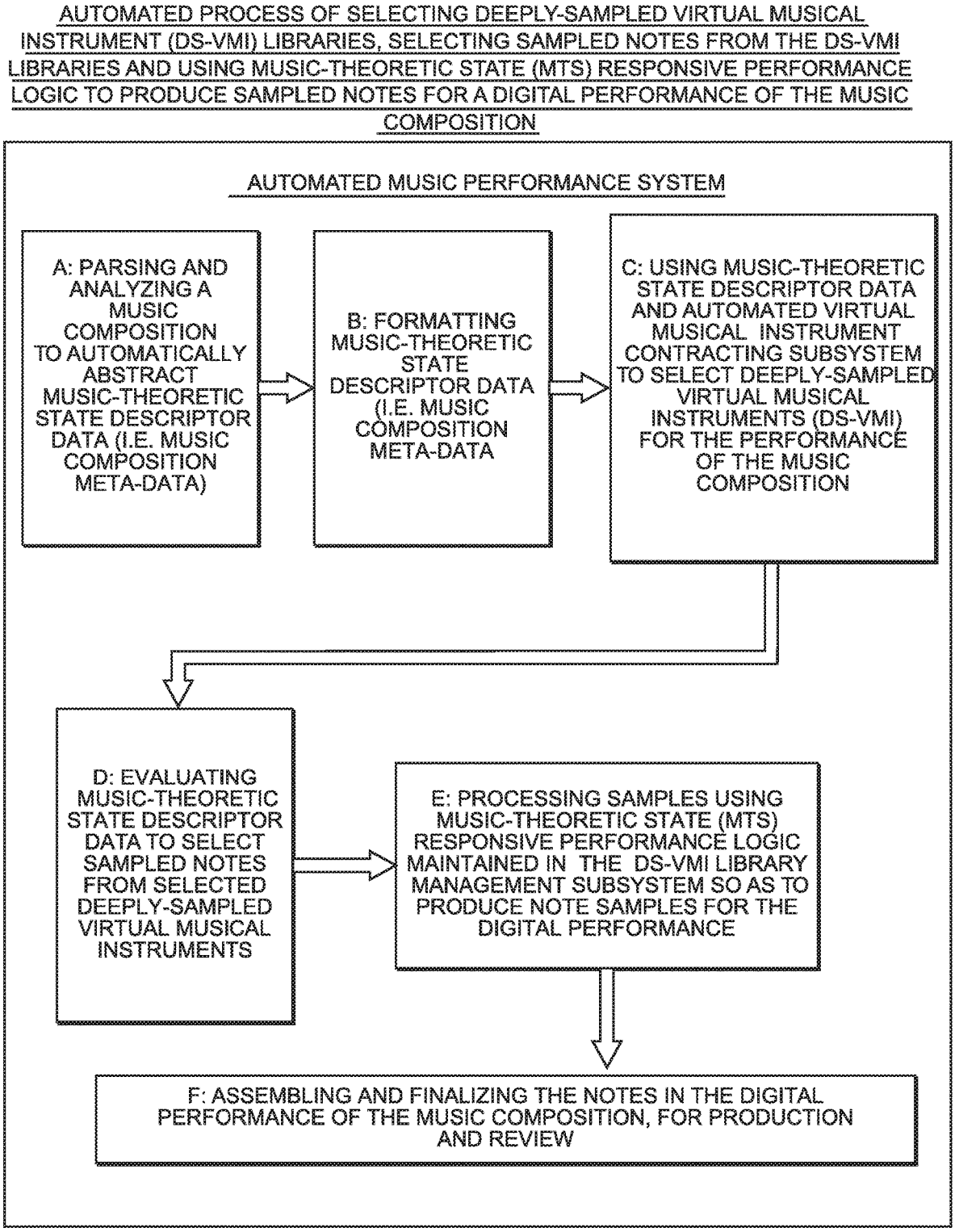
FIG. 20 illustrates the process of automated selection of sampled notes in deeply-sampled virtual musical instrument (DS-VMI) libraries to produce the notes for the digital performance of a composed piece of music in accordance with the principles of the present invention, involving (a) the parsing and analyzing the music composition to abstract music-theoretic state descriptor data (i.e. music composition meta data), (b) formatting the music-theoretic state descriptor data (i.e. music composition meta-data) abstracted from the music composition, (c) using music-theoretic state descriptor data and automated virtual musical instrument contracting subsystem to select deeply-sampled virtual musical instruments (DS-VMI) for the performance of the music composition, (d) using music-theoretic state descriptor data to select sampled note or audio files from selected deeply-sampled virtual musical instrument (DSVMI) libraries, (e) processing samples using music-theoretic state (mts) responsive performance logic maintained in the DS-VMI library management subsystem so as to produce note samples for the digital performance, and (f) assembling and finalizing the notes in the digital performance of the music composition, for production and review.

Specification of the Process of Automated Selection of Sampled Notes in Deeply-Sampled Virtual Musical Instrument (DS-VMI) Libraries to Produce the Notes for the Digital Performance of a Music Composition FIG. 20 illustrates the process of automated selection of sampled notes in deeply-sampled virtual musical instrument (DS-VMI) libraries to produce the notes for the digital performance of a music composition in accordance with the principles of the present invention. As shown, the process comprises: (a) the parsing and analyzing the music composition to abstract music-theoretic state descriptor data (i.e. music composition meta data); (b) formatting the music-theoretic state descriptor data (i.e. music composition meta-data) abstracted from the music composition; (c) using music-theoretic state descriptor data (i.e. music composition meta-data) to select sampled notes from deeply-sampled virtual musical instruments (DS-VMI) and processing sampled notes using music-theoretic state (MTS) responsive performance logic maintained in the DS-VMI library management subsystem, to produce processed sampled notes in the digital performance of the music composition; and (d) assembling and finalizing the processed sampled notes for the digital performance of the music composition, for subsequent production, review and evaluation.

Figure 21:
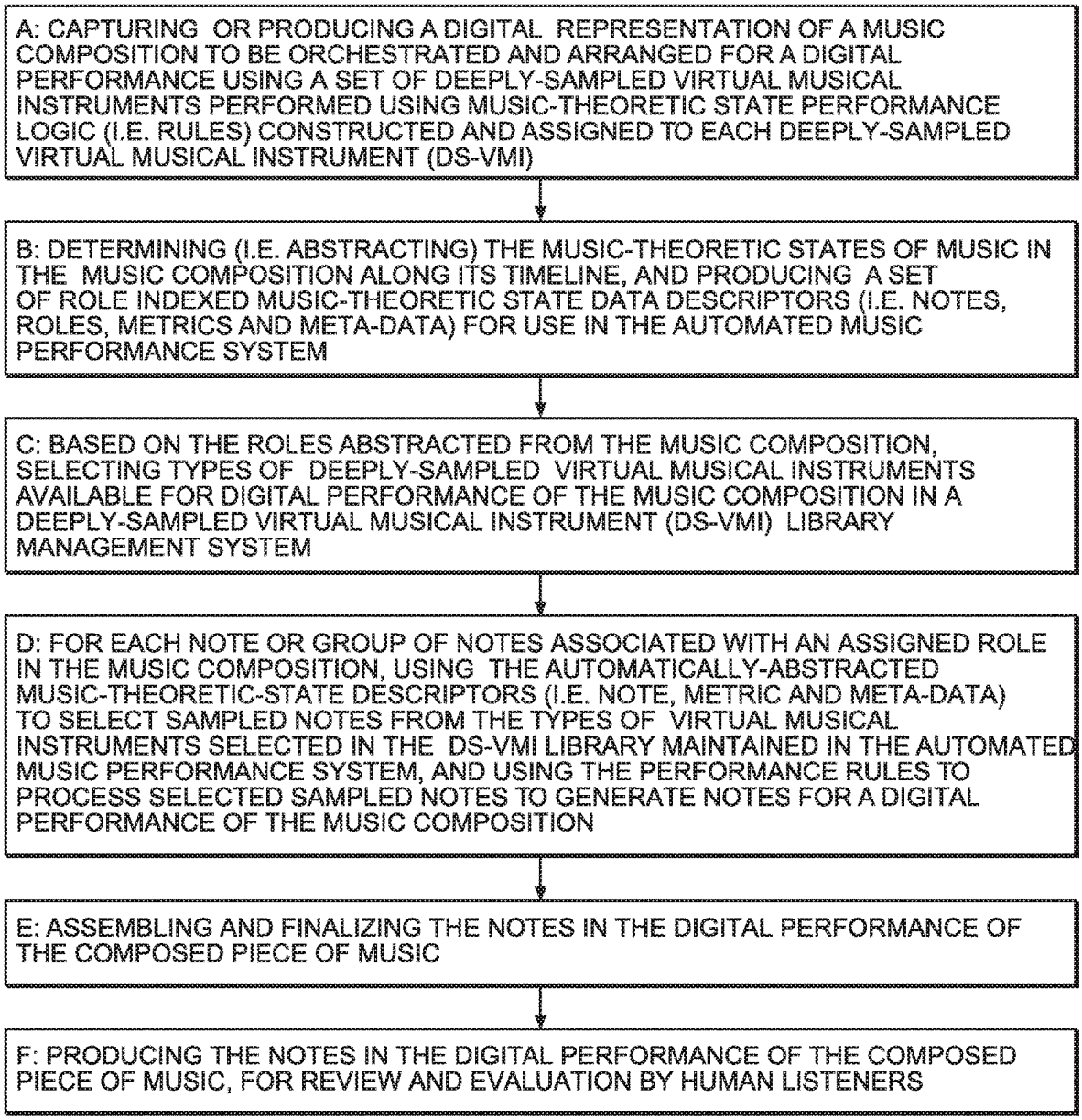
FIG. 21 a flow chart describing method of automated selection and performance of notes in deeply-sampled virtual instrument libraries to generate a digital performance of a composed piece of music, comprising the steps of (a) capturing or producing a digital representation of a music composition to be orchestrated and arranged for a digital performance using a set of deeply-sampled virtual musical instruments performed using music-theoretic state performance logic (i.e. rules) constructed and assigned to each deeply-sampled virtual musical instrument (DS-VMI), (b) determining (i.e. abstracting) the music-theoretic states of music in the music composition along its timeline, and producing a set of timeline-indexed music-theoretic state descriptor data (i.e. roles, notes, metrics and meta-data) for use in the automated music performance system, (c) based on the roles abstracted from the music composition, selecting types of deeply-sampled virtual musical instruments available for digital performance of the music composition in a deeply-sampled virtual musical instrument (DS-VMI) library management system, (d) for each note or group of notes along the timeline of the music composition, using the automatically-abstracted music-theoretic-state descriptors (i.e. music composition meta-data) to select sampled notes from a deeply-sampled virtual musical instrument library maintained in the automated music performance system, and using the music-theoretic state responsive performance rules to process the selected sampled notes to generate notes for a digital performance of the music composition; (e) assembling and finalizing the notes in the digital performance of the music composition; and (f) producing the notes in the digital performance of the music composition, for review and evaluation by human listeners.

Specification of the Method of Automated Selection and Performance of Notes in Deeply-Sampled Virtual Instrument Libraries to Generate a Digital Performance of a Music Composition FIG. 21 describes a method of automated selection and performance of notes in deeply-sampled virtual instrument libraries to generate a digital performance of a composed piece of music using the system shown in FIG. 17. As shown in FIG. 21, the method comprises the steps of: (a) capturing or producing a digital representation of a music composition to be orchestrated and arranged for a digital performance using a set of deeply-sampled virtual musical instruments performed using music-theoretic state performance logic (i.e. rules) constructed and assigned to each deeply-sampled virtual musical instrument (DS-VMI); (b) determining (i.e. abstracting) the music-theoretic states of music in the music composition along its timeline, and producing a set of timeline-indexed music-theoretic state descriptor data (i.e. roles, notes, metrics and meta-data) for use in the automated music performance system; (c) based on the roles abstracted from the music composition, selecting types of deeply-sampled virtual musical instruments available for digital performance of the music composition in a deeply-sampled virtual musical instrument (DS-VMI) library management system; (d) for each note or group of notes along the timeline of the music composition, using the automatically-abstracted music-theoretic-state descriptors (i.e. music composition meta-data) to select sampled notes from a deeply-sampled virtual musical instrument library maintained in the automated music performance system, and using the music-theoretic state responsive performance rules to process the selected sampled notes to generate notes for a digital performance of the music composition; (e) assembling and finalizing the processed sampled notes in the digital performance of the music composition; and (f) producing the performed sampled notes in the digital performance of the music composition, for review and evaluation by human listeners.

Figure 22:
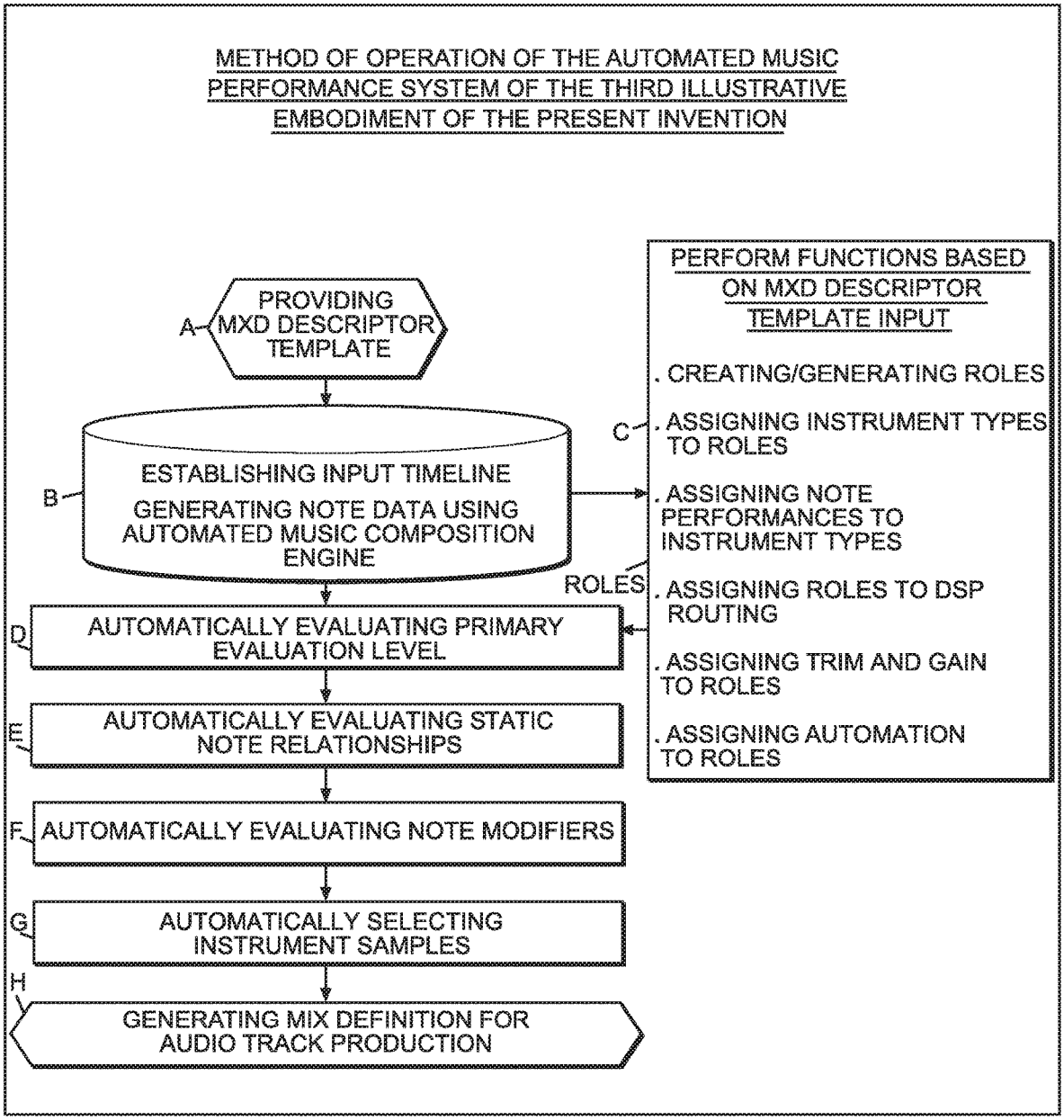
FIG. 22 is a flow chart specification of the method of operation of the automated music performance system of the first illustrative embodiment of the present invention, shown in FIGS. 17 through 21.

Method of Operation of the Automated Music Performance System of the Third Illustrative Embodiment of the Present Invention FIG. 22 describes the method of operation of the automated music performance system of the first illustrative embodiment of the present invention, shown in FIGS. 17 through 21.

As shown at Block A in FIG. 22, the method involves providing a musical experience descriptor (MEX) template containing input MEX descriptor data to an automated music composition engine of the present invention.

As shown at Block B in FIG. 22, the method involves establishing an input timeline and generating note data for a music composition automatically generated using the automated music composition engine provided with the MEX descriptor template data input.

As shown at Block C in FIG. 22, the method involves performing the following functions by evaluating the note data generated at Block B, namely: (a) creating/generating Roles for specific groups of notes; (b) assigning Instrument Types to the Roles; (c) Assigning Note Performances to Instrument Types; (d) Assigning Roles to DSP routing; (e) Assigning Trim and Gain to Roles; and (f) Assigning Automation Logic to Roles.

FIG. 23 shows a set of music-theoretic state descriptors (e.g. parameters) that are automatically evaluated at Blocks C, D, E, F and G (for a given music composition) by the automated music performance subsystem of the present invention so as to (i) automatically select at least one Instrument Type for each Role abstracted from the automated music composition analysis, and also (ii) automatically select and sample the sound sample files (e.g. sampled notes) for the selected Instrument Type that is represented in and supported by the deeply-sampled virtual musical instrument library (DS-VMI) subsystem of the present invention.

As shown at Block D in FIG. 22, the method involves automatically evaluating the Primary Evaluation Level parameters specified in FIG. 23.

As shown at Block E in FIG. 22, the method involves automatically evaluating Static Note Relationships as specified in FIG. 23

As shown at Block F in FIG. 22, the method involves automatically evaluating Note Modifiers as specified in FIG. 23

As shown at Block G in FIG. 22, the method involves automatically selecting Instrument Samples based on the Instrument Selection parameters specified in FIG. 23.

As shown at Block H in FIG. 22, the method involves automatically generating a mix definition for the audio track production for the final digital performance of the automated music composition generated within the system.

Music-Theoretic State Descriptors Automatically Evaluated by the Automated Music Performance System of the Third Illustrative Embodiment During Automated Selection of Musical Instruments and Sampled Notes During Each Digital Performance FIG. 23 describes a set of music-theoretic state descriptors (e.g. parameters) that are automatically evaluated within each music-theoretic state descriptor file (for a given music composition) by the automated music performance subsystem of the present invention deployed in the system of FIG. 17, so as to (i) automatically select at least one instrument for each Role abstracted from the music composition, and also (ii) automatically select and sample the sound files (e.g. sampled notes) for the selected instrument type represented in and supported by the deeply-sampled virtual musical instrument library (DS-VMI) subsystem of the present invention.

The function of DS-VMI behavior-sample choosing supported by the automated DS-VMI Selection and Performance Subsystem shown in FIG. 17 involves automated evaluation of all of the Role-indexed/organized note data, music metric data, and music meta-data collected during automated analysis of the music composition to be digitally performed. In the preferred embodiment, this automated intelligent evaluation of music state data associated with any given music composition to be digitally performed will be realized using the rich set of instrument performance rules (i.e. performance logic) written and deployed within each DS-VMI Library supported within the automated music performance engine of the present invention.

When carrying out this automated data evaluation process, for the purpose of automatically selecting/choosing instrument types and sampled notes and appropriate sample note processing, the music-theoretic state data descriptor file schematically depicted in FIG. 39 will be supplied as subsystem input, the Automated DS-VMI Selection and Performance Subsystem and the Automated Virtual Musical Instrument Contracting Subsystem of FIG. 17 will (i) review each Performance Rule in the DS-VMI Library and (ii) check the music data states reflected in the input music-theoretic data descriptor file depicted in FIG. 39 to automatically determine Instrument Performance Rules (i.e. Logic) to execute in order to generate the rendered notes of a digital music performance to be produced from the automated music performance subsystem. This data evaluation process will be carried out in a syllogistic manner, to determine when and where "If X, then Y" performance rule conditions are satisfied and instrument and note selections should be made in a real-time manner. Below are the various levels of data evaluation performed by this intelligent process within the automated music performance system during automated instrument and note selection and modification.

1. Primary Evaluation Level—this is the initial level by which DS-VMI system starts the evaluation of notes.
   a. Rhythmic density by tempo—Initial step to determine selections of behavior and articulation types based on how dense the notes are in a given tempo. For example if
   b. tempo was at 140 and $16^{th}$ notes were detected performances of a shaker may ignore every other $16^{th}$ note, or choose a sample set that can articulate fast enough to perform those samples.
   c. Duration of notes—how long each rhythmic assignment should hold out (sustain) for, important for determining release samples, intestinal samples, guitar string relationships, etc.
   d. MIDI note value—the pitch assignments of the duration of notes
   e. Dynamics—at what velocity to play the note at (select the correct timbre/volume of a sample)
2. Static Note Relationships—this is the process of analyzing where the notes come in relation to time and space
   a. Position of notes in a chord—where the note is in relation to the root, third, fifth, etc.
   b. Meter and position of strong and weak beats—determine if compound or simple meter, where the strong and weak beats are
   c. Position of notes in a measure—determine where the notes are in relation to the strong and weak beats based on meter
   d. Position of notes in a phrase—determine where the notes are in relation to a phrase (a group of measures)
   e. Position of notes in a section—determine where the notes are in relation to a section (a group of phrases)
   f. Position of notes in a region—determine where the notes are in relation to a region (a group of sections)
3. Situational Relationship—this establishes the modifiers (behaviors of an instrument) that allow for alternate sample selections (hit vs rim-shot, staccato vs spiccato, etc.)
   a. MIDI note value precedence and antecedence—evaluate what notes come before and after the current note and choose to alter the sample selection with a difference behavior type
   b. Position or existence of notes from other roles—determine the other notes written in other instrument parts (roles) and alter sample selection (or don't play) ex: instruments are snare, kick and hi-hat, if kick is playing don't play the snare hit sample and only play a closed rim hit on the hi-hat
   c. Relation of sections to each other—evaluate what has been played before in a previous section and either copy or alter the sample selection.
   d. Accents—evaluate any system-wide musical accents and alter samples (velocity or sample selection) based on this modifier.
   e. Timing based rhythms—based on 1.a resolve any samples that may not be able to perform the rhythms properly and choose an approved sample set, or not play.
4. Instrument Selection—this is the actual sample bank that makes up a selected instrument. Note that the Instruments are assigned to the Role before notes are sent from the above automated evaluation stage. This stage in the process allows the system to be aware of the instruments chosen and to make sample behavior modifications as instruments are added or taken away.
   a. What instruments are available—all instruments that exist in a "band"—different notes may be sent to other instruments if some instruments don't exist so important parts are covered, this can change register of the instrument as well as sample selection
   b. What instruments are playing—all instruments that are playing, this determines if certain instruments should not play, not play as much, or play the same as another instrument
   c. What instruments should/might play—all the instruments available that are not playing, but could help double another instrument.

Figure 24:
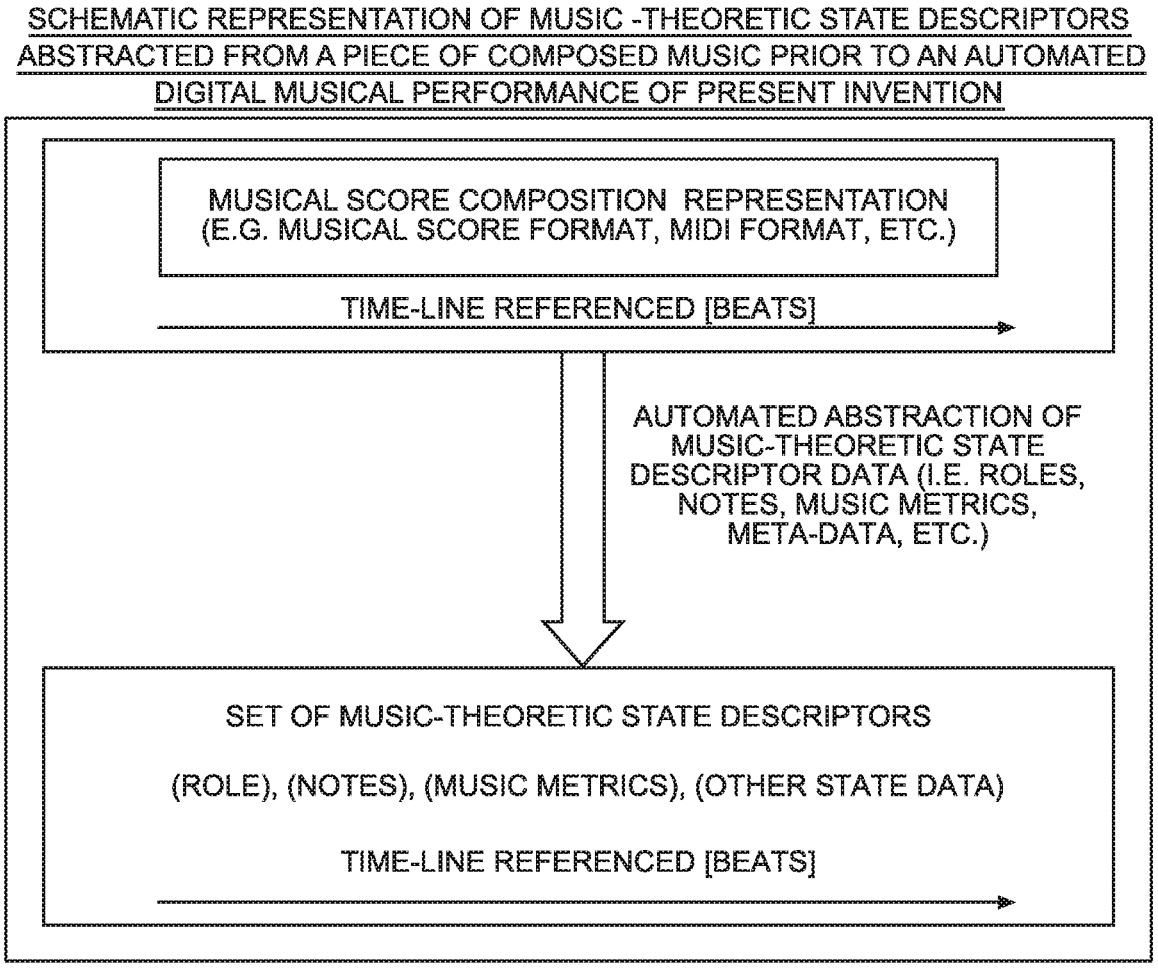
FIG. 24 is a schematic representation of the process of automatically abstracting music-theoretic states as well as note data from a music composition to be digitally performed by the system of the present invention, and automatically producing music-theoretic state descriptor data (i.e. music composition meta-data) along the timeline of the music composition, for use in driving the automated music performance system of the present invention.
Figure 25:
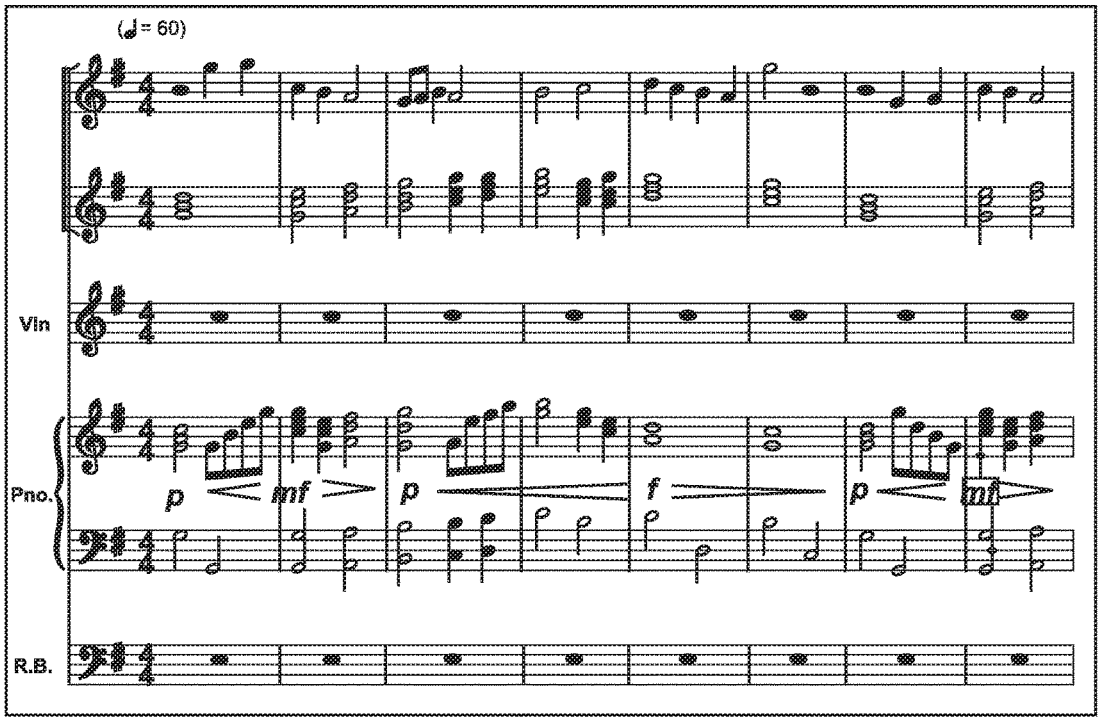
FIG. 25 is a schematic representation of an exemplary sheet-type music composition to be digitally performed by a digital musical performance performed using deeply-sampled virtual musical instruments supported by the automated music performance system of the present invention.

Specification of the Generalized Method of Automatically Abstracting Music-Theoretic State Descriptors, Including Roles, Notes, Music Metrics and Meta-Data, from a Piece of Composed Music Prior to Submission to the Automated Digital Music Performance System of the Present Invention FIG. 24 describes the process of automatically abstracting music-theoretic states, including Roles, Note data, Music Metrics and Meta-Data, from a music composition to be digitally performed by the system of the present invention, and automatically producing music-theoretic state descriptor data along the timeline of the music composition, for use in driving the automated music performance system of the present invention.

The steps involved in this process will depend on the particular format of the music composition requiring automated music-theoretic note and state analysis, as taught herein and illustrated throughout the Drawings and Specification. In the three illustrative system embodiments, slightly different methods will be employed to accommodate the different formats of music composition under automated analysis. However, each music composition under automated analysis will typically employ similar methods to automatically abstract time-indexed note data, music metrics, and meta-data contained in the music composition, all of which is preferably organized under abstracted Musical Roles (or Parts) to be performed by selected Virtual Musical Instruments (or MIDI-controlled Real Musical Instruments MIDI-RMI) during an automated digital music performance of the analyzed music composition. The details of each of these music composition analysis methods, constructed in accordance with the illustrative embodiments of the present invention, will be described in detail below.

Method of Generating a Music-Theoretic State Descriptor Representation for a Sheet-Type Music Composition to be Used in the Automated Music Performance System During Selection, Assembling and Performance of Sampled Notes from Deeply-Sampled Virtual Musical Instruments Supported by the Automated Music Performance System of the Present Invention FIGS. 25 through 29 describes a method of automatically processing a sheet-type music composition file provided as input in a conventional music notation format, determining the music-theoretic states thereof including notes, music metrics and meta-data organized by Roles automatically abstracted from the music composition, and generating a music-theoretic state descriptor data file containing time-line-indexed note data, music metrics and meta-data organized by Roles (and arranged in data lanes) for use with the automated music performance system of present invention.

Figure 26:
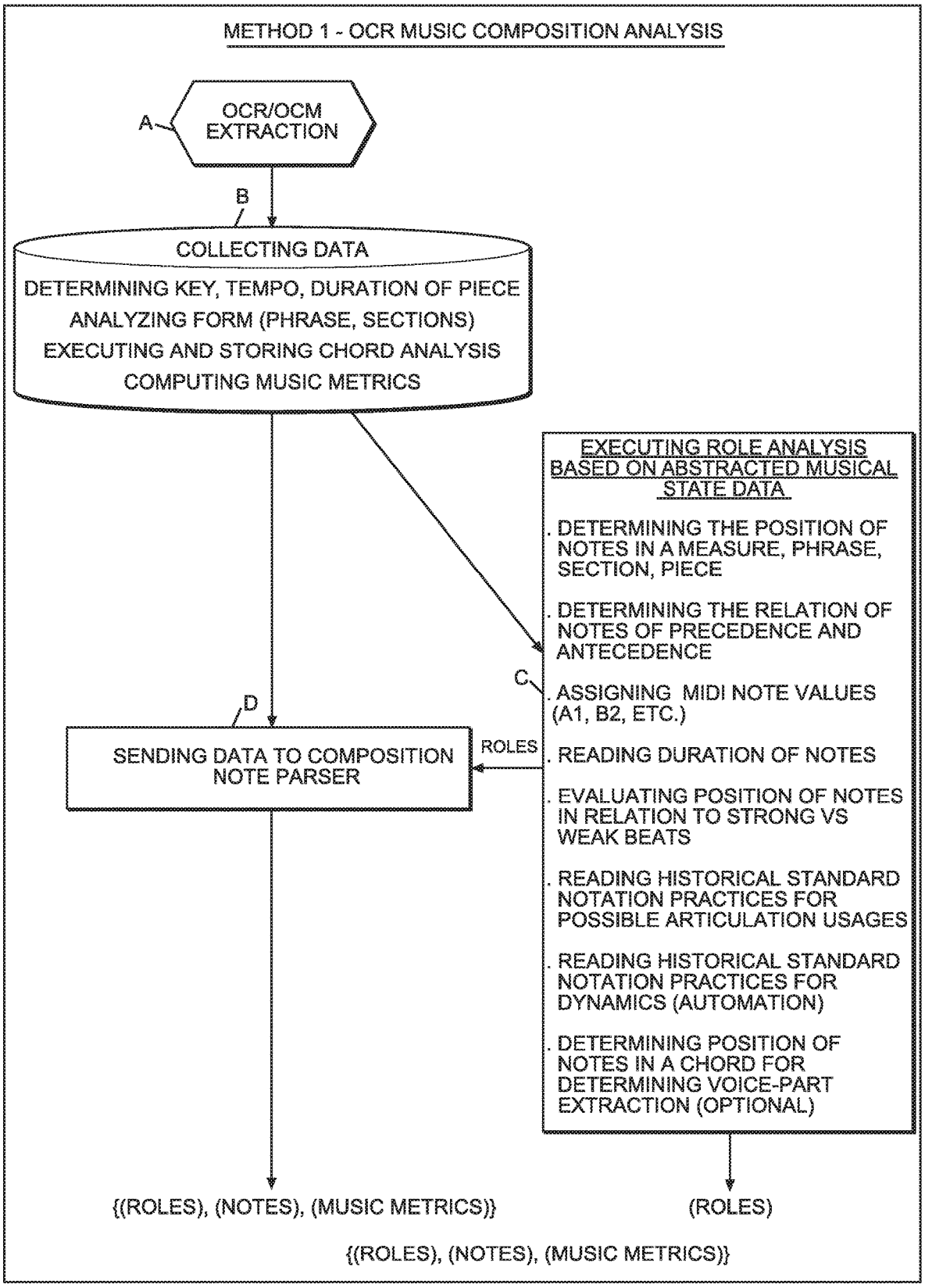
FIG. 26 is a schematic illustration of the automated OCR-based music composition analysis method adapted for use with the automated music performance system of the first illustrative embodiment, and designed for processing sheet-music-type music compositions, executing Roles to extracted musical parts (e.g., Background Role to piano, pedal role to bass), and How many instruments are available.

FIG. 26 describes the automated OCR-based music composition analysis method adapted for use with the automated music performance system of the first illustrative embodiment, and designed for processing sheet-music-type music compositions, showing the bed, play bass, etc.), and How many instruments are available.

As shown at Block A in FIG. 26, the process involves receiving a piece of sheet-type music composition input and OCR/OCM processing the file to abstract and collect music state data including note data, music state data and meta-data abstracted from the music composition file to be digitally performed.

At Block B in FIG. 26, the method involves (a) analyzing the key, tempo and duration of the piece, (b) analyzing the form of phrases and sections, (c) executing and shorting chord analysis, and (d) computing music metrics based on the parameters specified in FIG. 27, and described hereinabove.

Figure 26A:
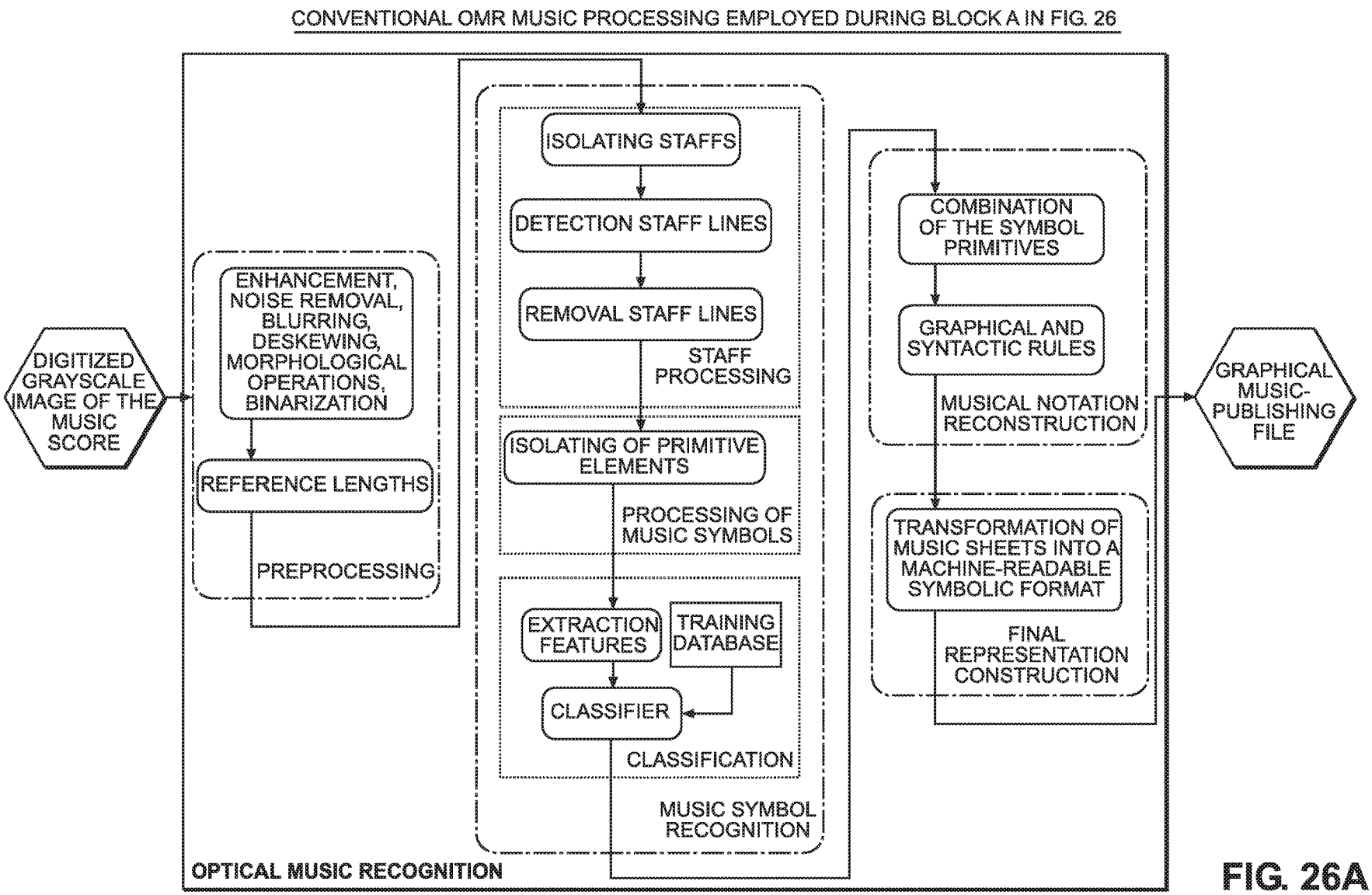
FIG. 26A is a block diagram describing conventional process steps that can be performed when carrying out Block A in FIG. 26 to automatically read and recognition music composition and performance notation graphically expressed on conventional sheet-type music engraved by hand or printed by computer software based music notation systems.

In FIG. 26A, there is shown a basic processing flow chart for any conventional OCR music composition algorithm designed to reconstruct the musical notation for any OCR scanned music composition in sheet music format (i.e. sheet music composition). Under the Music Notation Reconstruction Block in FIG. 26A, there is a "Music-Theoretic State" Data Abstraction Stage which supports and performs the data recognition and abstraction functions described in FIG. 27.

As shown at Block C in FIG. 26, the method involves abstracting Roles from analyzed music-theoretic state data As shown at Block D in FIG. 26, the method involves parsing note data based on Roles abstracted from the music composition, and sending this data to the output of the music composition analyzer.

FIG. 27 specifies all music-theoretic state descriptors that might be automatically abstracted/determined from any automatically-analyzed music composition during the pre-processing stage of the automated music performance process of the present invention. The exemplary set of music-theoretic state descriptors shown in FIG. 27 include, but are not limited to: Rhythmic Density by Tempo; Duration of Notes; MIDI Note Value (A1, B2, etc.), Dynamics; Static Note Relations, such as, Position of Notes in a Chord, Meter and Position of Strong and Weak Notes, Position of Notes in a Measure, Position of Notes in a Phrase, Position of Notes in a Section, Position of Notes in a Region; Situational Relationships such as MIDI Note Value Precedence and Antecedence, Position or Existence of Notes from other Instruments Lanes, Relation of Sections to Each Other, Note Modifiers (Accents); Instrument Specification, such as, What Instruments are Playing, What Instruments Should or Might Be Played, Position of Notes from Other Instruments, Meter and Position of Downbeats and Beats, Tempo Based Rhythms, What Instruments are assigned to a role (e.g. Play in background, play as a bed, play bass, etc.), and How many instruments are available.

In accordance with the principles of the present invention, all deeply-sampled virtual musical instruments in the DS-VMI library management subsystem are provided with some level of intelligent performance control via coding (aka sample selection/playback) written as performance logic for them, whether it's a simple "Hit" of a Snare or the complex "Strum" of a Guitar. The performance dictates what sample to trigger and how to trigger with note, velocity, manual, automation, and articulation information. To reiterate: the composer writes out the notes in the music composition, and when to play those notes, and then the automated music performance system adapts those notes on how to playback those samples.

In order to make a deeply-sampled virtual musical instrument (DS-VMI) sound realistic, the automated music performance system does not need to interpret a direct note-for-note playback, but rather is capable of calling many instruments and extrapolating sampled note information to choose a correct sample playback at any instant in time. For instance, if the composer says play a G chord on a downbeat, then a possible performance written for the guitar might be to build the chord as "E1 String: $3^{rd}$ fret (G), A1 String: $2^{nd}$ Fret (B), D2 String: Open (D), G2 String: Open (G), B2 String: Open (B), E3 String: $3^{rd}$ fret (G)". Then select the samples based on each separately recorded string, set a velocity range to trigger in, modifier type: Open (choices: Mute, Dead or Open) which strum direction: Down (choices: up or down). The samples would be requested and played in the audio engine, and then a timing differential would be added between each string to make the performance of the chord occur on the downbeat. If there was a G on the next beat, then the automated music performance system would play the same configuration, but may choose the up sample sets and start from the top E3 string, down through to the E1 string.

Each virtual musical instrument in the automated music performance system has a specific instrument performance logic (i.e. "a Performance) based on its parent template. Notably, Performances are actually set to Instruments specifically, and can be applied in batches based on their template/instrument_type association.

Some musical instruments could have one performance assigned, or have hundreds of performances assigned. Each performance adds dimensionality to an instrument's capabilities. The automated music performance system of the present invention interprets what the music composition contains in terms of its full music-theoretic states of music, along its entire timeline. The music composition contains chords and/or notes with timing information in them. To support its contextual-awareness capacities, the automated music performance system includes automated music-theoretic state abstraction processing algorithm(s) which automatically analyze what those notes are in the music composition to be digitally performed, and formulas can be used around these notes to help determine a playback scheme for triggering the samples through an audio mixing engine supported within the automated music performance system.

As will be described in greater detail hereinafter, a human or machine composer transmits a music composition to be digitally performed to the automated music performance system of the present invention. The music composition containing note data is automatically analyzed by the system to generate music-theoretic state data (i.e. music composition meta-data) such as: roles, note data, music metric data such as the position of notes within a song structure (chorus, verse, etc.), mode/key, chords, notes and their position within a measure, how long the notes are held (note duration) and when they are performed, and other forms of music composition meta-data.

By analyzing the music composition, the automated music performance system automatically abstracts and organizes collected note data, music metric data, music composition meta-data within an enveloped assigned an abstracted Musical Role (or Part), so as to inform the automated music performance system of the notes and possible music-theoretic states contained in the music composition such as, for example:

Duration of Notes:

1. Duration can tell what type of sample to trigger at the end of a sample (i.e. short releases).
2. Duration can also have several overriding parameters that can modify the note duration to either create a shorter (staccato-like) or longer (legato-like) performance.
3. Duration also allows for behavior types of monophonic instruments for portamento type/glide type.
4. Duration is also aware of any type of downbeat offset and how to manipulate the release of a performance based on when the start of the note is triggered vs when the note is perceived as the "downbeat"

Position of Notes in Time:

The performance tool can isolate where items are within 3 levels of granularity. Measure, Phrase, and Section. The composer creates music measure by measure, assembles those measures into phrases and then the phrases belong to sections. The performance system uses the positions of notes to determine a velocity, articulation choice, or a manual switch. These are chosen through deterministic, stochastic, or purely random methods/algorithms.

Position of Notes in a Chord:

When a composer sends out a chord to a specific deeply-sampled virtual musical instrument, the automated music performance system can isolate a note performance based on what notes can be assigned to the deeply-sampled virtual musical instrument. Understanding the note relationship within the chord allows the automated music performance system, with its music-theoretic state responsive performance rules, to automatically process and change specific tuning to a sample, a velocity change, how the chord should be voiced, which string to play, or even what note in the chord to play (if it's a monophonic virtual musical instrument). Assigned Instrument Roles can help orchestration decisions.

Note Modifiers:

Accents: This is an extra layer of data that is written from the composer to unify a layer of accents (or strong-beat) control that allow for sample selection on quick dynamic changes (on single beats). For example switching from a regular stick-hit on a snare to a rim-shot, or changing the velocity of a piano from mf to ff.

Dynamics:

Dynamics, with regards to sample selection, can request playback, where to blend the two sample sets together, as well as different recorded sampled manuals. For example: Violins at ppp may select a "con sordino" (or with-mute) sample set. Or when moving from pp to p on a piano —start blending two samples together to create the timbral shift. Dynamics can also inform control data explained further below.

Note Value Precedence and Antecedence:

Equipped with music-theoretic state descriptor data streams and logical performance rules assigned to deeply-sampled virtual musical instruments libraries, the automated music performance system of the present invention is provided with an artificial intelligence and awareness of notes that come before and come after any given note along the timeline of a music composition being digitally performed using the DS-VMI libraries. This capacity helps inform the automated music performance system when to switch between articulations of sampled notes, as well as when to use legato, perform a note-off release, then a note on (repeated round robin), or when to choose a transition effect. For example, moving from a higher hand-shape on a guitar to a lower hand shape, the automated music performance system can then insert the transition effect of "finger noise-down by middle distance."

Instrumentation Awareness:

Role: When an instrument is assigned into a Role, this allows for other instruments to know that instruments importance, where it fits within the structure of note assignments, performance assignment, and what sample sets that should be chosen. For example, if a string part is assigned a fast, articulated performance, the sample set chosen would be short note recordings. Examples of Roles are specified in FIG. 28

Availability: Knowing what instruments are available as to assign instrument performances to more valuable and important roles. For example, when two guitars are assigned, one takes a lead, mono role, while the other supports rhythm. When only one guitar is selected, which role is more important and move to that role (or move between the two based on material type (song structure location).

What is playing: This is being aware of which other instruments are playing which Roles helps to determine range, volume and activity level assigned to an instrument performance.

Physical Limitations: "The four handed drummer" problem—Limiting the voices based on physical constraints of the instrument, while allowing the users to select more than one-type of item. For example, if there are 4 cymbals, 1 hi-hat, 1 snare, and 4 toms and a kick: if there is a fill in a drum part, don't play more than 2 "hand hits" and 2 "foot hits" at one time.

Position of Notes from other Notes: This allows for complicated and orchestration decisions based on available notes, what other instruments are playing those notes, position in Role type and importance of that Role.

Structural Awareness:

Relation of Sections: Similar to how notes within a section are selected, knowing which sections have happened and what permutation of a section you are in can inform sample changes, such as dynamic shifts, moving from a type of articulation to another type. For example, switching from the first verse to the second, you would have the piano play "pedal" on the first verse, but maybe be drier or heavier on the second verse and play "regular" or "without pedal".

Meter and position of Downbeats and Beats: Similar to how samples are selected from an accent lane, knowing what meter, where the strong vs weak beats are and the relation with in a part of a phrase will determine what sample could be selected.

Tempo:

Having knowledge of the music-theoretic parameter, Tempo, of the music composition can enable the automated music performance system of the present invention to automatically switch sample sets that are based on length or agility. Knowledge of Tempo can also help determine note cut-off and secondary note cut-off performances.

Each instrument assigned to a Role abstracted from the music composition to be digitally performed becomes an "instrument assignment." This assignment is then given a mixing algorithm with a set of controllable DSPs (from volume to filters, reverb, etc.). These algorithms are written with the same parameters as the sample selections—but happen on an "instrument assignment" (also known as a "instrument_type") level, not on the specific sample set or instruments. The instrument assignment becomes an audio bus, which allows for any specific instrument, within the assignment constraints, to be swapped out with a similar instrument type. For example, when a grand piano is being used and the user wants to swap it out with an upright piano, that assignment would stay the same—using all the same DSP and mixing algorithms. Finally all these assignments (that have become busses) are assigned to a master mixing bus and are delivered to users as either stems (each buss individually) or a master track.

FIG. 28A describes an exemplary set of Musical Roles or Musical Parts ("Roles") of each music composition to be automatically analyzed by the automated music performance system of the present invention, prior to automatically generating a digital music performance using the deeply-sampled virtual musical instrument (DS-VMI) libraries maintained in accordance with the principles of the present invention. As shown, musical instruments and associated performances can be assigned any of the exemplary Roles listed in the table of FIG. 28. It is understood that others skilled in the art will coin or define other Roles for the purposes of practicing the system and methods of the present invention. In general, a single role is assigned to an instrument, and multiple roles cannot be assigned to a single instrument. However, multiple instruments can be assigned to a single role.

As shown in FIG. 28A, Accent—is a Role assigned to note that provide information on when large musical accents should be played; Back Beat—is a Role that provides note data that happen on the weaker beats of a piece; Background—is a lower density role, assigned to notes that often are the lowest energy and density that lives in the background of a composition; Big Hit—a Role assigned to notes that happen outside of any measurement, usually a singular note that happens rarely; Color—is a Role reserved for small musical segments that play semi-regular but add small musical phrases throughout a piece; Consistent—is a Role that is reserved for parts that live outside of the normal structure of phrase; Constant—is a Role that is often monophonic and has constant set of notes of the same value (e.g.: all 8th notes played consecutively); Decoration—is a Role similar to Color, but this role is reserved for a small flourish of notes that happens less regularly than color; High Lane—is a Role assigned to very active and high-note density, usually reserved for percussion; High-Mid Lane—is a Role assigned to mostly active and medium-note density, usually reserved for percussion; Low Lane—is a Role assigned to low active, low note-density instrument, usually reserved for percussion; Low-Mid Lane—is a Role assigned to mostly low activity, mostly low note-density instrument, usually reserved for percussion; Middle—is a Role assigned to middle activity, above the background Role, but not primary or secondary information; On Beat—is a Role assigned to notes that happen on strong beats; Pad—a Role assigned to long held notes that play at every chord change; Pedal—Long held notes, that hold the same note throughout a section; Primary—is Role that is the "lead" or main melodic part; Secondary—is a Role that is secondary to the "lead" part, often the counterpoint to the Primary role; Drum set Roles: (this is a single performer that has multiple instruments which are assigned multiple roles that are aware of each other), Hi-Hat—is a Drum set Role that does hi-hat notes, Snare—Drum set role that does snare notes, Cymbal—is Drum set Role of that does either a crash or a ride, Tom—Drum set role that does the tom parts, and Kick—is a Drum set Role that does kick notes.

Specification of Role Assignment Rules/Principles of the Present Invention

FIGS. 28B1 through 28B8 provide a set of exemplary Rules for use during the automated role assignment processes carried out by within the automated music performance system of the first illustrative embodiment of the present invention.

The following describes an exemplary way of assigning Roles to Notes, roles to Instrument Types and roles to Instrument Performance logic (i.e. Role Assignments) across the various stages of the automated music performance system of the present invention.

Roles are a way of organizing notes along a timeline that are sent to assigned Instrument Types to be handled by the Instrument Performance Logic which will select the correct samples for playback in the production of a musical piece.

Instruments and Performance Logic (Rules) are all labeled (tagged) with data that allow for rulesets to choose the appropriate Instrument/Performance combination.

With all three types of input (e.g. OCM, MIDI, AMPER), the following rules can be applied to an assigned Instrument Type, and then a specific Sample Instrument would be assigned to the Role Assignment. Each of these Roles can have a many variants of a role, if multiple roles of similar type are needed (e.g. accent.a, accent.b, or accent.1, accent.2, etc.).

Accent Role:

1. Role-to-Note Assignment Rule: If the density of notes are fairly sparse and follow along a consistent strong beat to weak beat periodicity, or/and if several instrument parts have regular periodicity in strong beat groupings, then assign to the Accent Role to these notes.
2. Role-to-Instrument-Type Assignment Rule: Assign the Accent Role to instrument_types reserved for accents, which are typically percussive, (e.g. ".hit( )" aspect value of: aux_perc, big_hit, cymbal, etc.).
3. Role-to-Instrument-Performance-Logic Assignment Rule: Assign the Accent Role to Instrument Performance Logic of other roles by through change in velocity or not play/play notes in current assigned role (ex: augmenting role).

Back Beat Role:

1. Role-to-Note Assignment Rule: If notes have a periodicity of primarily weak beat and that are tonal, then assign to the Back Beat Role to these notes.
2. Role-to-Instrument-Type Assignment Rule: Assign this Role Instrument Types that provide a more rhythmic and percussive tonal performance (mono or polyphonic)
3. Role-to-Instrument-Performance-Logic Assignment Rule: Assign this Role to Instrument Performances (i.e. Instrument Performance Logic/Rules) such as, e.g. acoustic_piano with "triadic chords closed voicing", acoustic_guitar with "up-strum top three strings", etc.

Background Role:

1. Role-to-Note Assignment Rule: If notes have a medium-low density (playing slightly more than once per chord, polytonal), then assign the Background Role to these notes.
2. Role-to-Instrument-Type Assignment Rule: Assign the Background Role to instrument types that can support polyphonic (note) performances.
3. Role-to-Performance-Logic Assignment Rule: Play polyphonic chords or parts of chords in instrument types (e.g. keyboard, acoustic_piano, synth_strings, etc.)

Big Hit Role:

1. Role-to-Note Assignment Rule: If notes happen with extreme irregularity and are very sparse, and/or either fall with a note in the accent lane or outside of any time signature, then assign the Big Hit Role to these notes.

2. Role-to-Instrument-Type Assignment Rule: Assign this role instrument type primarily to single hit, non-tonal, percussive instruments 3. Role-to-Instrument-Performance-Logic Assignment Rule: Performance Logic is play a "hit( )" in the assigned instrument type (e.g. big_hit, bass_drum, etc.)

Color Role:

1. Role-to-Note Assignment Rule: If notes happen in small clusters, with rests between each set of clusters, and have some regular periodicity less than once per phrase, then assign the Color role to these notes.

2. Role-to-Instrument-Type Assignment Rule: Assign the Color Role to instrument types that are either percussive (if notes are unpitched) or tonal (if notes follow pitches within the key) and can be assigned to typically monophonic or instruments with harmonic/rhythmic tags (e.g. instruments with delay tag, tickies, synth_lead, etc.)

3. Role-to-Instrument-Performance-Logic Assignment Rule: May assign performances that are softer in velocity or lighter in articulation attack.

Consistent Role:

1. Role-to-Note Assignment Rule: If notes are relatively dense, have some periodicity, and change in either note pattern organization, rhythmic pattern organization more than once per a few bars, then assign the Consistent Role to these notes.

2. Role-to-Instrument-Type Assignment Rule: Assign the Color Role to instrument types that have typically monophonic performances (e.g. synth_lead, guitar_lead).

3. Role-to-Instrument-Performance-Logic Assignment Rule: May assign performances that utilize various arpeggiation patterns (e.g. line up/down, sawtooth, etc.)

Constant Role:

1. Role-to-Note Assignment Rule: If notes that are relatively dense, and have very static rhythmic information with periodicity, then assign the Constant Role to these notes.

2. Role-to-Instrument-Type Assignment Rule: Assign the Constant Role to either tonal (monophonic) or percussive instrument types.

3. Role-to-Instrument-Performance-Logic Assignment Rule: Assign the Constant Role to Instrument Performances that are tempo dependent (e.g. shaker with "front( )" only, synth_lead with "arpeggiation up", etc.).

Decoration Role:

1. Role-to-Note Assignment Rule: If notes happen in small clusters, with rests between each set of clusters, and occur one per phrase or longer, then assign the Decoration role to these notes.

2. Role-to-Instrument-Type Assignment Rule: Assign the Decoration Role to instrument types that are either percussive (if notes are unpitched) or tonal (if notes follow pitches within the key) and can be assigned to typically monophonic or instruments with harmonic/rhythmic tags (e.g. instruments with delay tag, tickies, synth_lead, etc.)

3. Role-to-Instrument-Performance-Logic Assignment Rule: May assign performances that are softer in velocity or lighter in articulation attack.

High Lane Role:

1. Role-to-Note Assignment Rule: If notes that are unpitched that happen in usually rapid succession or high density, then assign the High Lane Role to these notes.

2. Role-to-Instrument-Type Assignment Rule: Unless otherwise directed by an external input, usually assign the High Lane Role to high-pitched in timbre percussion instruments (e.g. tickies, shakers, aux_drum ("rim"), etc.)

3. Role-to-Instrument-Performance-Logic Assignment Rule: Choose performances that activate articulations that are tagged with "high" and/or "short"

High-Mid Lane Role:

1. Role-to-Note Assignment Rule: If notes that are unpitched that happen in medium-high density, then assign the High-Mid Lane Role to these notes.

2. Role-to-Instrument-Type Assignment Rule: Unless otherwise directed by an external input, usually assign this Role to high-pitched or medium in timbre percussion instruments (e.g. tickies, aux_drum, hand_drum, etc.)

3. Role-to-Instrument-Performance-Logic Assignment Rule:

Choose performances that activate articulations that are tagged with "middle" and/or "short/medium"

Low-Mid Lane Role:

1. Role-to-Note Assignment Rule: If notes that are unpitched that happen in medium-low density, then assign the Low-Mid Lane Role to these notes.

2. Role-to-Instrument-Type Assignment Rule: Unless otherwise directed by an external input, usually assign this Role to medium to medium-low in timbre percussion instruments (e.g. aux_drum, hand_drum, taiko, etc.)

3. Role-to-Instrument-Performance-Logic Assignment Rule:

Choose performances that activate articulations that are tagged with "middle," "low," and/or "medium/long"

Low Lane Role:

1. Role-to-Note Assignment Rule: Assign the Low Lane Role to notes that are unpitched that happen in low density.

2. Role-to-Instrument-Type Assignment Rule: Unless otherwise directed by an external input, assign this Role usually to instrument types that are low in timbre percussion (e.g. bass_drum, surdo, taiko, etc.)

3. Role-to-Instrument-Performance-Logic Assignment Rule:

Choose performances that activate articulations that are tagged with "low," and/or "long"

Middle Role:

1. Role-to-Note Assignment Rule: If notes have a medium density (playing more than once per chord, polytonal, with occasional running lines), then assign the Middle Role to these notes.

2. Role-to-Instrument-Type Assignment Rule: Typically assign this Role to instrument types that can support polyphonic playback and performance. (e.g. keyboard, acoustic_piano, synth_strings, violins, etc.).

3. Role-to-Instrument-Performance-Logic Assignment Rule: Typically assign this Role to Instrument Performances support polyphonic performance. (e.g. keyboard, acoustic_piano, synth_strings, violins, etc.).

On Beat Role:

1. Role-to-Note Assignment Rule: If notes have a periodicity of primarily strong beat and that are tonal, then assign the On Beat Role to these notes.

2. Role-to-Instrument-Type Assignment Rule: Assign this Role to instrument types that produce more rhythmic and percussive tonal performances (mono or polyphonic)

Role-to-Instrument-Performance-Logic Assignment Rule: Assign this Role to Instrument 3. Performances that have "strong" performance tag association (eg: acoustic_bass "roots with 5ths", acoustic_guitar with "down-strum power chord", etc.)

Pad Role:

1. Role-to-Note Assignment Rule: If notes are sustained through the duration of a chord, then assign the Pad Role to these notes.

2. Role-to-Instrument-Type Assignment Rule: Typically assign this Role to polyphonic instrument types that sustain notes (e.g. mid_pad, synth_string, synth_bass)

3. Role-to-Instrument-Performance-Logic Assignment Rule: Typically assign this Role to Instrument Performances involving polyphonic performances that sustain notes during a chord, and change notes on chord change (e.g. mid_pad, synth_string, synth_bass)

Pedal Role:

1. Role-to-Note Assignment Rule: If notes sustain through chords and stay on one pitch (often the root) of an entire phrase, then assign the Pedal Role to these notes.

2. Role-to-Instrument-Type Assignment Rule: Assign this Role typically to monophonic instrument types such as, e.g. low_pad, synth_bass, pulse, etc.

Role-to-Instrument-Performance-Logic Assignment Rule: Assign this Role Typically to Instrument 3. Performances supporting monophonic performances that either sustain indefinitely, or can quickly reattack consecutively to create a pulse-like pedal tone (e.g. low_pad, synth_bass, pulse, etc.) Primary Role:

1. Role-to-Note Assignment Rule: If notes are mostly monophonic, played with more density, rhythmic structure variances, often with some repetition and periodicity, and are accompanied with either great dynamic markings, high velocities, and/or other indications depending on the medium read, then assign the Primary Role to these notes.

2. Role-to-Instrument-Type Assignment Rule: Assign this Role typically to instrument types often used to perform as lead instruments (e.g. violin, lead_synth, lead_guitar, etc.)

3. Role-to-Instrument-Performance-Logic Assignment Rule: May choose limited polyphonic or monophonic performance, that may utilize a great amount of articulation control and switching.

Secondary Role:

1. Role-to-Note Assignment Rule: If notes are mostly monophonic, play with more density, rhythmic structure variances, often with some repetition and periodicity, and are accompanied with either great dynamic markings, high velocities, are either lower in pitch or play less dense then another part, and/or other indications depending on the medium read, then assign the Secondary Role to these notes.

2. Role-to-Instrument-Type Assignment Rule: Assign this Role to instrument types that often perform as lead instruments (e.g. violin, lead_synth, lead_guitar, etc.)

3. Role-to-Instrument-Performance-Logic Assignment Rule: May choose limited polyphonic or monophonic performance, that may utilizes a great amount of articulation control and switching. Drum Set Roles: These are the roles listed below that are given specific rhythmic parts (non-tonal) that should be assigned to one role-performer, but have to be broken out because the instruments used are naturally separated. Notes will need to be parsed into different roles, and often can be determined by MIDI note pitch, staff position, or rhythmic density.

Hi-Hat Drum Set Role:

1. Role-to-Note Assignment Rule: Assign this Role to often repeated consecutive notes, usually a quarter note or faster.

2. Role-to-Instrument-Type Assignment Rule: This Role may be assigned to instrument types such related to hi-hats.

3. Role-to-Instrument-Performance-Logic Assignment Rule: Depending on density of part, and perceived style, this role will be assigned a specific performance that can determine how to switch all the articulations contained within a hi-hat. (e.g. closed hit with open on 4 and)

Snare Drum Set Role:

1. Role-to-Note Assignment Rule: This Role is often assigned to notes close to or around the weak beats.

2. Role-to-Instrument-Type Assignment Rule: This Role may be assigned to be instrument types related to Snare (stick_snare, brush_snare, synth_snare, etc.).

3. Role-to-Instrument-Performance-Logic Assignment Rule: Depending on density of part, and perceived style, this Role will be assigned a specific performance that can determine how to switch all the articulations contained within a snare drum.

Cymbal Drum Set Role:

1. Role-to-Note Assignment Rule: This Role may be assigned to either repeated consecutive notes (ride) or single notes on downbeats of measures or phrases (crash).

2. Role-to-Instrument-Type Assignment Rule: This Role may be assigned to be instrument types related to Cymbal.

3. Role-to-Instrument-Performance-Logic Assignment Rule: Depending on density of part, and perceived style, the Cymbal Drum set role will be assigned to a specific performance that can determine how to switch all the articulations contained within a Cymbal.

Tom Drum Set Role:

1. Role-to-Note Assignment Rule: This Role may be assigned to clusters of notes that happen at the end of measures, or that are denser, but that are less consistent than Hi-Hat or Cymbal(ride).

2. Role-to-Instrument-Type Assignment Rule: This Role may be assigned to Instrument Types related to a Tom Drum Set.

3. Role-to-Instrument-Performance-Logic Assignment Rule: This role will be assigned to instrument performances based on density and position in measure that will determine which toms play which pitches and when the pitches switch. (e.g. Tom "low pitch only", Tom "low tom with low-mid tom accent")

Kick Drum Set Role:

1. Role-to-Note Assignment Rule: This Role is assigned often to notes close to or around the strong beats.

2. Role-to-Instrument-Type Assignment Rule: The Kick Drum Set Role may be assigned instrument types related to Kick.

3. Role-to-Instrument-Performance-Logic Assignment Rule: The Kick Drum set role may be assigned to instrument performances related to Kick. Depending on density of part, and perceived style, this Role will be assigned a specific performance that can determine how to switch all the articulations contained within a Kick.

As described above, these Role Assignment Rules/Principles are illustrative in nature and will vary from illustrative embodiment to illustrative embodiment, when practicing the present invention.

FIG. 29 provides a specification for the output file structure of the automated music composition analysis stage, containing all music-theoretic state descriptors (including notes, music metrics and meta-data organized by extracted "Roles") that might be automatically abstracted/determined from a sheet-type music composition during the preprocessing state of the automated music performance process of the present invention. As shown, the exemplary set of music-theoretic state descriptors include, but are not limited to, Role or Part of Music (e.g. Accent, Back Beat, Background, Big Hit, Color, Constant, High Lane, Low Lane, etc.) to be performed; MIDI Note Value (A1, B2, etc.), Duration of Notes, and Music Metrics including Position of Notes in a Measure, Position of Notes in a Phrase; Position of Notes in a Section, Position of Notes in a Chord, Note Modifiers (Accents), Dynamics, MIDI Note Value Precedence and Antecedence, What Instruments are Playing, Position of Notes from Other Instruments, Relation of Sections to Each Other, Meter and Position of Downbeats and Beats, Tempo Based Rhythms, What Instruments might be assigned to a Role, based on the automated analysis of the music composition and its recognized notation.

In some ways, this output data file for the pre-analyzed music composition is an augmented music performance notation file that is Role-organized and timeline indexed and contains all of the music state data required for the automated music performance system of the present invention to make intelligent and contextually-aware instrument and note selections and processing operations in real-time, to digitally perform the music composition in a high-quality, deeply expressive and contextually relevant manner, using the instrument performance logic deployed in the innovative DS-VMI Libraries of the present invention. As described hereinabove, this performance logic will typically be expressed in the form of "If X, then Y" performance rules, driven by the music-theoretic states that are captured and reflected in the structure of the music-theoretic state data descriptor file generated for each music composition to be digitally performed. However, this performance logic may be implemented in other ways which will occur to those with ordinary skill in the art.

Using the music-theoretic music composition analysis method of the present invention, each pre-analyzed music composition state descriptor file generated by the process, will embody Role-based note data, music (note) metric data and music-meta data automatically abstracted from the music composition to be digitally performed. Also, each music-theoretic state data descriptor file output from this pre-processor should be capable of driving the automated music performance engine of the present invention, by virtue of the fact that the music-theoretic state descriptor data will logically trigger (and cause to execute) relevant musical instrument performance rules that have been created and assigned to groups of sampled notes/sounds managed in each deeply-sampled virtual musical instrument (DS-VMI) Libraries maintained by the automated music performance system.

When the music-theoretic state data descriptor file, functioning as an augmented music performance notation file, is supplied to the Automated Music Performance Engine of the present invention, the Automated Music Performance Engine automatically analyzes and processes the data file for Roles, Notes, Music Metrics, and Meta-Data contained in the music-theoretic state data descriptor file. If the Automated Music Performance Engine determines that certain Music-Theoretic State Data Descriptors are present in the input music composition/performance file (representative of certain music conditions present in the music composition to be digitally performed), then certain Musical Instrument Performance Rules will be automatically triggered and executed to process and handle particular sampled notes, and corresponding Music Instrument Performance Rules will operate on the notes and generate the processed notes required by the input music composition/performance file being processed by the Automated Music Performance Engine, to produce a unique and expressive musical experience, with a sense of realism hitherto unachievable when using conventional machine-driven music performance engines.

Method of Generating a Music-Theoretic State Descriptor Representation of a MIDI-Type Music Composition for Use in Applying Performance Logic in the Automated Music Performance System and Selecting, Performing and Assembling Sampled Notes from Deeply-Sampled Virtual Musical Instruments Supported by the Automated Music Performance System of the Present Invention FIGS. 30 through 34 describes a method of automatically processing a MIDI-type music composition file provided as input in a conventional MIDI music file format, determining the music-theoretic states thereof including notes, music metrics and meta-data organized by Roles automatically abstracted from the music composition, and generating a music-theoretic state descriptor data file containing timeline-indexed note data, music metrics and meta-data organized by Roles (and arranged in data lanes) for use with the automated music performance system of present invention.

Figure 30:
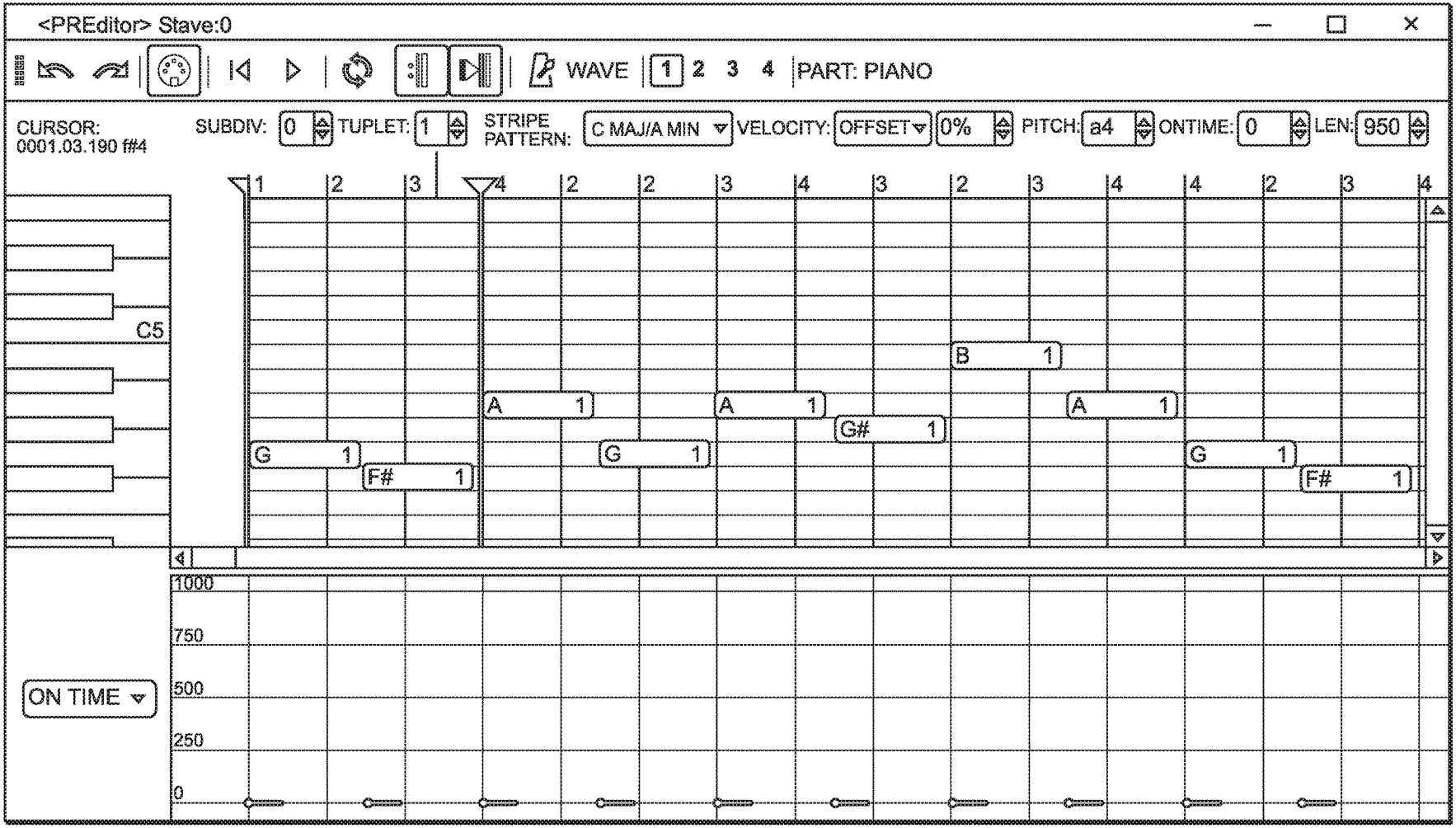
FIG. 30 is a schematic representation of an exemplary Piano Scroll representation of MIDI data in a music composition to be digitally performed by a digital musical performance performed using deeply-sampled virtual musical instruments supported by the automated music performance system of the present invention.

FIG. 30 shows an exemplary MIDI piano roll illustration supported by a MIDI music composition file that can be automatically analyzed by the music composition analysis method of the second illustrative embodiment of the automated music performance system of the present invention shown in FIG. 9.

Figure 31:
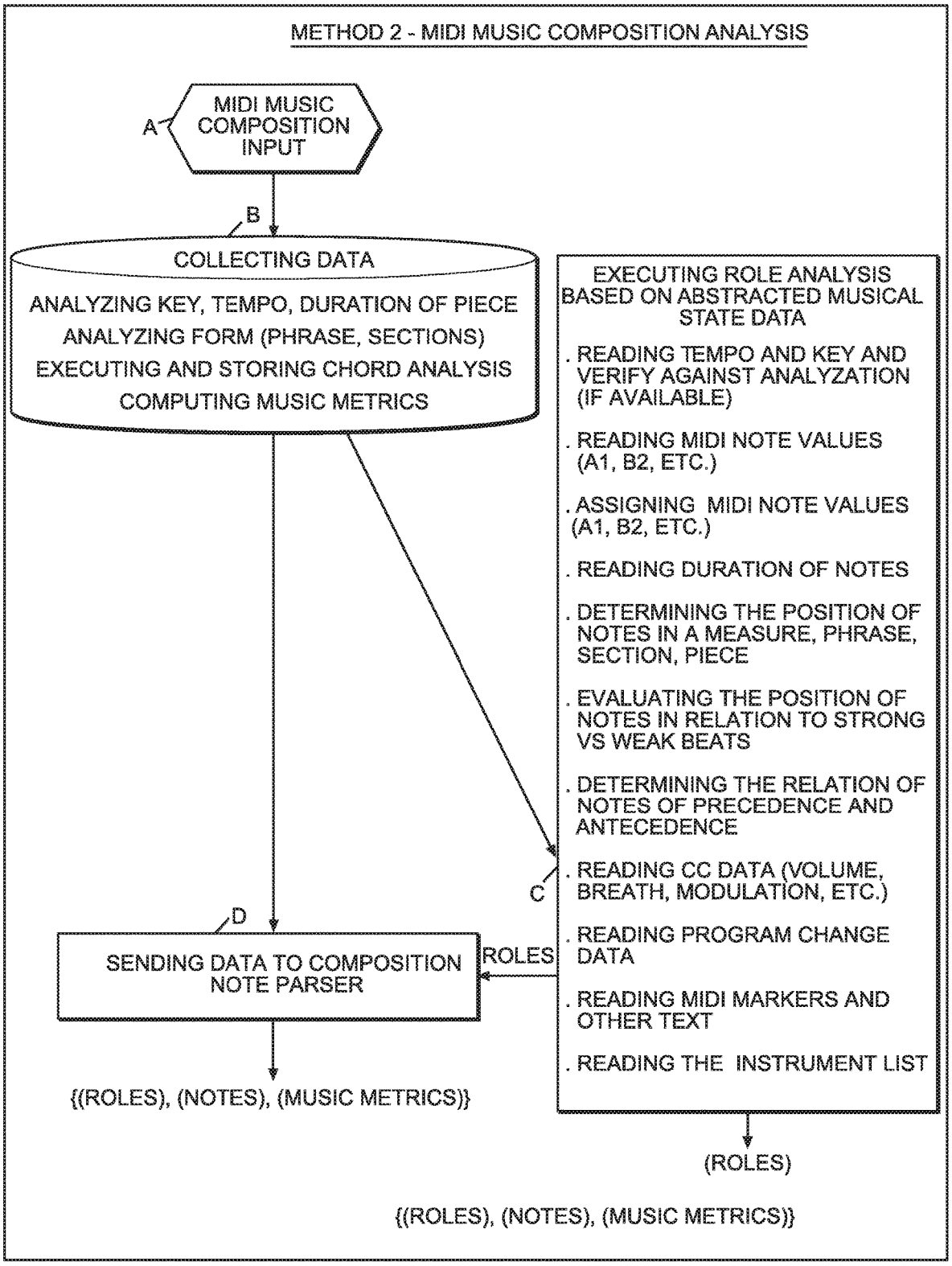
FIG. 31 is a schematic illustration of the automated MIDI-based music composition analysis method adapted for use with the automated music performance system of the second illustrative embodiment, and designed for executing Roles to extracted musical parts (e.g., background role to piano, pedal role to bass), and How many instruments are available.

FIG. 31 is a schematic illustration of the automated MIDI-based music composition analysis method adapted for use with the automated music performance system of the second illustrative embodiment, and designed for processing MIDI-music-file music compositions.

As shown at Block A in FIG. 31, the process involves receiving MIDI music composition file input and processing the file to collect music state data including note data, music state data and meta-data abstracted from the music composition file. This step will involve analyzing the key, tempo and duration of the piece, analyzing the form of phrases and sections, executing and shorting chord analysis, and computing music metrics based on the parameters specified in FIG. 32, and described hereinabove.

At Block B in FIG. 31, the method involves (a) analyzing the key, tempo and duration of the piece, (b) analyzing the form of phrases and sections, (c) executing and shorting chord analysis, and (d) computing music metrics based on the parameters specified in FIG. 32, and described hereinabove.

As shown at Block C in FIG. 31, the method involves abstracting Roles from analyzed music-theoretic state data, and performing the functions specified in this Block, including: (a) Reading Tempo and Key and verify against analyzation (if available); (b) Reading MIDI note values (A1, B2, etc.); (c) Reading duration of notes; (d) Determining the Position of notes in a measure, phrase, section, piece; (e) Evaluating the position of notes in relation to strong vs weak beats; (f) Determining the Relation of notes of precedence and antecedence; (g) Reading CC data (Volume, Breath, Modulation, etc.); (h) Reading program change data; (i) Reading MIDI markers and other text; and (j) Reading the instrument list.

As shown at Block D in FIG. 31, the method involves parsing note data based on Roles abstracted from the MIDI music composition data file, and sending this data to the output of the music composition analyzer.

FIG. 32 provides a specification of all music-theoretic state descriptors generated from the analyzed music composition (including notes, metrics and meta-data) that might be automatically abstracted/determined from a MIDI-type music composition during the preprocessing state of the automated music performance process of the present invention, wherein the exemplary set of music-theoretic state descriptors include, but are not limited to, Role (or Part of Music) to be performed, MIDI Note Value (A1, B2, etc.), Duration of Notes, and Music Metrics including Position of Notes in a Measure, Position of Notes in a Phrase, Position of Notes in a Section, Position of Notes in a Chord, Note Modifiers (Accents), Dynamics, MIDI Note Value Precedence and Antecedence, What Instruments are Playing, Position of Notes from Other Instruments, Relation of Sections to Each Other, Meter and Position of Downbeats and Beats, Tempo Based Rhythms, What Instruments are assigned to a Role (e.g. Accent, Background, etc.).

FIG. 33A specifies exemplary Musical Roles ("Roles") or Musical Parts of each MIDI-type music composition to be automatically analyzed by the automated music performance system of the present invention, wherein instruments with the associated performances can be assigned any of the Roles listed in this table, and a single role is assigned to an instrument, multiple roles cannot be assigned to a single instrument, but multiple instruments can be assigned a single role.

As shown in FIG. 33A, Accent—is a Role assigned to note that provide information on when large musical accents should be played; Back Beat—is a Role that provides note data that happen on the weaker beats of a piece; Background—is a lower density role, assigned to notes that often are the lowest energy and density that lives in the background of a composition; Big Hit—a Role assigned to notes that happen outside of any measurement, usually a singular note that happens rarely; Color—is a Role reserved for small musical segments that play semi-regular but add small musical phrases throughout a piece; Consistent—is a Role that is reserved for parts that live outside of the normal structure of phrase; Constant—is a Role that is often monophonic and has constant set of notes of the same value (e.g.: all 8th notes played consecutively); Decoration—is a Role similar to Color, but this role is reserved for a small flourish of notes that happens less regularly than color; High Lane—is a Role assigned to very active and high-note density, usually reserved for percussion; High-Mid Lane—is a Role assigned to mostly active and medium-note density, usually reserved for percussion; Low Lane—is a Role assigned to low active, low note-density instrument, usually reserved for percussion; Low-Mid Lane—is a Role assigned to mostly low activity, mostly low note-density instrument, usually reserved for percussion; Middle—is a Role assigned to middle activity, above the background Role, but not primary or secondary information; On Beat—is a Role assigned to notes that happen on strong beats; Pad—a Role assigned to long held notes that play at every chord change; Pedal—Long held notes, that hold the same note throughout a section; Primary—is Role that is the "lead" or main melodic part; Secondary—is a Role that is secondary to the "lead" part, often the counterpoint to the Primary role; Drum set Roles: (this is a single performer that has multiple instruments which are assigned multiple roles that are aware of each other), Hi-Hat—is a Drum set Role that does hi-hat notes, Snare—Drum set role that does snare notes, Cymbal—is Drum set Role of that does either a crash or a ride, Tom—Drum set role that does the tom parts, and Kick—is a Drum set Role that does kick notes.

Specification of Role Assignment Rules/Principles of the Present Invention

FIGS. 33B1 through 33B8 provide a set of exemplary Rules for use during the automated role assignment processes carried out by within the automated music performance system of the second illustrative embodiment of the present invention.

The following describes an exemplary way of assigning Roles to Notes, roles to Instrument Types and roles to Instrument Performance logic (i.e. Role Assignments) across the various stages of the automated music performance system of the present invention.

Roles are a way of organizing notes along a timeline that are sent to assigned Instrument Types to be handled by the Instrument Performance Logic which will select the correct samples for playback in the production of a musical piece.

Instruments and Performance Logic (Rules) are all labeled (tagged) with data that allow for rulesets to choose the appropriate Instrument/Performance combination.

With all three types of input (e.g. OCM, MIDI, AMPER), the following rules can be applied to an assigned Instrument Type, and then a specific Sample Instrument would be assigned to the Role Assignment. Each of these Roles can have a many variants of a role, if multiple roles of similar type are needed (e.g. accent.a, accent.b, or accent.1, accent.2, etc.).

Accent Role:

1. Role-to-Note Assignment Rule: If the density of notes are fairly sparse and follow along a consistent strong beat to weak beat periodicity, or/and if several instrument parts have regular periodicity in strong beat groupings, then assign to the Accent Role to these notes.
2. Role-to-Instrument-Type Assignment Rule: Assign the Accent Role to instrument_types reserved for accents, which are typically percussive, (e.g. ".hit( )" aspect value of: aux_perc, big_hit, cymbal, etc.).
3. Role-to-Instrument-Performance-Logic Assignment Rule: Assign the Accent Role to Instrument Performance Logic of other roles by through change in velocity or not play/play notes in current assigned role (ex: augmenting role).

Back Beat Role:

1. Role-to-Note Assignment Rule: If notes have a periodicity of primarily weak beat and that are tonal, then assign to the Back Beat Role to these notes.
2. Role-to-Instrument-Type Assignment Rule: Assign this Role Instrument Types that provide a more rhythmic and percussive tonal performance (mono or polyphonic)
3. Role-to-Instrument-Performance-Logic Assignment Rule: Assign this Role to Instrument Performances (i.e. Instrument Performance Logic/Rules) such as, e.g. acoustic_piano with "triadic chords closed voicing", acoustic_guitar with "up-strum top three strings", etc.

Background Role:

1. Role-to-Note Assignment Rule: If notes have a medium-low density (playing slightly more than once per chord, polytonal), then assign the Background Role to these notes.
2. Role-to-Instrument-Type Assignment Rule: Assign the Background Role to instrument types that can support polyphonic (note) performances.
3. Role-to-Performance-Logic Assignment Rule: Play polyphonic chords or parts of chords in instrument types (e.g. keyboard, acoustic_piano, synth_strings, etc.)

Big Hit Role:

1. Role-to-Note Assignment Rule: If notes happen with extreme irregularity and are very sparse, and/or either fall with a note in the accent lane or outside of any time signature, then assign the Big Hit Role to these notes.
2. Role-to-Instrument-Type Assignment Rule: Assign this role instrument type primarily to single hit, non-tonal, percussive instruments
3. Role-to-Instrument-Performance-Logic Assignment Rule: Performance Logic is play a "hit( )" in the assigned instrument type (e.g. big_hit, bass_drum, etc.) Color Role:

1. Role-to-Note Assignment Rule: If notes happen in small clusters, with rests between each set of clusters, and have some regular periodicity less than once per phrase, then assign the Color role to these notes.

2. Role-to-Instrument-Type Assignment Rule: Assign the Color Role to instrument types that are either percussive (if notes are unpitched) or tonal (if notes follow pitches within the key) and can be assigned to typically monophonic or instruments with harmonic/rhythmic tags (e.g. instruments with delay tag, tickies, synth_lead, etc.)

3. Role-to-Instrument-Performance-Logic Assignment Rule: May assign performances that are softer in velocity or lighter in articulation attack.

Consistent Role:

1. Role-to-Note Assignment Rule: If notes are relatively dense, have some periodicity, and change in either note pattern organization, rhythmic pattern organization more than once per a few bars, then assign the Consistent Role to these notes.

2. Role-to-Instrument-Type Assignment Rule: Assign the Color Role to instrument types that have typically monophonic performances (e.g. synth_lead, guitar_lead).

3. Role-to-Instrument-Performance-Logic Assignment Rule: May assign performances that utilize various arpeggiation patterns (eg: line up/down, sawtooth, etc.)

Constant Role:

1. Role-to-Note Assignment Rule: If notes that are relatively dense, and have very static rhythmic information with periodicity, then assign the Constant Role to these notes.

2. Role-to-Instrument-Type Assignment Rule: Assign the Constant Role to either tonal (monophonic) or percussive instrument types.

3. Role-to-Instrument-Performance-Logic Assignment Rule: Assign the Constant Role to Instrument Performances that are tempo dependent (e.g. shaker with "front( )" only, synth_lead with "arpeggiation up", etc.).

Decoration Role:

1. Role-to-Note Assignment Rule: If notes happen in small clusters, with rests between each set of clusters, and occur one per phrase or longer, then assign the Decoration role to these notes.

2. Role-to-Instrument-Type Assignment Rule: Assign the Decoration Role to instrument types that are either percussive (if notes are unpitched) or tonal (if notes follow pitches within the key) and can be assigned to typically monophonic or instruments with harmonic/rhythmic tags (e.g. instruments with delay tag, tickies, synth_lead, etc.)

3. Role-to-Instrument-Performance-Logic Assignment Rule: May assign performances that are softer in velocity or lighter in articulation attack.

High Lane Role:

1. Role-to-Note Assignment Rule: If notes that are unpitched that happen in usually rapid succession or high density, then assign the High Lane Role to these notes.

2. Role-to-Instrument-Type Assignment Rule: Unless otherwise directed by an external input, usually assign the High Lane Role to high-pitched in timbre percussion instruments (e.g. tickies, shakers, aux_drum ("rim"), etc.)

3. Role-to-Instrument-Performance-Logic Assignment Rule: Choose performances that activate articulations that are tagged with "high" and/or "short"

High-Mid Lane Role:

1. Role-to-Note Assignment Rule: If notes that are unpitched that happen in medium-high density, then assign the High-Mid Lane Role to these notes.

2. Role-to-Instrument-Type Assignment Rule: Unless otherwise directed by an external input, usually assign this Role to high-pitched or medium in timbre percussion instruments (e.g. tickies, aux_drum, hand_drum, etc.)

3. Role-to-Instrument-Performance-Logic Assignment Rule:

Choose performances that activate articulations that are tagged with "middle" and/or "short/medium"

Low-Mid Lane Role:

1. Role-to-Note Assignment Rule: If notes that are unpitched that happen in medium-low density, then assign the Low-Mid Lane Role to these notes.

2. Role-to-Instrument-Type Assignment Rule: Unless otherwise directed by an external input, usually assign this Role to medium to medium-low in timbre percussion instruments (e.g. aux_drum, hand_drum, taiko, etc.)

3. Role-to-Instrument-Performance-Logic Assignment Rule:

Choose performances that activate articulations that are tagged with "middle," "low," and/or "medium/long" Low Lane Role:

1. Role-to-Note Assignment Rule: Assign the Low Lane Role to notes that are unpitched that happen in low density.

2. Role-to-Instrument-Type Assignment Rule: Unless otherwise directed by an external input, assign this Role usually to instrument types that are low in timbre percussion (e.g. bass_drum, surdo, taiko, etc.)

3. Role-to-Instrument-Performance-Logic Assignment Rule:

Choose performances that activate articulations that are tagged with "low," and/or "long" Middle Role:

1. Role-to-Note Assignment Rule: If notes have a medium density (playing more than once per chord, polytonal, with occasional running lines), then assign the Middle Role to these notes.

2. Role-to-Instrument-Type Assignment Rule: Typically assign this Role to instrument types that can support polyphonic playback and performance. (e.g. keyboard, acoustic_piano, synth_strings, violins, etc.).

3. Role-to-Instrument-Performance-Logic Assignment Rule: Typically assign this Role to Instrument Performances support polyphonic performance. (e.g. keyboard, acoustic_piano, synth_strings, violins, etc.).

On Beat Role:

1. Role-to-Note Assignment Rule: If notes have a periodicity of primarily strong beat and that are tonal, then assign the On Beat Role to these notes.

2. Role-to-Instrument-Type Assignment Rule: Assign this Role to instrument types that produce more rhythmic and percussive tonal performances (mono or polyphonic)

3. Role-to-Instrument-Performance-Logic Assignment Rule: Assign this Role to Instrument Performances that have "strong" performance tag association (eg: acoustic_bass "roots with 5ths", acoustic_guitar with "down-strum power chord", etc.)

Pad Role:

1. Role-to-Note Assignment Rule: If notes are sustained through the duration of a chord, then assign the Pad Role to these notes.

2. Role-to-Instrument-Type Assignment Rule: Typically assign this Role to polyphonic instrument types that sustain notes (e.g. mid_pad, synth_string, synth_bass)

3. Role-to-Instrument-Performance-Logic Assignment Rule: Typically assign this Role to Instrument Performances involving polyphonic performances that sustain notes during a chord, and change notes on chord change (e.g. mid_pad, synth_string, synth_bass) Pedal Role:

1. Role-to-Note Assignment Rule: If notes sustain through chords and stay on one pitch (often the root) of an entire phrase, then assign the Pedal Role to these notes.
2. Role-to-Instrument-Type Assignment Rule: Assign this Role typically to monophonic instrument types such as, e.g. low_pad, synth_bass, pulse, etc.
3. Role-to-Instrument-Performance-Logic Assignment Rule: Assign this Role typically to Instrument Performances supporting monophonic performances that either sustain indefinitely, or can quickly reattack consecutively to create a pulse-like pedal tone (e.g. low_pad, synth_bass, pulse, etc.)

Primary Role:
1. Role-to-Note Assignment Rule: If notes are mostly monophonic, played with more density, rhythmic structure variances, often with some repetition and periodicity, and are accompanied with either great dynamic markings, high velocities, and/or other indications depending on the medium read, then assign the Primary Role to these notes.
2. Role-to-Instrument-Type Assignment Rule: Assign this Role typically to instrument types often used to perform as lead instruments (e.g. violin, lead_synth, lead_guitar, etc.)
3. Role-to-Instrument-Performance-Logic Assignment Rule: May choose limited polyphonic or monophonic performance, that may utilizes a great amount of articulation control and switching.

Secondary Role:
1. Role-to-Note Assignment Rule: If notes are mostly monophonic, play with more density, rhythmic structure variances, often with some repetition and periodicity, and are accompanied with either great dynamic markings, high velocities, are either lower in pitch or play less dense then another part, and/or other indications depending on the medium read, then assign the Secondary Role to these notes.
2. Role-to-Instrument-Type Assignment Rule: Assign this Role to instrument types that often perform as lead instruments (e.g. violin, lead_synth, lead_guitar, etc.)
3. Role-to-Instrument-Performance-Logic Assignment Rule: May choose limited polyphonic or monophonic performance, that may utilizes a great amount of articulation control and switching.

Drum Set Roles: These are the roles listed below that are given specific rhythmic parts (non-tonal) that should be assigned to one role-performer, but have to be broken out because the instruments used are naturally separated. Notes will need to be parsed into different roles, and often can be determined by MIDI note pitch, staff position, or rhythmic density.

Hi-Hat Drum Set Role:
1. Role-to-Note Assignment Rule: Assign this Role to often repeated consecutive notes, usually a quarter note or faster.
2. Role-to-Instrument-Type Assignment Rule: This Role may be assigned to instrument types such related to hi-hats.
3. Role-to-Instrument-Performance-Logic Assignment Rule: Depending on density of part, and perceived style, this role will be assigned a specific performance that can determine how to switch all the articulations contained within a hi-hat. (e.g. closed hit with open on 4 and)

Snare Drum Set Role:
1. Role-to-Note Assignment Rule: This Role is often assigned to notes close to or around the weak beats.
2. Role-to-Instrument-Type Assignment Rule: This Role may be assigned to be instrument types related to Snare (stick_snare, brush_snare, synth_snare, etc.).
3. Role-to-Instrument-Performance-Logic Assignment Rule: Depending on density of part, and perceived style, this Role will be assigned a specific performance that can determine how to switch all the articulations contained within a snare drum.

Cymbal Drum Set Role:
1. Role-to-Note Assignment Rule: This Role may be assigned to either repeated consecutive notes (ride) or single notes on downbeats of measures or phrases (crash).
2. Role-to-Instrument-Type Assignment Rule: This Role may be assigned to be instrument types related to Cymbal.
3. Role-to-Instrument-Performance-Logic Assignment Rule: Depending on density of part, and perceived style, the Cymbal Drum set role will be assigned to a specific performance that can determine how to switch all the articulations contained within a Cymbal.

Tom Drum Set Role:
1. Role-to-Note Assignment Rule: This Role may be assigned to clusters of notes that happen at the end of measures, or that are denser, but that are less consistent than Hi-Hat or Cymbal(ride).
2. Role-to-Instrument-Type Assignment Rule: This Role may be assigned to Instrument Types related to a Tom Drum Set.
3. Role-to-Instrument-Performance-Logic Assignment Rule: This role will be assigned to instrument performances based on density and position in measure that will determine which toms play which pitches and when the pitches switch. (e.g. Tom "low pitch only", Tom "low tom with low-mid tom accent") Kick Drum Set Role:
1. Role-to-Note Assignment Rule: This Role is assigned often to notes close to or around the strong beats.
2. Role-to-Instrument-Type Assignment Rule: The Kick Drum Set Role may be assigned instrument types related to Kick.
3. Role-to-Instrument-Performance-Logic Assignment Rule: The Kick Drum set role may be assigned to instrument performances related to Kick. Depending on density of part, and perceived style, this Role will be assigned a specific performance that can determine how to switch all the articulations contained within a Kick.

As described above, these Role Assignment Rules/Principles are illustrative in nature and will vary from illustrative embodiment to illustrative embodiment, when practicing the present invention.

FIG. 34 is a schematic representation of an exemplary sheet-type music composition to be digitally performed by a digital musical performance performed using deeply-sampled virtual musical instruments supported by the automated music performance system of the present invention.

Method of Generating a Music-Theoretic State Descriptor Representation of Automatically-Generated Music Composition for Use in Applying Performance Logic in the Automated Music Performance System and Selecting, Performing and Assembling Sampled Notes from Deeply-Sampled Virtual Musical Instruments Supported by the Automated Music Performance System of the Present Invention FIGS. 35 through 39 describes an automated music composition and performance system of the present invention, shown in large part in Applicant's U.S. Pat. No. 10,262,641, wherein system input includes linguistic and/or graphical-icon based musical experience descriptors and timing parameters, to generate a digital music performance.

Figure 35:
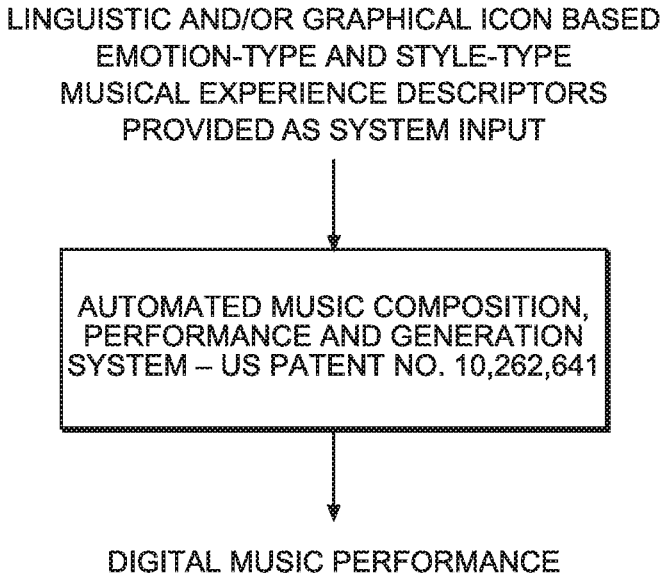
FIG. 35 is a schematic representation of an automated music composition and performance system of the present invention, described in large part in U.S. Pat. No. 10,262,641 assigned to Applicant, wherein system input includes linguistic and/or graphical-icon based musical experience descriptors and timing parameters, to generate a digital music performance

FIG. 35 illustrates the provision of emotional and style type linguistic and/or graphical-icon based musical experience descriptors (MXD) and timing parameters to the automated music composition and generation system of the third illustrative embodiment shown in FIG. 17.

Figure 36:
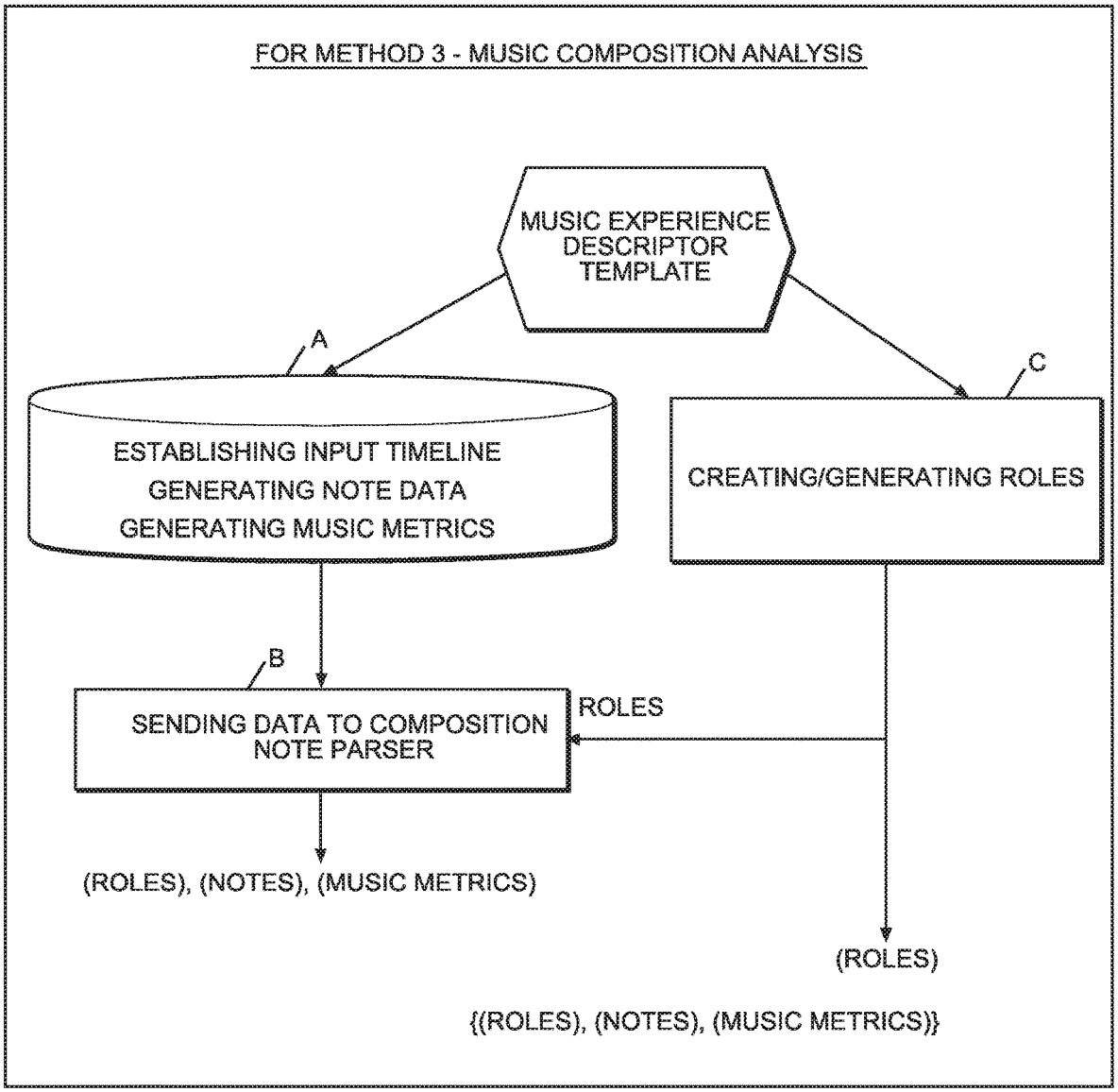
FIG. 36 is a schematic illustration of the automated musical-experience descriptor (MEX)-based music composition analysis method adapted for use with the automated music performance system of the third illustrative embodiment, and designed for processing data entered into the musical experience descriptor (MEX) input template and provided to the system user interface of the system.

FIG. 36 shows the automated MXD-based music composition analysis method adapted for use with the automated music performance system shown in FIG. 17.

As shown at Block A in FIG. 36, the method involves receiving Music Experience Descriptor (MXD) template from the system, processing the file to generate note data and computing music Metrics based on the parameters specified in FIG. 37, and described hereinabove.

As shown at Block B in FIG. 31, the process involves creating/generating Roles to perform the notes generated during Block A.

As shown at Block C in FIG. 31, the process involves organizing the note data, music metrics and other meta-data under the assigned Roles, and then combining this data into an output file for transmission to the automated music performance subsystem, for subsequent processing in accordance with the principles of the present invention.

FIG. 37 specifies an exemplary set of music-theoretic state descriptors (including notes, metrics and meta-data) that might be automatically abstracted/determined from a music composition during the preprocessing state of the automated music performance process of the present invention. As shown the exemplary set of music-theoretic state descriptors includes, but is not limited to, Role (or Part of Music) to be performed, MIDI Note Value (A1, B2, etc.), Duration of Notes, and Music Metrics including Position of Notes in a Measure, Position of Notes in a Phrase, Position of Notes in a Section, Position of Notes in a Chord, Note Modifiers (Accents), Dynamics, MIDI Note Value Precedence and Antecedence, What Instruments are Playing, Position of Notes from Other Instruments, Relation of Sections to Each Other, Meter and Position of Downbeats and Beats, Tempo Based Rhythms, What Instruments might be assigned to a Role (e.g. Accent, Background, etc.);

FIG. 38A specifies an exemplary Musical Roles ("Roles") or Musical Parts of each music composition to be automatically analyzed by the automated music performance system of the third-illustrative embodiment, wherein instruments with the associated performances can be assigned any of the Roles listed in this table, and a single role is assigned to an instrument, multiple roles cannot be assigned to a single instrument, but multiple instruments can be assigned a single role.

As shown in FIG. 38A, Accent—is a Role assigned to note that provide information on when large musical accents should be played; Back Beat—is a Role that provides note data that happen on the weaker beats of a piece; Background—is a lower density role, assigned to notes that often are the lowest energy and density that lives in the background of a composition; Big Hit—a Role assigned to notes that happen outside of any measurement, usually a singular note that happens rarely; Color—is a Role reserved for small musical segments that play semi-regular but add small musical phrases throughout a piece; Consistent—is a Role that is reserved for parts that live outside of the normal structure of phrase; Constant—is a Role that is often monophonic and has constant set of notes of the same value (e.g.: all 8th notes played consecutively); Decoration—is a Role similar to Color, but this role is reserved for a small flourish of notes that happens less regularly than color; High Lane—is a Role assigned to very active and high-note density, usually reserved for percussion; High-Mid Lane—is a Role assigned to mostly active and medium-note density, usually reserved for percussion; Low Lane—is a Role assigned to low active, low note-density instrument, usually reserved for percussion; Low-Mid Lane—is a Role assigned to mostly low activity, mostly low note-density instrument, usually reserved for percussion; Middle—is a Role assigned to middle activity, above the background Role, but not primary or secondary information; On Beat—is a Role assigned to notes that happen on strong beats; Pad—a Role assigned to long held notes that play at every chord change; Pedal—Long held notes, that hold the same note throughout a section; Primary—is Role that is the "lead" or main melodic part; Secondary—is a Role that is secondary to the "lead" part, often the counterpoint to the Primary role; Drum set Roles: (this is a single performer that has multiple instruments which are assigned multiple roles that are aware of each other), Hi-Hat—is a Drum set Role that does hi-hat notes, Snare—Drum set role that does snare notes, Cymbal—is Drum set Role of that does either a crash or a ride, Tom—Drum set role that does the tom parts, and Kick—is a Drum set Role that does kick notes.

Specification of Role Assignment Rules/Principles of the Present Invention

FIGS. 38B1 through 38B8 provide a set of exemplary Rules for use during the automated role assignment processes carried out by within the automated music performance system of the first illustrative embodiment of the present invention.

The following describes an exemplary way of assigning Roles to Notes, roles to Instrument Types and roles to Instrument Performance logic (i.e. Role Assignments) across the various stages of the automated music performance system of the present invention.

Roles are a way of organizing notes along a timeline that are sent to assigned Instrument Types to be handled by the Instrument Performance Logic which will select the correct samples for playback in the production of a musical piece.

Instruments and Performance Logic (Rules) are all labeled (tagged) with data that allow for rulesets to choose the appropriate Instrument/Performance combination.

With all three types of input (e.g. OCM, MIDI, AMPER), the following rules can be applied to an assigned Instrument Type, and then a specific Sample Instrument would be assigned to the Role Assignment. Each of these Roles can have a many variants of a role, if multiple roles of similar type are needed (e.g. accent.a, accent.b, or accent.1, accent.2, etc.).

Accent Role:

1. Role-to-Note Assignment Rule: If the density of notes are fairly sparse and follow along a consistent strong beat to weak beat periodicity, or/and if several instrument parts have regular periodicity in strong beat groupings, then assign to the Accent Role to these notes.
2. Role-to-Instrument-Type Assignment Rule: Assign the Accent Role to instrument_types reserved for accents, which are typically percussive, (e.g. ".hit( )" aspect value of: aux_perc, big_hit, cymbal, etc.).
3. Role-to-Instrument-Performance-Logic Assignment Rule: Assign the Accent Role to Instrument Performance Logic of other roles by through change in velocity or not play/play notes in current assigned role (ex: augmenting role).

Back Beat Role:

1. Role-to-Note Assignment Rule: If notes have a periodicity of primarily weak beat and that are tonal, then assign to the Back Beat Role to these notes.
2. Role-to-Instrument-Type Assignment Rule: Assign this Role Instrument Types that provide a more rhythmic and percussive tonal performance (mono or polyphonic)
3. Role-to-Instrument-Performance-Logic Assignment Rule: Assign this Role to Instrument Performances (i.e. Instrument Performance Logic/Rules) such as, e.g. acoustic_piano with "triadic chords closed voicing", acoustic_guitar with "up-strum top three strings", etc.

Background Role:

1. Role-to-Note Assignment Rule: If notes have a medium-low density (playing slightly more than once per chord, polytonal), then assign the Background Role to these notes.

2. Role-to-Instrument-Type Assignment Rule: Assign the Background Role to instrument types that can support polyphonic (note) performances.

3. Role-to-Performance-Logic Assignment Rule: Play polyphonic chords or parts of chords in instrument types (e.g. keyboard, acoustic_piano, synth_strings, etc.)

Big Hit Role:

1. Role-to-Note Assignment Rule: If notes happen with extreme irregularity and are very sparse, and/or either fall with a note in the accent lane or outside of any time signature, then assign the Big Hit Role to these notes.

2. Role-to-Instrument-Type Assignment Rule: Assign this role instrument type primarily to single hit, non-tonal, percussive instruments 3. Role-to-Instrument-Performance-Logic Assignment Rule: Performance Logic is play a "hit( )" in the assigned instrument type (e.g. big_hit, bass_drum, etc.)

Color Role:

1. Role-to-Note Assignment Rule: If notes happen in small clusters, with rests between each set of clusters, and have some regular periodicity less than once per phrase, then assign the Color role to these notes.

2. Role-to-Instrument-Type Assignment Rule: Assign the Color Role to instrument types that are either percussive (if notes are unpitched) or tonal (if notes follow pitches within the key) and can be assigned to typically monophonic or instruments with harmonic/rhythmic tags (e.g. instruments with delay tag, tickies, synth_lead, etc.)

3. Role-to-Instrument-Performance-Logic Assignment Rule: May assign performances that are softer in velocity or lighter in articulation attack.

Consistent Role:

1. Role-to-Note Assignment Rule: If notes are relatively dense, have some periodicity, and change in either note pattern organization, rhythmic pattern organization more than once per a few bars, then assign the Consistent Role to these notes.

2. Role-to-Instrument-Type Assignment Rule: Assign the Color Role to instrument types that have typically monophonic performances (e.g. synth_lead, guitar_lead).

3. Role-to-Instrument-Performance-Logic Assignment Rule: May assign performances that utilize various arpeggiation patterns (eg: line up/down, sawtooth, etc.)

Constant Role:

1. Role-to-Note Assignment Rule: If notes that are relatively dense, and have very static rhythmic information with periodicity, then assign the Constant Role to these notes.

2. Role-to-Instrument-Type Assignment Rule: Assign the Constant Role to either tonal (monophonic) or percussive instrument types.

3. Role-to-Instrument-Performance-Logic Assignment Rule: Assign the Constant Role to Instrument Performances that are tempo dependent (e.g. shaker with "front( )" only, synth_lead with "arpeggiation up", etc.).

Decoration Role:

1. Role-to-Note Assignment Rule: If notes happen in small clusters, with rests between each set of clusters, and occur one per phrase or longer, then assign the Decoration role to these notes.

2. Role-to-Instrument-Type Assignment Rule: Assign the Decoration Role to instrument types that are either percussive (if notes are unpitched) or tonal (if notes follow pitches within the key) and can be assigned to typically monophonic or instruments with harmonic/rhythmic tags (e.g. instruments with delay tag, tickies, synth_lead, etc.)

3. Role-to-Instrument-Performance-Logic Assignment Rule: May assign performances that are softer in velocity or lighter in articulation attack.

High Lane Role:

1. Role-to-Note Assignment Rule: If notes that are unpitched that happen in usually rapid succession or high density, then assign the High Lane Role to these notes.

2. Role-to-Instrument-Type Assignment Rule: Unless otherwise directed by an external input, usually assign the High Lane Role to high-pitched in timbre percussion instruments (e.g. tickies, shakers, aux_drum ("rim"), etc.)

3. Role-to-Instrument-Performance-Logic Assignment Rule: Choose performances that activate articulations that are tagged with "high" and/or "short"

High-Mid Lane Role:

1. Role-to-Note Assignment Rule: If notes that are unpitched that happen in medium-high density, then assign the High-Mid Lane Role to these notes.

2. Role-to-Instrument-Type Assignment Rule: Unless otherwise directed by an external input, usually assign this Role to high-pitched or medium in timbre percussion instruments (e.g. tickies, aux_drum, hand_drum, etc.)

3. Role-to-Instrument-Performance-Logic Assignment Rule: Choose performances that activate articulations that are tagged with "middle" and/or "short/medium"

Low-Mid Lane Role:

1. Role-to-Note Assignment Rule: If notes that are unpitched that happen in medium-low density, then assign the Low-Mid Lane Role to these notes.

2. Role-to-Instrument-Type Assignment Rule: Unless otherwise directed by an external input, usually assign this Role to medium to medium-low in timbre percussion instruments (e.g. aux_drum, hand_drum, taiko, etc.)

3. Role-to-Instrument-Performance-Logic Assignment Rule:

Choose performances that activate articulations that are tagged with "middle," "low," and/or "medium/long"

Low Lane Role:

1. Role-to-Note Assignment Rule: Assign the Low Lane Role to notes that are unpitched that happen in low density.

2. Role-to-Instrument-Type Assignment Rule: Unless otherwise directed by an external input, assign this Role usually to instrument types that are low in timbre percussion (e.g. bass_drum, surdo, taiko, etc.)

3. Role-to-Instrument-Performance-Logic Assignment Rule:

Choose performances that activate articulations that are tagged with "low," and/or "long" Middle Role:

1. Role-to-Note Assignment Rule: If notes have a medium density (playing more than once per chord, polytonal, with occasional running lines), then assign the Middle Role to these notes.

2. Role-to-Instrument-Type Assignment Rule: Typically assign this Role to instrument types that can support polyphonic playback and performance. (e.g. keyboard, acoustic_piano, synth_strings, violins, etc.).

3. Role-to-Instrument-Performance-Logic Assignment Rule: Typically assign this Role to Instrument Performances support polyphonic performance. (e.g. keyboard, acoustic_piano, synth_strings, violins, etc.).

On Beat Role:

1. Role-to-Note Assignment Rule: If notes have a periodicity of primarily strong beat and that are tonal, then assign the On Beat Role to these notes.

2. Role-to-Instrument-Type Assignment Rule: Assign this Role to instrument types that produce more rhythmic and percussive tonal performances (mono or polyphonic)

3. Role-to-Instrument-Performance-Logic Assignment Rule: Assign this Role to Instrument Performances that have "strong" performance tag association (eg: acoustic_bass "roots with 5ths", acoustic_guitar with "down-strum power chord", etc.)

Pad Role:

1. Role-to-Note Assignment Rule: If notes are sustained through the duration of a chord, then assign the Pad Role to these notes.

2. Role-to-Instrument-Type Assignment Rule: Typically assign this Role to polyphonic instrument types that sustain notes (e.g. mid_pad, synth_string, synth_bass)

3. Role-to-Instrument-Performance-Logic Assignment Rule: Typically assign this Role to Instrument Performances involving polyphonic performances that sustain notes during a chord, and change notes on chord change (e.g. mid_pad, synth_string, synth_bass)

Pedal Role:

1. Role-to-Note Assignment Rule: If notes sustain through chords and stay on one pitch (often the root) of an entire phrase, then assign the Pedal Role to these notes.

2. Role-to-Instrument-Type Assignment Rule: Assign this Role typically to monophonic instrument types such as, e.g. low_pad, synth_bass, pulse, etc.

3. Role-to-Instrument-Performance-Logic Assignment Rule: Assign this Role typically to Instrument Performances supporting monophonic performances that either sustain indefinitely, or can quickly reattack consecutively to create a pulse-like pedal tone (e.g. low_pad, synth_bass, pulse, etc.) Primary Role:

1. Role-to-Note Assignment Rule: If notes are mostly monophonic, played with more density, rhythmic structure variances, often with some repetition and periodicity, and are accompanied with either great dynamic markings, high velocities, and/or other indications depending on the medium read, then assign the Primary Role to these notes.

2. Role-to-Instrument-Type Assignment Rule: Assign this Role typically to instrument types often used to perform as lead instruments (e.g. violin, lead_synth, lead_guitar, etc.)

3. Role-to-Instrument-Performance-Logic Assignment Rule: May choose limited polyphonic or monophonic performance, that may utilizes a great amount of articulation control and switching.

Secondary Role:

1. Role-to-Note Assignment Rule: If notes are mostly monophonic, play with more density, rhythmic structure variances, often with some repetition and periodicity, and are accompanied with either great dynamic markings, high velocities, are either lower in pitch or play less dense then another part, and/or other indications depending on the medium read, then assign the Secondary Role to these notes.

2. Role-to-Instrument-Type Assignment Rule: Assign this Role to instrument types that often perform as lead instruments (e.g. violin, lead_synth, lead_guitar, etc.)

3. Role-to-Instrument-Performance-Logic Assignment Rule: May choose limited polyphonic or monophonic performance, that may utilizes a great amount of articulation control and switching.

Drum Set Roles: These are the roles listed below that are given specific rhythmic parts (non-tonal) that should be assigned to one role-performer, but have to be broken out because the instruments used are naturally separated. Notes will need to be parsed into different roles, and often can be determined by MIDI note pitch, staff position, or rhythmic density.

Hi-Hat Drum Set Role:

1. Role-to-Note Assignment Rule: Assign this Role to often repeated consecutive notes, usually a quarter note or faster.

2. Role-to-Instrument-Type Assignment Rule: This Role may be assigned to instrument types such related to hi-hats.

3. Role-to-Instrument-Performance-Logic Assignment Rule: Depending on density of part, and perceived style, this role will be assigned a specific performance that can determine how to switch all the articulations contained within a hi-hat. (e.g. closed hit with open on 4 and) Snare Drum Set Role:

1. Role-to-Note Assignment Rule: This Role is often assigned to notes close to or around the weak beats.

2. Role-to-Instrument-Type Assignment Rule: This Role may be assigned to be instrument types related to Snare (stick_snare, brush_snare, synth_snare, etc.).

3. Role-to-Instrument-Performance-Logic Assignment Rule: Depending on density of part, and perceived style, this Role will be assigned a specific performance that can determine how to switch all the articulations contained within a snare drum.

Cymbal Drum Set Role:

1. Role-to-Note Assignment Rule: This Role may be assigned to either repeated consecutive notes (ride) or single notes on downbeats of measures or phrases (crash).

2. Role-to-Instrument-Type Assignment Rule: This Role may be assigned to be instrument types related to Cymbal.

3. Role-to-Instrument-Performance-Logic Assignment Rule: Depending on density of part, and perceived style, the Cymbal Drum set role will be assigned to a specific performance that can determine how to switch all the articulations contained within a Cymbal.

Tom Drum Set Role:

1. Role-to-Note Assignment Rule: This Role may be assigned to clusters of notes that happen at the end of measures, or that are denser, but that are less consistent than Hi-Hat or Cymbal(ride).

2. Role-to-Instrument-Type Assignment Rule: This Role may be assigned to Instrument Types related to a Tom Drum Set.

3. Role-to-Instrument-Performance-Logic Assignment Rule: This role will be assigned to instrument performances based on density and position in measure that will determine which toms play which pitches and when the pitches switch. (e.g. Tom "low pitch only", Tom "low tom with low-mid tom accent")

Kick Drum Set Role:

1. Role-to-Note Assignment Rule: This Role is assigned often to notes close to or around the strong beats.

2. Role-to-Instrument-Type Assignment Rule: The Kick Drum Set Role may be assigned instrument types related to Kick.

3. Role-to-Instrument-Performance-Logic Assignment Rule: The Kick Drum set role may be assigned to instrument performances related to Kick. Depending on density of part, and perceived style, this Role will be assigned a specific performance that can determine how to switch all the articulations contained within a Kick.

As described above, these Role Assignment Rules/Principles are illustrative in nature and will vary from illustrative embodiment to illustrative embodiment, when practicing the present invention.

FIG. 39 specifies the music-theoretic state descriptor data file generated for an exemplary music composition containing music composition note data, roles, metrics and metadata.

Method of Sampling, Recording and Cataloging Real Musical Instruments and Producing a Deeply-Sampled Virtual Musical Instrument (DS-VMI) Library Management System for Use in the Automated Music Performance System of the Present Invention FIG. 40 shows a framework for classifying and cataloging a group of real musical instruments, and standardizing how such musical instruments are sampled, named and performed as virtual musical instruments during a digital performance of a piece of composed music. As shown, real and virtual musical instruments are classified by their performance behaviors, and musical instruments with common performance behaviors are classified under the same or common instrument type, thereby allowing like musical instruments to be organized and catalogued in the same class and be readily available for selection and use when the instrumentation and performance of a composed piece of music in being determined.

FIG. 41 shows an exemplary catalog of deeply-sampled virtual musical instruments maintained in the deeply-sampled virtual musical instrument library management subsystem of the present invention. In the illustrated embodiment of the present invention, the automated music performance system supports an extremely robust classification that provides a known set of parameters across each of the 100+ Types that allows a performance logic to be applied to chosen samples, given a performance with a musical composition.

Specification of Instrument Names, Instrument Types, Instrument Behaviors Classified in the Deeply-Sampled Virtual Musical Instrument DS-VMI Library Management System of the Present Invention Lists of Instruments In FIGS. 42A through 42J, there is shown an exemplary list of all the instrument contractors in the automated music performance system which will be maintained and updated in the system. These Instruments are grouped by their parent "Type".

List of Instrument Types

In the illustrative embodiment, the classifier called "Type" is used to denote how a usable template is created and how the Instrument should be assigned in the automated music performance system, and thus the Instrument should be recorded during the sampling session. FIGS. 43A though 43C show an exemplary list of Instrument "Types" supported by the automated List of Behaviors In FIGS. 44A through 44E, there is shown an exemplary List of Behaviors supported by the deeply-sampled virtual musical instruments (DS-VMI) supported in the automated music performance system. Typically, a "Behavior" tab will be generated by the automated music performance system, along with a "Behavior/Range" tab. This set of Behaviors will grow with each new instrument Type that gets added into the automated music performance system. As shown in the Drawings, the Type of Behavior called "Downbeat" has two Aspects with Values of "Long" and "Down". When reading this list, the first element of the Behavior specification, namely "XXXX( )." is always the Behavior specification, with the Aspects following with their associated Values.

Preferably, the system is designed so that by selecting a Type from the Type List will result in the automated generation of a sampling template specifying what Notes to sample on the real instrument (to be sampled) based on its Type, as well as a Note Range that is associated with it. If there is no note range, then it's not a tonal behavior/aspect, and does not have a "range". When a user wants to add an instrument into the automated music performance system, the instrument list is referenced to determine if the requested instrument relates to an Instrument Type. However, the Instrument List does not dictate a number of sample attributes, namely: how many round robins, velocities and other granular level sample things that need to be addressed. Often, these decisions are made on the day of the sampling session and is based on time and financial constraints. Also, a file naming structure for sound samples should be developed and used that helps parse out the names to be read by the Type and Instrument Lists.

During system operation, the automated music performance system of the present invention automatically (i) classifies each deeply-sampled virtual musical instrument (DS-VMI) entered into its instrument catalog, (ii) informs the system of the type of the instrument and what range of note it performs, (iii) sets a foundation for the automated music performance logic subsystem to be generated for the instrument, enabling automatic selection of appropriate sample articulations that dramatically alter the sound produced from each deeply-sampled virtual musical instrument, based on the music-theoretic states of an input music composition being digitally performed.

Specification of the Method of Sampling and Recording Samples from Real Musical Instruments and Other Non-Musical Audio Sources of the Present Invention FIG. 45 illustrates various audio sound sources that can be sampled during a sampling and recording session to produce deeply-sampled virtual musical instrument (DS-VMI) libraries capable of producing "sampled audio sounds" produced from real musical instruments, as well as natural sound sources, including humans and animals.

FIG. 46 describes a sampling template for use in organizing and managing any audio sampling and recording session involving the deep-sampling of a specified type of real musical instrument (or other audio sound source) for the purpose of producing a deeply-sampled virtual musical instrument (DS-VMI) library for entry into the DS-VMI library management subsystem of the present invention. As shown, this sampling template includes many information fields for capturing many different kinds of information items, including, for example: real instrument name; instrument type; recording session—place, date, time, and people; information categorizing essential attributes of each note sample to be captured from the real instrument during the sampling session; etc.

FIG. 47 graphically illustrates a musical instrument data file, structured using the sampling template of FIG. 46, and organizing and managing sample data recorded during an audio sampling and recording session of the present invention involving, for example, the deep-sampling of a specified type of real musical instrument to produce a musical instrument data file for supporting a deeply-sampled virtual musical instrument library, for use during digital performance.

FIG. 48 illustrates a definition of a deeply-sampled virtual music instrument (DS-VMI) according to the principles of the present invention. As shown, the definition shows a virtual musical instrument data set containing (i) all data files for the sets of sampled notes performed by a specified type of real musical instrument deeply-sampled during an audio sampling session and mapped to note/velocity/microphone/round-robin descriptors, and (ii) MTS-responsive performance logic (i.e. performance rules) for use with samples in the deeply-sampled virtual musical instrument.

Specification of the Music-Theoretic State Responsive Instrument Contracting Logic for the Deeply-Sampled Virtual Musical Instruments of the Present Invention FIG. 49 illustrates the music-theoretic state (MTS) responsive virtual musical instrument contracting/selection logic for automatically selecting a specific deeply-sampled virtual musical instrument to perform in the digital performance of a music composition. Collectively, the Automated Virtual Musical Instrument (VMI) Contractor/Selection Subsystem shown in FIGS. 2, 9 and 17 and associated VMI Contractor Logic (Rules) shown in FIG. 49 enable the Automated Music Performance System to automatically select Deeply-Sampled Virtual Musical Instruments (DS-VMIs) to perform in the music performance for the input music composition. Preferably, the VMI contractor logic includes [IF X, then Y] formatted rules that specify the music-theoretic states and conditions that automatically select specific virtual musical instruments from the DS-VMI library management subsystem for digital performance of the music composition.

Specification of the Music-Theoretic State (MTS) Responsive Performance Logic for the Deeply-Sampled Virtual Musical Instruments of the Present Invention FIG. 50 illustrates music-theoretic state (MTS) responsive performance logic for controlling specific types of performance of each deeply-sampled virtual musical instrument supported in the deeply-sampled virtual musical instrument (DS-VMI) library management subsystem of the present invention. Also, the Automated DS-VMI Selection and Performance Subsystem in FIGS. 2, 9 and 17 and associated (Music-Theoretic State Responsive) Performance Logic (Rules) in FIG. 50 enable the Automated Music Performance System to automatically select samples from automatically-selected (and manually-override-selected) Deeply-Sampled Virtual Musical Instruments (DS-VMIs) and then execute their Performance Logic (i.e. Rules) to process selected samples to generate a music performance that is contextually-relevant to the music theoretic states of the input music composition.

These two rule-based subsystems described above and schematically depicted in FIGS. 49 and 50 provide the automated music performance system with its advanced musical-awareness and music-intelligence functionalities.

Figure 51:
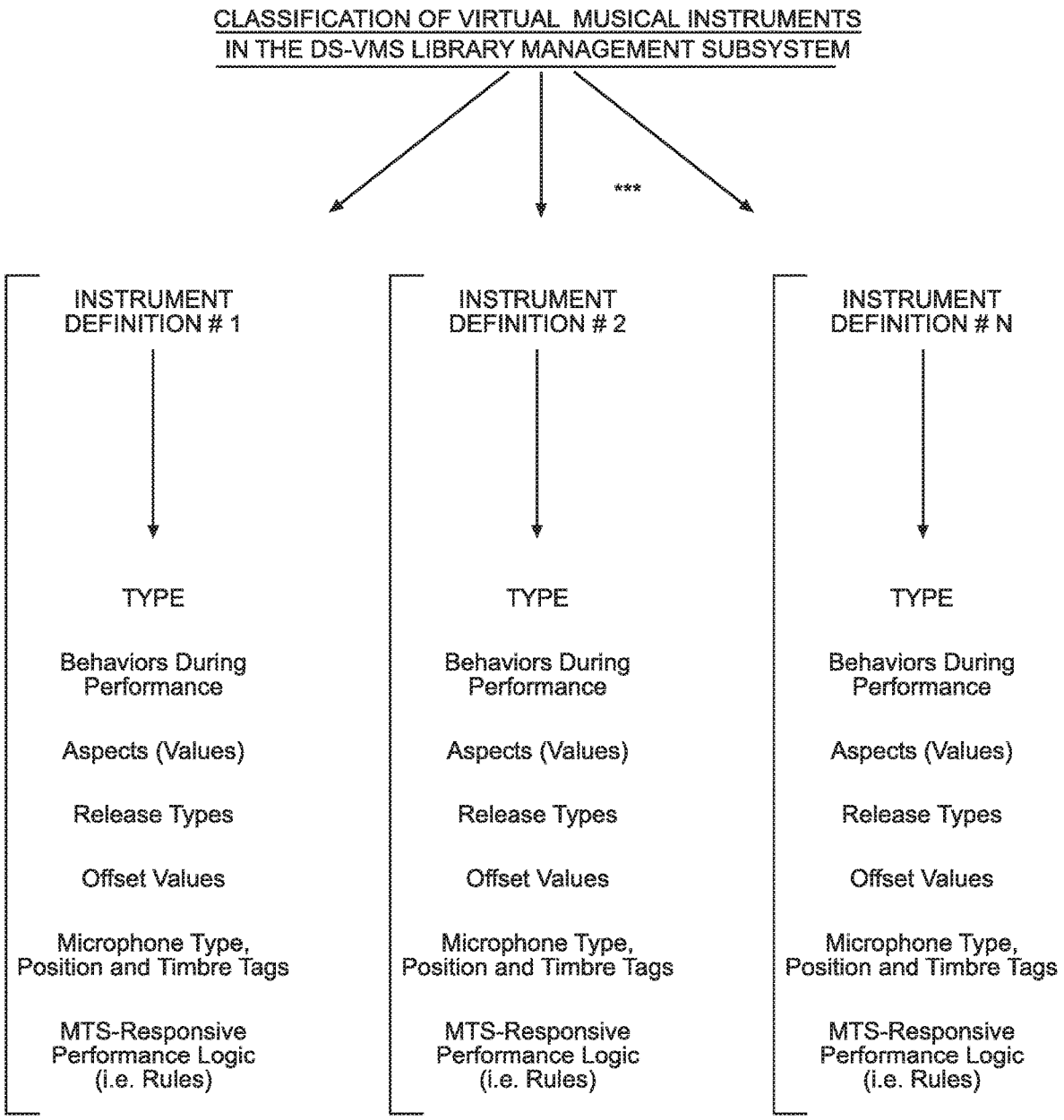
FIG. 51 is a schematic representation in the form of a tree diagram illustrating the classification of deeply-sampled virtual musical instruments (DS-VMI) that are cataloged in the DS-VMI library management subsystem, using Instrument Definitions based on one or more of the following attributes: instrument Behaviors with Aspect values visible for selection in the performance algorithm; release types, offset values, microphone type, position and timbre tags used during recording, and MTS responsive performance rules created for a given DS-VMI.

Classification of Virtual Musical Instruments in the DS-VMS Library Management Subsystem FIG. 51 shows a tree diagram illustrating the classification of deeply-sampled virtual musical instruments (DS-VMI) that are cataloged in the DS-VMI library management subsystem of the present invention. As shown, this classification uses Instrument Definitions based on one or more of the following attributes: Instrument Type, Instrument Behaviors, Aspects (Values), Release Types, Offset Values, Microphone Type, Position and Timbre Tags used during a sampling and recording session, and Instrument Performance Logic (i.e. Performance Rules) specially created for a given DS-VMI given its Instrument Type and Behavior.

Figure 52:
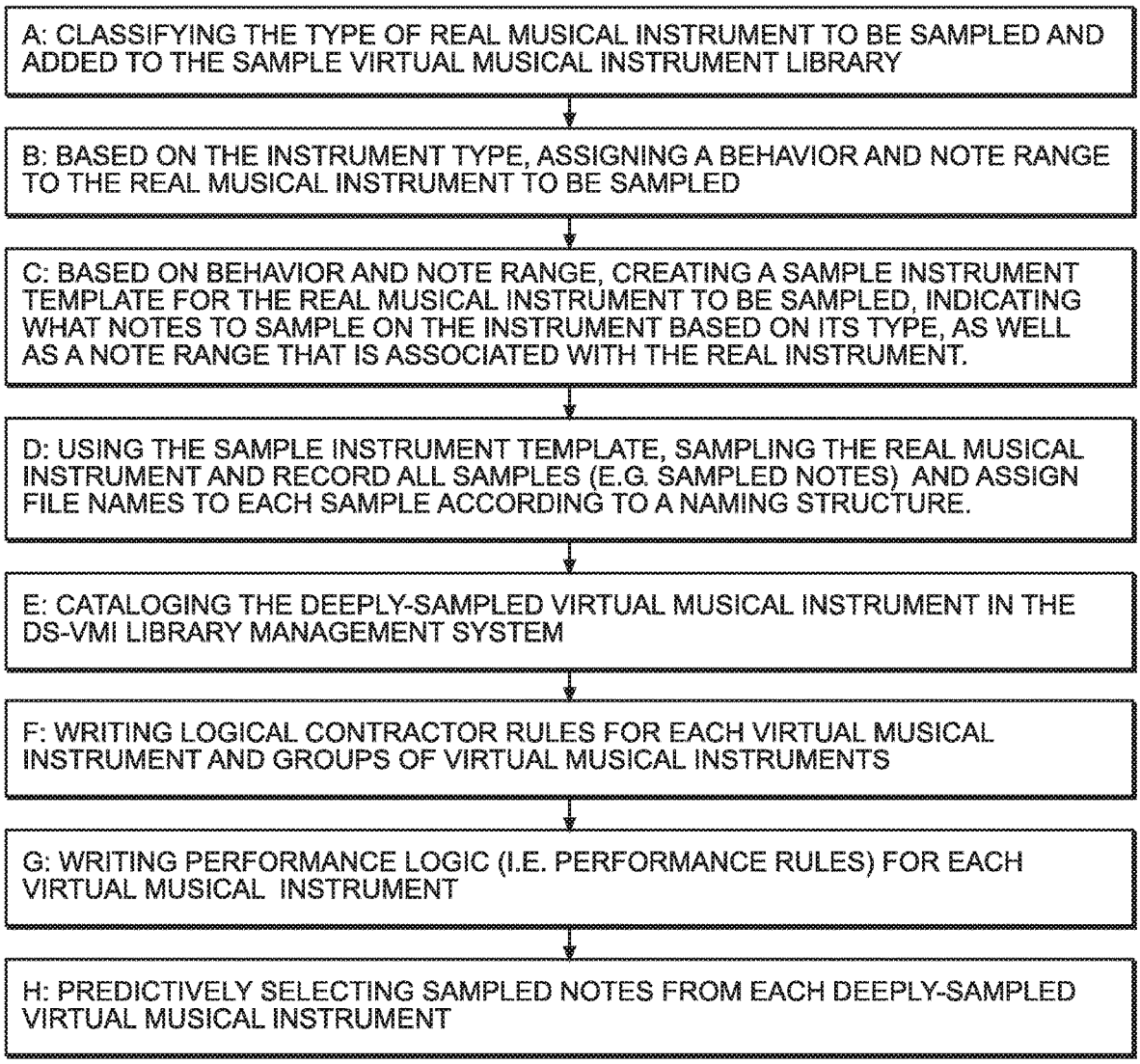
FIG. 52 is a flow chart describing the primary steps in the method of sampling, recording, and cataloging real musical instruments for use in developing corresponding deeply-sampled virtual musical instruments (DS-VMI) for deployment in the deeply-sampled virtual musical instrument (DS-VMI) library management system of present invention, comprising (a) classifying the type of real musical instrument to be sampled and added to the sample virtual musical instrument library, (b) based on the instrument type, assigning behavior and aspect values, and note range to the real musical instrument to be sampled, (c) based on instrument type, creating a sample instrument template for the real musical instrument to be sampled, indicating what notes to sample on the instrument based on its type, as well as a note range that is associated with the real instrument, (d) using the sample instrument template, sampling the real musical instrument and record all samples (e.g. sampled notes) and assign file names and meta data to each sample according to a naming structure, (e) cataloging the deeply-sampled virtual musical instrument in the DS-VMI library management system, (f) writing logical contractor (i.e. orchestration) rules for each virtual musical instrument and groups of virtual musical instruments, (g) writing performance logic (i.e. performance rules) for each deeply-sampled virtual musical instrument, and (h) predictively selecting sampled notes from each deeply-sampled virtual musical instrument.

Method of Sampling, Recording, and Cataloging Real Musical Instruments for Use in Developing Corresponding Deeply-Sampled Virtual Musical Instruments (DS-VMI) for Deployment in the Deeply-Sampled Virtual Musical Instrument (DS-VMI) Library Management System of Present Invention FIG. 52 describes the primary steps in the method of sampling, recording, and cataloging real musical instruments for use in developing corresponding deeply-sampled virtual musical instruments (DS-VMI) for deployment in the deeply-sampled virtual musical instrument (DS-VMI) library management system of present invention.

In order to be able to predictively select sampled notes from a deeply-sampled virtual musical instrument library, that plays very well with the music-theoretic states of the music composition being digitally performed, the present invention teaches to sample the real instrument based on its Instrument Type, Behavior and how it is performed. Also, the present invention also teaches to catalogue each sampled note using a naming convention that is expressed in a performance logic (i.e. set of performance rules) created for the Type of the deeply-sampled virtual musical instrument, executed upon the detection of conditions in the music-theoretic state of the music composition that matches the condition expressed in the conditional part of the performance rules.

Using this technique, it is possible for the automated music performance system to be provided a degree of artificial intelligence and predictive insight on what sampled notes in the DS-VMI library management subsystem should be selected and processed for assembly and finalization in the digital performance being produced for the music composition provided to the system.

As indicated at Step A in FIG. 52, the method involves classifying the type of (i) real musical instrument to be sampled, (ii) natural audio sound source, or (iii) synthesized sound source, and adding this type of "instrument" to the deeply-sample virtual musical instrument (DS-VMI) library. Each instrument has to be defined as to the scope of what to record, how to record, and what mixes (or microphones) need to be captured.

In general, in accordance with the spirit of the present invention, sampled audio sounds can be synthesized sampled notes, AI produced samples, Sample Modeling, or sampled audio sounds, and therefore, sampled audio can represent (i) a sample note produced by a real (tonal) musical instrument typically tuned to produce tonal sounds or notes (e.g. piano, string instruments, drums, horns, (ii) a sampled sound produced by an atonal sound source (e.g. ocean breeze, thunder, airstream, babbling brook, doors closing, and electronic sound synthesizers, etc.) or (iii) a sampled voice singing or speaking, etc.

Also, the term "virtual musical instrument (VMI)" as used throughout the Patent Specification is any virtual musical instrument is made from (i) a library of sampled audio sound files representative of musical notes and/or other sounds, and/or (ii) a library of digitally synthesized sounds representative of musical notes and/or other sounds. When using an audio-sound sampling method, the notes and/or sounds do not have to be sampled and recorded from a real musical instrument (e.g. piano, drums, string instrument, etc.), but may be produced from non-musical instrument audio source, including sources of nature, human voices, animal sounds, etc.

When using a digital sound synthesis method, the notes and/or sounds may be digitally designed, created and produced using sound synthesis software tools such as, for example, MOTU's MACHFIVE and MX4 software tools, and Synclavier® sound synthesis software products, and the notes and sounds produced for these VMI libraries may have any set of sonic characteristics and/or attributes that can be imagined by the sound designer and engineered into a digital file for loading and storage in, and playback from the virtual musical instrument (VMI) library being developed in accordance with the principles of the present invention.

When using a digital audio/sound synthesis method to produce the notes and sound files for a particular virtual musical instrument (VMI) library, the users may readily adapt the sampling template, instrument definitions, and cataloging principles used for sound sampling methods disclosed and taught herein for digitally-synthesized virtual musical instruments (DS-VMI) having notes and sounds created using digital sound synthesis methods known in the art.

It is appropriate at this junction to describe in greater detail how such tools and devices may be readily adapted and used when producing notes and sounds for VMIs using the digital sound synthesis (DS) method.

A synthesis sound module can be defined as a set of synthesis parameters (FM, Spectral, Additive, etc.) that could contain a sound generating oscillator(s) that is assigned a waveform(s), manipulated by amplitude, frequency and filters, with control of each manipulation via other oscillators, generated envelopes, gates, and external controllers. In the VMI sound synthesis space, each designed synthesis module with specified static or ranged parameters can be assigned the same Behavior and Aspect value schema as when developing a deeply-sampled virtual musical instrument (DS-VMI) library. A single digitally-synthesized VMI could contain multiple sound modules to support a robust deep synthesis of a single instrument type. For example, a sound module could be created to mimic the sustain of a violin, a pizzicato of a violin, or a tremolo of a violin, each are separate modules, but could exist as a single VMI so that the role/performance algorithm that is assigned to the violin instrument could use either the sampled version or the synthesis version agnostically.

These classifications of these sound modules for digitally synthesized VMIs is done in the same way that a single sound sample would be classified, but instead of a bank of individual note samples, a sound module would provide open handles for data to be submitted, for example: Instrument Definition: Synthesized Harp: 2 Sound modules: Sound Module 1 consists of 2 Oscillators (sine and noise), Sine oscillator has an envelope applied that controls amplitude over time (decay), Noise oscillator has a filter and amplitude envelope applied that has a hard attack and a very fast decay. Second Sound Module has 3 Oscillators, (Sine+0(semitones), Sine+12(semitones), Noise). Both sine oscillators have an envelope applied that controls amplitude over time (decay) with the first sine oscillator at −30 db gain and the second at 0 db gain. Noise oscillator has a filter and amplitude envelope applied that has a hard attack and a very fast decay. The instrument definition has open handles for manipulation by the engine: Pitch Selection (oscillator pitch change, based on MIDI note), Velocity Selection (oscillator filter and volume change based on MIDI velocity), and Gate (trigger of note on/off, based on MIDI note start and end times).

Each synthesized instrument definition can be cataloged (with the exception of the cataloging of the single sample note recorded audio) against the same template instrument definition as used when developing a deeply-sampled virtual musical instrument (DS-VMI) library. Using the prior example, the Synthesized Harp would fall under the instrument type "Harp" template which states the Behavior is a "single_note" and can change Aspects with the values of "regular" or "harmonic". The first sound module would be cataloged as the "regular" aspect and the second would be the "harmonic" aspect. If the system had available the Synthesized harp and set a harp performance, the instrument would perform the same way as the sampled harp would, allowing for switching of regular and harmonics, and pitch/velocity controlled data, but instead of playing back samples, the engine would render the synthesized reproduction through the sound modules.

Returning now to the operations flow of the system, as indicated at Step B in FIG. 52, based on the instrument type, assigning a behavior and note range to the real musical instrument to be sampled.

As indicated at Step C in FIG. 52, based on behavior and note range, creating a sample instrument template for the real musical instrument to be sampled, indicating what notes to sample on the instrument based on its type, as well as a note range that is associated with the real instrument.

As indicated at Step D in FIG. 52, using the sample instrument template illustrated in FIG. 26, sample the real musical instrument and record all samples (e.g. sampled notes) or sample non-musical sound sources and record all samples (e.g. sampled audio sounds), and assign File Names to each audio sample according to a Naming Structure, as illustrated below:

Sound Sampling Process According to the Present Invention:

a. Each sound sample is categorized by the following:
   - i. Recording Session
     1. This is a single data point, just for organization of a set of samples
   - ii. Manual Type/Style
     1. Multiple data can be stored in the form of CamelCase Tokens—this is then entered and read by our cataloging system to inform what the samples are and what they do.
     2. This is typically an alternate version of the family of instruments, For example: Different types of Snares, Violin Pizzicato vs Bowed
   - iii. Articulation Type (if percussion)
     1. Often defined as stroke type: Buzz Roll, Rim Shot, Stick on Head, etc. (see glossary)
   - iv. MIDI Note Range (0-127)
   - v. MIDI Dynamic (or velocity) Range (0-127)
   - vi. Sample-Hold Trigger Style
     1. Sustain (loops until note-off)
     2. One-Shot (plays until Release is finished)
     3. Legato (Transitions from one note to the next note)
   - vii. Number in Round Robin Count (see glossary)
   - viii. Sample Release Type (see glossary)
     1. Short
     2. Long
     3. Modifier: Performance Release
   - ix. Mix or Specified Microphone Position As indicated at Step E in FIG. 52, the method involves cataloging the deeply-sampled virtual musical instrument, in the DS-VMI library management system, as illustrated below:

Cataloging Process:

b. Instrument File (The physical container for the sample sets) illustrated in FIG. 27
   - i. This is the Musical Instrument File containing all the data from Sampling Process, what samples were recorded, the mapping of each sample to a note/velocity/microphone/round-robin, etc.
   - ii. Can contain multiple instruments
   - iii. Contains the data for all the sample names to be read by the following Instrument Definitions.

c. Instrument Definition (The Data Set for an instrument illustrated in FIG. 28
   i. Constructed from the Instrument File shown in FIG. 27
   ii. Several Instrument Definitions can reference an Instrument File
d. Behaviors
   i. Behaviors are the types of things an instrument can do—for example "Do I play a single string, or a single note on a keyboard, am I triggering some type of FX or Hit?"
   ii. Behaviors are all related/linked to a single Instrument Definition
e. Aspects
   i. Aspects belong to a single behavior; a single behavior can have many aspects. Example: What direction am I bowing on a string; Am I triggering a type of Stroke; can I alter the timbre of something; is there a duration associated?—these can all be associated to a behavior of "Plays a Note".
   ii. Aspects inform the system whether note value should be read, or if the note value is not part of a specific aspect
   iii. Aspects signify the order of where to look for a type of aspect in the sample file name
   iv. Aspects signify if there is an articulation in play or not.
f. Values
   i. These are assigned to a single aspect. For example: Aspect of "Direction" can have values of Up and Down.
   ii. These also contain note values ranges (in MIDI standard format)
   iii. These assign the file sample name components
g. Release Types
   i. Does this instrument contain a "performance" release, or just a single, regular type of release (Long or Short).
h. Offset Values
   i. Offset Values are assigned to an entire manual+ articulation and referenced by the Behavior ID.
   ii. Offset Values tell the system to trigger a sample early by {x} number of milliseconds so a sample can trigger in time.
      1. Samples have pre-transients that are part of the sound but often happen before a sound should be on a "downbeat", For example: moving a stick through the air to strike a drum creates a slight "whoosh" beforehand. The moment the strike hits the drum head, that is where the downbeat should happen, not at the point of the "whoosh". If the "whoosh" was cut out, then the natural sound of the drum would not sound right and missing all the sonic data before the downbeat.
      2. The other advantage to offset values is to "time" samples for playback. Example: Take a short violin bow sample from a section of players. A player may be slightly early to the rest of the group, so the perceived downbeat should be a little after the start of the sample. This allows us to "time" a string of these samples in a row to allow for a consistent playback of sound.
i. Contractor Instruments
   i. Contractor Instruments contain:
      1. The mix position or microphone type
      2. Hard-coded digital signal processing (like reverbs, eq),
      3. Proper of the instrument associated with the microphone type to be read by users.
      4. Timbre and other classification tags
j. Contractor Groups
   i. Contractor Groups are made up of Contractor Instruments (often just one instrument to a group)
   ii. Contractor Groups are assigned to bands
   iii. Contractor Groups have timbre and other Classification Tags
   iv. Contractor Groups are assigned to specific sets of descriptors for availability for our users to select and create/edit their own bands.
k. Timbre Tagging
   i. Allows for us to catalog each instrument in the system for search and retrieval
l. Band Assignments
   i. Bands exists in descriptors and are made from Contractor Groups.
m. Instrument Constraints
   i. A set of constraints defined within a descriptor that prevent users from adding to many of one instrument. For example: 2 or more Kick Drums would not be acceptable for most descriptors.
n. Orchestration Decisions
   i. Each performance lane gets a priority of when it should play and instrument based on combinations of instruments and activity instructions provided by either the system or the user.

As indicated at Step F in FIG. 52, the method involves writing logical contractor rules (i.e. contractor logic) for each virtual musical instrument and groups of virtual musical instruments, for use by the automated music performance system in automatically selecting particular deeply-sampled virtual musical instrument (DS-VMI) libraries, based on the music-theoretic states of the music composition being digitally performed using the principles of the present invention, as follows:

Instrument Contractor (i.e. Instrumentation) Logic:

o. Contractor (i.e. Instrumentation) Logic is a system that establishes what instruments should be chosen under what music-theoretic states in the music composition, and what function these instruments should perform.
p. Contractor Logic helps make Bands and allows for the automated music performance system to show awareness of when virtual musical instruments exist in the library system, and when particular virtual musical instruments should be used As indicated at Step G in FIG. 52, the method involves writing custom performance logic (i.e. rules) for each deeply-sample virtual musical instrument library, following the Instrument Type and Behavior Schema used in designing and deploying the automated music performance system of the present invention.

In general, all instruments in the automated music performance system will get a specific type of performance (or logical instructions) written for them, and executable when specific music-theoretic states are detected along the timeline of a music composition being digitally performed. These performances can range from "play a simple hit at {x} velocity" to a "strum a guitar with 6 strings, muting the first two, playing an up stroke on all 6, assembling this position of a chord".

Preferably, each logical performance rule will have an "IF X, THEN Y" format, where X specifies a particular state or condition detected in the music composition and characterized in the music composition meta-data file (i.e. music-theoretic state descriptor data), and Y specifies the specific performance instruction to be performed by the virtual musical instrument on the sampled note selected from a deeply-sampled virtual musical instrument, that has been selected by the logical contractor rules performed by the automated instrument contracting subsystem, employed within the automated music performance system.

Below are common examples of music-theoretic states (i.e. music composition meta-data) abstracted from the music composition being digitally performed:

i. MIDI Note values (A1, B2, etc.),
ii. Durations of notes
iii. Position of Notes in a measure
iv. Position of Notes in a phrase
v. Position of Notes in a section
vi. Position of Notes in a chord
vii. Note Modifiers (accents)
viii. Dynamics
ix. MIDI Note value precedence and antecedence
x. What instruments are available, what instruments are playing and what instruments are playing
xi. Position of Notes from other instruments
xii. Relation of sections to each other
xiii. Meter and position of downbeats and beats
xiv. Tempo based rhythms
xv. What instruments are assigned to a role (play in background, play as a bed, play bass, etc.)
xvi. How many instruments are available?
  1. IE: Drummer has 4 things they can hit, don't play 5 cymbals, kick and snare at the same time
  2. IE: I have a bass, don't add 2 other basses When analyzing and detecting music-theoretic state data (i.e. music composition meta data), the automated music performance subsystem will identify the performance rule associated with the MIDI note values, and determine for what logical performance rule both the music composition state and the performance rule state (i.e. X) matches, and if for performance rule with a match, then the automated music performance system automatically executes the performance rule on the sampled note. Such performance rule execution will typically involve processing the sampled note in some way so that the virtual musical instrument will reasonably perform the sampled note at a specified trigger point, and thereby adapt to the musical notes that are being played around the sampled note. By assigning logical performance rules to certain groups of sampled notes in a (contractor-selected) deeply-sampled virtual musical instrument library, based on instrument type, the automated music performance system is provided with both artificial musical intelligence and contextual awareness, so that it has the capacity to select, process and playback various sampled notes in any given digital performance of the music composition.

Values (specially velocity/dynamics) for sampled note processing can be deterministic or random.

As indicated at Step H in FIG. 52, the method involves predictively selecting sampled notes from each deeply-sampled virtual musical instrument, during the digital music performance of a music composition. Predictive selection of sampled notes in any given deeply-sampled virtual musical instrument library system involves using music-theoretic state data (i.e. music composition meta-data) automatically abstracted from the music composition. Essentially, this music-theoretic state data is used to search and analyze the logical performance rules in the deeply-sampled virtual musical instrument (DS-VMI) library. Setting up this automated mechanism involves some data organization within the deeply-sampled virtual musical instrument (DS-VMI) library management system.

For example, each instrument group in the DS-VMI library management system is placed into a family of like instruments called "Types." This means that each Instrument Type will have exactly the same expected Behavior/Aspect values associated with them.

xvii. Typically, the DS-VMI library management system will maintain over one hundred different Instrument Types as reflected in FIG. 24B1 through 24B3;
xviii. This provides a framework for standardizing how instruments are sampled, named and performed using the automated music performance system; and
xix. For instance: a shaker will have a Front, a Back and a Double Hit Sample Value associated with it.

Many DS-VMI performances will have logical performance rules written for each Type, depending on how an instrument is desired to operate within a given descriptor. Example of the Shaker: Forward, Back and Double, also has 3 velocities associated with it. A soft shake, a sharper "louder" shake, and then a very short, hard "accent" forward shake. These velocities are divided from midi velocity values 1-100, 101-126, and 127-127. One logical performance rule might state: IF the composer sends a series of $8^{th}$ notes, THEN play Forward @ 127, Back at @ 100, Forward @ 110, Back @ 100. Another logical performance rule might state: IF the composer sends a series of $8^{th}$ notes, THEN Play forward, but choose between 101-126 with a 30% chance of playing 127, play back between 90-100, etc. Another logical performance rule might state: IF the composer gives a note on a downbeat, and had a series of notes before it, THEN play a Double @
127. Note: because the shaker has a lot of sound that precedes it (the pre-transient)—all shakers will be asked to play 250 milliseconds before the actual notes are sent by the composer to "play"—this allows all the shakers to perform in time, without sounding chopped, or late.

While the above examples of logical performance rules are rudimentary, they clearly highlight the fact that even the simplest instrument (e.g. shaker) can have multiple instrument performances just given that the instrument has 3 different articulations which it can play.

Performance logic created for and used in the DS-VMI libraries of the present invention is not only used for intelligent selection of musical instruments and sampled notes, but also for DSP control involving modifying sampled note selections based on dynamic choice, role assignment, role priority, and other virtual musical instruments available in the library management system. Logical performance rules can be written for executing algorithmic automation and intelligent selection of how to send control to note behavior and sample selection. Logical performance rules can be written to create algorithms that modulate parameters to affect the sound, which may include dynamic blending, filter control, volume level, or a host of other parameters.

Matrixing and Using Instrument Types to Create Circular Awareness

Allowing instruments to be aware of each other provides some unique and untested waters within performance automation. Consideration might also be given to timing, volume control and iteration and part copy/mutation, as discussed below.

Regarding timing, one use case could be if one instrument slows down, what do the other instruments do. If one instrument is assigned a slightly shuffled beat pattern, then can the others respond.

Regarding volume control, allowing instruments to self-adjust their overall volume based on other instruments playing around will drastically help in the automation of volume control based on user selectivity and instrument role assignments.

Not with regard to specific compositional note assignment, but with regards to how instruments perform, such performance mutation based on other instruments playing types of performances would allow users to select performers and mutate those performers within a given instrument family. Want a mix between Hendrix and Santana? Mutate the performance to select different types of guitar articulations and when to choose various types.

Generating a Digital Music Performance of a Music Composition Using the Sampled Notes Selected from the Deeply-Sampled Virtual Musical Instruments Supported by the Automated Music Performance System of the Present Invention FIG. 52 illustrates the primary steps involved in the method of operation of the automated music performance system of the present invention. As shown, the method comprises: (a) using the music composition meta-data abstraction subsystem to automatically parse and analyze each time-unit (i.e. beat/measure) in a music composition to be digitally performed so as to automatically abstract and produce a set of time-line indexed music-theoretic state descriptor data (i.e. music composition meta-data) specifying the music-theoretic states of the music composition including note and composition meta-data; (b) using the automated deeply-sampled virtual musical instrument (DS-VMI) selection and performance subsystem and the automated VMI contracting subsystem, with the set of music-theoretic state descriptor data (i.e. music composition meta-data) and the virtual musical instrument contracting/selection logic (i.e. rules), to automatically select, for each time-unit in the music composition, one or more deeply-sampled virtual musical instruments from the DS-VMI library subsystem to perform the sampled notes of a digital music performance of the music composition; (c) using the automated deeply-sampled virtual musical instrument (DS-VMI) selection and performance subsystem and the set of music-theoretic state descriptor data (i.e. music composition meta-data) to automatically select, for each time-unit in the music composition, sampled notes from deeply-sampled virtual musical instrument libraries for a digital music performance of the music composition; (d) using the automated deeply-sampled virtual musical instrument (DS-VMI) selection and performance subsystem and music-theoretic state responsive performance logic (i.e. rules) in the deeply-sampled virtual musical instrument libraries to process and perform the sampled notes selected for the digital music performance of the music composition; and (e) assembling and finalizing the processed samples selected for the digital performance of the music composition for production, review and evaluation by human listeners.

By virtue of this method of the presence invention described above, it is now possible to make better use of deeply-sampled virtual musical instruments used in digital music performances and productions, with increased music performance uniqueness and differentiation. Pre-existing deeply-sampled virtual musical instrument (DS-VMI libraries can be readily transformed into virtual musical instruments with artificial intelligence and awareness of how to perform its sampled notes and sounds in response to the actual music-theoretic states reflected in the music composition being digitally performed. As a result of the present invention, the value and utility of preexisting deeply-sampled virtual musical instrument libraries can be quickly expanded to meet the growing needs in the global marketplace for acoustically rich and contextually-relevant digital performances of music compositions in many diverse applications, while reducing the costs of licensing musical loops required in conventional music performance and production practices. Consequentially, the present invention creates new value in both current and new music performance and production applications.

Fourth Illustrative Embodiment of the Automated Music Performance System of the Present Invention, where a Human Composer Composes an Orchestrated "Music Composition" Expressed in a Sheet-Music Format Kind of Music-Theoretic Representation and Wherein the Music Composition is Provided to the Automated Musical Performance System of the Present Invention so that this System can Select Deeply-Sampled Virtual Musical Instruments Supported by the Automated Music Performance System Based on Roles Abstracted During Music Composition Processing, and Digitally Perform the Music Composition Using Automated Selection of Notes from Deeply-Sampled Virtual Musical Instrument Libraries Having described various illustrative embodiments of the automated music performance system of the present invention, it is understood that there will be applications where added functionality will be desired or required, and the system architecture of the present invention is uniquely positioned to support such musical functionalities as will be described below.

For example, consider the function of "musical arrangement", wherein a previously composed work is musically reconceptualized to produce new and different pieces of music, containing elements of the prior music composition. A musical arrangement of a prior music composition may differ from the original work by means of reharmonization, melodic paraphrasing, orchestration, or development of the formal structure. Sometimes, musical arrangement of a musical composition involves a reworking of a piece of music so that it can be played by a different instrument or different combination of instruments, based on the original music composition. However imagined, musical arrangement is an important function when composing and producing music.

Also, consider the function of "musical instrument performance style" used when performing a particular musical instrument. Often, the technique employed in practicing a particular musical instrument performance style will significantly change the musical performance by the instrument playing the same group of notes, and therefore is also considered an important function when composing and producing music.

Therefore, another object of the present invention is to provide a fourth illustrative embodiment automated music performance system and method of the present invention that supports (i) Automated Musical (Re)Arrangement and (ii) Musical Instrument Performance Style Transformation of a music composition to be digitally performed by the automated music performance system.

Figure 65:
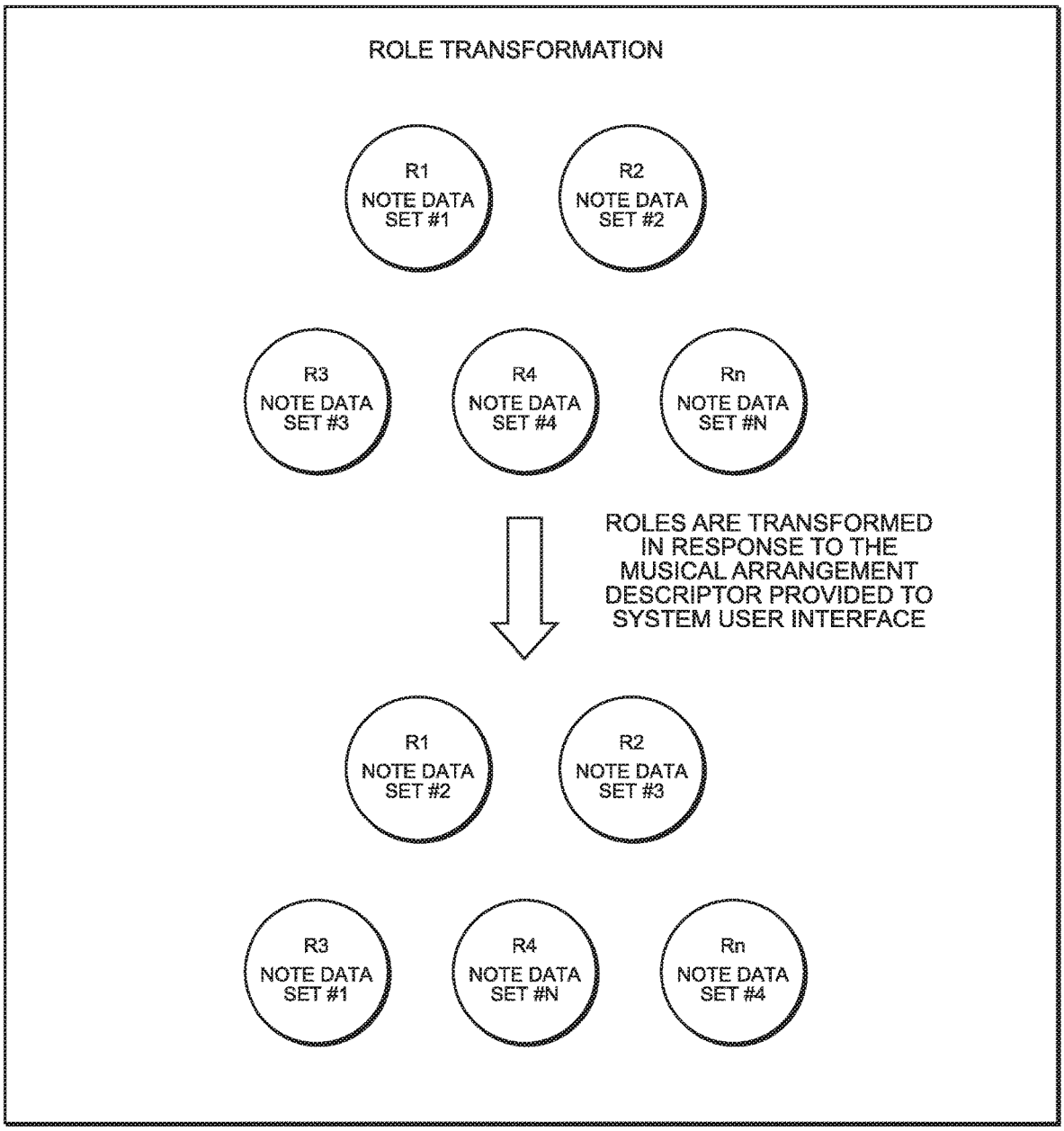
FIG. 65 is a schematic representation illustrating how a set of Roles and associated Note data automatically abstracted from a music composition are transformed in response to the Musical Arrangement Descriptor selected a system user from the GUI-based system user interface of FIG. 56, wherein different groups of Note Data are reorganized under different Roles depending on the Musical Arrangement Descriptor selected by the system user.

As will be described in great technical detail below, these two creative musical functions described above can be implemented in the automated music performance system of the present invention as follows: (i) selecting Musical Arrangement Descriptors and Musical Instrument Performance Style Descriptors described in FIGS. 57 and 58, from a GUI-based system user interface supported by the system; (ii) providing the user-selected Musical Arrangement Descriptors and Musical Instrument Performance Style Descriptors to the system user interface, as shown in FIG. 56; (iii) then remapping/editing the Musical Roles abstracted from the given music composition as illustrated in FIGS. 64 and 65; and (iv) during automated performance, selecting Musical Instrument Performance Logic supported in the DS-VMI Libraries, that is indexed/tagged with the Music Instrument Performance Style Descriptors selected by the system user, as illustrated in FIG. 66, so as to support the automated music performance process illustrated in FIGS. 67 and 68 and achieve the musical arrangement and music performance style selected/requested by the system user.

These additional features of the present invention will be described in greater detail hereinbelow in the context of the automated music performance system of the fourth illustrative embodiment shown in FIGS. 54 through 68.

Figure 54:
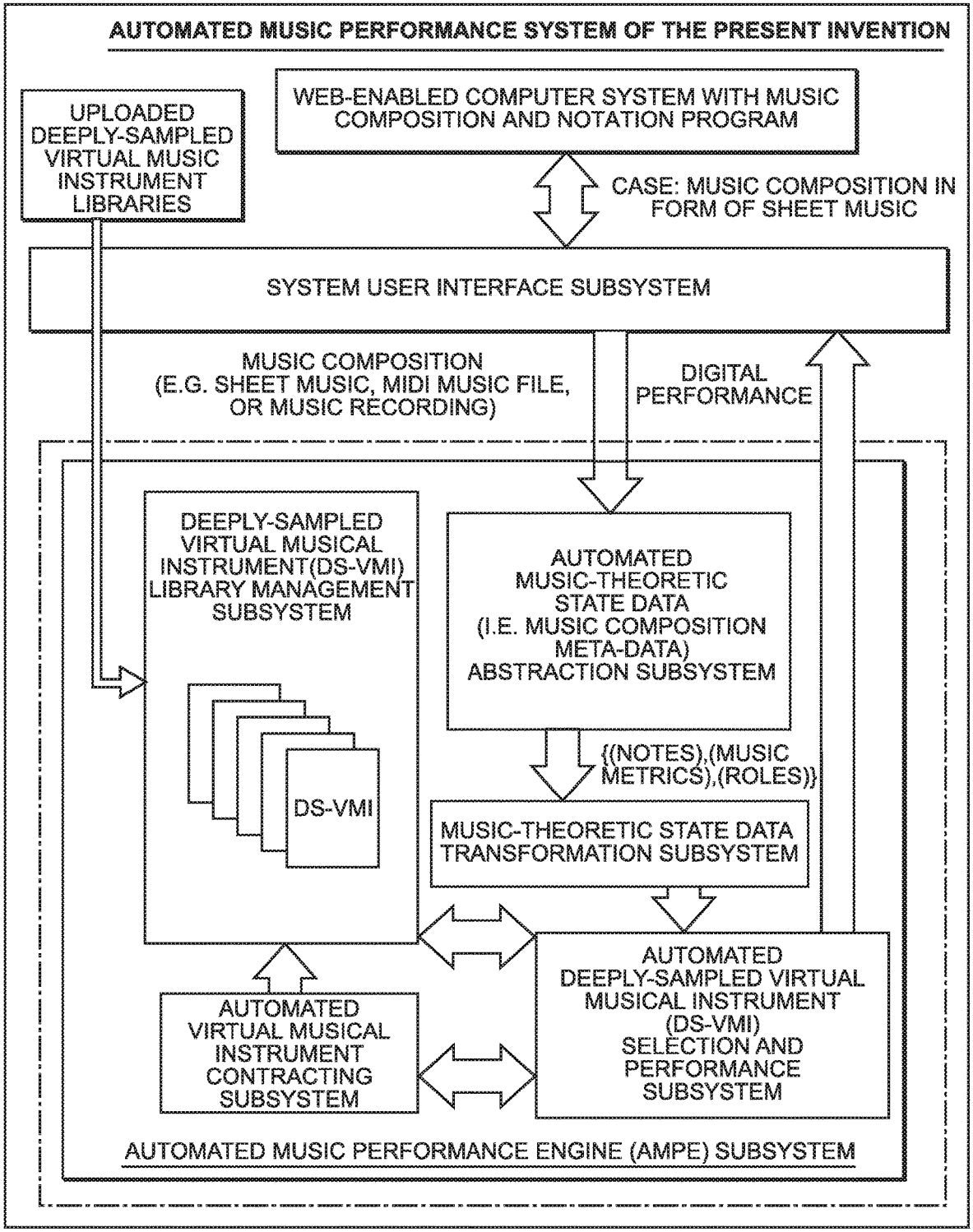
FIG. 54 shows the automated music performance system of the fourth illustrative embodiment of the present invention, comprising (i) a system user interface subsystem for use by a web-enabled computer system provided with music composition and notation software programs to produce a music composition, and (ii) an automated music performance engine (AMPE) subsystem interfaced with the system user interface subsystem, for producing a digital performance based on the music composition, wherein the system user interface subsystem transfers a music composition to the automated music performance engine subsystem, and wherein the automated music performance engine subsystem includes: (i) an automated music-theoretic state (MTS) data abstraction subsystem for automatically abstracting all music-theoretic states contained in the music composition and producing a set of music-theoretic state descriptors data (i.e. music composition meta-data) representative thereof; (ii) a deeply-sampled virtual musical instrument (DS-VMI) library management subsystem for managing the sample libraries supporting the deeply-sampled virtual musical instruments to be selected for performance of notes specified in the music composition; and (iii) an automated deeply-sampled virtual musical instrument (DS-VMI) selection and performance subsystem for selecting deeply-sampled virtual musical instruments in the DS-VMI library management subsystem and processing the sampled notes selected from selected deeply-sampled virtual musical instruments using music-theoretic state (MTS) responsive performance rules (i.e. logic), to automatically produce the sampled notes selected for a digital performance of the music composition, and wherein the automated music performance engine (AMPE) subsystem transfers the digital performance to the system user interface subsystem for production, review and evaluation.

FIG. 54 shows the automated music performance system of the fourth illustrative embodiment of the present invention. As shown, the system comprises: (i) a system user interface subsystem for a system user using a web-enabled computer system provided with music composition and notation software programs to produce a music composition in any format (e.g. sheet music format, MIDI music format, music recording, etc.); and (ii) an automated music performance engine (AMPE) subsystem interfaced with the system user interface subsystem, for producing a digital performance based on the music composition, wherein the system user interface subsystem transfers a music composition to the automated music performance engine subsystem.

As shown in FIG. 54, the automated music performance engine subsystem includes: (i) an automated music-theoretic state (MTS) data abstraction subsystem for automatically abstracting all music-theoretic states contained in the music composition and producing a set of music-theoretic state descriptors data (i.e. music composition meta-data) representative thereof; (ii) a deeply-sampled virtual musical instrument (DS-VMI) library management subsystem for managing the sample libraries supporting the deeply-sampled virtual musical instruments to be selected for performance of notes specified in the music composition; and (iii) an automated deeply-sampled virtual musical instrument (DS-VMI) selection and performance subsystem for selecting deeply-sampled virtual musical instruments in the DS-VMI library management subsystem and processing the sampled notes selected from selected deeply-sampled virtual musical instruments using music-theoretic state (MTS) responsive performance rules (i.e. logic), to automatically produce the sampled notes selected for a digital performance of the music composition, and wherein the automated music performance engine (AMPE) subsystem transfers the digital performance to the system user interface subsystem for production, review and evaluation.

Figure 54A:
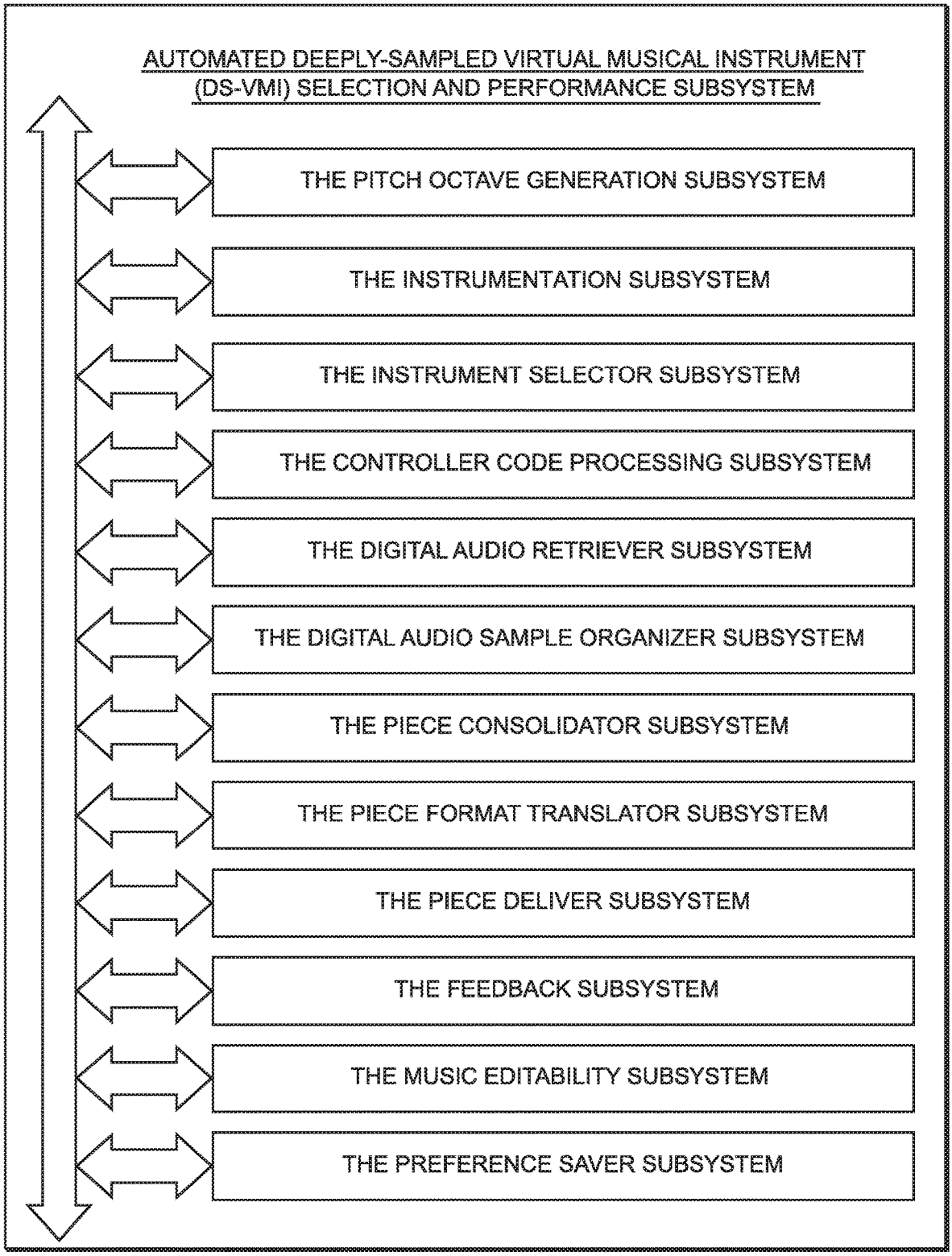
FIG. 54A is a schematic block representation of the subsystem architecture of the Automated Deeply-Sampled Virtual Musical Instrument (DS-VMI) Selection and Performance Subsystem employed in the Automated Music Performance (and Production) System of the present invention, shown comprising a Pitch Octave Generation Subsystem, an Instrumentation Subsystem, an Instrument Selector Subsystem, a Digital Audio Retriever Subsystem, a Digital Audio Sample Organizer Subsystem, a Piece Consolidator Subsystem, a Piece Format Translator Subsystem, the Piece Deliver Subsystem, a Feedback Subsystem, and a Music Editability Subsystem, interfaced as shown with the other subsystems (e.g. an Automated Music-Theoretic State Data (i.e. Music Composition Meta-Data) Abstraction Subsystem, a Deeply-Sampled Virtual Musical Instrument (DS-VMI) Library Management Subsystem, and an Automated Virtual Musical Instrument Contracting Subsystem) deployed within the Automated Music Performance System of the present invention.

FIG. 54A shows the subsystem architecture of the Automated Deeply-Sampled Virtual Musical Instrument (DS-VMI) Selection and Performance Subsystem employed in the Automated Music Performance (and Production) System of the present invention. As shown, this subsystem architecture comprises: a Pitch Octave Generation Subsystem, an Instrumentation Subsystem, an Instrument Selector Subsystem, a Digital Audio Retriever Subsystem, a Digital Audio Sample Organizer Subsystem, a Piece Consolidator Subsystem, a Piece Format Translator Subsystem, the Piece Deliver Subsystem, a Feedback Subsystem, and a Music Editability Subsystem, interfaced as shown with the other subsystems (e.g. an Automated Music-Theoretic State Data (i.e. Music Composition Meta-Data) Abstraction Subsystem, a Deeply-Sampled Virtual Musical Instrument (DS-VMI) Library Management Subsystem, and an Automated Virtual Musical Instrument Contracting Subsystem) deployed within the Automated Music Performance System of the present invention. The functions of these subsystems are described in great detail in Applicant's U.S. Pat. No. 9,721,551, incorporated herein by reference in its entirety.

The Role Assignment Rules shown and described herein in great detail for the first, second and third illustrative embodiments of the present invention also can be used to practice the automated music performance system of the fourth illustrative embodiment of the present invention, and carry out each of its stages of data processing described hereinabove.

Figure 55:
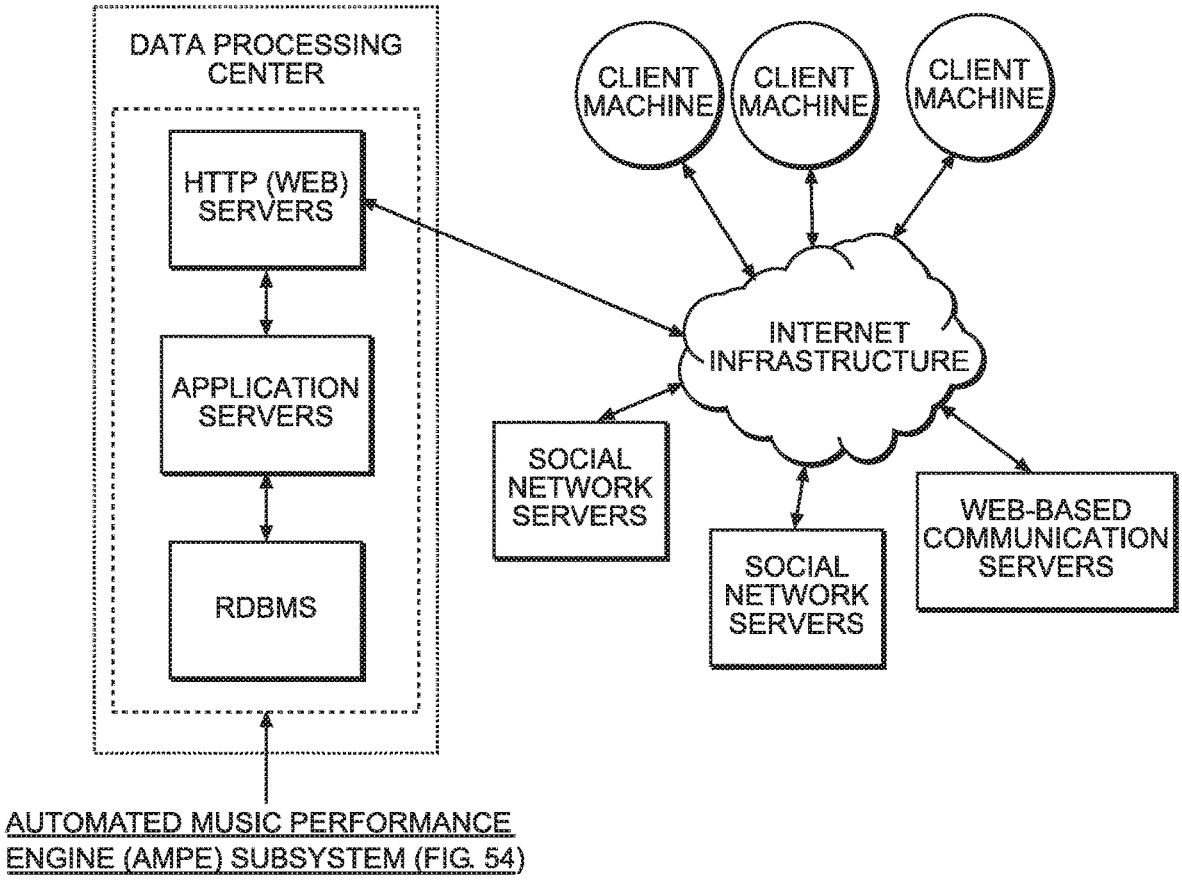
FIG. 55 shows the system of the FIG. 54 implemented as enterprise-level internet-based music composition, performance and generation system, supported by a data processing center with web servers, application servers and database (RDBMS) servers operably connected to the infrastructure of the Internet, and accessible by client machines, social network servers, and web-based communication servers, and allowing anyone with a web-based browser to access automated music composition, performance and generation services on websites to score videos, images, slide-shows, podcasts, and other events with music using deeply-sampled virtual musical instrument (DS-VMI) synthesis methods of the present invention as disclosed and taught herein.

FIG. 55 shows the system of the FIG. 54 implemented as enterprise-level internet-based music composition, performance and generation system, supported by a data processing center with web servers, application servers and database (RDBMS) servers operably connected to the infrastructure of the Internet, and accessible by client machines, social network servers, and web-based communication servers, and allowing anyone with a web-based browser to access automated music composition, performance and generation services on websites to score videos, images, slide-shows, podcasts, and other events with music using deeply-sampled virtual musical instrument (DS-VMI) synthesis methods of the present invention as disclosed and taught herein.

FIG. 56 shows an exemplary wire-frame-type graphical user interface (GUI) screen based system user interface of the automated music performance system of the fourth illustrative embodiment. As shown, this GUI screen indicates and instructs the system user on how to transform the musical arrangement and musical instrument performance style of a music composition before the automated digital performance of the music composition. As shown, the GUI-based system user interface modeled in FIGS. 54 through 55 invites a system user to select (via menus) (i) an Automated Musical (Re)Arrangement, and/or (ii) Musical Instrument Performance Style Transformation of the music composition to be digitally performed by the system, through a simple end-user process involving: (i) selecting Musical Arrangement Descriptors and Musical Instrument Performance Style Descriptors from a GUI-bases system user interface; and (ii) then providing the user-selected Musical Arrangement Descriptors and Musical Instrument Performance Style Descriptors to the automated music performance system; whereupon (iii) the Musical Roles abstracted from the given music composition are automatically remapped/edited to achieve the selected musical arrangement; and (iv) the Musical Instrument Performance Logic supported in the DS-VMI Libraries, and indexed/tagged with the Music Instrument Performance Style Descriptors selected by the system user, are automatically selected for modification of sampled notes during the automated digital performance process.

FIG. 57 shows an exemplary generic customizable list of musical arrangement descriptors supported by the automated music performance system of the fourth illustrative embodiment. Each of these generic musical arrangement descriptors can be customized to a particular musical arrangement conceived by the system engineers/designers, and identified by linguistic (or graphical-icon) descriptors which will be culturally relevant to the intended system users. Also, appropriate programming will be carried out to ensure that proper Role remapping and editing will take place in an automated manner when the corresponding musical arrangement descriptor is selected by the system user.

FIG. 58 shows an exemplary generic customizable list of musical instrument performance style descriptors supported by the automated music performance system of the fourth illustrative embodiment. Each of these generic musical instrument performance style descriptors can be customized to a particular musical arrangement conceived by the system engineers/designers, and identified by linguistic (or graphical-icon) descriptors which will be culturally relevant to the intended system users. Also, appropriate programming will be carried out to ensure that proper Musical Instrument Performance Logic (Rules) are indexed or tagged with the corresponding Musical Instrument Performance Style Descriptor in the DS-VMI Libraries, for automated selection and use when the corresponding musical instrument performance style descriptor is selected by the system user. It is understood that the function and each of its performance style descriptors can be globally defined to cover and control the instrument performance style of many different instrument types so that by a single parameter selection on this musical function, the system will automate the instrument style performance for dozens if not hundreds of different virtual musical instruments maintained in the DS-VMI library management subsystem of the present invention. For example, in the event that "Calypso" is defined as a Musical Instrument Performance Style Descriptor, to reflect the Afro-Caribbean music originated in Trinidad and Tobago, then this Musical Instrument Performance Style Descriptor will be used to tag/index each written Musical Instrument Performance Rule (i.e. Performance Logic) installed in the DS-VMI Libraries of the system, and activated in the DS-VMI library management subsystem when selected by the system user, to ensure that the automated music performance system will automatically consider and possibly use this Performance Rule during the automated music performance process if and when the contextual conditions abstracted from the music composition are satisfied. This will ensure that all virtual music instrument performances sound as if they were being played performers following the traditions and musical style of Calypso music.

Figure 59:
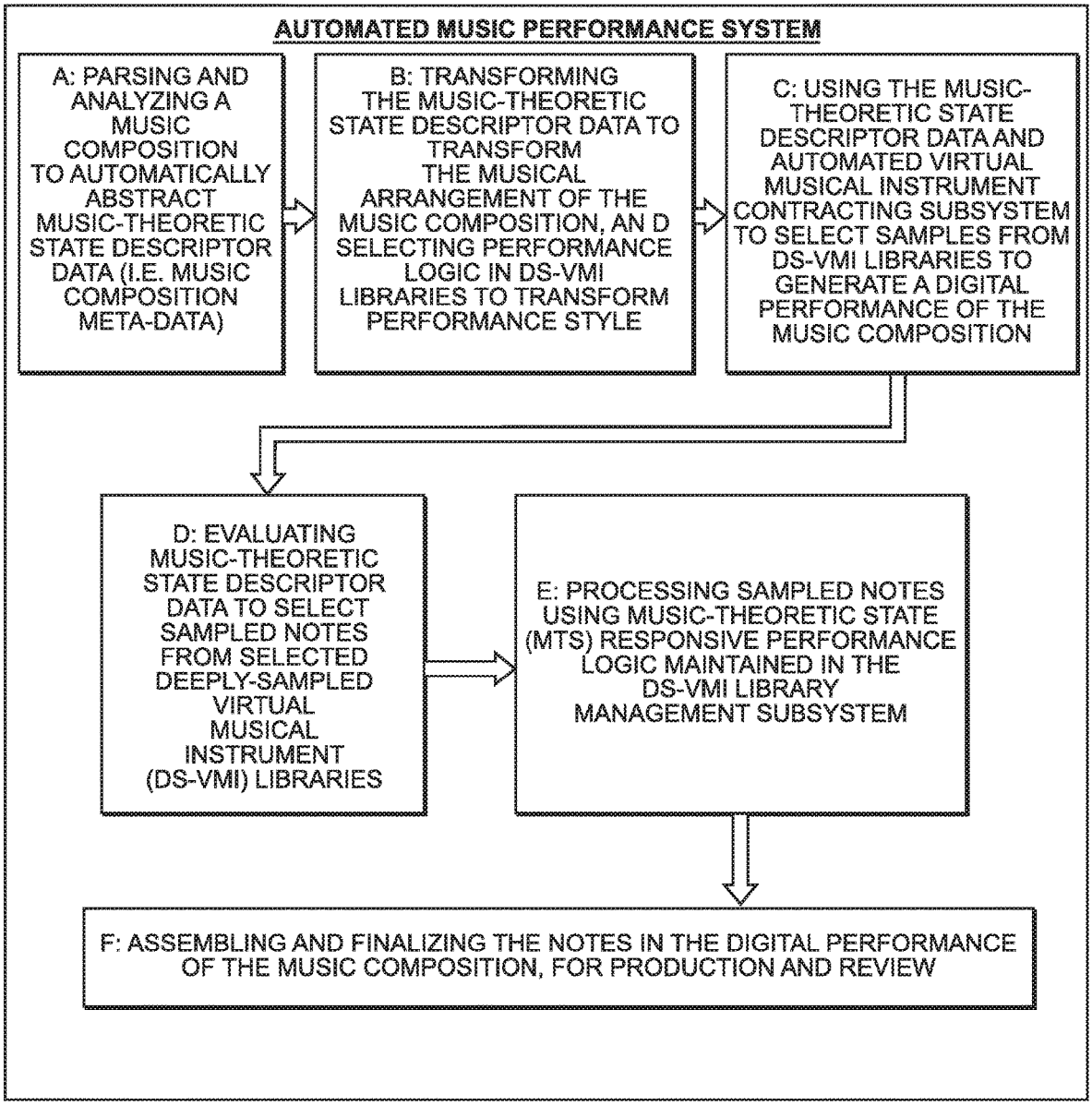
FIG. 59 illustrates the process of automated selection of sampled notes in deeply-sampled virtual musical instrument (DS-VMI) libraries to produce the notes for the digital performance of a composed piece of music in accordance with the principles of the present invention, involving (a) the parsing and analyzing the music composition to abstract music-theoretic state descriptor data (i.e. music composition meta data), (b) transforming the music-theoretic state descriptor data to transform the musical arrangement of the music composition, and modifying performance logic in DS-VMI libraries to transform performance style, (c) using music-theoretic state descriptor data and automated virtual musical instrument contracting subsystem to select deeply-sampled virtual musical instruments (DS-VMI) for the performance of the music composition, (d) using music-theoretic state descriptor data to select samples from selected deeply-sampled virtual musical instrument (DS-VMI) libraries, (e) processing samples using music-theoretic state (MTS) responsive performance logic maintained in the DS-VMI library management subsystem so as to produce processed note samples for the digital performance, and (f) assembling and finalizing the notes in the digital performance of the music composition, for final production and review.

FIG. 59 illustrates the process of automated selection of sampled notes in deeply-sampled virtual musical instrument (DS-VMI) libraries to produce the notes for the digital performance of a composed piece of music in accordance with the principles of the present invention. As shown, this process comprises the following steps: (a) the parsing and analyzing the music composition to abstract music-theoretic state descriptor data (i.e. music composition meta data); (b) transforming the music-theoretic state descriptor data to transform the musical arrangement of the music composition, and modifying performance logic in DS-VMI libraries to transform performance style; (c) using music-theoretic state descriptor data and automated virtual musical instrument contracting subsystem to select deeply-sampled virtual musical instruments (DS-VMI) for the performance of the music composition; (d) using music-theoretic state descriptor data to select notes and/or sounds from selected deeply-sampled virtual musical instrument (DS-VMI) libraries; (e) processing sampled noted using music-theoretic state (MTS) responsive performance logic maintained in the DS-VMI library management subsystem so as to produce processed note samples for the digital performance; and (f) assembling and finalizing the notes in the digital performance of the music composition, for final production and review.

Figure 60:
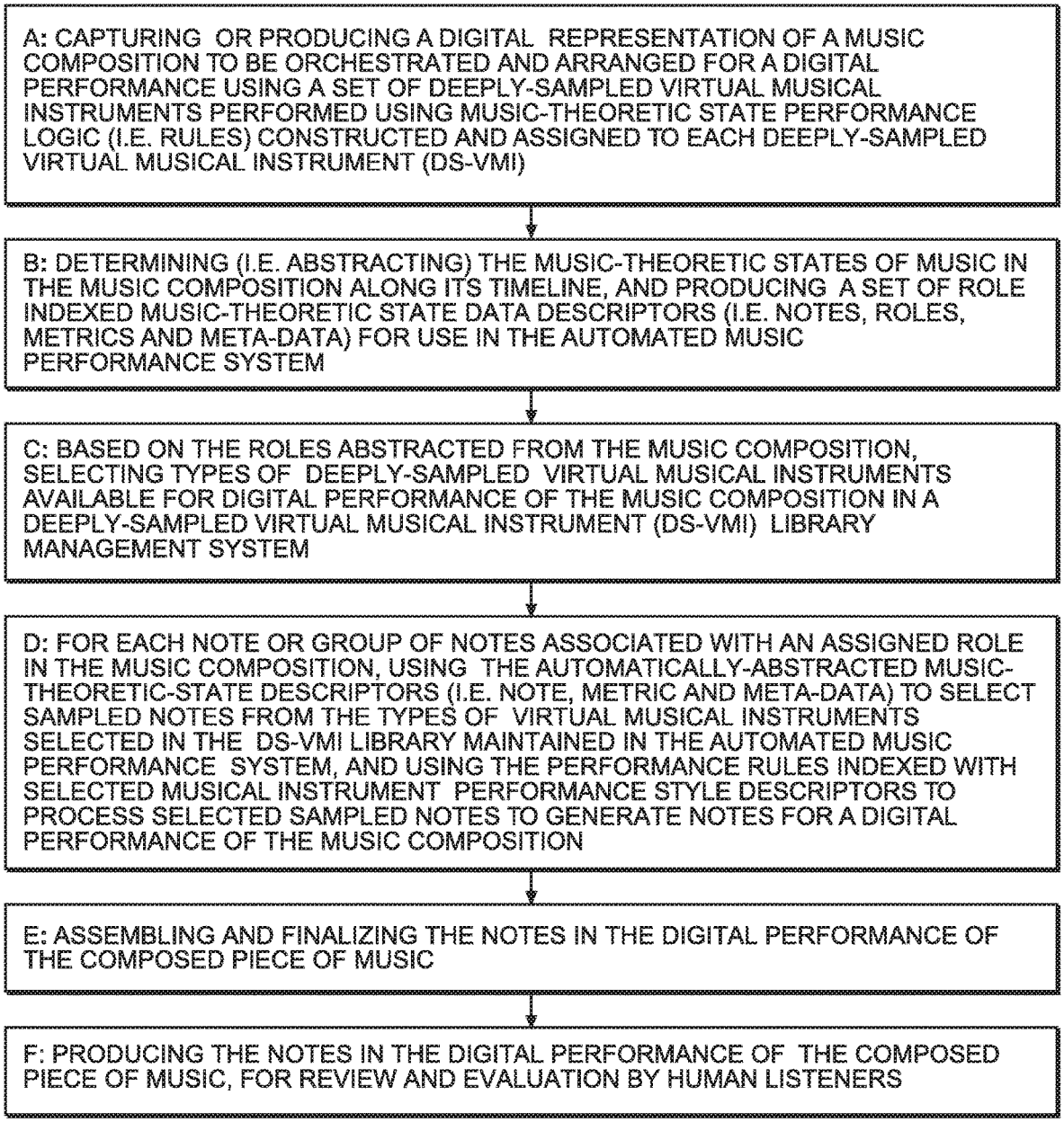
FIG. 60 is a flow chart describing a method of automated selection and performance of notes in deeply-sampled virtual instrument libraries to generate a digital performance of a composed piece of music, comprising the steps of (a) capturing or producing a digital representation of a music composition to be orchestrated and arranged for a digital performance using a set of deeply-sampled virtual musical instruments performed using music-theoretic state performance logic (i.e. rules) constructed and assigned to each deeply-sampled virtual musical instrument (DS-VMI), (b) determining (i.e. abstracting) the music-theoretic states of music in the music composition along its timeline, and producing a set of timeline-indexed music-theoretic state descriptor data (i.e. roles, notes, metrics and meta-data) for use in the automated music performance system, (c) based on the roles abstracted from the music composition, selecting deeply-sampled virtual musical instruments available for digital performance of the music composition in a deeply-sampled virtual musical instrument (DS-VMI) library management system, (d) for each note or group of notes associated with an assigned Role in the music composition, using the automatically-abstracted music-theoretic-state descriptors (i.e. note, metric and meta-data) to select sampled notes from a deeply-sampled virtual musical instrument (DS-VMI) library maintained in the automated music performance system, and using the music-theoretic state responsive performance rules to process the selected sampled notes to generate notes for a digital performance of the music composition; (e) assembling and finalizing the processed sampled notes in the digital performance of the music composition; and (f) producing the performed notes in the digital performance of the music composition, for review and evaluation by human listeners.

FIG. 60 describes a method of automated selection and performance of notes in deeply-sampled virtual instrument (DS-VMI) libraries to generate a digital performance of a composed piece of music. As shown, the system comprises the steps of: (a) capturing or producing a digital representation of a music composition to be orchestrated and arranged for a digital performance using a set of deeply-sampled virtual musical instruments performed using music-theoretic state performance logic (i.e. rules) constructed and assigned to each deeply-sampled virtual musical instrument (DS-VMI); (b) determining (i.e. abstracting) the music-theoretic states of music in the music composition along its timeline, and producing a set of timeline-indexed music-theoretic state descriptor data (i.e. roles, notes, metrics and meta-data) for use in the automated music performance system; (c) based on the roles abstracted from the music composition, selecting deeply-sampled virtual musical instruments available for digital performance of the music composition in a deeply-sampled virtual musical instrument (DS-VMI) library management system; (d) for each note or group of notes associated with an assigned role in the music composition, using the automatically-abstracted music-theoretic-state descriptors (i.e. notes, metrics and meta-data) to select sampled notes from the types of virtual musical instruments selected in the DS-VMI library maintained in the automated music performance system, and using the performance rules indexed with selected musical instrument performance style descriptors to process selected sampled notes to generate notes for a digital performance of the music composition; (e) assembling and finalizing the processed sampled notes in the digital performance of the music composition; and (f) producing the performed notes in the digital performance of the music composition, for review and evaluation by human listeners.

Figure 61:
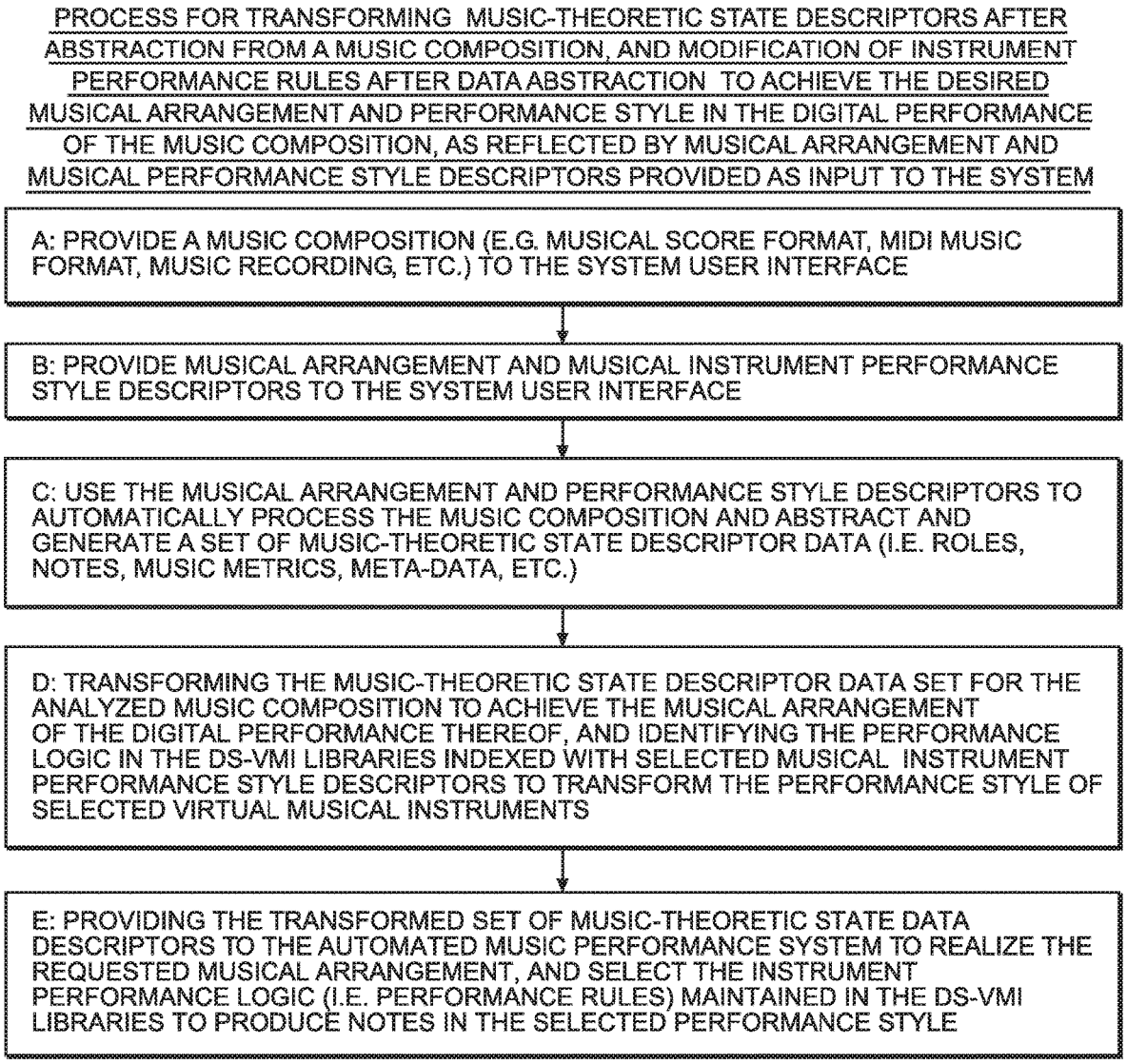
FIG. 61 is a flow chart describing the primary steps performed during the method of operation of the automated music performance system of the fourth illustrative embodiment of the present invention shown in FIGS. 53 through 58, wherein music-theoretic state descriptors are transformed after automated abstraction from a music composition to be digitally performed, and instrument performance rules are modified after the data abstraction process, so as to achieve a desired musical arrangement and performance style in the digital performance of the music composition as reflected by musical arrangement and musical instrument performance style descriptors selected by the system user and provided as input to the system user interface, wherein the method comprises the steps of (a) providing a music composition (e.g. musical score format, midi music format, music recording, etc.) to the system user interface, (b) providing musical arrangement and musical instrument performance style descriptors to the system user interface, (c) using the musical arrangement and performance style descriptors to automatically process the music composition and abstract and generate a set of music-theoretic state descriptor data (i.e. roles, notes, music metrics, meta-data, etc.), (d) transforming the music-theoretic state descriptor data set for the analyzed music composition to achieve the musical arrangement of the digital performance thereof, and identifying the performance logic in the DS-VMI libraries indexed with selected musical instrument performance style descriptors to transform the performance style of selected virtual musical instruments, and (e) providing the transformed set of music-theoretic state data descriptors to the automated music performance system to realize the requested musical arrangement, and select the instrument performance logic (i.e. performance rules) maintained in the DS-VMI libraries to produce notes in the selected performance style.

FIG. 61 describes the primary steps performed during the method of operation of the automated music performance system of the fourth illustrative embodiment of the present invention shown in FIGS. 53 through 58. As described in FIG. 61, the music-theoretic state descriptors are transformed after automated abstraction from a music composition to be digitally performed, and the musical instrument performance style rules are modified after the data abstraction process, so as to achieve a desired musical arrangement and performance style in the digital performance of the music composition as reflected by musical arrangement and musical instrument performance style descriptors selected by the system user and provided as input to the system user interface.

As shown in FIG. 61, the method comprises the steps of: (a) providing a music composition (e.g. musical score format, midi music format, music recording, etc.) to the system user interface; (b) providing musical arrangement and musical instrument performance style descriptors to the system user interface; (c) using the musical arrangement and performance style descriptors to automatically process the music composition and abstract and generate a set of music-theoretic state descriptor data (i.e. roles, notes, music metrics, meta-data, etc.); (d) transforming the music-theoretic state descriptor data set for the analyzed music composition to achieve the musical arrangement of the digital performance thereof, and identifying the performance logic in the DS-VMI libraries indexed with selected musical instrument performance style descriptors to transform the performance style of selected virtual musical instruments; and (e) providing the transformed set of music-theoretic state data descriptors to the automated music performance system to realize the requested musical arrangement, and select the instrument performance logic (i.e. performance rules) maintained in the DS-VMI libraries to produce notes in the selected performance style.

FIG. 62 describes the high-level steps performed in a method of automated music arrangement and musical instrument performance style transformation supported within the automated music performance system of the fourth illustrative embodiment of the present invention, wherein an automated music arrangement function is enabled within the automated music performance system by remapping and editing of roles, notes, music metrics and meta-data automatically abstracted and collected during music composition analysis, and an automated musical instrument performance style transformation function is enabled by selecting instrument performance logic provided for groups of note and instruments in the deeply-sampled virtual musical instrument (DS-VMI) libraries of the automated music performance system, that are indexed with the musical instrument performance style descriptors selected by the system user.

FIG. 63 specifies an exemplary set of Musical Roles ("Roles") or musical parts of each music composition to be automatically analyzed and abstracted (i.e. identified) by the automated music performance system of the fourth-illustrative embodiment. These roles have been described in detail hereinabove with respect to FIGS. 28A, 33A, and 38A.

FIG. 64 provides a technical specification for a transformed music-theoretic state descriptor data file generated from the analyzed music composition, including notes, metrics and meta-data automatically abstracted/determined from a music composition and then transformed during the preprocessing state of the automated music performance process of the present invention, wherein the exemplary set of transformed music-theoretic state descriptors include, but are not limited to, Role (or Part of Music) to be performed, MIDI Note Value (A1, B2, etc.), Duration of Notes, and Music Metrics including Position of Notes in a Measure, Position of Notes in a Phrase, Position of Notes in a Section, Position of Notes in a Chord, Note Modifiers (Accents), Dynamics, MIDI Note Value Precedence and Antecedence, What Instruments are Playing, Position of Notes from Other Instruments, Relation of Sections to Each Other, Meter and Position of Downbeats and Beats, Tempo Based Rhythms, What Instruments are assigned to a Role (e.g. Accent, Background, etc.).

FIG. 65 illustrates how a set of Roles and associated Groups of Note Data automatically abstracted from a music composition are transformed (e.g. remapped and/or edited) in response to the Musical Arrangement Descriptor selected by a system user from the GUI-based system user interface of FIG. 56. As shown, different Groups of Note Data are reorganized under different Roles depending on the Musical Arrangement Descriptor selected by the system user. While there are various ways to effect musical arrangement of a music composition, this method illustrated in FIG. 65 operates by remapping and/or editing the Roles assigned to Groups of Notes identified in the music composition during the automated music composition stage of the automated music performance process of the present invention. It is understood, however, that the musical arrangement function supported within the automated music performance system of the present invention can also involve editing any of the music-theoretic state descriptors (e.g. Roles, Notes, metrics and meta-data) abstracted from a music composition to create a different yet principled musical re-arrangement of a music composition so that the resulting musical arrangement of a prior music composition differs from the original work by means of reharmonization, melodic paraphrasing, orchestration, and/or development of the formal structure, in accordance with principles well known in the musical arrangement art.

FIG. 66 shows a deeply-sampled virtual musical instrument (DS-VMI) library that has been provided with music instrument performance logic (e.g. performance logic rules) that haves been indexed/tagged with one or more music performance style descriptors listed in FIG. 58 in accordance with the principles of the present invention, so that such performance logic rules will be responsive and active to the music performance style descriptor selected by the system user and provided to the system user interface prior to each automated music performance process supported on the system.

Figure 67:
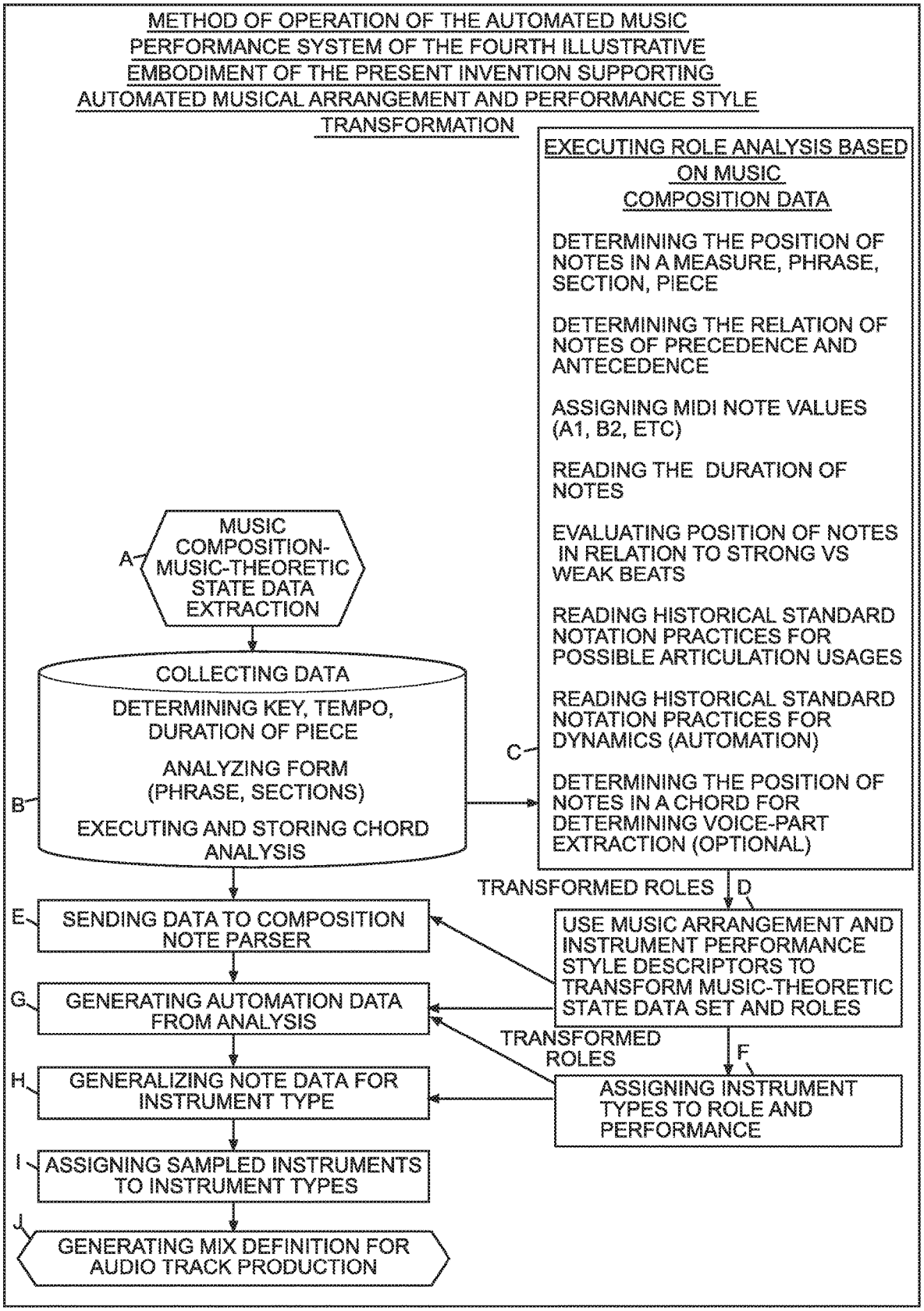
FIG. 67 is a schematic representation illustrating a method of operating the automated music performance system of the fourth illustrative embodiment of the present invention, supporting automated musical arrangement and performance style transformation functions selected by the system user.

FIG. 67 illustrates a method of operating the automated music performance system of the fourth illustrative embodiment of the present invention. As shown, the system supporting automated musical arrangement and performance style transformation functions selected by the system user.

As indicated at Block A in FIG. 67, the system is provided with a music composition for music-theoretic state data abstraction to result in the collection of note, metric and meta data at Block B, involving determining the key, tempo and duration of the music piece; analyzing the music form of the phrases and sections to obtain note metrics; and executing and storing chord analysis and other data evaluations described in FIG. 68.

As indicated at Block B in FIG. 67, the system executes an automated Role Analysis Method based on the music composition data and other data abstracted at Block B.

As shown at Block C, the Role Analysis Method involves performing the following data processing operations: (a) determining the Position of notes in a measure, phrase, section, piece; (b) determining the Relation of notes of precedence and antecedence; (c) assigning MIDI note values (A1, B2, etc.); (d) reading the duration of notes; (e) evaluating position of notes in relation to strong vs weak beats; (f) reading historical standard notation practices for possible articulation usages; (g) reading historical standard notation practices for dynamics (via automation); and (h) determining the position of notes in a chord for optionally determining voice-part extraction.

As indicated at Block D in FIG. 68, the system uses Music Arrangement and Musical Instrument Performance Style Descriptors provided to the system user interface to automatically transform the music-theoretic state data set abstracted from the music composition, and generate transformed roles for use in the automated music performance process.

As indicated at Block E in FIG. 68, the system uses the transformed Role send data to the composition note parser and group the Note data with the assigned Roles.

As indicated at Block F in FIG. 68, the system assigns Instrument Types to the transformed Roles and associated (Note) Performances.

As indicated at Block G in FIG. 68, the system generates automation data from the analysis.

As indicated at Block H in FIG. 68, the system generates Note data for each Instrument Type.

As indicated at Block I in FIG. 68, the system assigns to Instrument Types, virtual musical instruments (VMI) supported in the DS-VMI Library Management Subsystem.

As indicated at Block J in FIG. 68, the system generates a mix definition for audio track production of the final digital performance of the music composition. The final digital performance will be musically (re)arranged and express the music instrument performance of the musical arrangement and performance style descriptors supplied to the system by the system user.

At any time, the system user can return to the system user interface shown in FIG. 56 and select different musical arrangement and/or performance style descriptors supported in the system menu and regenerate a new digital music performance of the music composition using the DS-VMI Libraries maintained in the system.

By virtue of the present invention, automated music (re)arranging and performance style transform functionalities are now available to the automated music performance system of the present invention, along with other custom modes, wherein the music-theoretic state data —automatically abstracted and collected from any music composition—is automatically transformed in a specified manner to generate a suitable and different musical-theoretic state descriptor file that is then used (as system input) by the automated music performance system of the present invention.

The advantage of such functionalities will be to enable others to (i) provide a musical composition as system input (via an API, sheet music, audio, MIDI or any other file), and (ii) then make a few simple selections from an arrangement/style menu or have these and/or any selections be made automatically by the system, to then automatically generate new kinds of digital music performances having different instrument arrangements and performed according to different performance styles.

In a regular or normal mode of operation, abstracted and collected music theoretic state data parameters (e.g. Roles, Notes, Metrics and Meta-Data) will be transmitted to the automated music performance system without modification or transformation. However, in other alternative musical arrangement/style-transformation modes supported by the system, the abstracted music-theoretic state data parameters (including the Roles, Notes, Metrics and Meta-Data) will be transformed to change the musical instrumental arrangement (in one way or another) and/or performance style thereof in an automated and creative manner to meet the creative desires of users around the world.

The innovative functionalities and technological advancements enabled by the present invention promise to create enormous new value in the market allowing billions of ordinary users with minimal music experience or education to automatically rearrange millions of music compositions (and music recordings) to perform, create and deliver new musical experiences by the users selecting (from a menu) or having the system automatically create and/or select system input parameters under descriptors such as: Music Performance Arrangement Descriptors; Music Instrument Performance Style Descriptors; to name just a few.

Employing the Automated Music Performance Engine Subsystem of the Present Invention in Other Applications The Automated Music Performance Engine of the present invention will have use in many application beyond those described this invention disclosure.

For example, consider the use case where the system is used to provide indefinitely lasting music or hold music (i.e. streaming music). In this application, the system will be used to create unique music of definite or indefinite length. The system can be configured to convey a set of musical experiences and styles and can react to real-time audio, visual, or textual inputs to modify the music and, by changing the music, work to bring the audio, visual, or textual inputs in line with the desired programmed musical experiences and styles. For example, the system might be used in Hold Music to calm a customer, in a retail store to induce feelings of urgency and need (to further drive sales), or in contextual advertising to better align the music of the advertising with each individual consumer of the content.

Another use case would be where the system is used to provide live scored music in virtual reality or other social environments, real or imaginary. Here, the system can be configured to convey a set of musical experiences and styles and can react to real-time audio, visual, or textual inputs. In this manner, the system will be able to "live score" content experiences that do well with a certain level of flexibility in the experience constraints. For example, in a video game, where there are often many different manners in which to play the game and courses by which to advance, the system would be able to accurately create music for the game as it is played, instead of (the traditional method of) relying on pre-created music that loops until certain trigger points are met. The system would also serve well in virtual reality and mixed reality simulations and experiences.

Modifications of the Illustrative Embodiments of the Present Invention

The present invention has been described in great detail with reference to the above illustrative embodiments. It is understood, however, that numerous modifications will readily occur to those with ordinary skill in the art having had the benefit of reading the present invention disclosure.

As described in great detail herein, the automatic music performance and production system of the present invention supports the input of conventionally-notated musical information of music compositions of any length or complexity, containing musical events such as, for example, notes, chords, pitch, melodies, rhythm, tempo and other qualifies of music. However, it is understood that the system can also be readily adapted to support non-conventionally notated musical information, based on conventions and standards that may be developed in the future, but can be used as a source of musical information input to the automated music performance and production system of the present invention. Understandably, such alternative embodiments will involve developing music composition processing algorithms that can process, handle and interpret the musical information, including notes and states expressed along the timeline of the music composition While the automated music performance and generation system of the present invention has been disclosed for use in automatically generating digital music performances for music compositions that have been completed, and represented in either music score format or MIDI-music format, it is understood that the automated music performance system of the present invention can be readily adapted to digitally perform music being composed in a "live" or "on-the-fly" manner for the enjoyment of others, using the deeply-sampled virtual musical instruments (DS-VMI) selected from the DS-VMI library management subsystem of the system. In such alternative embodiments, music being composed is either digitally represented in small time-blocks of music score (i.e. sheet music) representation as illustrated in FIG. 29 or MIDI-music representation as illustrated in FIG. 30. Using such methods, small pieces of music-theoretic state data can be automatically abstracted for small time pieces of music being composed by human and/or machine sources, and such streams of music-theoretic state data can be provided to the automated music performance system for automated processing in accordance with the principles disclosed here, to digitally perform the live piece of music as it is being composed "on the fly." Such alternative embodiments of the present invention are fully embraced by the systems and models disclosed herein and fall within the scope and spirit of the present invention.

Also, in alternative embodiments of the present invention described hereinabove, the automated music performance and production system can be realized a stand-alone appliance, instrument, embedded system, enterprise-level system, distributed system, as well as an application embedded within a social communication network, email communication network, SMS messaging network, telecommunication system, and the like. Such alternative system configurations will depend on particular end-user applications and target markets for products and services using the principles and technologies of the present invention.

Alternate Methods of Sound Sample Representation and Sound Sample Synthesis when Developing Virtual Musical Instrument (VMI) Libraries According to Principles of the Present Invention As disclosed herein, when using the sound/audio sampling method to produce notes and sounds for a virtual musical instrument (VMI) library system according to the present invention, storage of each audio sample in the .wav audio file format is just one form of storing a digital representation of each audio samples within the automated music performance system of the present invention, whether representing a musical note or an audible sound event. The system described in the present invention should not be limited to sampled audio in .wav format, and should include other forms of audio file format including, but not limited to, the three major groups of audio file formats, namely:

- Uncompressed audio formats, such as WAV, AIFF, AU or raw header-less PCM;
- Formats with lossless compression such as FLAC, Monkey's Audio (.ape), WavPak (.wv), TTA, ATRAC advanced lossless, ALAC (.mpa), MPEG-4 SLS, MPEG-4 ALA, MPEG-4 DST, Windows Media Audio Lossless (WMA lossless), and Shorten (SNH)
- Formats with lossy compression, such as Opus, MPO3, Vorbis, Musepak, AAC, ATRAC, Windows Media Audio Lossy (WMA Lossy).

Also, when practicing a digital sound/audio synthesis method to synthesize notes and sounds for a virtual musical instrument (VMI) library system according to the present invention, MOTU's MACHFIVE and/or MX4 software tools, and Synclavier® software tools, are just a few software tools for producing a digital representation of each synthesized audio sample within the automated music performance system of the present invention. Other software tools can be used to create or synthesize digital sounds representative of notes and sounds of various natures.

The cataloging of Behaviors and Aspect values can also be applied to other forms of audio replication/synthesis specifically with regards to Role and Instrument Performance Assignment. For example, a synthesis module can be provided within the automated music performance engine, to support various controls to Attack and Release that could mimic the same kinds of Behaviors that a violin can perform. These Instrument Performance settings can be stored and sent to the synthesis module for the purpose of mimicking the same instrument_type template as violin, and assigned to this instrument_type for use within the automated music performance system.

These and all other such modifications and variations are deemed to be within the scope and spirit of the present invention as defined by the accompanying Claims to Invention.

Modifications to the Present Invention which Readily Come to Mind

The illustrative embodiments disclose the use of a novel method of developing and deploying deeply-sampled virtual musical instruments (DS-VMIs) provided with performance logic rules based on the behavior of its real corresponding musical instrument designed to predict and control the performance of the deeply-sampled virtual musical instrument in response to real-time detection of the music-theoretic states including notes of the music composition to be digitally performed using the deeply-sampled virtual musical instruments. Using this novel virtual musical instrument (VMI) design, it is now possible for libraries of deeply-sampled virtual musical instruments to produce more expressive, more intelligent and richer performances when driven by any source of composed music, however composed. However, it is understood that alternative products and technologies may be used to practice the various methods and apparatus of the present invention disclosed herein. For example, machine learning may be used within the automated music performance system to support deterministic or stochastic based music performances. The use of machine learning would analyze music compositions to abstract music-theoretic state data on each input music composition. Machine learning (ML) may also be used to analyze digital performances, either currently existing in the system, or through a training against real-world performances, through sample matching and recognition against audio. Then, with this analyzation, the automated music composition would come up with predictive models on how the automated music performance system would choose the modifications to sampled notes from a particular instrument, when the modification are placement specific (i.e. are called for by the logical performance rules).

These and other variations and modifications will come to mind in view of the present invention disclosure. While several modifications to the illustrative embodiments have been described above, it is understood that various other modifications to the illustrative embodiment of the present invention will readily occur to persons with ordinary skill in the art. All such modifications and variations are deemed to be within the scope and spirit of the present invention as defined by the accompanying Claims to Invention.

What is claimed is:

1. A method of automated digital music performance generation using a virtual musical instrument library management subsystem, and a music state aware and responsive performance logic supported in an automated music performance system, comprising:

(a) during a music composition, producing and recording multiple musical notes in a composed piece of music;
(b) automatically processing said music composition to generate a set of timeline-indexed music-theoretic state descriptor data abstracted from the music composition;
(c) providing a music-theoretic state descriptor data to an automated music performance system having a virtual musical instrument library management subsystem for managing a plurality of deeply-sampled virtual musical instrument libraries, for use in automatically selecting deeply-sampled virtual musical instrument libraries maintained in said virtual musical instrument library management subsystem, and automatically selecting sampled notes from selected deeply sampled virtual musical instrument libraries;
(d) processing the selected sampled notes to produce multiple notes of a digital music performance of the music composition;
(e) assembling and finalizing the sampled notes in a digital performance of the music composition; and
(f) producing multiple notes of the digital performance of the music composition for review and evaluation by human listeners.

2. The method of claim 1, wherein said automated music performance system comprises at least one of a digital audio workstation, a virtual studio technology plugin, and a cloud-based information network; and wherein the processing, the assembling, and the producing comprises accessing at least one of the digital audio workstation, the virtual studio technology plugin, and the cloud-based information network.

3. A method of generating a digital performance of a musical composition using an automated music composition and performance system, said method comprising the steps of:

(a) producing a digital representation of an automatically generated music composition to be orchestrated and arranged for a digital performance using virtual musical instrument libraries selected from an automated virtual musical instrument library management subsystem;

(b) automatically determining a music-theoretic state of music in said music composition, and producing a set of music-theoretic state descriptor data including roles, notes, metrics and meta-data for use in said automated music composition and performance system;

(c) based on a role abstracted from the music composition, selecting types of virtual musical instruments available for digital performance of the music composition and managed by said automated virtual musical instrument library management subsystem;

(d) using a set of music theoretic-state meta-data descriptor data to automatically select notes from virtual musical instrument libraries, and subsequently processing the notes to generate the notes for a digital performance of the music composition;

(e) assembling and finalizing the notes in the digital performance of the music composition; and (f) producing the notes in the digital performance of the music composition for review and evaluation by human listeners.

4. The method of claim 3, wherein said automated music composition and performance system comprises at least one of a digital audio workstation, a virtual studio technology plugin, and a cloud-based information network; and wherein the automatically determining, the selecting, the subsequently processing, the assembling, and the producing comprises accessing at least one of the digital audio workstation, the virtual studio technology plugin, and the cloud-based information network.

5. An automated music performance system driven by music-theoretic state descriptors, including roles, notes and music metrics, automatically abstracted from a musical structure, however composed or performed, for generating a unique digital performance of the musical structure, said automated music performance system comprising:

a plurality of virtual musical instrument libraries, wherein each said virtual musical instrument library supports a set of music-theoretic state responsive performance rules automatically triggered by said music-theoretic state descriptors, including roles, notes and music metrics, automatically abstracted from the music structure to be digitally performed by said automated music performance system; and an automated virtual musical instrument library selection and performance subsystem for managing said virtual musical instrument libraries, including automated selection of virtual musical instruments and notes to be performed during a digital performance of said musical structure in response to said music-theoretic state descriptors.

6. The automated music performance system of claim 5, wherein said automated music performance system comprises at least one of a digital audio workstation, a virtual studio technology plugin, and a cloud-based information network.

* * * * *